US010407917B1

(12) United States Patent
Bilge

(10) Patent No.: US 10,407,917 B1
(45) Date of Patent: Sep. 10, 2019

(54) SYSTEM FOR MOUNTING WALL PANELS TO A WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 15/916,826

(22) Filed: Mar. 9, 2018

Related U.S. Application Data

(63) Continuation-in-part of application No. 15/655,278, filed on Jul. 20, 2017, now Pat. No. 10,260,240, which is a continuation-in-part of application No. 15/488,897, filed on Apr. 17, 2017, now Pat. No. 10,253,507.

(51) Int. Cl.
*E04F 13/08* (2006.01)
*E04F 13/23* (2006.01)
*E04B 1/38* (2006.01)

(52) U.S. Cl.
CPC ..... *E04F 13/0801* (2013.01); *E04F 13/083* (2013.01); *E04F 13/23* (2013.01); *E04B 2001/405* (2013.01); *E04F 13/0817* (2013.01)

(58) Field of Classification Search
CPC ..... E04F 13/28; E04F 13/0817; E04F 13/23; E04F 13/083; E04F 13/0807; E04F 13/0814; E04F 13/0816; E04F 13/0819; E04F 13/0801; E04B 2001/405
USPC ... 52/506.06, 235, 775, 474, 506.01, 506.08
See application file for complete search history.

(56) References Cited

U.S. PATENT DOCUMENTS

| | | | | | |
|---|---|---|---|---|---|
| 2,591,361 | A | | 4/1952 | Knott | |
| 3,235,915 | A | | 2/1966 | Glaser | |
| 3,453,795 | A | * | 7/1969 | Heirich | E04F 13/0805 52/479 |
| 4,070,835 | A | * | 1/1978 | Reverend | E04F 13/0808 52/126.1 |
| 4,181,293 | A | | 1/1980 | Laribee | |
| 4,495,741 | A | * | 1/1985 | Pasiecznik | E04F 13/0807 52/404.1 |
| 4,625,481 | A | | 12/1986 | Crandell | |
| 4,672,784 | A | | 6/1987 | Pohlar | |
| 4,768,321 | A | | 9/1988 | Crandell | |
| 4,782,635 | A | | 11/1988 | Hegle | |
| 4,936,065 | A | | 6/1990 | Hutchinson | |
| 4,977,717 | A | | 12/1990 | Niwata | |
| 5,158,392 | A | * | 10/1992 | Takeda | E04B 2/34 403/315 |
| 5,265,396 | A | * | 11/1993 | Amimoto | E04F 13/0855 52/235 |

(Continued)

*Primary Examiner* — Brent W Herring
(74) *Attorney, Agent, or Firm* — Richard M. Goldberg

(57) ABSTRACT

A system for mounting wall panels to an existing wall, includes adjustment support members secured to an existing wall and including a platform and a side wall extending from a side thereof and including elongated slots therein; connecting panels connecting together spaced apart adjustment support members, each connecting panel including a main panel and a side wall having a slot therein which opens at one edge of the side wall for receipt in an elongated slot; and a hook member including a securing section to which a wall panel is mounted, an L-shaped hook wall so as to receive a connecting panel in a space between the L-shaped hook wall and the securing section, and an adjustment arrangement for adjusting a position of the hook wall on the securing section so as to move the hook wall toward and away from the securing section.

16 Claims, 99 Drawing Sheets

(56) References Cited

U.S. PATENT DOCUMENTS 5,307,602 A * 5/1994 Lebraut ..... E04F 13/0853 52/235
5,544,461 A * 8/1996 Sommerstein ..... E04F 13/0807 52/235
5,644,878 A 7/1997 Wehrmann
5,720,571 A 2/1998 Frobosilo et al.
5,829,216 A 11/1998 Newcomb et al.
5,846,018 A 12/1998 Frobosilo et al.
5,860,257 A * 1/1999 Gerhaher ..... E04F 13/0826 52/235
5,906,080 A 5/1999 diGirolamo et al.
6,098,364 A 8/2000 Liu
6,170,214 B1 * 1/2001 Treister ..... E04F 13/0808 52/235
6,213,679 B1 4/2001 Frobosilo et al.
6,226,947 B1 5/2001 Bado et al.
6,260,321 B1 7/2001 Rudduck
6,374,561 B1 * 4/2002 Ishiko ..... E04F 13/0814 52/366
6,612,087 B2 9/2003 diGirolamo et al.
6,688,069 B2 2/2004 Zadeh
6,964,137 B2 * 11/2005 Frascari ..... E04F 13/0819 52/235
7,043,884 B2 5/2006 Moreno
7,104,024 B1 9/2006 diGirolamo et al.
7,168,213 B2 1/2007 Rudduck et al.
7,174,690 B2 2/2007 Zadeh
7,503,150 B1 3/2009 diGirolamo et al.
7,562,509 B2 7/2009 Ness
7,849,651 B2 * 12/2010 Fujito ..... E04F 13/0889 248/216.1
7,926,230 B2 4/2011 Yoshida et al.
7,966,783 B2 6/2011 Wilson et al.
7,984,593 B2 * 7/2011 Weiser ..... E04F 13/12 52/235
8,033,066 B2 10/2011 Griffiths
8,051,623 B2 * 11/2011 Loyd ..... E04F 13/0803 52/235
8,127,507 B1 3/2012 Bilge
8,191,327 B2 * 6/2012 Griffiths ..... E04F 13/0825 24/457
8,240,099 B2 8/2012 Hummel, III
8,347,569 B1 1/2013 McIntyre et al.
8,365,484 B2 2/2013 Foley
8,453,388 B2 6/2013 Neuhofer, Jr.
8,468,765 B1 6/2013 Kim
8,555,577 B2 10/2013 Maday et al.
8,640,399 B2 * 2/2014 Fradera Pellicer ..... B28B 5/04 52/124.2
8,745,935 B2 6/2014 DuPont et al.
8,833,025 B2 * 9/2014 Krause ..... E04F 13/0828 52/506.08
9,010,056 B2 4/2015 Ben David
9,068,358 B2 6/2015 MacDonald et al.
9,091,078 B2 7/2015 Deschenes
9,091,079 B2 7/2015 Wright
9,416,529 B1 * 8/2016 Jeske ..... E04B 1/41
9,540,804 B1 1/2017 Farahmandpour
9,617,739 B2 * 4/2017 Krause ..... E04F 13/0817
9,631,373 B2 * 4/2017 Loyd ..... E04F 13/25
9,637,933 B2 * 5/2017 Zhou ..... E04F 13/0801
9,783,993 B2 10/2017 Gleeson et al.
9,834,941 B1 * 12/2017 Bilge ..... E04F 13/24
9,957,721 B2 * 5/2018 Krause ..... E04F 13/0817
10,011,997 B1 7/2018 Bilge
10,253,507 B1 * 4/2019 Bilge ..... E04F 13/0892
2002/0023405 A1 2/2002 Zadeh
2002/0083655 A1 7/2002 Paul et al.
2002/0083656 A1 7/2002 Paul et al.
2003/0150179 A1 8/2003 Moreno
2004/0118075 A1 6/2004 Zadeh
2004/0194417 A1 10/2004 Paul
2005/0223581 A1 10/2005 Hale
2005/0246983 A1 * 11/2005 Loyd ..... E04F 13/0803 52/235
2006/0016137 A1 1/2006 Ferro
2008/0010927 A1 1/2008 Wilson et al.
2008/0134594 A1 6/2008 Ness
2008/0216444 A1 * 9/2008 Loyd ..... E04F 13/0803 52/742.16
2009/0241451 A1 10/2009 Griffiths
2009/0282751 A1 11/2009 Orfield et al.
2012/0017530 A1 1/2012 Hummel, III
2012/0055109 A1 * 3/2012 Labonte ..... E04B 9/22 52/506.05
2012/0096799 A1 4/2012 Wright
2012/0186170 A1 7/2012 Macdonald et al.
2013/0091786 A1 4/2013 DuPont et al.
2013/0152498 A1 * 6/2013 Krause ..... E04F 13/0828 52/235
2013/0269276 A1 * 10/2013 Gaynor ..... E04F 13/083 52/506.05
2014/0112698 A1 4/2014 Ben David
2014/0123585 A1 5/2014 Deschenes
2014/0290166 A1 10/2014 Bordener
2015/0096251 A1 * 4/2015 McCandless ..... E04F 13/0807 52/404.3
2015/0308098 A1 10/2015 Tessadori
2015/0345152 A1 12/2015 Libreiro et al.
2016/0153189 A1 6/2016 Wright
2016/0244967 A1 8/2016 Zhou et al.
2016/0369496 A1 12/2016 Farahmandpour
2017/0130463 A1 * 5/2017 Taing ..... E04F 13/081
2017/0130464 A1 5/2017 Gleeson et al.
2017/0247882 A1 * 8/2017 Krause ..... E04F 13/0828
2017/0260751 A1 * 9/2017 Zhou ..... E04F 13/0801

* cited by examiner

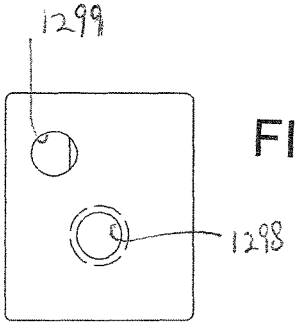
FIG. 98
FIG. 96
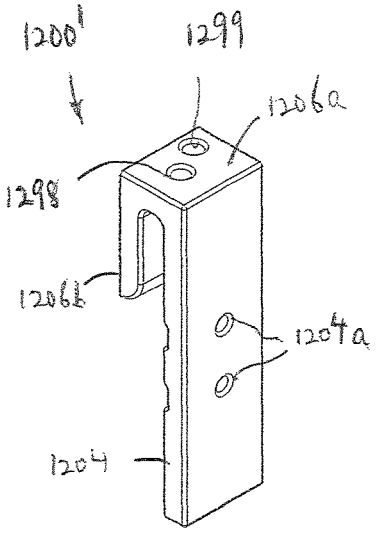
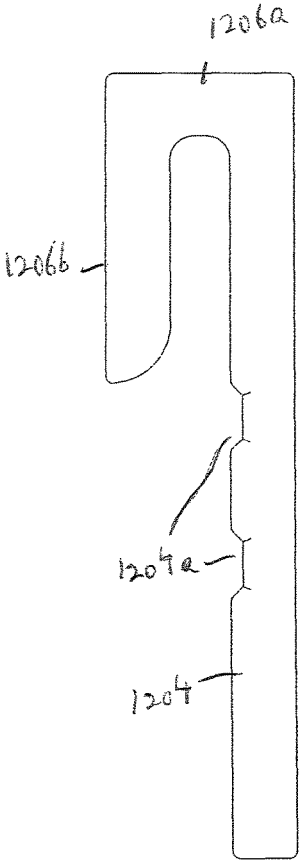
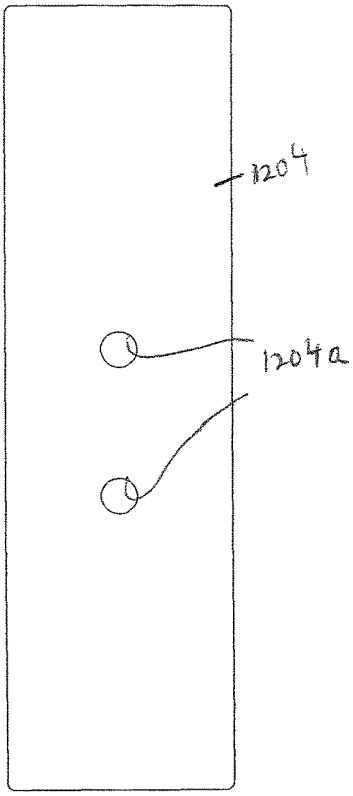
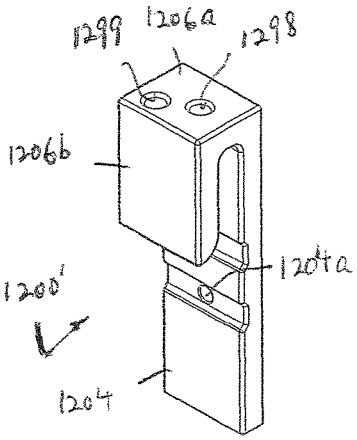
FIG. 99
FIG. 100
FIG. 97

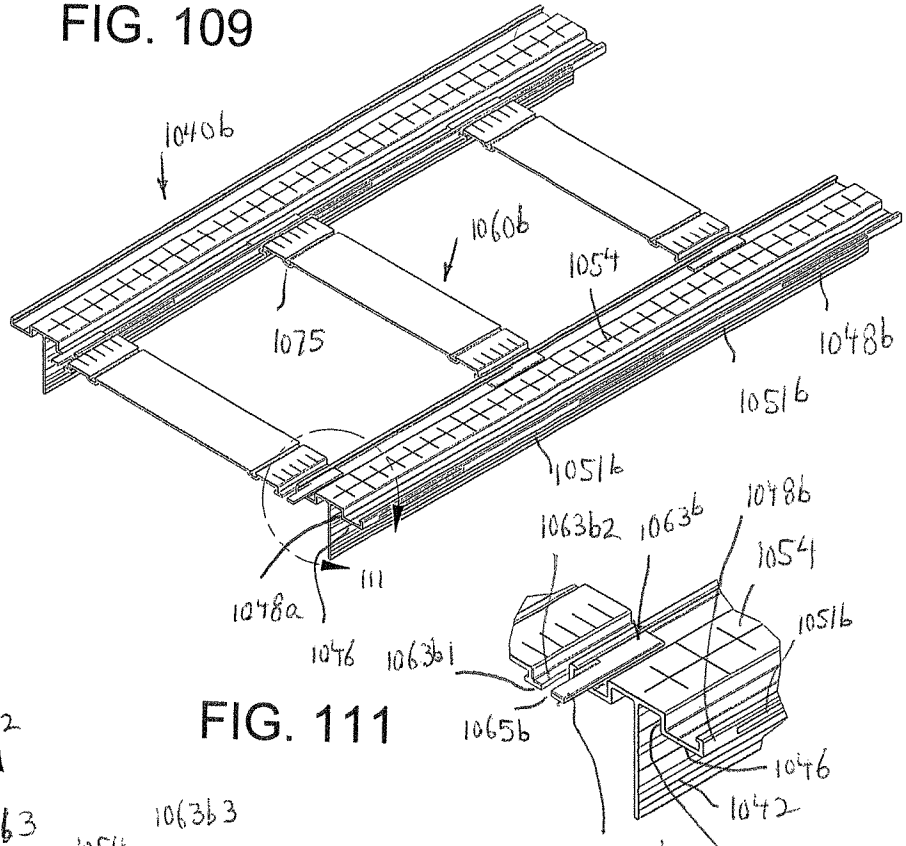
FIG. 109
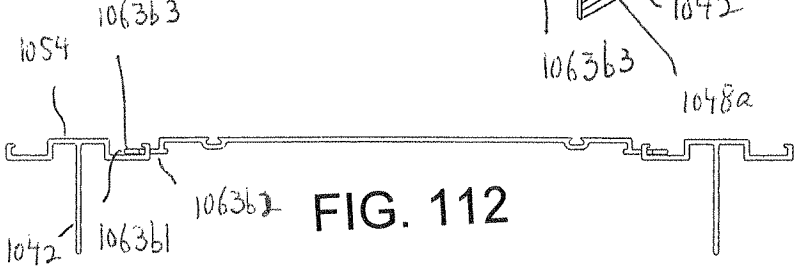
FIG. 111
FIG. 112
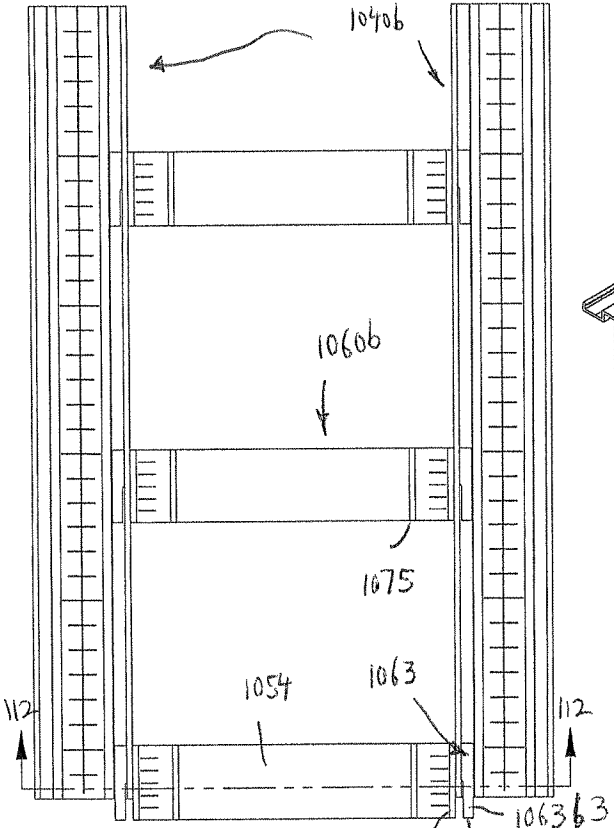
FIG. 110

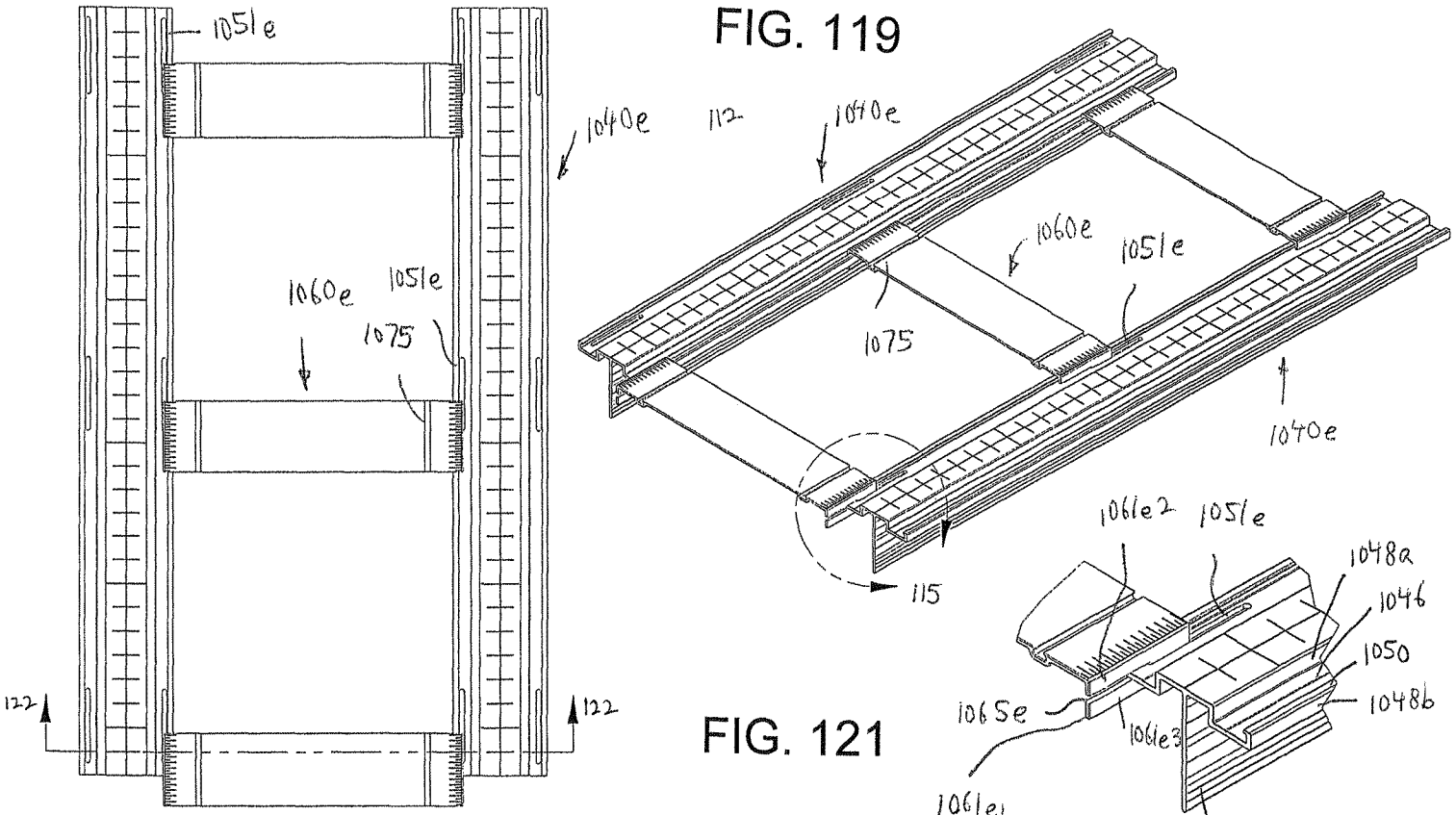
FIG. 119
FIG. 120
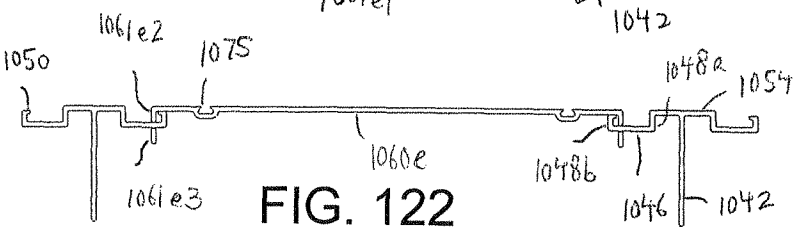
FIG. 121
FIG. 122

SYSTEM FOR MOUNTING WALL PANELS TO A WALL

REFERENCE TO RELATED APPLICATION

The present application is a Continuation-in-Part of U.S. patent application Ser. No. 15/655,278 filed Jul. 20, 2017 to the same inventor herein, and entitled SYSTEM FOR MOUNTING WALL PANELS TO A WALL, which in turn, is a Continuation-in-Part of U.S. patent application Ser. No. 15/488,897 filed Apr. 17, 2017 to the same inventor herein, and entitled SYSTEM FOR MOUNTING WALL PANELS TO A WALL, the entire disclosures of which are incorporated herein by reference.

BACKGROUND OF THE INVENTION

The present invention relates generally to a wall system, and more particularly, to a system for easily mounting wall panels over an existing wall.

In order to enhance the look of a wall structure, it is known to secure wall panels to the wall structure. However, the securement of wall panels to the wall structure is generally a long and tedious job since it entails using fastening devices such as nails and/or screws to secure the walls panels directly to the wall structure.

When securing the wall panels to an existing wall, precise measurements must be taken and the wall panels must be precisely positioned over the existing wall. This is time consuming and tedious. Further, if a mistake is made as to the positioning of one wall panel, this will affect the positioning of the remaining wall panels, and may result in removing the misaligned wall panels and re-securing these wall panels correctly in position. In addition, no consideration is taken for any unevenness in the existing wall.

It would therefore be desirable to provide wall panels that can be positioned and adjusted on the existing wall during assembly.

SUMMARY OF THE INVENTION

Accordingly, it is an object of the present invention to provide a system and method for easily mounting wall panels over an existing wall that overcomes the aforementioned problems.

It is another object of the present invention to provide a system and method for easily mounting wall panels over an existing wall, while permitting adjustment of the position of the wall panels in three dimensions.

It is still another object of the present invention to provide a system and method for mounting wall panels over an existing wall with exact precision.

It is yet another object of the present invention to provide a system and method for easily mounting wall panels over an existing wall which easily captures and restrains ends of the wall panels.

It is a further object of the present invention to provide a system and method for easily mounting wall panels over an existing wall which allows for thermal expansion of the wall panels.

In accordance with an aspect of the present invention, a system for mounting wall panels to an existing wall, includes a base assembly adapted to be secured to the existing wall; a wall panel securement arrangement adapted to be secured to a decorative wall panel; and an adjustment arrangement for adjustably securing the securement arrangement to the base assembly at a position with at least two degrees of freedom, the adjustment arrangement including a sliding member slidably received in the base assembly for movement in a first lengthwise direction of the base assembly, and wherein at least one of the base assembly and the sliding member include a wrap-around capture wall for wrapping around and capturing the other of the base assembly and the sliding member.

Preferably, the base assembly includes one wrap-around capture wall for wrapping around and capturing the sliding member; and the sliding member includes a wrap-around capture wall for wrapping around and capturing the base assembly.

In accordance with another aspect of the present invention, a system for mounting wall panels to an existing wall, includes at least one adjustment support member adapted to be secured either directly to an existing wall or indirectly to the existing wall through intermediary members, each adjustment support member including a central platform, and at least one U-shaped track extending to one side of the platform, each U-shaped track including an elongated lower plate, a first L-shaped side wall connected to one end of the elongated lower plate and extending upwardly therefrom, and a second L-shaped side wall connected to an opposite end of the elongated lower plate and extending upwardly therefrom.

In accordance with another aspect of the present invention, a system for mounting wall panels to an existing wall, includes at least one adjustment support member adapted to be secured either directly to an existing wall or indirectly to the existing wall through intermediary members; wherein each adjustment support member includes a central platform, and at least one U-shaped track extending to one side of the platform, wherein each adjustment support member further includes at least one slot in at least one of at least one U-shaped track thereof and the central platform thereof, for slidably receiving at least one hook member therein in order to hang a respective the wall panel thereon.

Preferably, each adjustment support member includes two U-shaped tracks, each extending to an opposite side of the platform.

In accordance with another aspect of the present invention, a system for mounting wall panels to an existing wall, includes a plurality of adjustment support members adapted to be secured either directly to an existing wall or indirectly to the existing wall through intermediary members; wherein each adjustment support member includes a central platform and at least one side wall extending to one side of the central platform; a plurality of connecting panels connecting together the plurality of adjustment support members; hook members slidably connected to the connecting panels; and a wall panel securing member secured to each hook member, with each wall panel securing member adapted to engage within openings in side walls of two adjacent wall panels.

Each wall panel securing member is movably adjustable toward and away from the respective hook member. Further, each wall panel securing member has a shape selected from one of the following: a circular disk, a rectangular plate and a cylinder.

Each connecting panel includes at least one slot therein for slidably receiving the hook members, and each hook member includes a first threaded opening for receiving a set screw to releasably bias the respective hook member against walls defining the respective slot to releasably lock the hook member at a desired position in the slot, and a second threaded opening for receiving a threaded post for supporting the wall panel securing member thereon. The threaded post is adapted to also bias the respective hook member against the walls defining the respective slot to releasably lock the hook member at a desired position in the slot. Further, the wall panel securing member is threadedly received on the threaded post.

In accordance with still another aspect of the present invention, for use with a system for mounting wall panels to an existing wall, the system being of a type including a mounting structure for supporting the wall panels, the improvement comprising a hook member including a wall panel securing section to which a wall panel is mounted, an L-shaped hook wall for mounting the hook member to the mounting structure, the L-shaped hook wall including a first wall and a second wall extending at an angle from the first wall so as to receive the mounting structure in a space between the L-shaped hook wall and the wall panel securing section, and an adjustment arrangement for adjusting a position of the hook wall on the wall panel securing section so as to move the second wall toward and away from the wall panel securing section.

In one embodiment, either the wall panel securing section or the first wall of the hook wall includes at least one groove therein, and the other of the wall panel securing section and the first wall of the hook wall includes at least one projection for engagement within the at least one groove, and further including a fastening arrangement for fixedly securing the wall panel securing section and the hook wall together after the at least one projection is in engagement within the at least one groove.

Preferably, there are a plurality of grooves and a plurality of projections, with the projections adapted to engage within different ones of the grooves in order to move the second wall toward and away from the wall panel securing section. Further, a wedge can be secured to an underside of the first wall and adjacent the second wall to wedge the mounting structure in the hook member.

The wall panel is mounted to the wall panel securing section by either projections extending from the wall panel securing section for engagement within grooves in the wall panel, or fastening devices extending through the wall panel securing section into the wall panel.

In another embodiment, the wall panel securing section includes a first wall to which a wall panel is mounted, and two parallel spaced apart walls connected at a right angle to the first wall; the first wall of the L-shaped hook wall is slidably positioned between the parallel, spaced apart walls, and the second wall of the L-shaped hook wall extends at a right angle from the first wall and is in parallel, spaced apart relation to the first wall of the wall panel securing section, the second wall being movable toward and away from the first wall of the wall panel securing section.

Preferably, the first wall of the L-shaped hook wall includes an elongated slot for receiving a fastening member extending through the two parallel, spaced apart walls of the wall panel securing section and through the elongated slot.

In another embodiment, the first wall of the L-shaped hook wall includes two parallel, spaced apart walls, the second wall of the L-shaped hook wall extends at a right angle from the first wall, and the wall panel securing section includes a first wall to which a wall panel is mounted, and a second wall connected at a right angle to the first wall and slidably positioned between the parallel, spaced apart walls such that the second wall of the L-shaped hook wall extends at a right angle from the two parallel, spaced apart walls of the first wall and is in parallel, spaced apart relation to the first wall of the wall panel securing section, the second wall being movable toward and away from the first wall of the wall panel securing section.

Preferably, second wall of the wall panel securing section includes an elongated slot for receiving a fastening member extending through the two parallel, spaced apart walls of the first wall of the L-shaped hook wall and through the elongated slot.

In still another embodiment, the wall panel securing section includes a first wall to which a wall panel is mounted, and a second wall connected at a right angle to the first wall, the second wall having an end face; the first wall of the L-shaped hook wall includes an end face in opposing position to the end face of the second wall of the wall panel securing section; and fastening devices extend through the first wall of the L-shaped hook wall into the end face of the second wall of the wall panel securing section to secure the first wall of the L-shaped hook wall to the second wall of the wall panel securing section with a variable distance therebetween.

Preferably, the first wall of the L-shaped hook wall includes a channel in an outer facing surface thereof for receiving the fastening devices therein. Also, preferably, the end faces have complementary zig-zag shapes.

In accordance with yet another aspect of the present invention, for use with a system for mounting wall panels to an existing wall, the system being of a type including a mounting structure for supporting wall panels, the improvement comprising a hook member including a wall panel securing section to which a wall panel is mounted, an L-shaped hook wall for mounting the hook member to the mounting structure, the L-shaped hook wall including a first wall connected with and extending from the wall panel securing section, and a second wall extending at an angle from the first wall so as to receive the mounting structure in a space between the L-shaped hook wall and the wall panel securing section, and an adjustment and securing arrangement for adjusting a position of the mounting structure in the space, the adjustment and securing arrangement including a first opening in the first wall for receiving a set screw to adjust the position of the mounting structure in the space, and a second opening in the first wall for securing the hook member to the mounting structure.

In accordance with a further aspect of the present invention, a system for mounting wall panels to an existing wall, includes at least one adjustment support member adapted to be secured either directly to an existing wall or indirectly to the existing wall through intermediary members; at least one connecting panel for connecting together spaced apart adjustment support members, with the at least one connecting panel adapted to support wall panels thereon; wherein each adjustment support member includes at least one U-shaped track extending along at least one side edge thereof, each U-shaped track including a lower wall having an upper exposed surface arranged parallel to the existing wall when a respective adjustment support member is secured to the existing wall and first and second end walls extending at an angle from opposite sides of the lower wall so as to define a channel therebetween. Each connecting panel includes a main panel wall and at least one side wall extending from a side edge of the main panel wall and adapted to be positioned in the channel. At least one side wall of each connecting panel includes at least one barb, and one of the first and second ends walls of each adjustment support member includes a recess for receiving the at least one barb to lock the at least one side wall of each connecting panel in the channel.

In accordance with a further aspect of the present invention, a system for mounting wall panels to an existing wall, includes at least one adjustment support member adapted to be secured either directly to an existing wall or indirectly to the existing wall through intermediary members; at least one connecting panel for connecting together spaced apart adjustment support members, with the at least one connecting panel adapted to support wall panels thereon, wherein each adjustment support member includes a platform, and at least one support member side wall extending from at least one side of the platform, the at least one side wall including at least one elongated slot therein. The connecting panel includes an elongated main panel and a connecting panel side wall connected to the elongated main panel and having a connecting panel slot therein which opens at one edge of the connecting panel side wall so as to separate the connecting panel side wall into an inner section and an outer section, with the outer section adapted to enter the at least one elongated slot and slide therein to releasably secure the connecting panel to the adjustment support member. The connecting panel slot is positioned at a position below an upper surface of the main panel.

In one embodiment, the connecting panel side wall extends parallel, but offset, from the elongated main panel, and each support member side wall extends in a direction perpendicular to a respective platform thereof.

In another embodiment, the connecting panel side wall extends perpendicular from the elongated main panel, and each support member side wall extends in a direction parallel, but offset, from a respective platform thereof.

In accordance with a still further aspect of the present invention, for use with a system for mounting wall panels to an existing wall, the system being of a type including a mounting structure for supporting wall panels, the improvement includes a hook member including a wall panel securing section to which a wall panel is mounted, an L-shaped hook wall for mounting the hook member to the mounting structure, the L-shaped hook wall including a first wall connected with and extending from the wall panel securing section, and a second wall extending at an angle from the first wall so as to receive the mounting structure in a space between the L-shaped hook wall and the wall panel securing section, and at least one thermal blocking member connected to the L-shaped hook wall for blocking heat transfer between the L-shaped hook member and the mounting structure.

In accordance with a yet further aspect of the present invention, a system for mounting wall panels to a ceiling of a building, including a plurality of adjustment support members; at least one plate slidably mounted to each said adjustment support member at one side thereof, each plate adapted to be mounted by a cable to a ceiling of a building; a plurality of connecting panels connecting together the plurality of adjustment support members; a plurality of hook members slidably mounted to an opposite side of the adjustment support members and/or connecting panels, for securing a ceiling panel thereto.

The above and other features of the invention will become readily apparent from the following detailed description thereof which is to be read in connection with the accompanying drawings.

BRIEF DESCRIPTION OF THE DRAWINGS

FIG. 96 is a top, rear perspective view of a yet further modified hook assembly;

FIG. 97 is a top, front perspective view of the hook assembly of FIG. 96;

FIG. 98 is a top plan view of the hook assembly of FIG. 96;

FIG. 99 is a side elevational view of the hook assembly of FIG. 96;

FIG. 100 is a rear elevational view of the hook assembly of FIG. 96;

FIG. 101A is a top, rear perspective view of another modified hook assembly;

FIG. 102 is a top, rear perspective view of the hook assembly of FIG. 101;

FIG. 102A is a rear elevational view of the hook assembly of FIG. 101A;

FIG. 103 is a top plan view of the hook assembly of FIG. 101;

FIG. 103A is a top plan view of the hook assembly of FIG. 101A;

FIG. 104 is a side elevational view of the hook assembly of FIG. 101;

FIG. 104A is a side elevational view of the hook assembly of FIG. 101A;

FIG. 105 is a perspective view showing the hook assembly of FIG. 101 assembly with connecting panels;

FIG. 106 is a side elevational view of the arrangement of FIG. 105;

FIG. 107 is a perspective view of modified adjustment support members and modified connecting panels;

FIG. 108 is a side elevational view of the arrangement of FIG. 107;

FIG. 109 is a perspective view of other modified adjustment support members and modified connecting panels;

Figure 113:
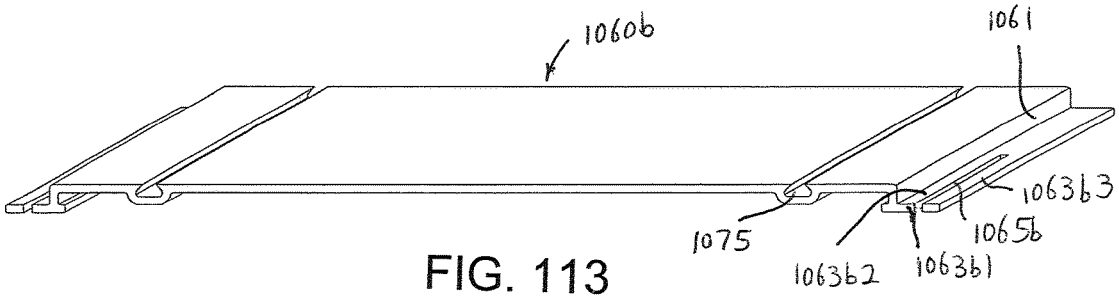
Figure 114:
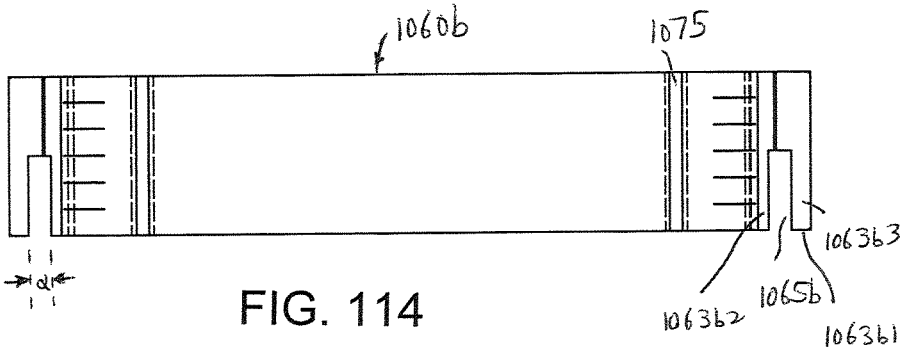
Figure 115:
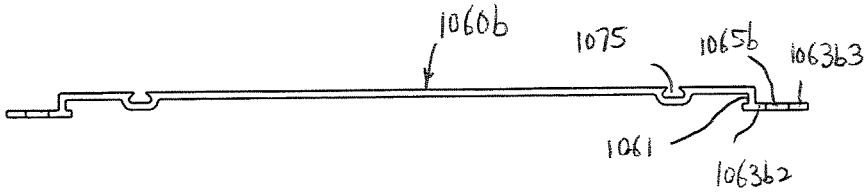
Figure 116:
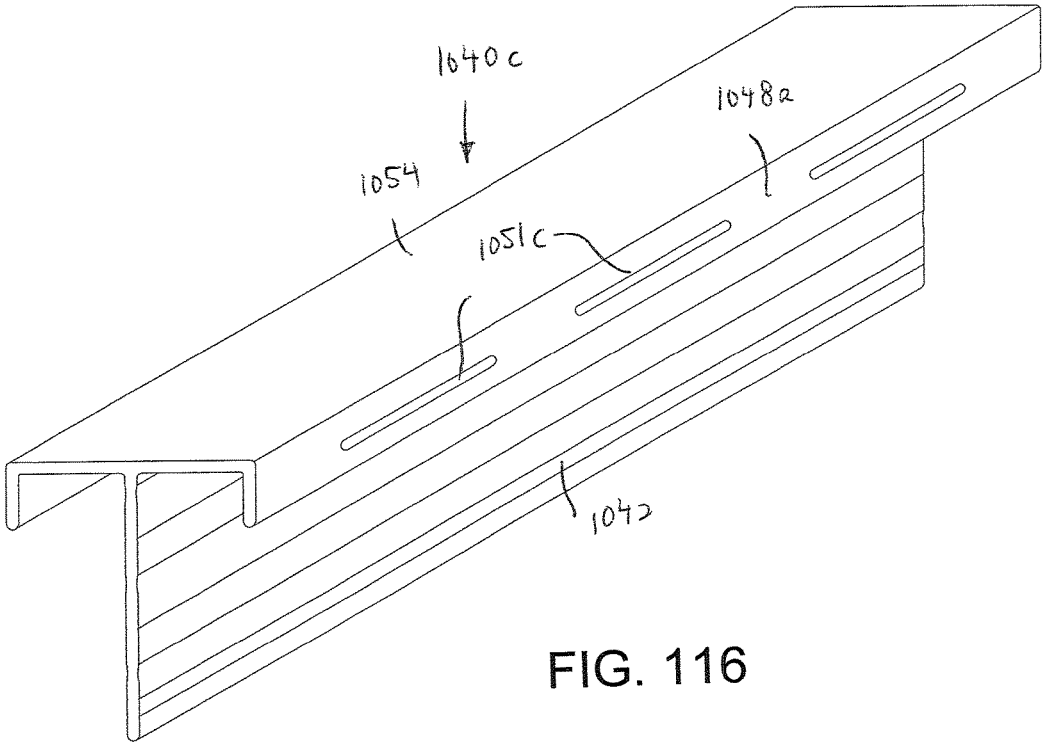
Figure 117:
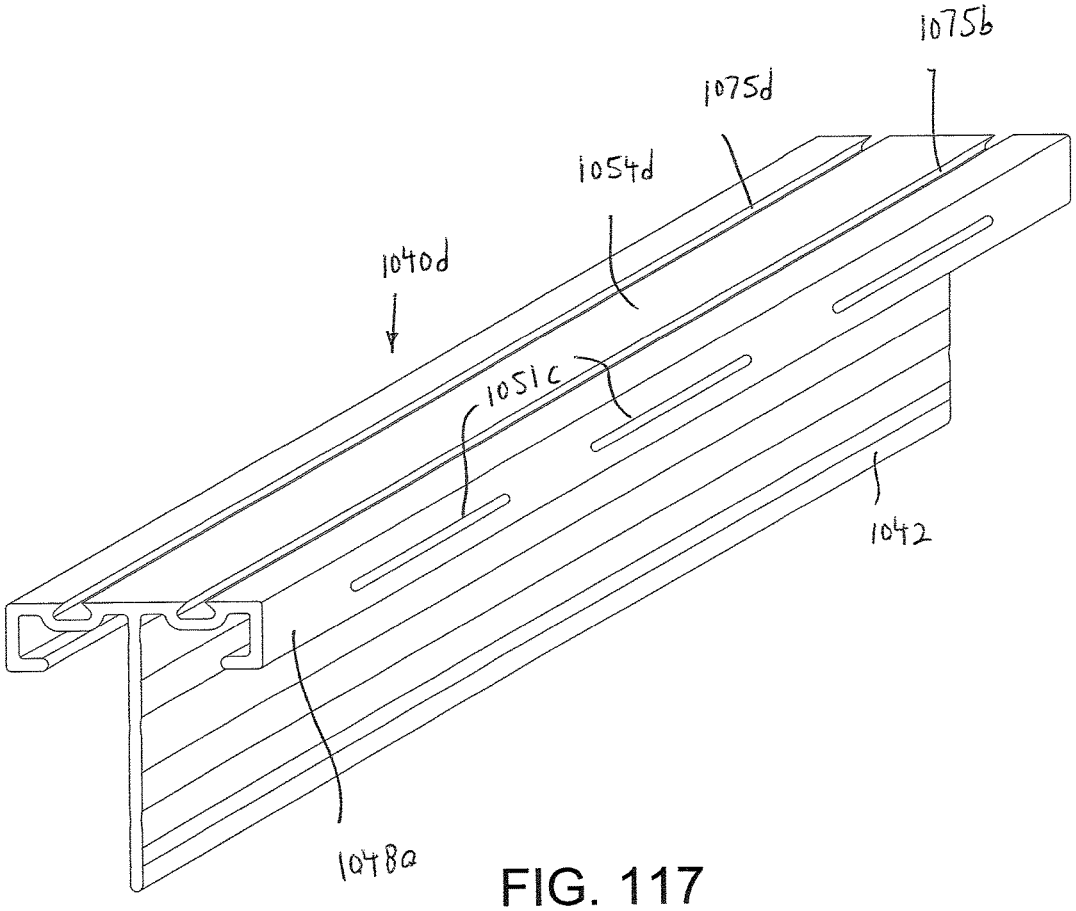
Figure 118:
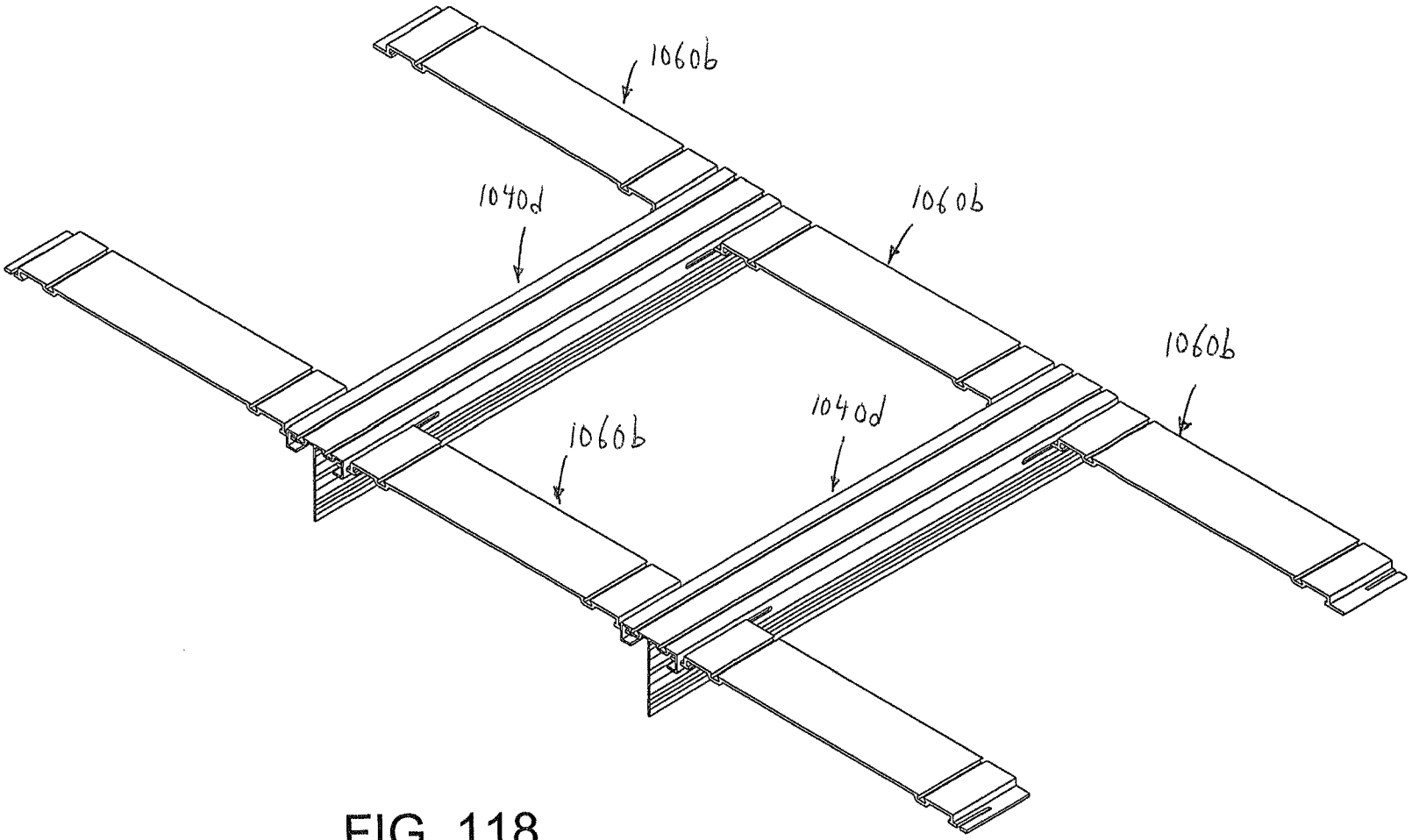
Figure 123:
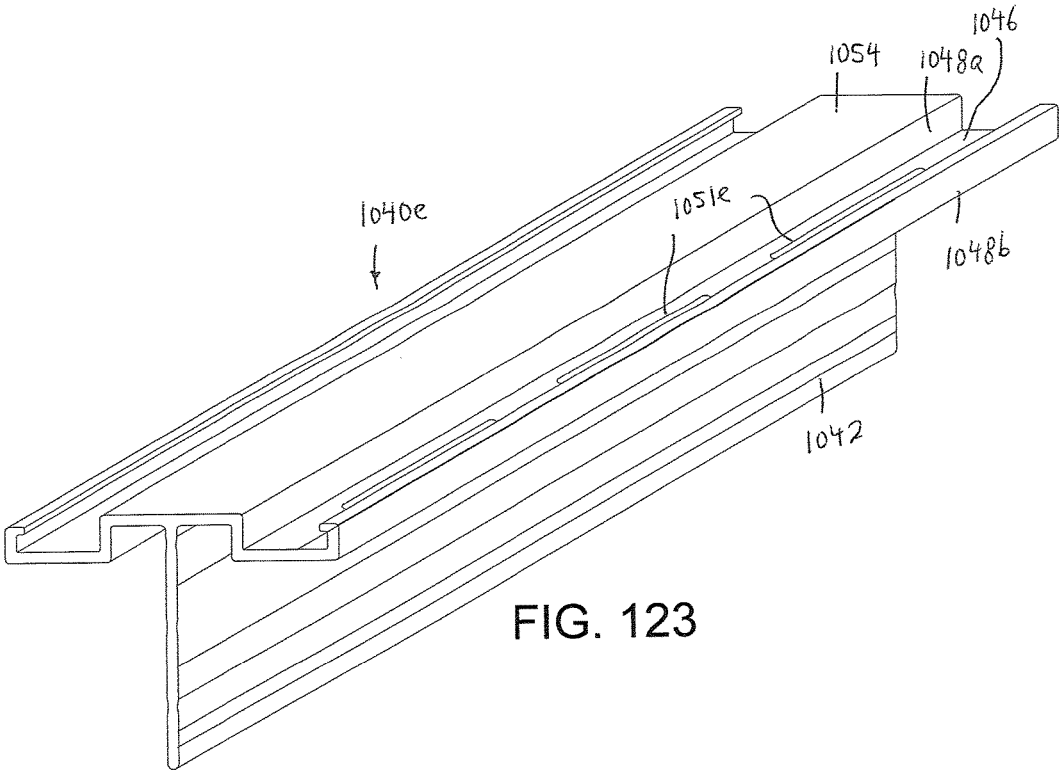
Figure 124:
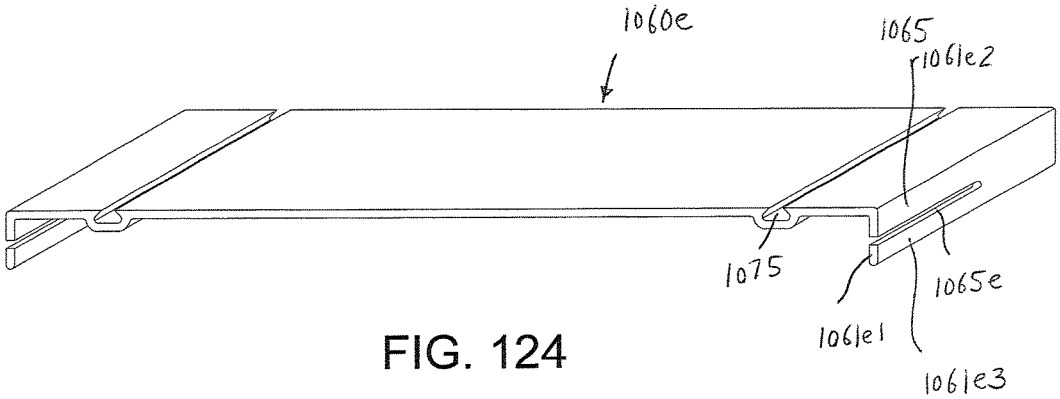
Figure 125:
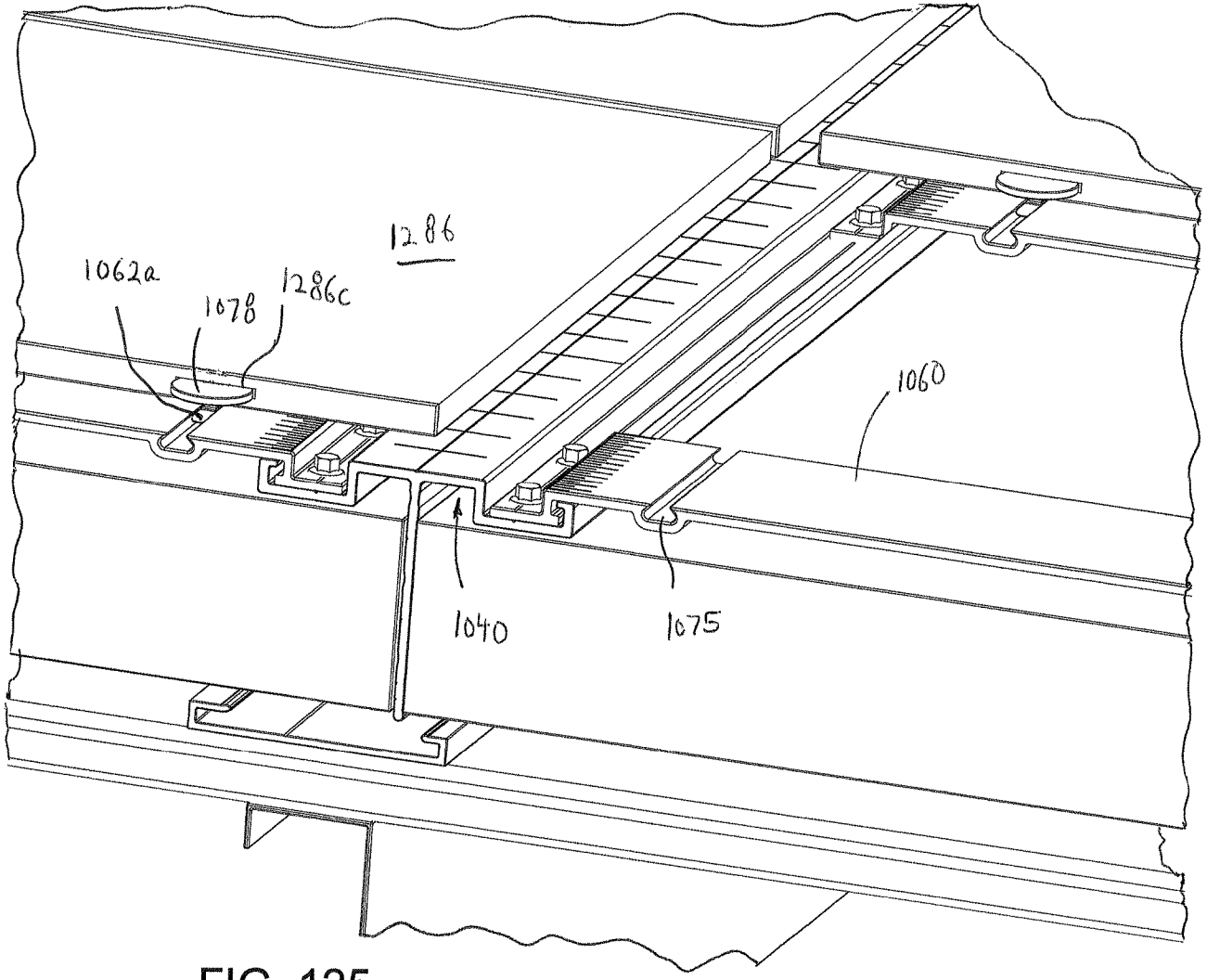
Figure 126:
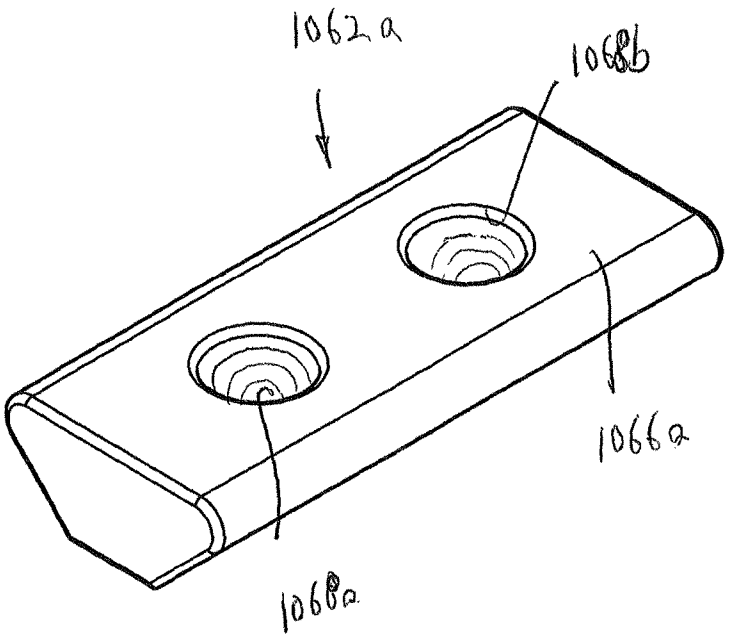
Figure 127:
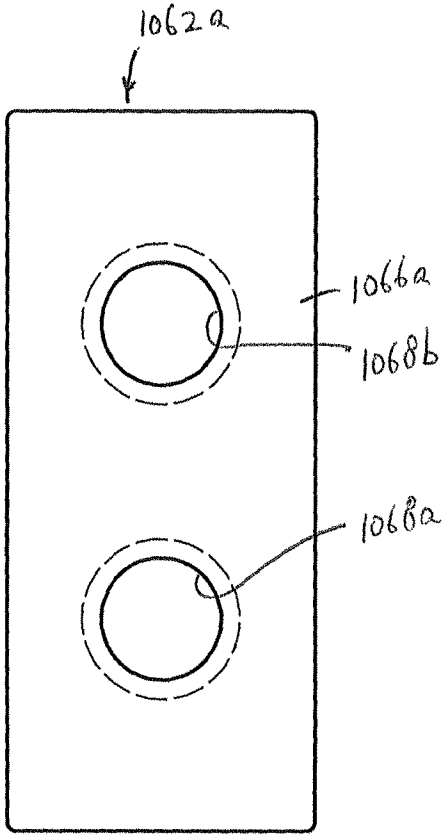
Figure 128:
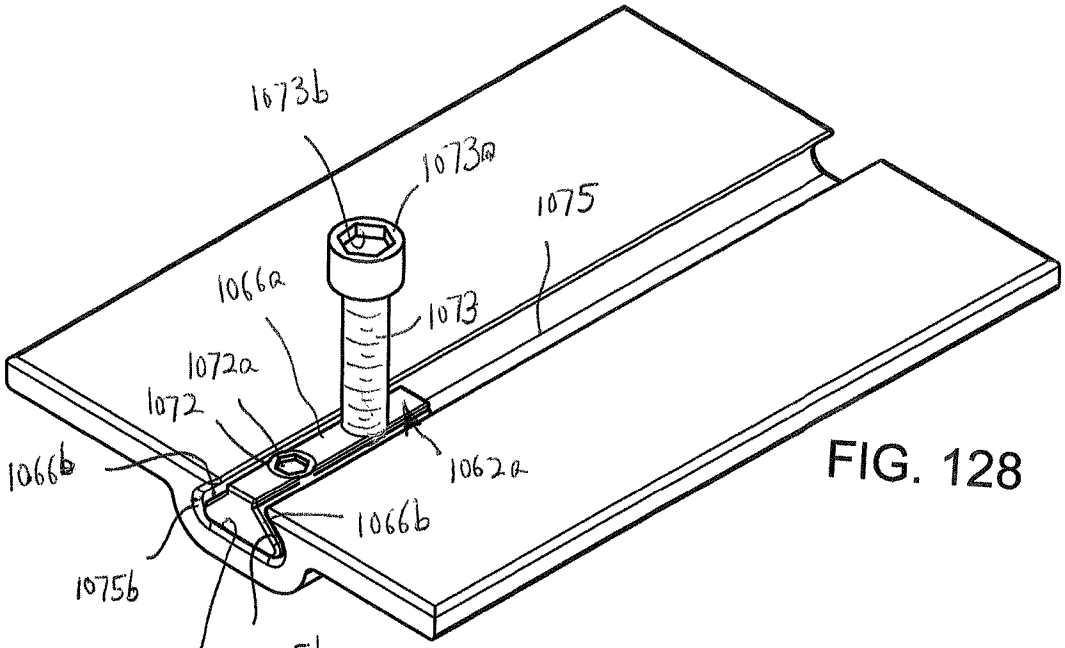
Figure 129:
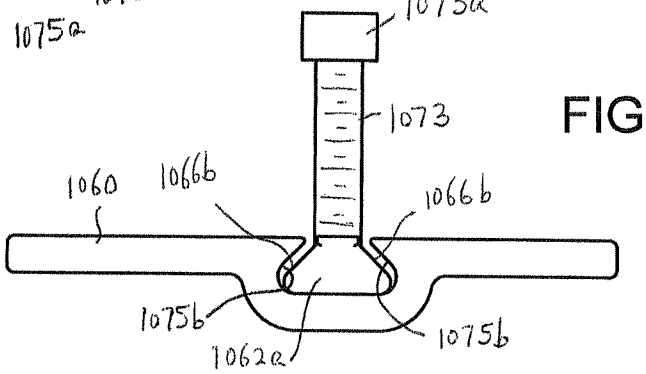
Figure 130:
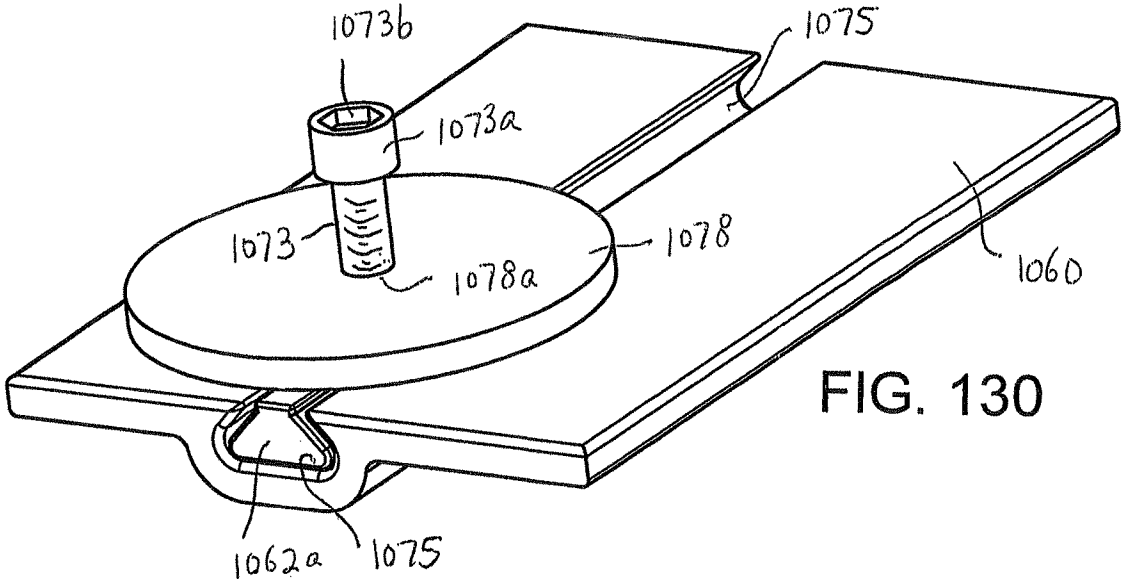
Figure 131:
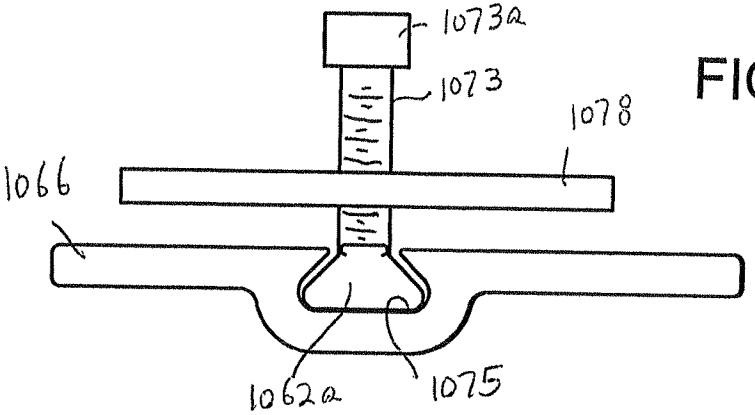
Figure 132:
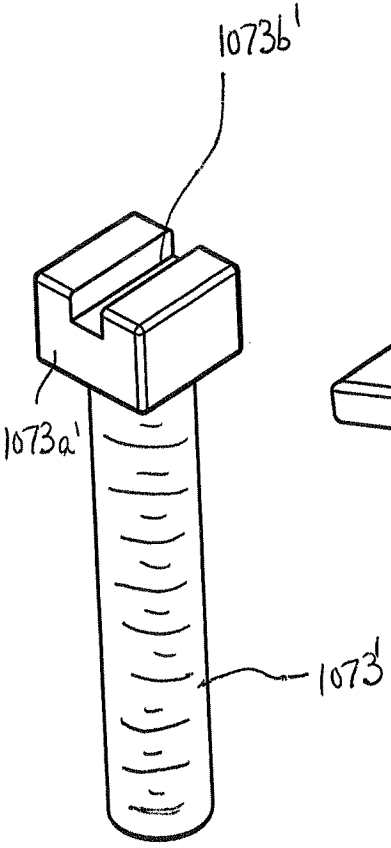
Figure 133:
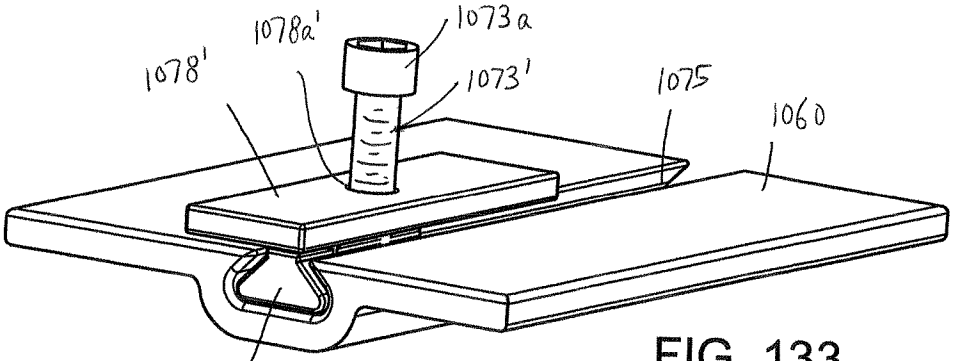
Figure 134:
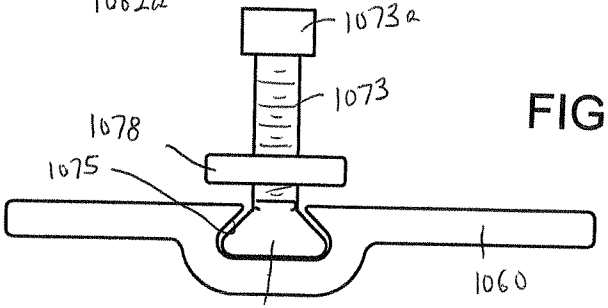
Figure 135:
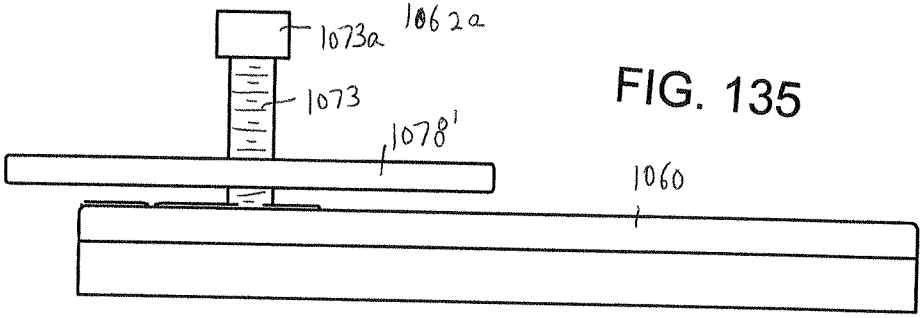
Figure 136:
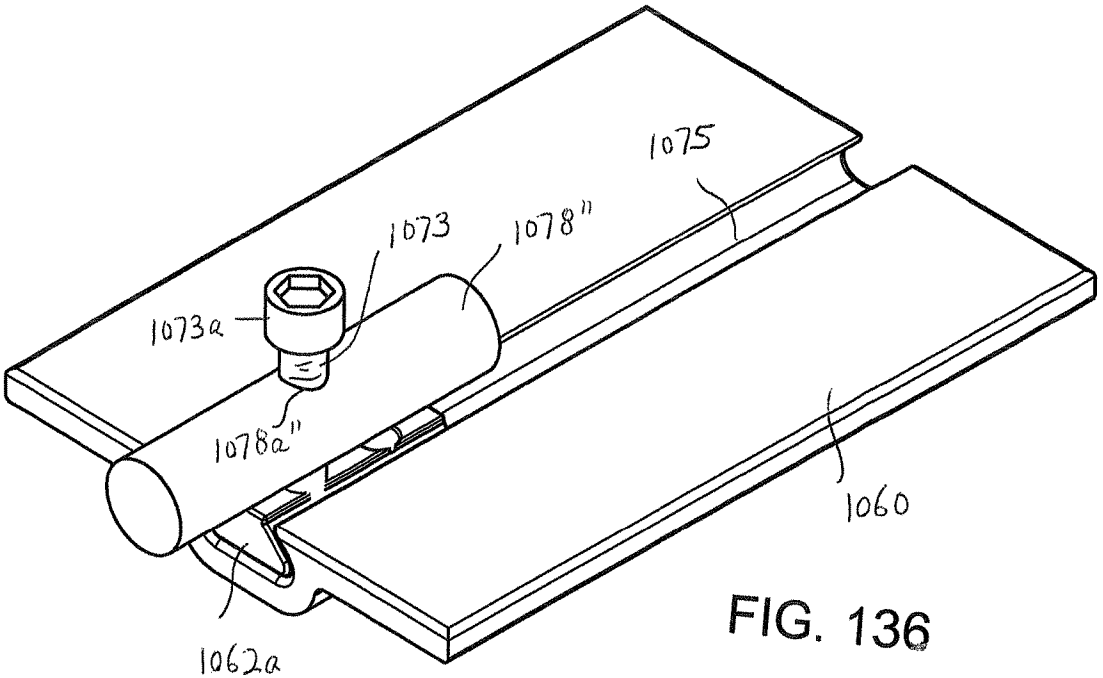
Figure 137:
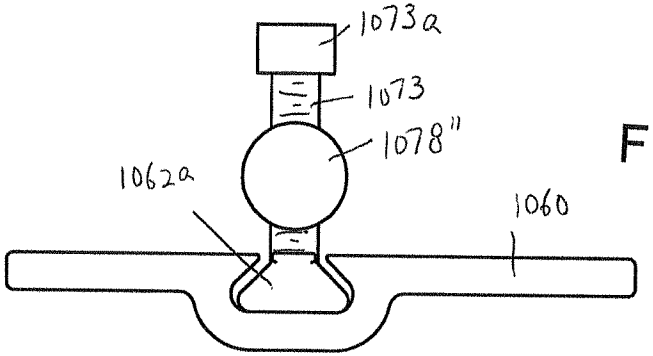

FIG. 110 is a top plan view of the arrangement of FIG. 109;

FIG. 111 is an enlarged perspective view of a portion of the of the arrangement of FIG. 109;

FIG. 112 is a cross-sectional view of the arrangement of FIG. 110, taken along line 112-112 thereof;

FIG. 113 is a perspective view of a modified connecting panel of FIG. 109;

FIG. 114 is a top plan view of the modified connecting panel of FIG. 113;

FIG. 115 is a front elevational view of the modified connecting panel of FIG. 113;

FIG. 116 is a perspective view of a further modified adjustment support member;

FIG. 117 is a perspective view of a still further modified adjustment support member;

FIG. 118 is a perspective view of other modified adjustment support members and modified connecting panels;

FIG. 119 is a perspective view of other modified adjustment support members and modified connecting panels;

FIG. 120 is a top plan view of the arrangement of FIG. 119;

FIG. 121 is an enlarged perspective view of a portion of the of the arrangement of FIG. 119;

FIG. 122 is a cross-sectional view of the arrangement of FIG. 120, taken along line 122-122 thereof;

FIG. 123 is a perspective view of the adjustment support member of FIG. 119;

FIG. 124 is a perspective view of the connecting panel of FIG. 119;

FIG. 125 is a perspective view of another arrangement for securing wall panels to an existing wall, using hooks and annular disks;

FIG. 126 is a perspective view of the annular disk of FIG. 125;

FIG. 127 is top plan view of the annular disk of FIG. 126;

FIG. 128 is a perspective view of the support post of FIG. 125 in a dovetail shaped slot;

FIG. 129 is a side elevational view of the support post of FIG. 128 in the dovetail shaped slot;

FIG. 130 is a perspective view of the annular disk and support post of FIG. 125 in the dovetail shaped slot;

FIG. 131 is a side elevational view of the annular disk and support post of FIG. 130 in the dovetail shaped slot;

FIG. 132 is a perspective view of another embodiment of a support post;

FIG. 133 is a perspective view of an arrangement similar to FIG. 125, but with a rectangular plate in place of the annular disk;

FIG. 134 is a side elevational view of the arrangement of FIG. 133;

FIG. 135 is an and elevational view of the arrangement of FIG. 133;

FIG. 136 is a perspective view of an arrangement similar to FIG. 125, but with a cylinder in place of the annular disk;

FIG. 137 is a side elevational view of the arrangement of FIG. 136; and

Figure 138:
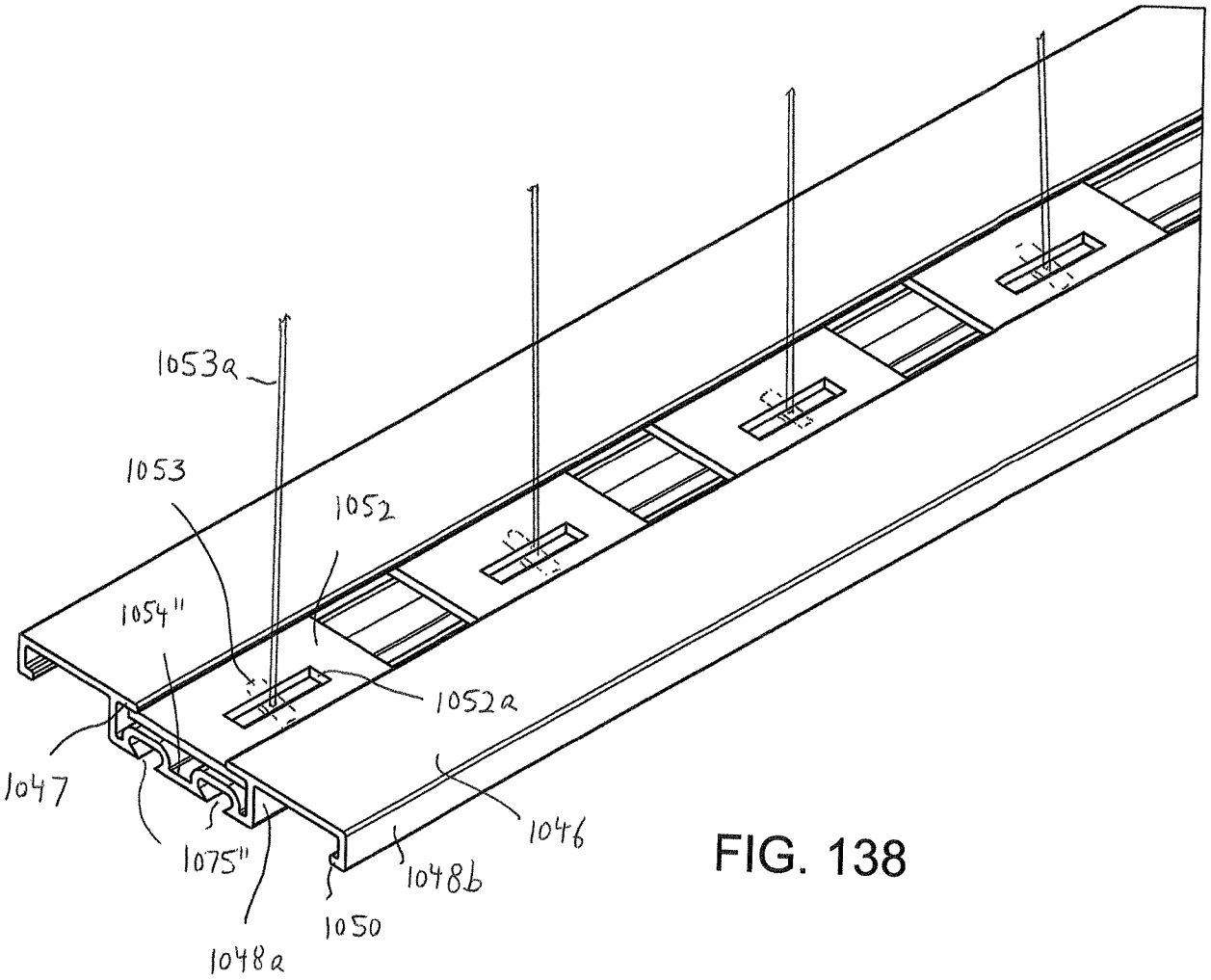

FIG. 138 is a perspective view showing the present invention used for hanging ceiling panels.

DETAILED DESCRIPTION

Figure 1:
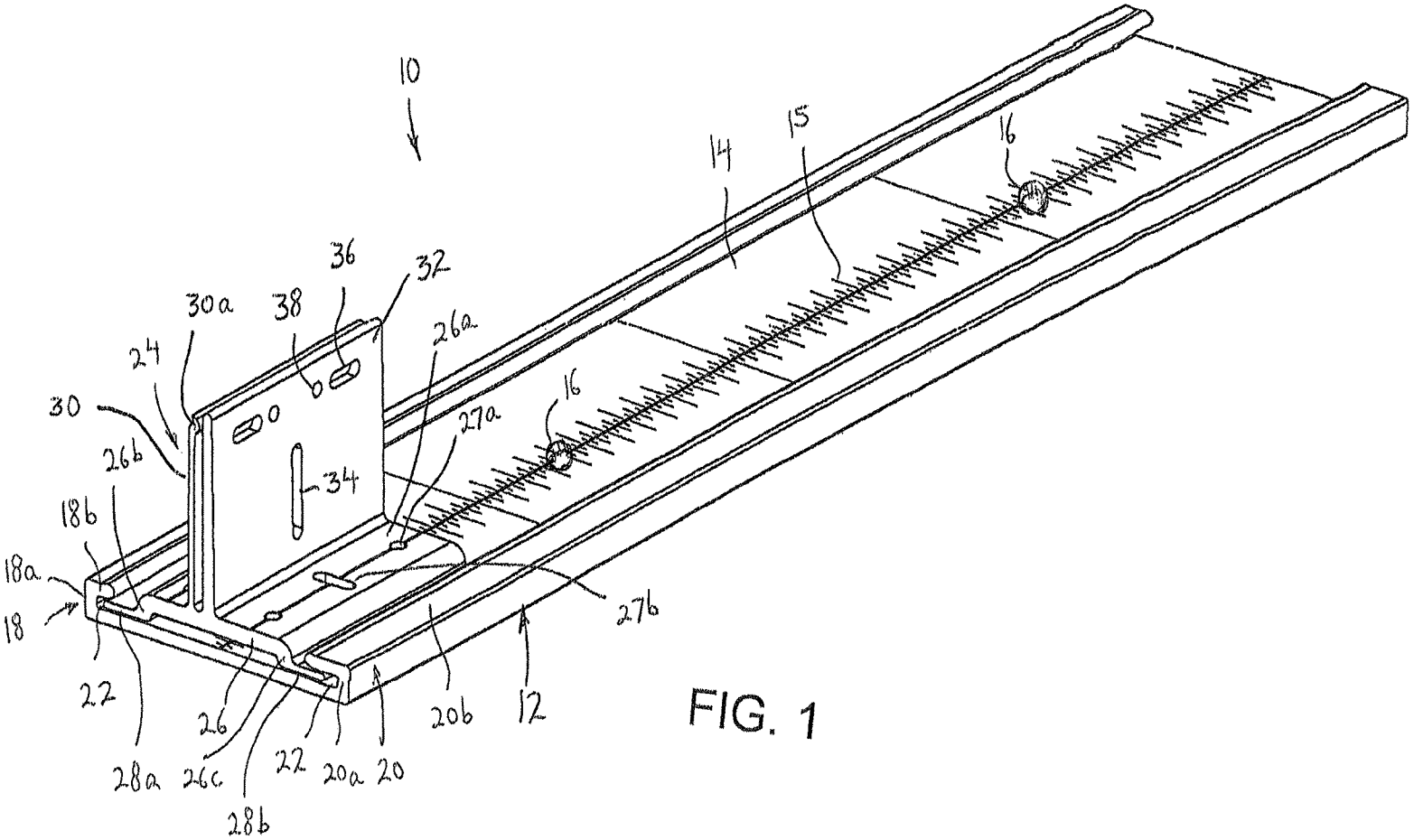
FIG. 1 is a perspective view of the base support and sliding support member of a system for easily mounting wall panels over an existing wall.

Referring to the drawings in detail, and initially to FIG. 1 thereof, there is shown a portion of a system 10 for easily mounting wall panels over an existing wall. System includes a base assembly including an elongated base support 12 that is adapted to be secured to an existing wall (not shown). Base support 12 includes an elongated base plate 14 having measuring gradations 15 along the upper surface thereof and openings 16 therealong through which screws (not shown) are adapted to extend to secure base plate 14 to the existing wall. L-shaped retaining walls 18 and 20 extend outwardly from opposite side edges of base plate 14. Specifically, each L-shaped retaining wall 18, 20 includes a first wall 18*a*, 20*a* that extends at a right angle from a side edge of base plate 14 and an inwardly extending second wall 18*b*, 20*b* that extends toward the opposite side edge of base plate 14 in parallel spaced apart relation to base plate 14 with a space 22 therebetween. Preferably, inwardly extending second wall 20*b* has a greater width than inwardly extending second wall 18*b*, as show best in FIG. 1C, although the present invention is not limited thereto.

An adjustment arrangement for adjustably securing the wall panels to base support 12 at a position with at least two degrees of freedom, includes a sliding support member 24 slidably retained within base support 12. Sliding support member 24 includes a central member formed by an inverted U-shaped plate 26 that fits in the space between the spaced-apart free edges of second walls 18*b*, 20*b*. Inverted U-shaped plate 26 thereby includes an upper plate 26*a* and two downwardly extending leg plate 26*b*, 26*c* at opposite ends thereof that position upper plate 26*a* in parallel, spaced apart relation from the upper surface of base plate 14. A plurality of threaded openings 27*a* and at least one slot 27*b* extend through upper plate 26*a*.

Wing plates 28*a*, 28*b* extend outwardly from opposite free ends of leg plates 26*b*, 26*c* at the side edges of inverted U-shaped plate 26, with wing plates 28*a*, 28*b* slidably retained in spaces 22. It will be appreciated that the distance between the free end edges of wing plates 28*a*, 28*b* is less than the distance between first walls 18*a*, 20*a* of L-shaped retaining walls 18, 20 so as to permit lengthwise sliding adjustment of sliding support member 24 along a first lengthwise direction of base support 12, while also permitting transverse, side to side sliding adjustment of sliding support member 24 within base support 12 along a second transverse direction, thereby providing two degrees of freedom.

In this manner, adjustment bolts 25 (FIG. 1A) are adapted to be threadedly received within threaded openings 27*a* to engage the upper surface of base plate 14 in order to adjust the height of sliding support member 24 relative thereto. In other words, as bolts 25 are rotated, with the free ends of bolts 25 in contact with the upper surface of base plate 14, sliding support member 24 moves up or down on bolts 25, depending upon the direction of rotation of bolts 25, to thereby raise or lower sliding support member 24. This also causes the upper surfaces of wing plates 28*a* and 28*b* to tightly engage against the underside of second walls 18*b* and 20*b*, respectively, to lock sliding support member 24 in that position. Thereafter, a screw (not shown) can be inserted through each slot 27*b* into base plate 14 and, if desired, into the existing wall, to further lock sliding support members 24 in position. Thus, sliding support member 24 can be locked to base plate 14 after sliding support member 24 has been moved and adjusted in the first lengthwise direction and second transverse direction. Further, slots 27*b* permit further later transverse adjustment by loosening any screws therein, transversely adjusting sliding support member 24 and re-tightening the screws.

Two parallel, spaced apart capture walls 30, 32 extend upwardly at the center of upper plate 26*a*, preferably along the entire length of upper plate 26*a*. The upper end of capture wall 30 includes an inwardly directed lip 30*a*, as best shown in FIG. 1D. Each capture wall 30, 32 preferably includes at least one slot 34 oriented in a third direction which is orthogonal to the first lengthwise direction and second transverse direction, at least one slot 36 oriented in the first lengthwise direction and at least one circular threaded will opening 38.

Although base support 12 has been shown with L-shaped retaining walls 18 and 20, second walls 18*b* and 20*b* can be eliminated.

Figure 1A:
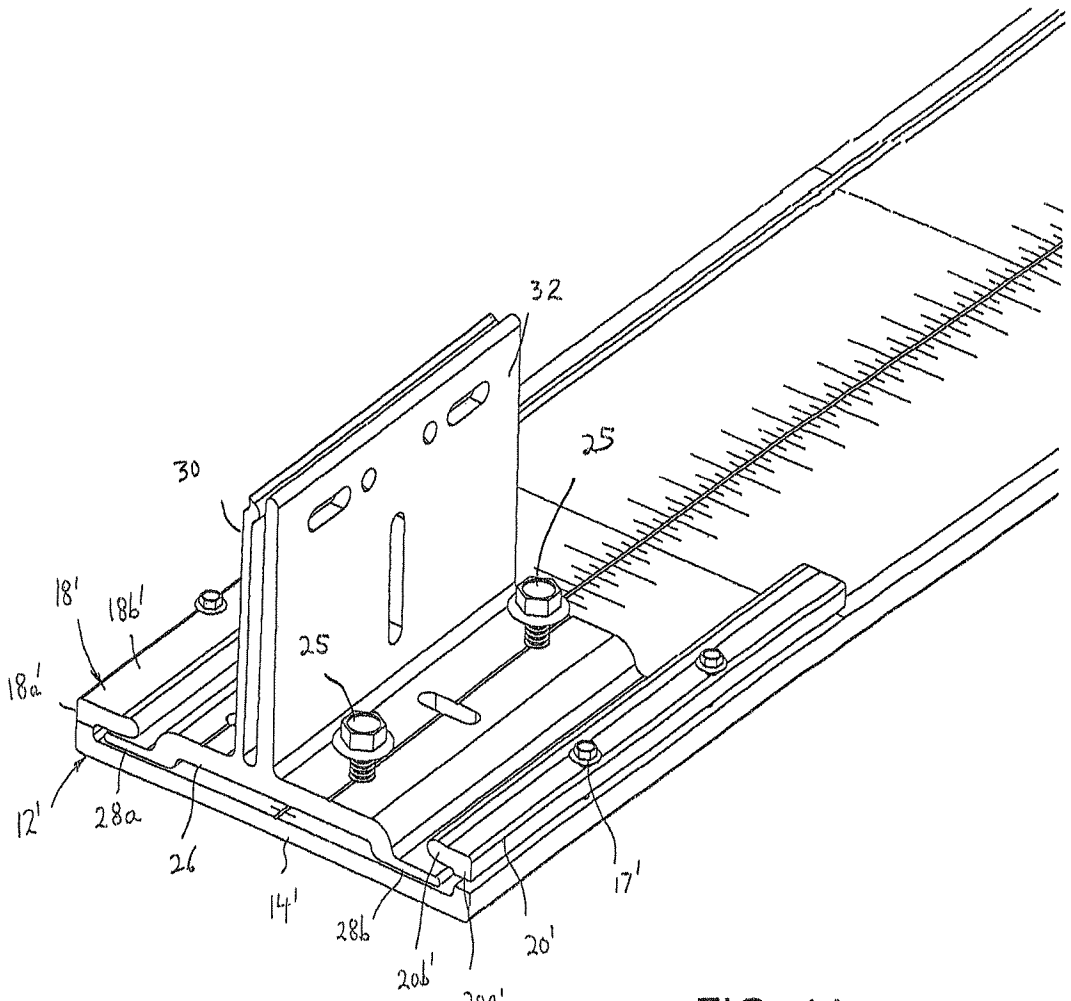
FIG. 1A is a perspective view of a first modified base support with sliding support member.

A first modified base support 12' is shown in FIG. 1A, in which second walls 18*b*', 20*b*' and a portion 18*a*', 20*a*' of the first walls of L-shaped retaining walls 18', 20' are formed separate from base plate 14', and are secured to base plate 14' by screws 17' that provide a small height adjustment of second walls 18*b*', 20*b*' relative to base plate 14' in the aforementioned third direction in order to accommodate different thickness wing plates 28*a*, 28*b* and/or allow for further height adjustment of wing plates 28*a*, 28*b* in a third direction by adjustment bolts 25.

Figure 1B:
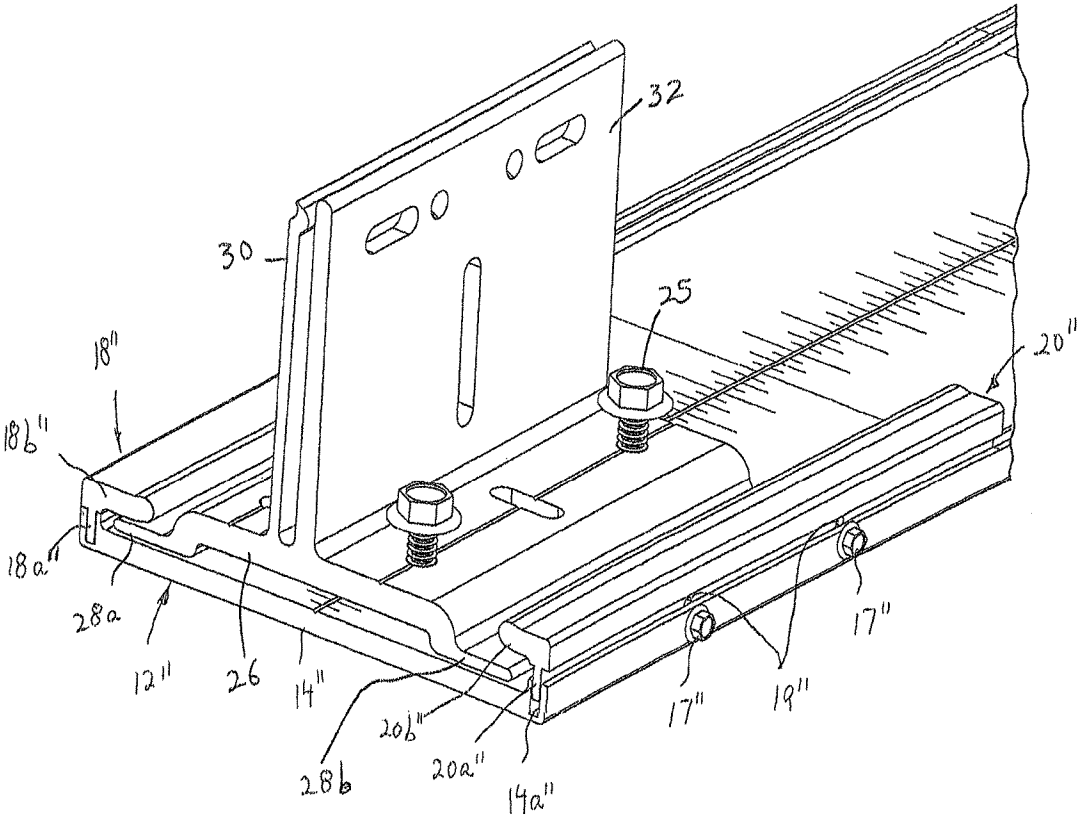
FIG. 1B is a perspective view of a second modified base support with sliding support member.

A second modified base support 12" is shown in FIG. 1B, in which L-shaped retaining walls 18", 20" are formed separate from base plate 14". In this modification, base plate 14" is provided with lengthwise slots 14*a*" along each side edge, and first walls 18*a*", 20*a*" of L-shaped retaining walls 18", 20" fit within slots 14*a*". Each first wall 18*a*", 20*a*" has a plurality of elongated slots 19" extending in the third direction and screws 17" extend through openings in side edges of base plate 14" and extend through elongated slots 19" and are tightened so as to hold L-shaped retaining walls 18", 20" at a small desired adjusted height in the third direction.

Figure 1C:
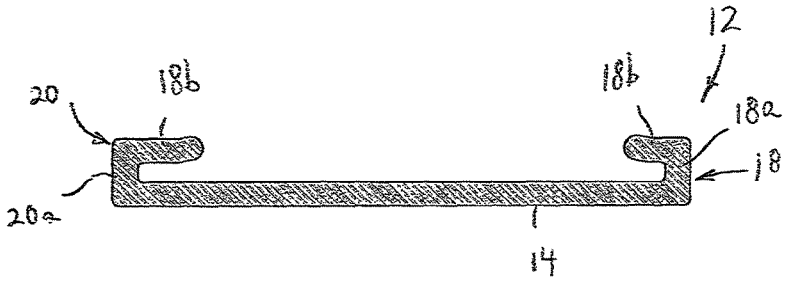
FIG. 1C is a cross-sectional view of the base support of FIG. 1.
Figure 1D:
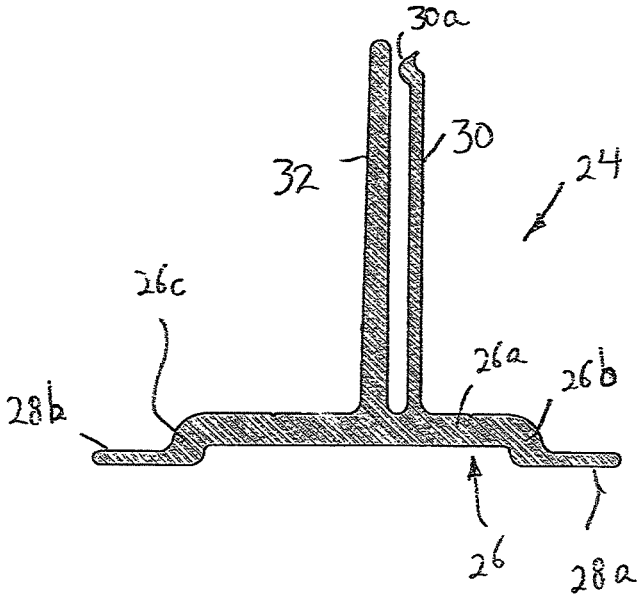
FIG. 1D is a cross-sectional view of the sliding support member of FIG. 1.

As shown best in FIG. 1C, second wall 18*b* is preferably shorter in the second transverse direction than the other second wall 20*b*, and the free ends of each second wall 18*b*, 20*b* are preferably upturned slightly.

Figure 1E:
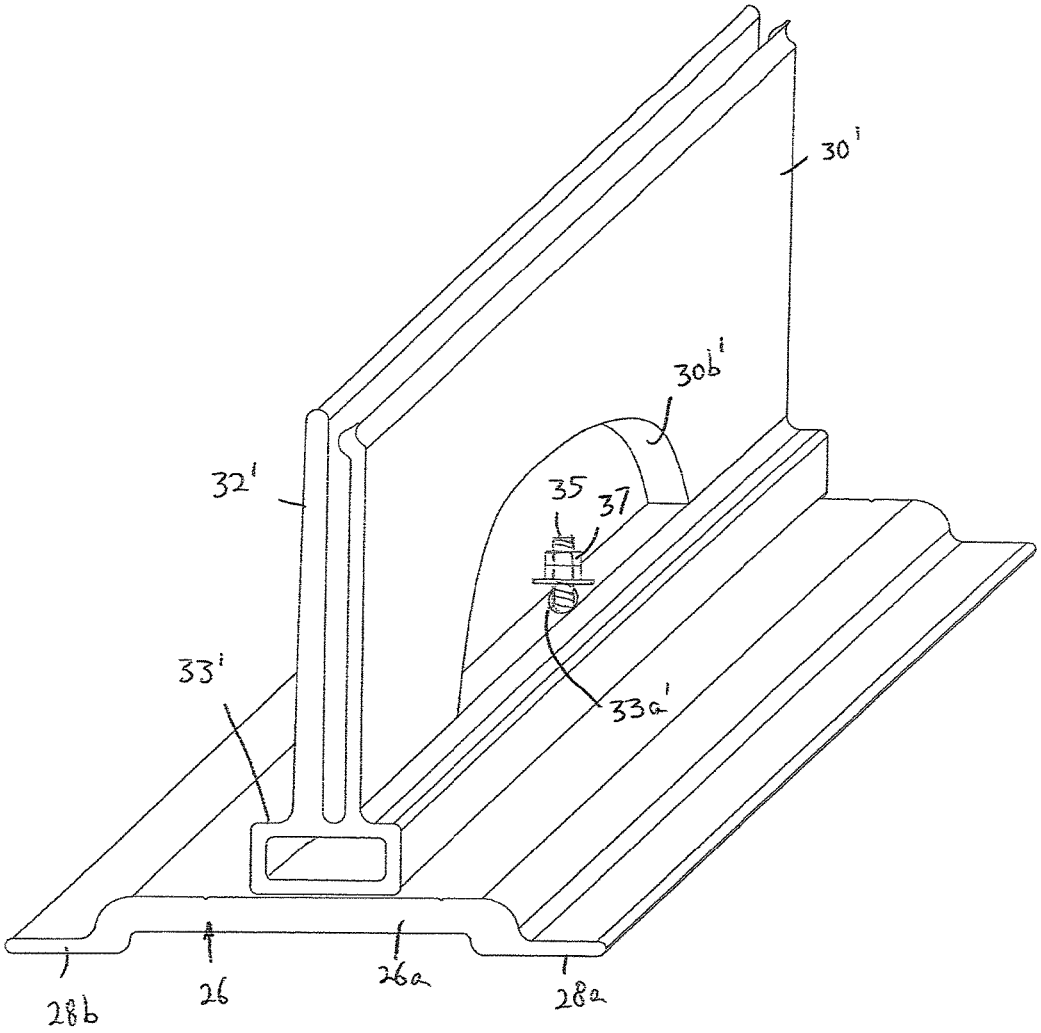
FIG. 1E is a perspective view of a modified sliding support member.
Figure 1F:
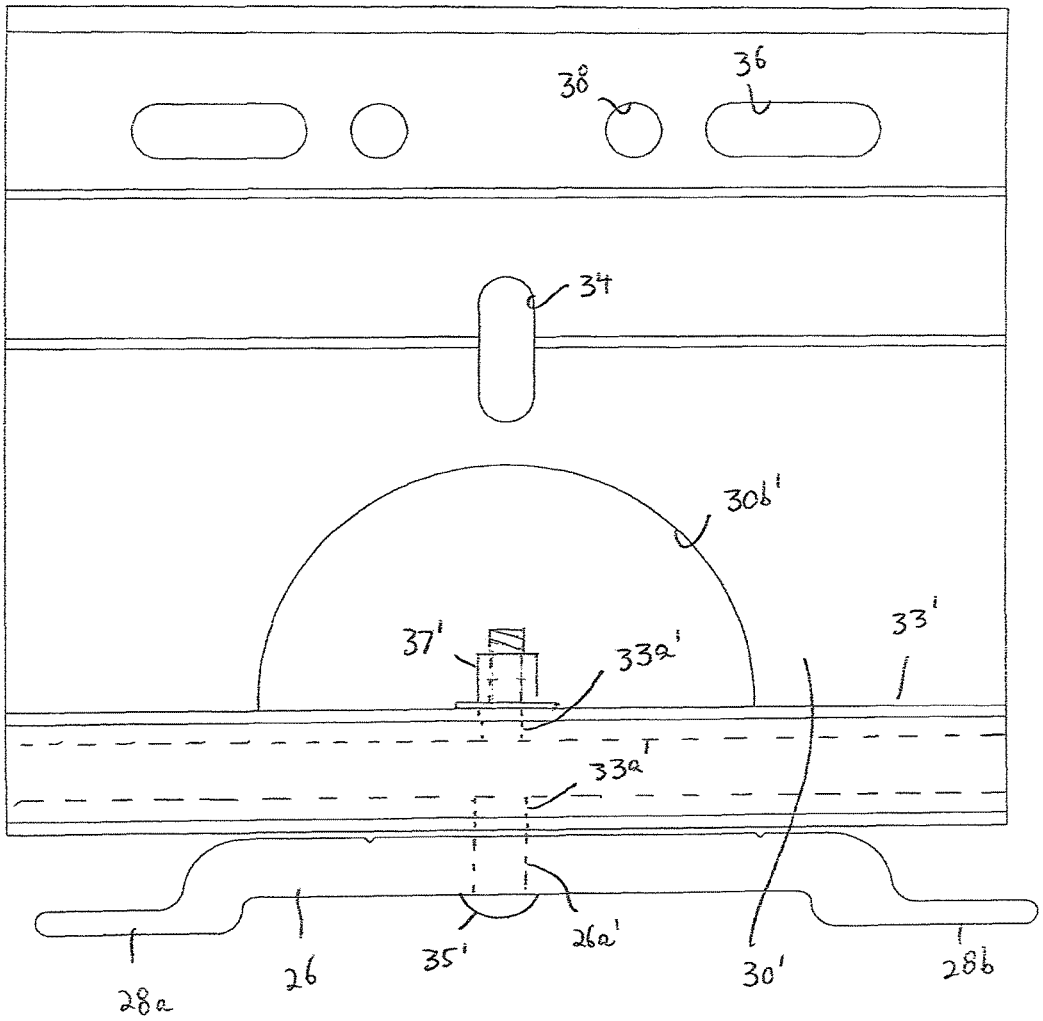
FIG. 1F is a plan view of the modified sliding support member of FIG. 1E.

It will be appreciated that, although sliding support member 24 is shown as a single piece, unitary member, it can be formed from a plurality of parts, for example, as shown in FIGS. 1E and 1F. Specifically, inverted U-shaped plate 26 and wing plates 28*a* and 28*b* are formed as a single, unitary member. Another single, unitary member is formed by capture walls 30' and 32' connected at the lower ends to an elongated hollow rectangular bar 33' that seats in the first lengthwise direction centrally on the upper surface of upper plate 26*a*. Capture wall 30' includes a central arc shaped opening 30*b*', and aligned through openings 33*a*' extend through the upper and lower portions of rectangular bar 33' and which are aligned with an opening 26*a*' through U-shaped plate 26. A bolt 35' extends upwardly through opening 26*a*' and openings 33*a*', and a nut 37' is threateningly connected to bolt 35' so as to secure rectangular bar 33' to U-shaped plate 26. It will be appreciated that this arrangement provides a further degree of adjustment, that is, an angular or rotating adjustment of capture walls 30' and 32' relative to the lengthwise direction of U-shaped plate 26.

Figure 1H:
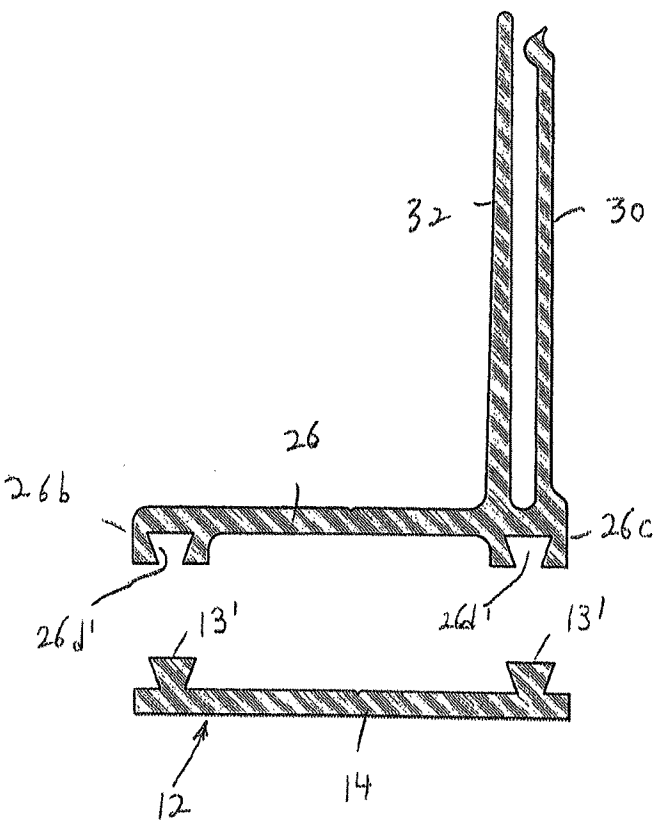
FIG. 1H is a cross-sectional view of a further modified sliding support member.
Figure 1G:
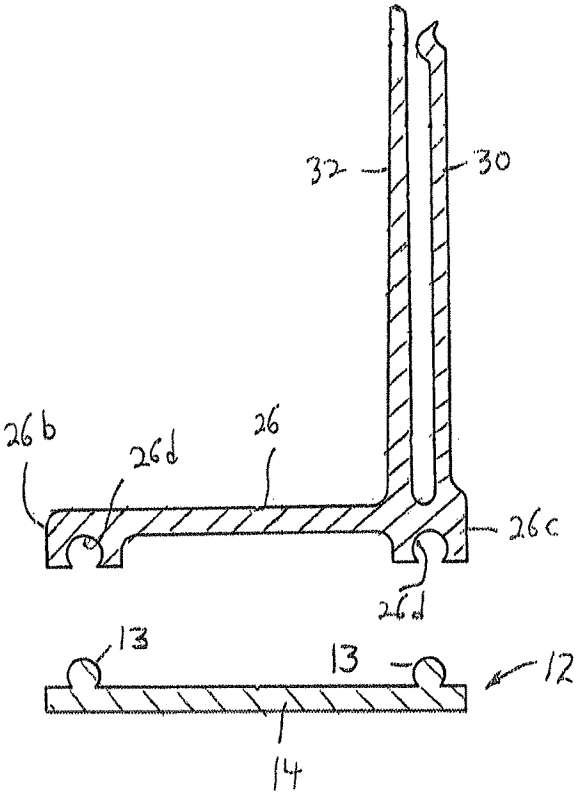
FIG. 1G is a cross-sectional view of a further modified sliding support member.

As another example, as shown in FIG. 1G, wing plates 28*a* and 28*b* are eliminated, and the underside of leg plates 26*b* and 26*c* are provided with elongated part circular openings 26*d*. In such case, L-shaped retaining walls 18 are eliminated from base support 12, with the upper surface of base plate 14 being provided with bulbous projections 13 that are adapted to snap or slide into part circular openings 26*d*. With such arrangement, after projections 13 have been snap or slid fit into openings 26*d*, inverted U-shaped plate 26 can either be permanently fixed, or alternatively, slid, relative to base plate 14. In addition, as shown, retaining walls 30 and 32 are positioned immediately over leg plate 26*c*, rather than being centered on inverted U-shaped plate 26.

FIG. 1H shows a modification in which the part circular openings 26*d* and bulbous projections 13 are replaced with dovetail shaped openings 26*d*' and dovetail shaped projections 13'.

Figure 1I:
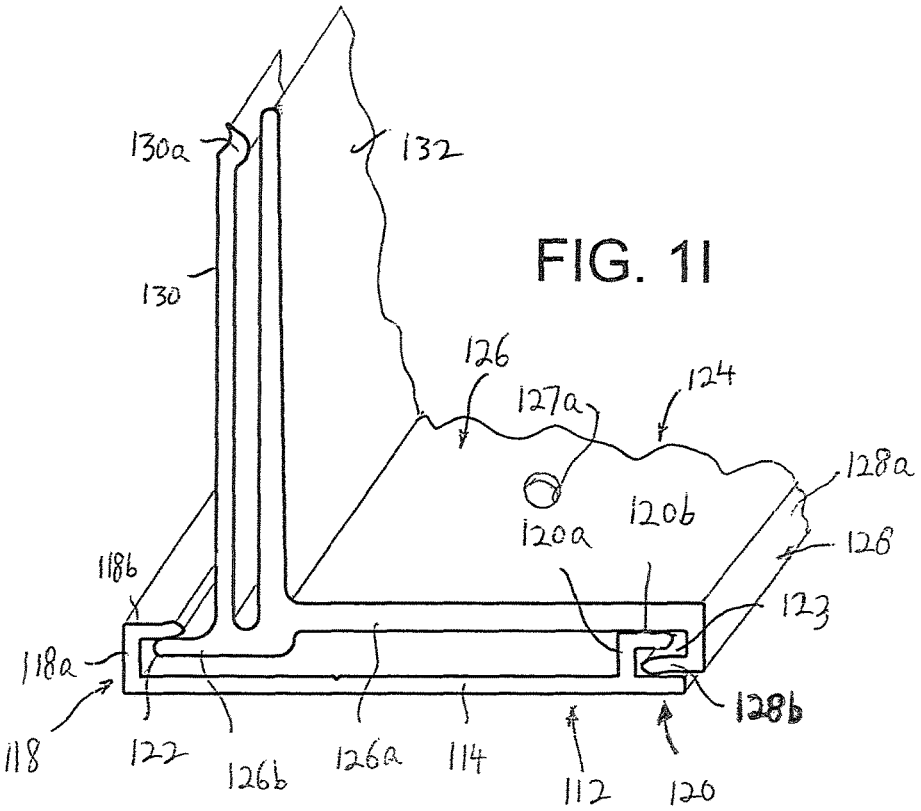
FIG. 1I is a perspective view of a modified base support and sliding support member.

FIG. 1I shows a modification of the embodiment of FIG. 1 in which base support 12 is replaced by a modified base support 112. Base support 112 includes an elongated base plate 114 having measuring gradations (not shown) along the upper surface thereof and openings (not shown but the same as openings 16) therealong through which screws (not shown) are adapted to extend to secure base plate 114 to the existing wall. L-shaped retaining walls 118 and 120 extend outwardly from opposite side edges of base plate 114. Specifically, L-shaped retaining wall 118 is identical to L-shaped retaining wall 18, and includes a first wall 118*a* that extends at a right angle from one side edge of base plate 114 and an inwardly extending second wall 118*b* that extends toward the opposite side edge of base plate 114 in parallel spaced apart relation to base plate 114 with a space 122 therebetween. However, in place of second wall 20, L-shaped retaining wall 120 includes a first wall 120*a* that extends at a right angle from the upper surface of base plate 114 and spaced slightly inwardly from the opposite side edge of base plate 114, and an outwardly extending second wall 120*b* that extends outwardly from the upper end of first wall 120*a* in parallel spaced apart relation to base plate 114 with a space 123 therebetween.

Sliding support member 24 is replaced by a modified sliding support member 124 slidably retained within base support 112. Sliding support member 124 includes a central member that differs from inverted U-shaped plate 26 of the embodiment of FIG. 1. Specifically, sliding support member 124 includes an upper plate 126 formed by a first rectangular plate section 126*a* and a second smaller rectangular plate section 126*b* that is stepped down from one side edge of first rectangular plate section 126*a* so as to be parallel thereto. A plurality of threaded openings 127*a*, only one of which is shown, and at least one slot (not shown but the same as slot 27*b*) extend through first rectangular plate section 126*a*.

The free end of second smaller rectangular plate section 126*b* slides beneath second wall 118*b*. An L-shaped retaining wall 128 extends downwardly and inwardly from the free end of first rectangular plate section 126*a*. Specifically, L-shaped retaining wall 128 includes a first wall section 128*a* downwardly extending at a right angle from first rectangular plate section 126*a*, to the outside of second wall 120*b*, and a second wall section 128*b* that extends inwardly from the lower free end of first wall section 128*a*, into sliding engagement in space 123. In this manner, as in the first embodiment, lengthwise sliding adjustment of sliding support member 124 is permitted along a first lengthwise direction of base support 112, while also permitting transverse, side to side sliding adjustment of sliding support member 124 within base support 112 along a second transverse direction, thereby providing two degrees of freedom.

In this regard, L-shaped retaining wall 118 and L-shaped retaining wall 128 constitute wrap-around capture walls, with L-shaped retaining wall 118 wrapping about and capturing second smaller rectangular plate section 126*b* of sliding support member 124 and L-shaped retaining wall 128 wrapping about and capturing outwardly extending second wall 120*b* of base support 12.

In this manner, adjustment bolts (25 in FIG. 1A) are adapted to be threadedly received within threaded openings 127*a* to engage the upper surface of base plate 114 in order to adjust the height of sliding support member 124 relative thereto. In other words, as bolts 25 are rotated, with the free ends of bolts 25 in contact with the upper surface of base plate 114, sliding support member 124 moves up or down on bolts 25, depending upon the direction of rotation of bolts 25, to thereby raise or lower sliding support member 124. This also causes the upper surfaces of second smaller rectangular plate section 126*b* and second wall section 128*b* to tightly engage against the underside of second walls 118*b* and 120*b*, respectively, to lock sliding support member 124 in that position. Thereafter, a screw (not shown) can be inserted through each slot (27*b* shown in FIG. 1) into base plate 114 and, if desired, into the existing wall, to further lock sliding support members 124 in position. Thus, sliding support member 124 can be locked to base plate 114 after sliding support member 124 has been moved and adjusted in the first lengthwise direction and second transverse direction. Further, slots 27*b* permit further later transverse adjustment by loosening any screws therein, transversely adjusting sliding support member 24 and re-tightening the screws.

Two parallel, spaced apart capture walls 130, 132 extend upwardly from the upper surface of upper plate 126, preferably along the entire length of upper plate 126. Specifically, capture wall 132 extends upwardly from the edge of first rectangular plate section 126*a* where it meets with second smaller rectangular plate section 126*b*, and capture wall 130 extends upwardly from the upper surface of second smaller rectangular plate section 126*b*. It will therefore be appreciated that, unlike the embodiment of FIG. 1, capture walls 130, 132 are not centered, but rather, are positioned to one side of sliding support member 124, similar to that shown in FIGS. 1G and 1H. The upper end of capture wall 130 includes an inwardly directed lip 130*a*. Each capture wall 30, 32 preferably includes at least one slot (the same as slot 34 in FIG. 1) oriented in a third direction which is orthogonal to the first lengthwise direction and second transverse direction, at least one slot (the same as slot 36 in FIG. 1) oriented in the first lengthwise direction and at least one circular threaded will opening (the same as opening 38 in FIG. 1).

Figure 1J:
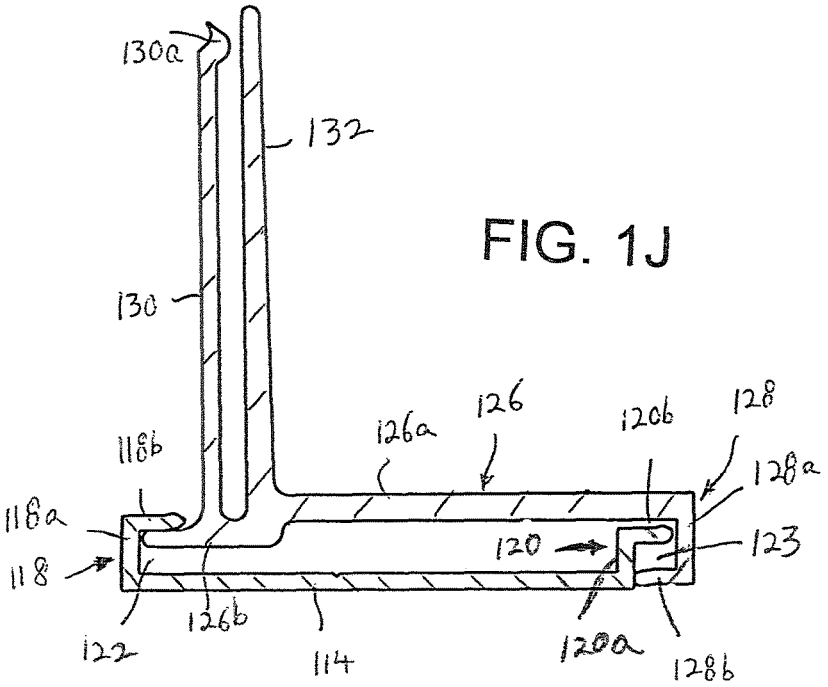
FIG. 1J is a cross-sectional view of another modified base support and sliding support member.

FIG. 1J shows a modification of the embodiment of FIG. 1I in which all elements are identical and denoted by the same reference designator, where applicable. The only difference is that first wall 120*a* extends at a right angle from the upper surface of base plate 114 at the opposite side edge of base plate 114, rather than being spaced slightly inwardly from the opposite side edge of base plate 114.

Figure 2:
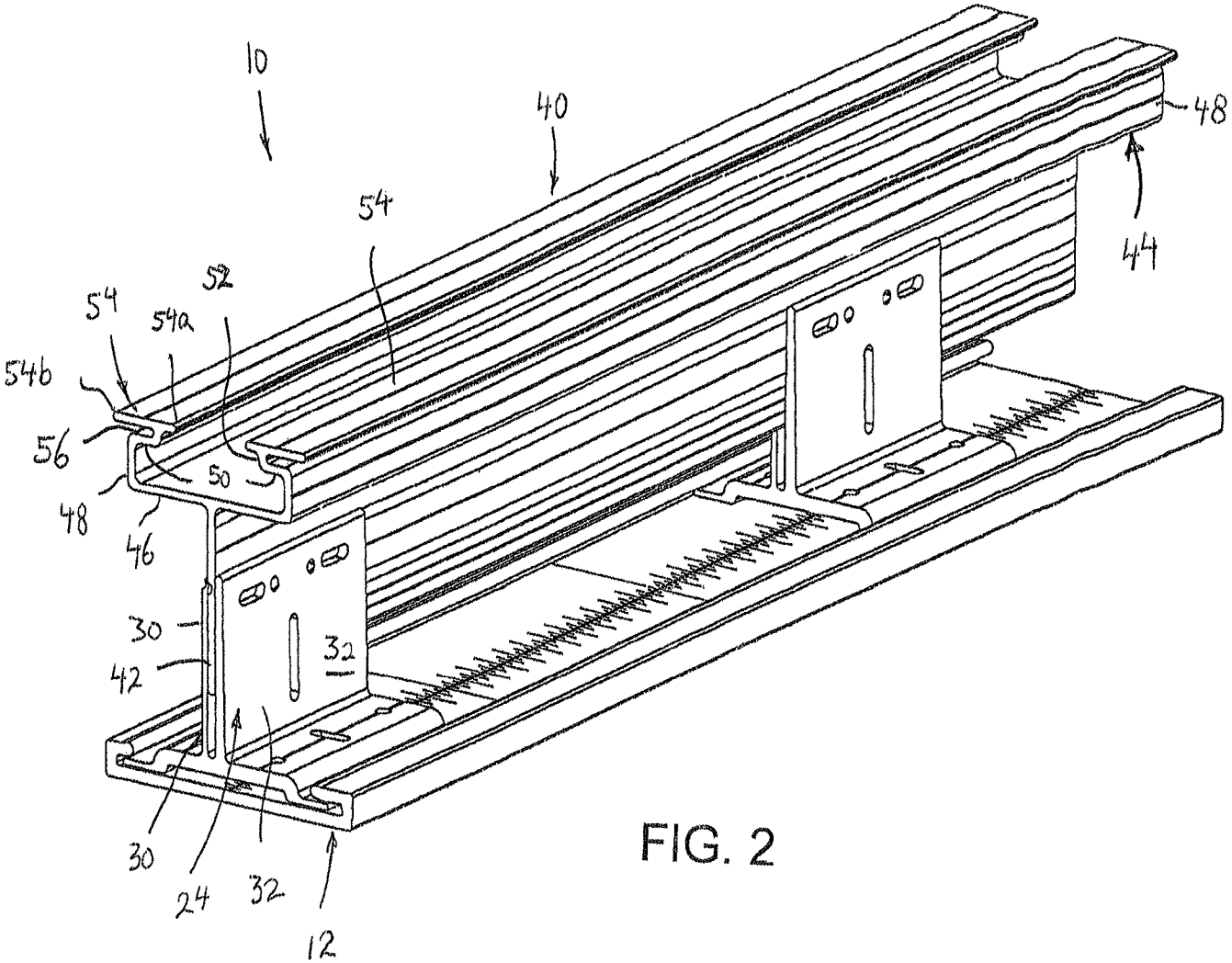
FIG. 2 is a perspective view of an adjustment support member with the assembly of FIG. 1.

As shown in FIG. 2, in order to provide large adjustment in the third direction which is orthogonal to the first lengthwise direction and second transverse direction, an adjustment support member 40 is connected with sliding support member 24 and can be adjusted relative thereto in the third direction which is orthogonal to the first lengthwise direction and second transverse direction. Preferably, sliding support member 24 is made of a thermal blocking material, such as polyamide, to thermally block heat transfer between base 12 and adjustment support member 40.

Specifically, adjustment support member 40 includes an elongated rectangular plate 42 that is dimensioned to fit snugly between capture walls 30 and 32, such that retaining lip 30*a* applies pressure to plate 42. It will be appreciated that plate 42 can be moved in the first lengthwise direction, as well as the third direction which is orthogonal to the first lengthwise direction and second transverse direction, and once positioned at the desired location, is secured in that position by screws extending through at least one of slots 34, 36 and openings 38. Although there are no fixed openings in plate 42, the screws can still pass therethrough. Alternatively, openings can also be provided in plate 42. Further, at any time, the screws can be loosened, plate 42 is then adjusted in position and the screws are retightened. Alternatively, it will be appreciated that slots 34, 36 and openings 38 can be provided in plate 42 instead of, or in addition to, capture walls 30 and 32.

Adjustment support member 40 includes a U-shaped track 44, with an elongated rectangular lower plate 46 and two upstanding, parallel, spaced apart walls 48 extending in the third direction from opposite lengthwise edges of lower plate 46. The opposite free lengthwise edge of rectangular plate 42 is fixed centrally to the lower surface of lower plate 46 in the lengthwise direction thereof, such that when plate 42 is captured between capture walls 30 and 32, lower plate 46 of track 44 is preferably oriented in parallel spaced relation from base plate 14.

U-shaped track 44 further includes inwardly directed walls 50 extending inwardly toward each other from the lengthwise edges of spaced apart walls 48, in parallel, spaced apart relation to lower plate 46. A further elongated stub wall 52 extends in the third direction from the free lengthwise edge of each inwardly directed wall 50. Finally, an elongated retaining wall 54 is connected to the free end of each stub wall 52 and extends in a direction in parallel, spaced apart relation to inwardly directed walls 50. Specifically, each stub wall 52 is connected to each retaining wall 54 at a position slightly spaced from the inner edge thereof such that a first inner portion 54*a* of each retaining wall 54 extends inwardly of the respective stub wall 52 so as to be in parallel, spaced apart relation from lower plate 46, and such that a larger second outer portion 54*b* of each retaining wall 54 extends outwardly of the respective stub wall 52 so as to be in parallel, spaced apart relation from the respective inwardly directed wall 50 with an elongated gap 56 therebetween.

Although not shown in FIG. 2, lower plate 46 of adjustment support member 40 preferably includes measuring gradations thereon similar to the measuring gradations 15. In this regard, reference is made to measuring gradations 715 in FIG. 37. Further, although not shown in FIG. 2, each retaining wall 54 preferably also includes measuring gradations thereon similar to the measuring gradations 15. In this regard, reference is made to measuring gradations 719 in FIG. 37.

Preferably, base support 12, sliding support member 24 and adjustment support member 40 are made of a thermally isolated material such as polyamide, an equivalent thereof or any other suitable material.

With the above arrangement, it will be appreciated that adjustment of the position of the wall panels on an existing wall can occur in the first lengthwise, second transverse and third orthogonal directions by adjustment of sliding support members 24 in base support 12, and in the third orthogonal direction as well as the first lengthwise direction by adjustment of plates 42 in sliding support member 24.

Figure 3:
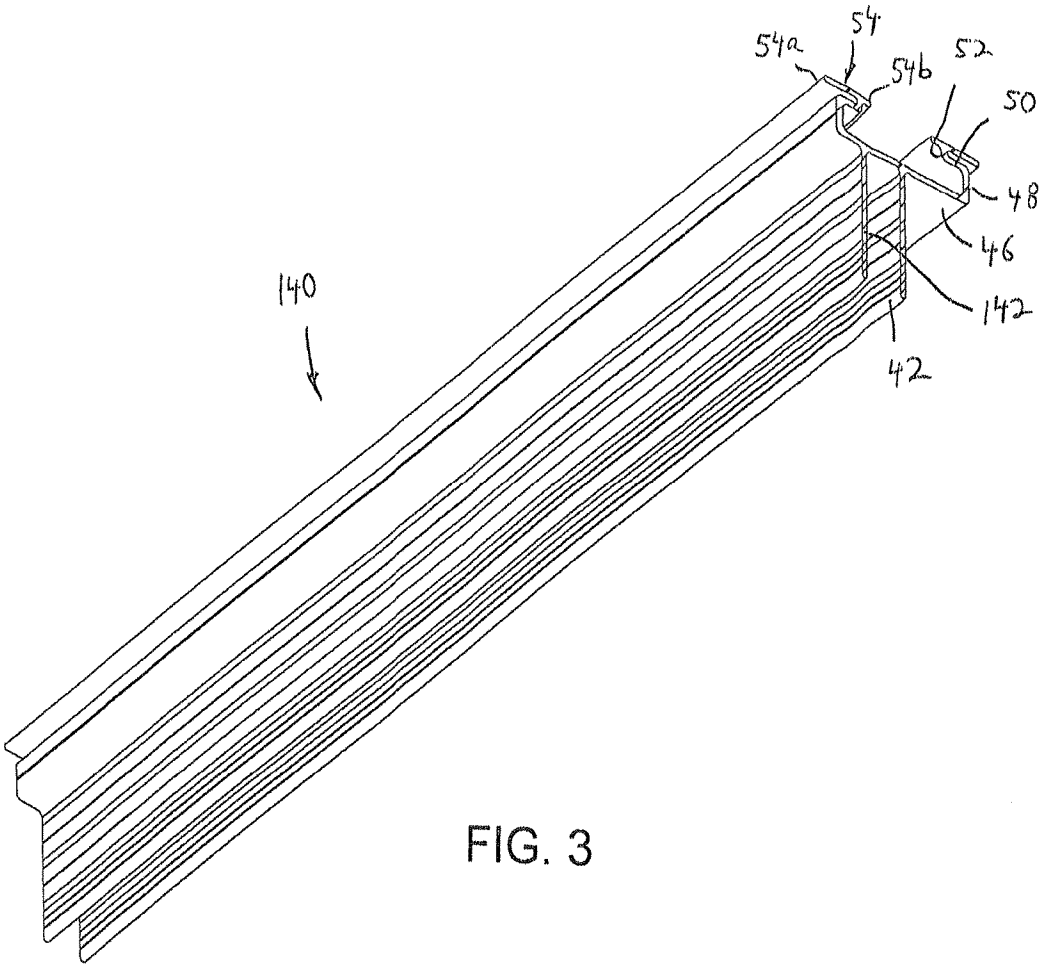
FIG. 3 is a perspective view of a modified adjustment support member.

Referring now to FIG. 3, there is shown a modified adjustment support member 140 which is identical to adjustment support member 40, and the same numerals are provided, except for any differences. Modified adjustment support member 140 provides a second elongated rectangular plate 142 that extends from the underside of lower plate 46 in parallel, spaced apart relation from elongated rectangular plate 42. In this manner, while elongated rectangular plate 42 is positioned between retaining walls 30 and 32, second elongated rectangular plate 142 is positioned to the outside of one of retaining walls 30 and 32, to provide additional securement and stability.

Figure 4:
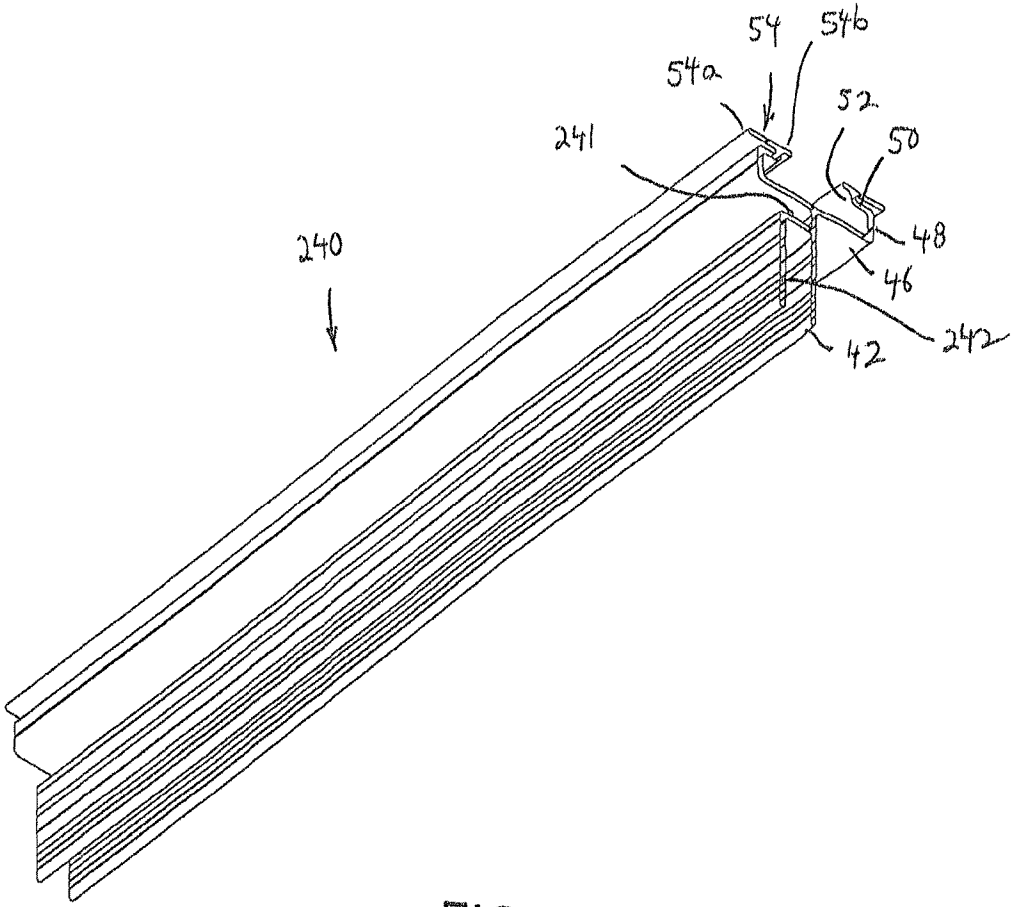
FIG. 4 is a perspective view of another modified adjustment support member.

FIG. 4 shows another modified adjustment support member 240 which is identical to adjustment support member 40, and the same numerals are provided, except for any differences. Modified adjustment support member 240 provides an L-shaped wall connected to elongated rectangular plate 42 at a position spaced slightly below the underside of lower plate 46, and thereby includes a transverse connecting wall 241 and a second elongated rectangular plate 242 that extend from the free end of transverse connecting wall 241 in parallel, spaced apart relation from elongated rectangular plate 42. This arrangement provides additional height adjustability of adjustment support member 40.

One manner of connecting wall panels over an existing wall with the above arrangement, will now be discussed.

Figure 5:
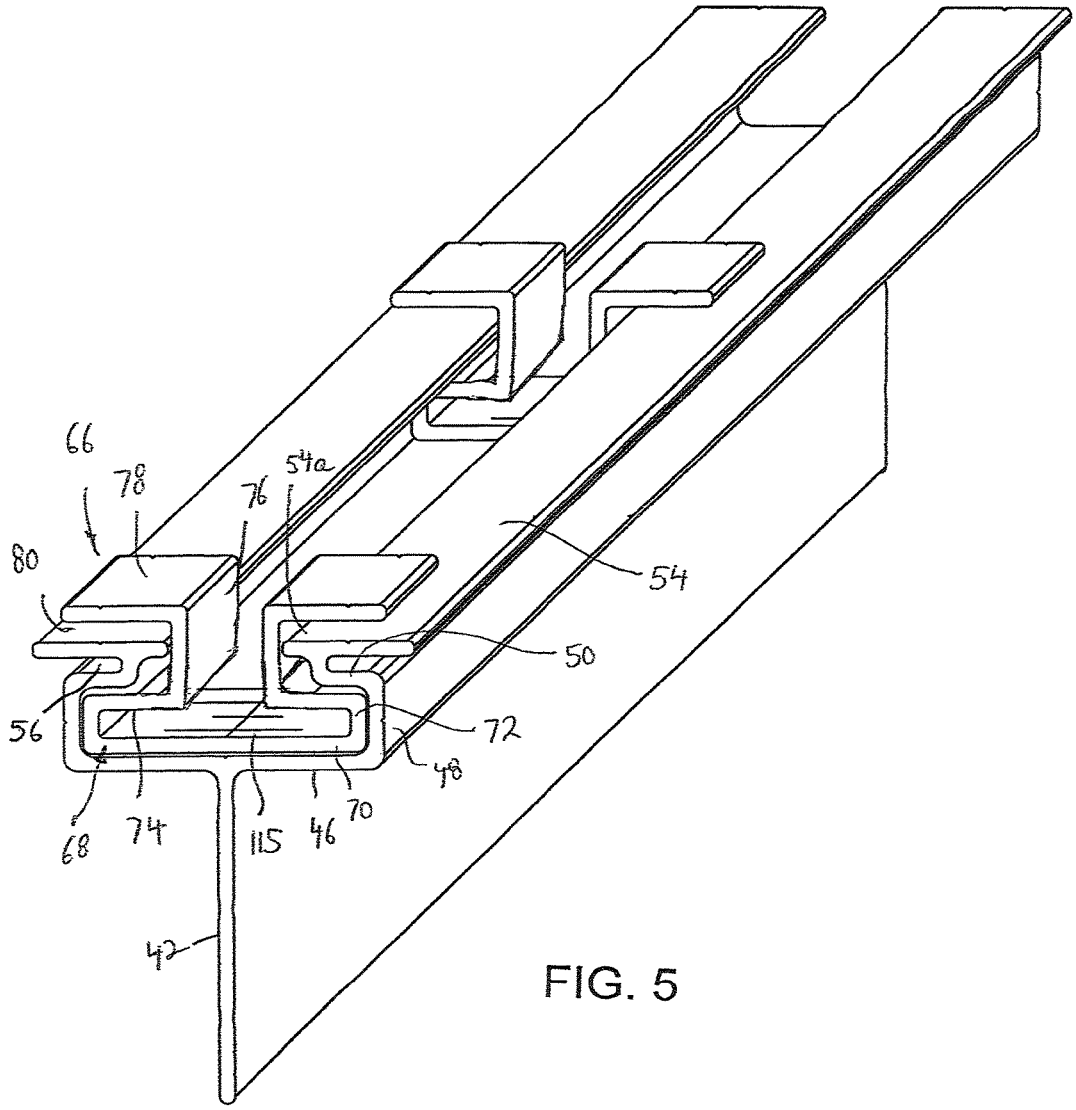
FIG. 5 is a perspective view of the adjustment support member of FIG. 2, assembled with wall panel sliding supports.
Figure 6:
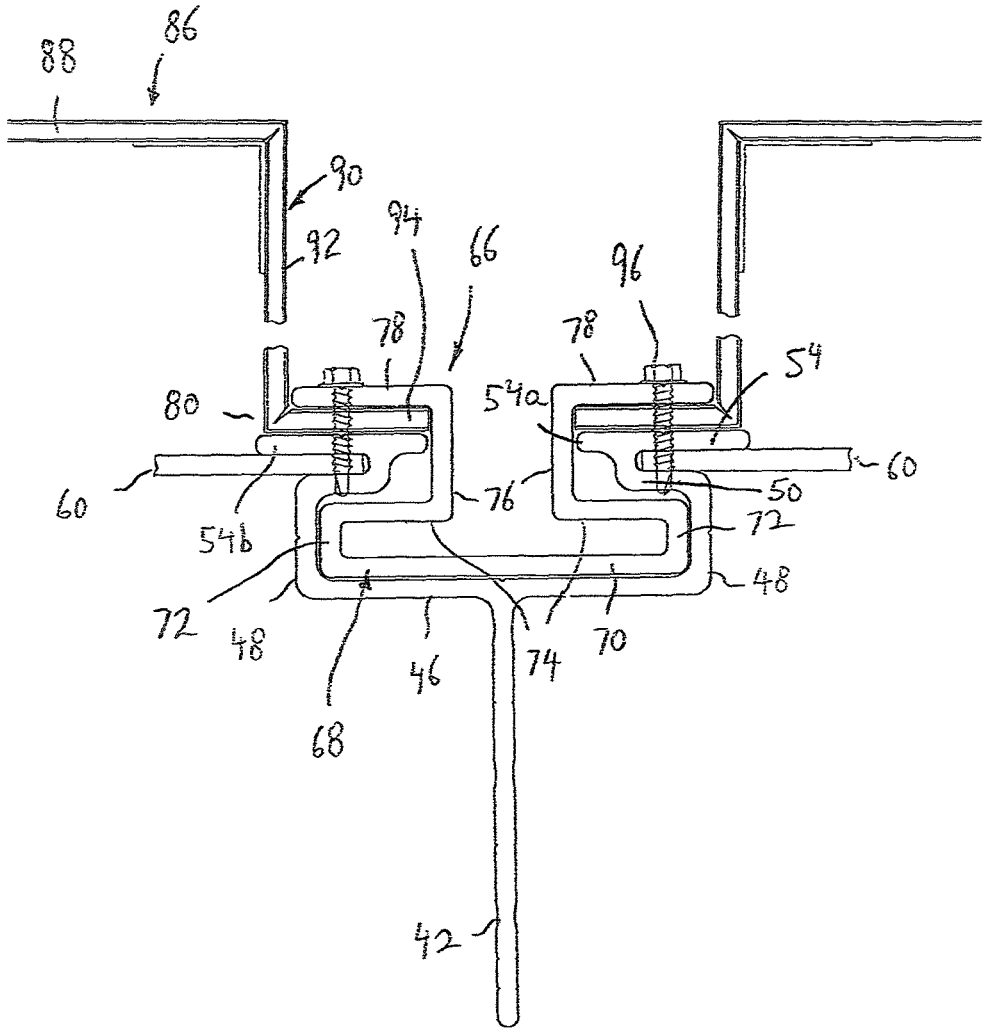
FIG. 6 is a plan view of arrangement of FIG. 5, assembled with wall panels and connecting panels.

Specifically, as shown in FIGS. 5 and 6, wall panel sliding supports 66 are slidably retained in each U-shaped track 44. Each wall panel sliding support 66 includes a U-shaped slide 68 that fits slidably within U-shaped track 44, and includes an elongated rectangular lower plate 70 positioned in sliding engagement on lower plate 46, and two upstanding, parallel, spaced apart walls 72 positioned in parallel, sliding engagement within upstanding walls 48 and extending from opposite lengthwise edges of lower plate 70. Measuring markings or gradations 115 are provided on the upper surface of elongated rectangular lower plate 70 similar to measuring gradations 15.

U-shaped slide 68 further includes inwardly directed walls 74 extending inwardly toward each other from the lengthwise edges of spaced apart walls 72 and positioned in parallel, sliding engagement beneath inwardly directed walls 50, so as to slidably capture U-shaped slide 68 within U-shaped track 44.

Extension walls 76 extend in the third direction from the free lengthwise edge of each inwardly directed wall 74 at a position inwardly of the first inner portion 54*a* of retaining walls 54 such that the opposite lengthwise edges of walls 76 terminate inwardly and are spaced above in the third orthogonal direction from the inner edge of first portion 54*a* of retaining walls 54. A retaining wall 78 is connected to the outer free end of each wall 76 and extends in a direction in the second transverse direction in parallel, spaced apart relation to the respective retaining wall 54 with a space 80 therebetween.

As shown in FIG. 6, connecting panels 60 can be provided to connect together spaced apart adjustment support members 40. Specifically, each connecting panels 60 has one end inserted in a gap 56 of one adjustment support member 40 and the opposite end in a gap 56 of another spaced apart adjustment support member 40.

With this arrangement, wall panels 86 to be secured over an existing wall, include an outer exposed main panel section 88 and inwardly extending L-shaped connecting walls 90 at each edge of outer exposed panel section 88. Outer exposed main panel section 88 is preferably a planar, rectangular panel, although the present invention is not limited thereby, and outer exposed main panel section 88 can have any suitable shape, including a three dimensional shape. Each L-shaped connecting wall 90 includes an inwardly extending bent end wall 92 that extends from an outer edge of a main panel section 88 in the third direction and a securing wall 94 that extends from the opposite free end of inwardly extending wall 92 in a direction parallel but opposite from main panel section 88. Securing wall 94 is inserted within the space 80 between retaining walls 54 and 78. Screws 96 are then inserted through retaining wall 78, securing wall 94, retaining wall 54, connecting panel 60 and inwardly directed wall 50 to secure these elements together, as shown in FIG. 6.

Accordingly, with this arrangement, each wall panel 86 can be adjusted easily in three dimensions to take into account any unevenness in the existing wall or any repositioning that may be required.

Figure 6A:
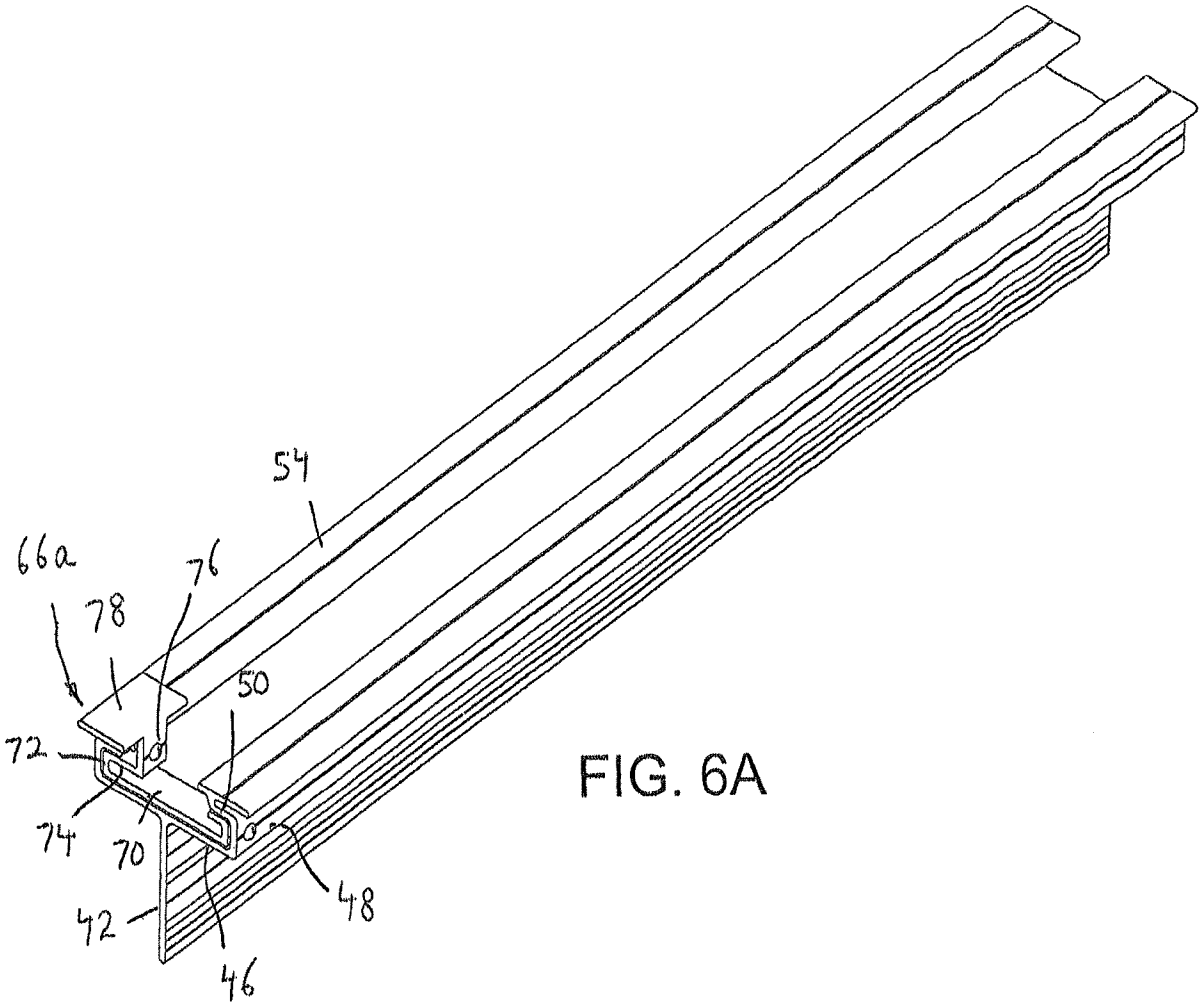
FIG. 6A is a perspective view of the adjustment support member of FIG. 2, assembled with a modified wall panel sliding support.

FIG. 6A shows a modified wall panel sliding support 66*a* in which one extension wall 76 and its corresponding retaining wall 78 are eliminated. Modified wall panel sliding support 66*a* is provided at a corner where only one retaining wall 78 is required.

Figure 7:
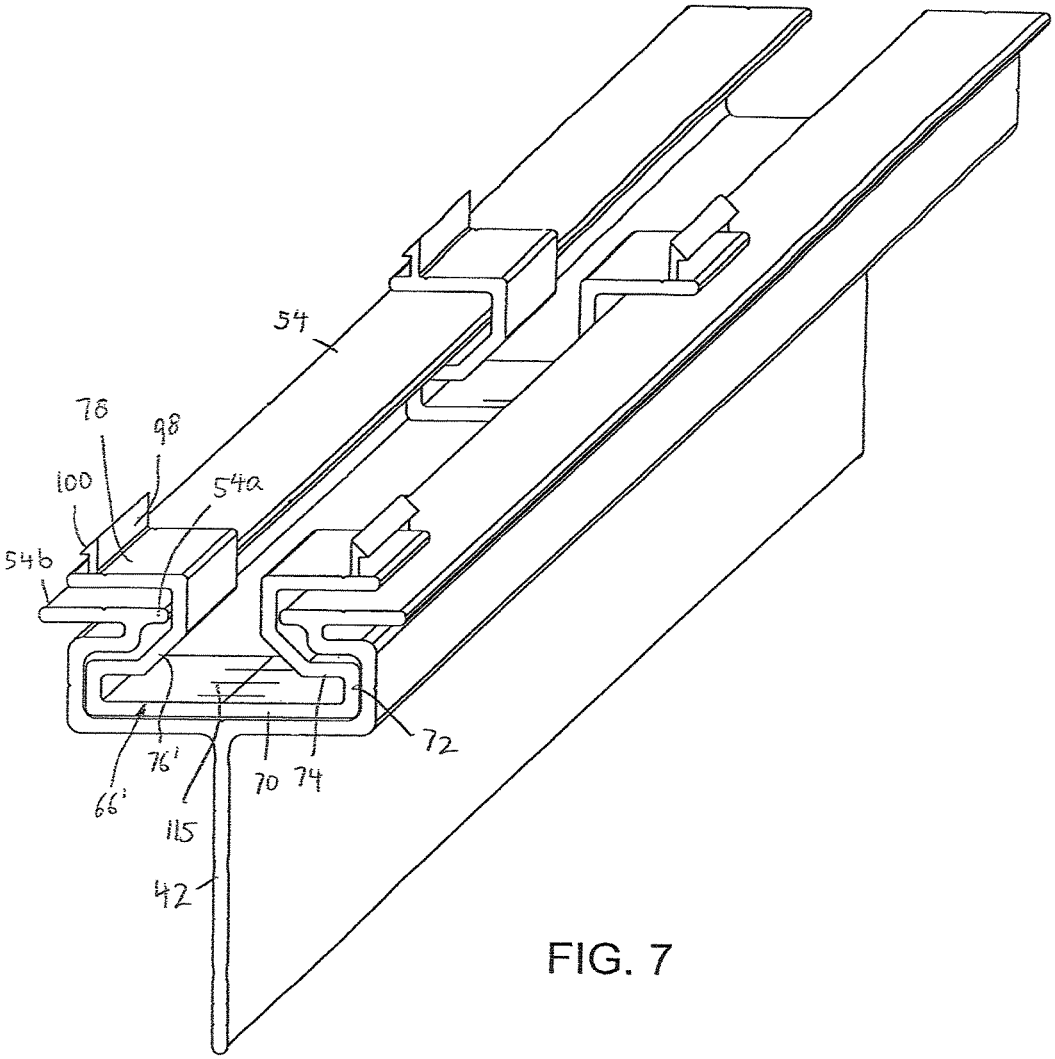
FIG. 7 is a perspective view of the adjustment support member of FIG. 2, assembled with a further modified wall panel sliding support.
Figure 8:
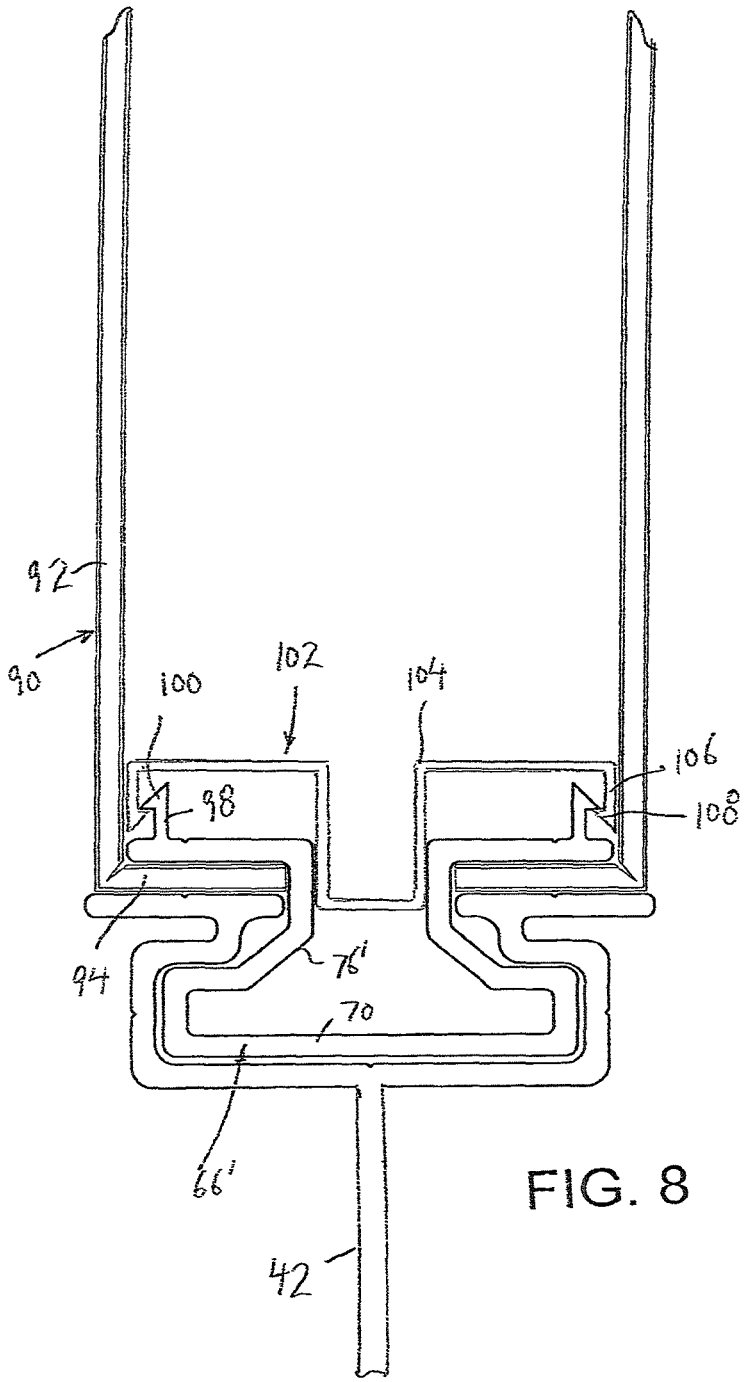
FIG. 8 is a plan view of the assembly of FIG. 7 with wall panels and a cover.

Referring now to FIGS. 7 and 8, modified wall panel sliding supports 66' are shown. Specifically, extension walls 76 are replaced by V-shaped extension walls 76'. More importantly, catch walls 98 extend outwardly from the exposed surface of each retaining wall 78 in the third direction at a position slightly spaced inwardly from the outer free edge thereof. Each catch wall 98 includes an outwardly facing V-shaped catch 100 at the upper end thereof.

A cover 102 having a central section 104 is adapted to be secured in covering relation to wall panel sliding support 66', and includes capture walls 106 at opposite ends thereof, with each capture wall 106 having an inwardly facing V-shaped latch 108 at the free end thereof for engaging with a respective V-shaped catch 100.

Figure 9:
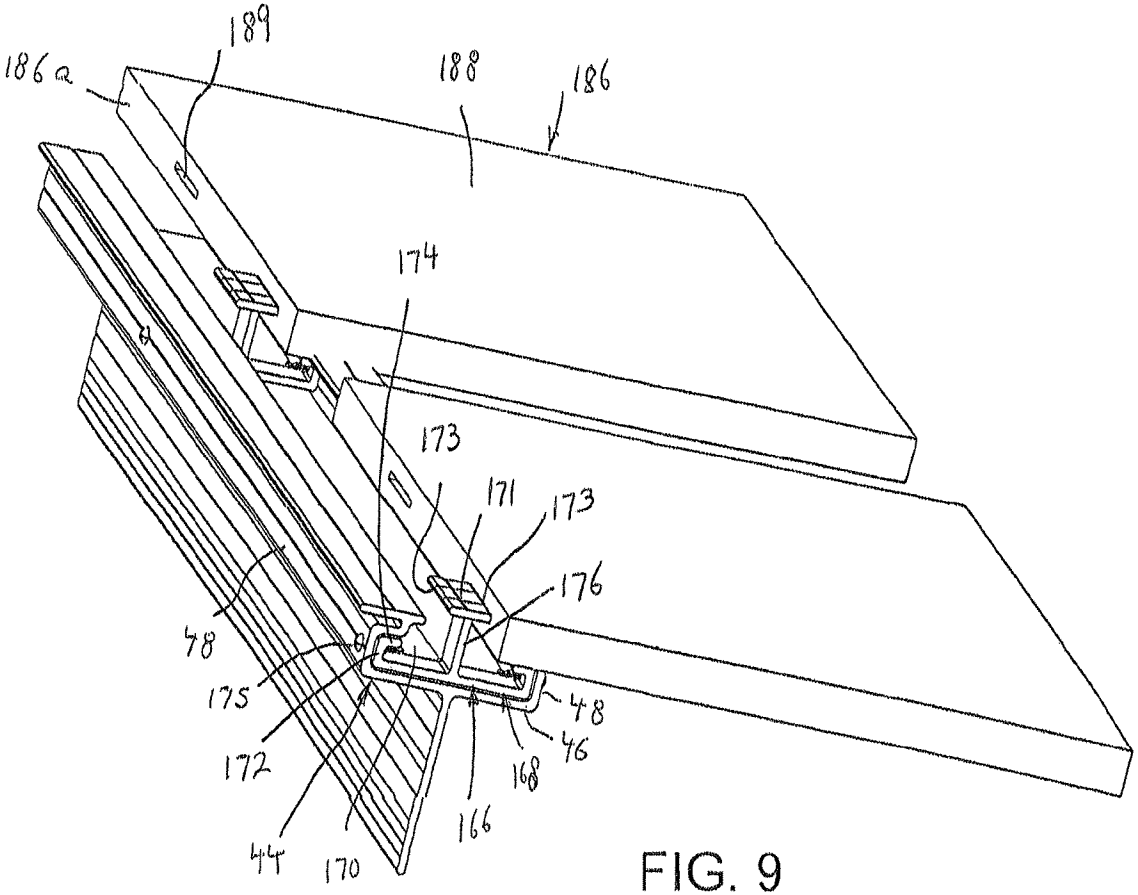
FIG. 9 is a perspective view of modified wall panel sliding supports assembled with the adjustment support member of FIG. 2.

Referring now to FIG. 9, there is shown modified wall panel sliding supports 166 which are slidably retained in U-shaped track 44. Each wall panel sliding support 166 includes a U-shaped slide 168 that fits slidably within U-shaped track 44, and includes an elongated rectangular lower plate 170 positioned in sliding engagement on lower plate 46, and two upstanding, parallel, spaced apart walls 172 positioned in parallel, sliding engagement within upstanding walls 48 and extending from opposite lengthwise edges of lower plate 170. U-shaped slide 168 further includes inwardly directed walls 174 extending inwardly toward each other from the lengthwise edges of spaced apart walls 172 and positioned in parallel, sliding engagement beneath inwardly directed walls 50, so as to slidably capture U-shaped slide 168 within U-shaped track 44.

A single extension wall 176 extends in the third direction from the center of the elongated rectangular lower plate 170, and a rectangular securing plate 171 is mounted centrally to the free end of extension wall 176 so as to define tabs 173 extending to opposite sides of single extension wall 176.

Each wall panel 186 is formed from a single panel member 188 having slots 189 at opposite side edges thereof. With this arrangement, each single panel member 188 has an end thereof seated on top of a respective retaining wall 54, with a tab 173 inserted into a slot 189 in a side wall thereof, in order to retain wall panels 186 in position.

Thus, wall panel sliding supports 166 are slid to desired positions with tabs 173 inserted into slots 189, and screws 175 are screwed through upstanding walls 48 of U-shaped track 44 and upstanding walls 172 of U-shaped slide 168 to lock slides 168 in the desired positions.

It will further be appreciated that each wall panel 186 can be made as a solid panel, or alternatively, as a hollow panel with bent down side walls 186*a* through which slots 189 are provided. It will further be appreciated that, although not shown, there will be measuring markings or gradations on the upper surface of elongated rectangular lower plate 170 similar to measuring gradations 15.

Figure 10:
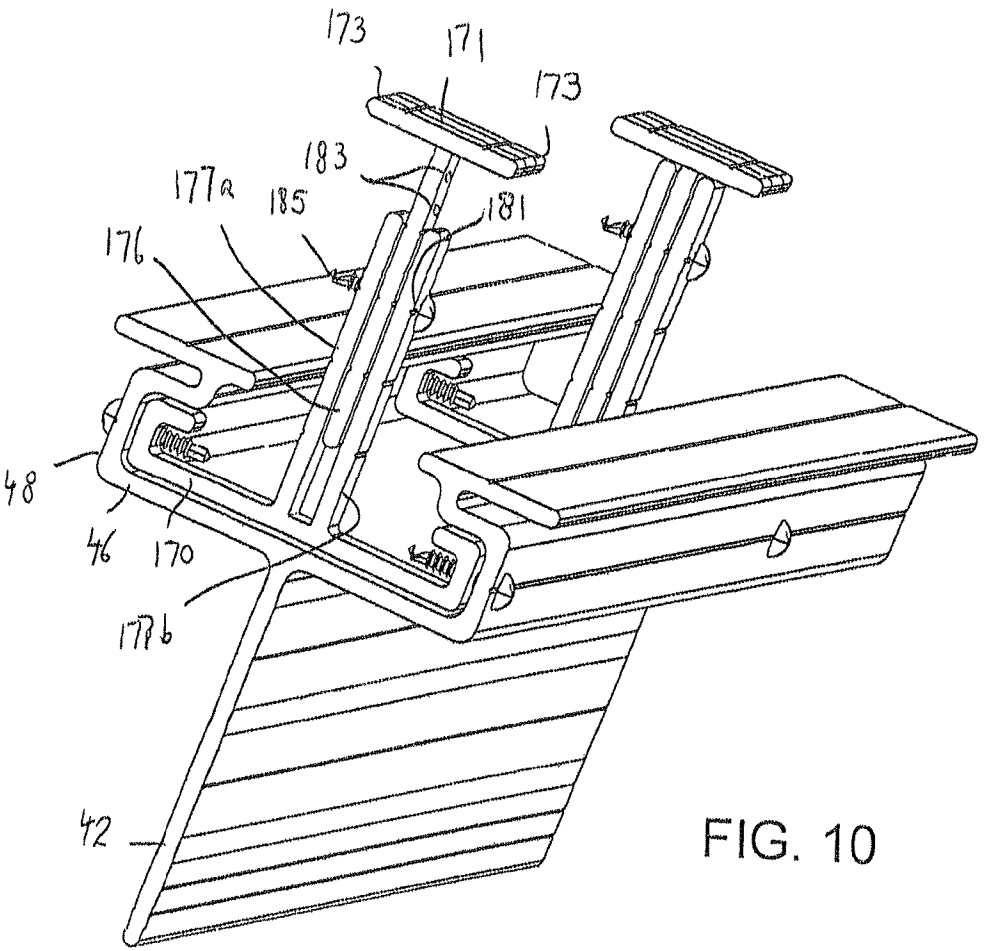
FIG. 10 is a perspective view of further modified wall panel sliding supports similar to those of FIG. 9, assembled with the adjustment support member of FIG. 2.

FIG. 10 shows a modification of the embodiment of FIG. 9 in which adjustability of rectangular securing plate 171 is provided relative to elongated rectangular lower plate 170 of U-shaped slide 168 in the third orthogonal direction.

Specifically, two parallel, spaced apart extension walls 177*a* and 177*b* extend outwardly in the third direction from the center of elongated rectangular lower plate 170, and have aligned openings 181. A single extension wall 176 is slidably positioned between extension walls 177*a* and 177*b*, and includes a plurality of spaced apart openings 183 therealong. Single extension wall 176 can be selectively secured at a desired height by adjusting the position of single extension wall 176 between extension walls 177*a* and 177*b*, and then secured in that position by a bolt 185 extending through aligned openings 181 and 183. Rectangular securing plate 171 is mounted centrally to the free end of single extension wall 176 so as to define tabs 173 extending to opposite sides of single extension wall 176.

It will be appreciated that other means for connecting the wall panels to the wall panel sliding supports can be provided.

Figure 11:
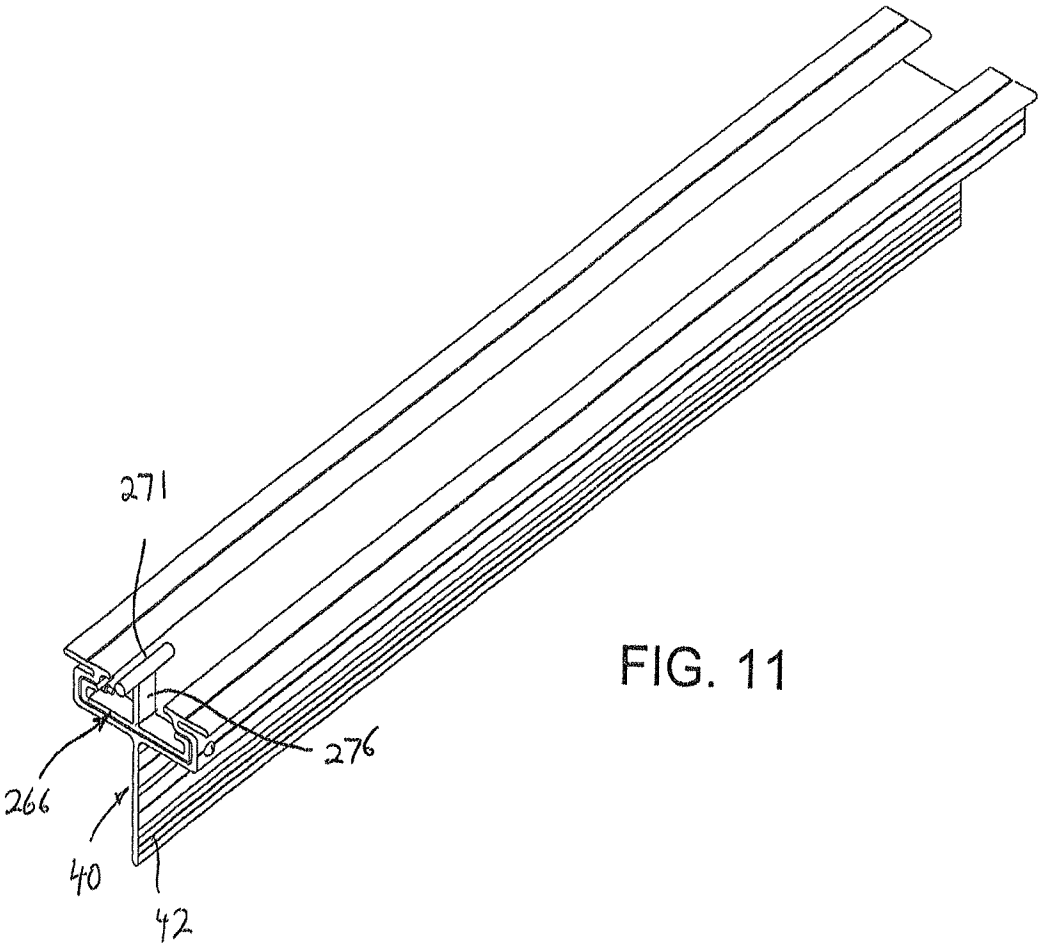
FIG. 11 is a perspective view of still further modified wall panel sliding supports similar to those of FIG. 9, assembled with the adjustment support member of FIG. 2.

For example, as shown in FIG. 11, a wall panel sliding support 266 is shown which is identical to wall panel sliding support 166 of FIG. 9, except that rectangular securing plate 171 is replaced with a rod 271 at the upper end of single extension wall 276, with rod 271 extending in the first lengthwise direction. With this arrangement, the wall panels would include circular openings (not shown) in place of rectangular slots 189 for receiving the ends of rod 271. It will be appreciated that the wall panels 186 will therefore be oriented perpendicular to the arrangement shown in FIG. 9 in order for the ends of the rod 271 to be inserted into the circular openings.

Figure 12:
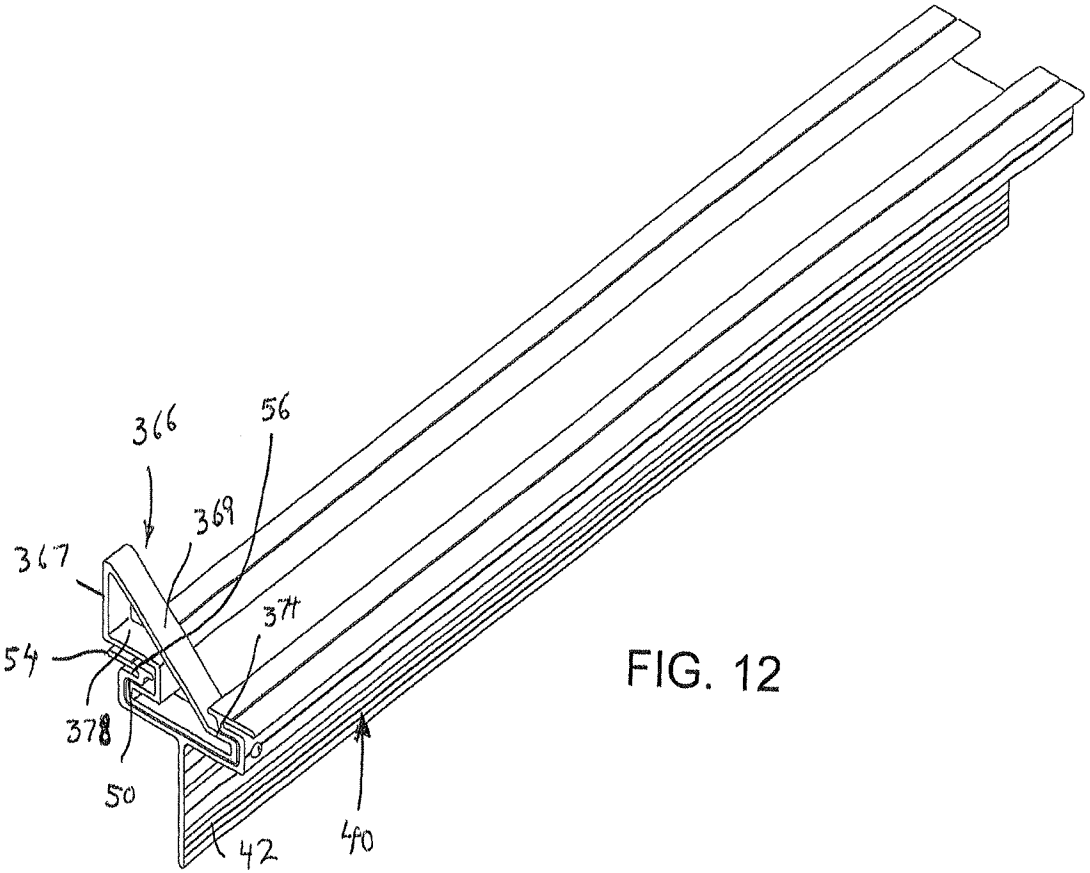
FIG. 12 is a perspective view of a yet further modified wall panel sliding support, assembled with the adjustment support member of FIG. 2.

FIG. 12 shows a modified wall panel sliding support 366 which is identical to wall panel sliding support 66 of FIG. 5, except that one extension wall 76 and its corresponding retaining wall 78 are eliminated. In place thereof, an extension wall 367 extends in the third orthogonal direction from the free end of the single retaining wall 378, and an inclined wall 369 connects the free end of extension wall 367 and the free and of inwardly directed wall 374 at the opposite side of wall panel sliding support 366.

Figure 13:
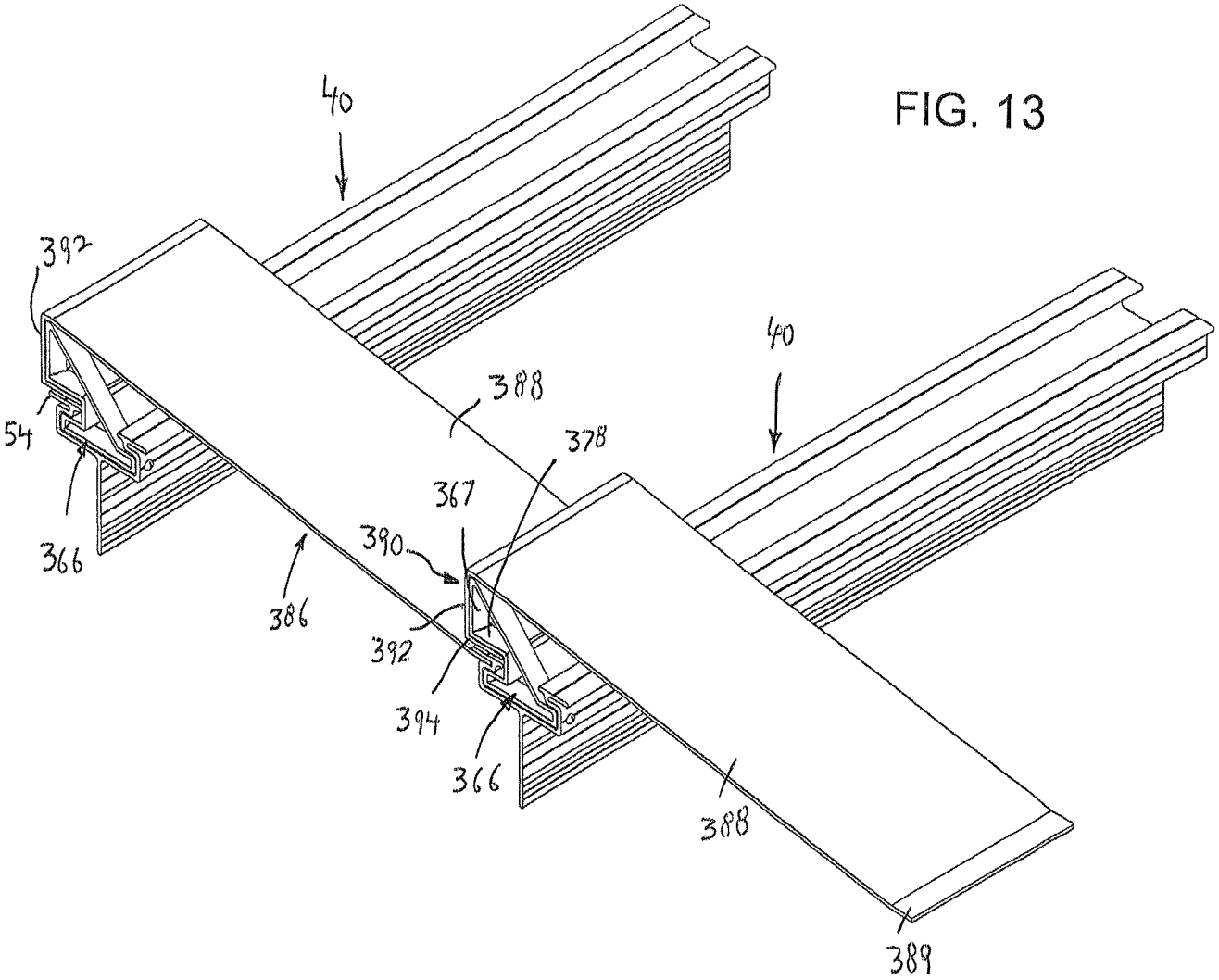
FIG. 13 is a perspective view of the assembly of FIG. 12, assembled with modified wall panels.

In this manner, as shown in FIG. 13, modified wall panels 386 can be secured thereto in an angled manner to provide a three-dimensional appearance. Specifically, each wall panel 386 includes an outer exposed panel section 388 having an inwardly extending L-shaped connecting wall 390 secured to one end thereof. Specifically, L-shaped connecting wall 390 includes an inwardly extending wall 392 that extends from an outer edge of main panel section 388 in the third orthogonal direction and at an acute angle relative to main panel section 388, and a securing wall 394 that extends from the opposite free end of inwardly extending wall 392 in the same direction as main panel section 388 but spaced therefrom. Securing wall 394 is inserted within the space between retaining walls 54 and 378, with inwardly extending wall 392 overlying extension wall 367.

The opposite end of main panel section 388 is slightly bent to define a bent end 389 which is inserted in the gap 56 between inwardly directed wall 50 and retaining wall 54. Screws (not shown) are then inserted through bent end 389, retaining wall 54, securing wall 394 and retaining wall 378 to secure these elements together.

It will be appreciated that, with this arrangement, because inclined wall 369 *h* foul as one end raised relative to the other end due to extension wall 367, one and of each wall panel 386 is raised relative to the other hand so as to present a three-dimensional arrangement.

Figure 14:
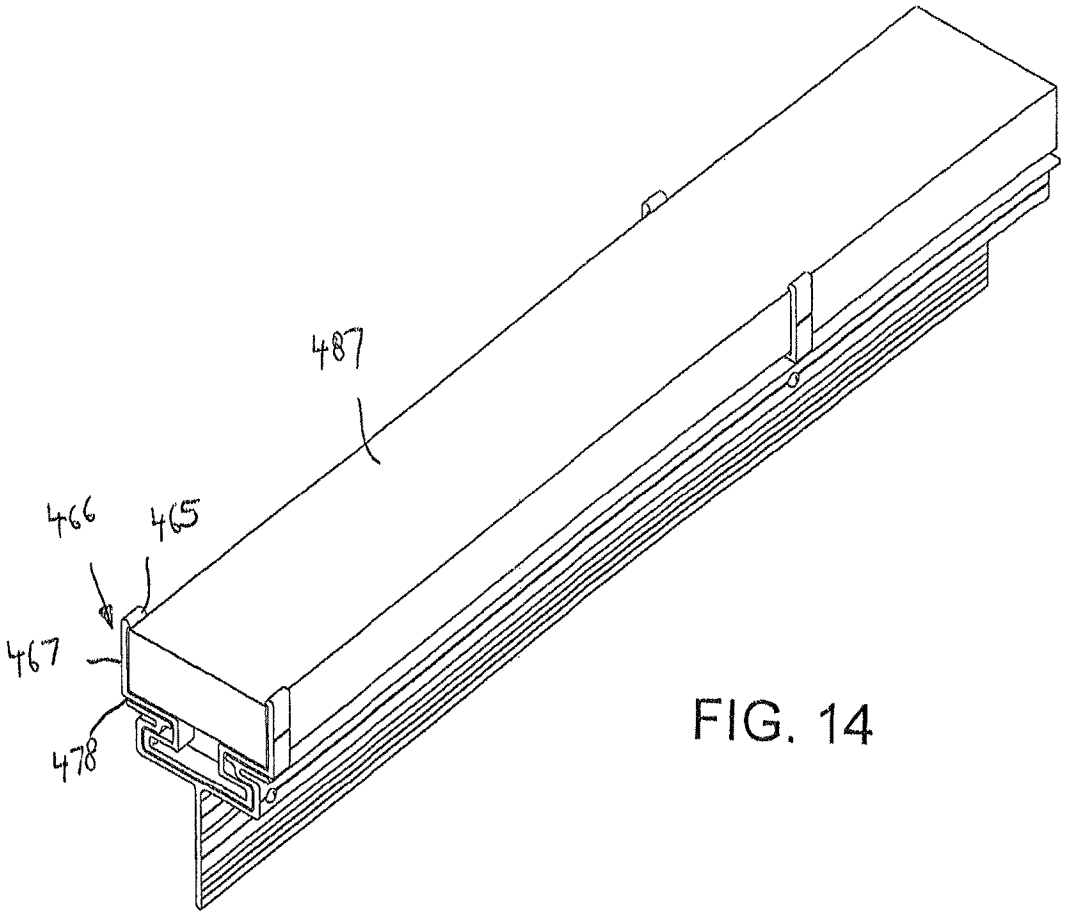
FIG. 14 is a perspective view of still further modified wall panel sliding supports for connection with a 2×4 framing stud, and assembled with the adjustment support member of FIG. 2.

FIG. 14 shows a further modified wall panel sliding support 466 which is identical to wall panel sliding support 66 of FIG. 5, except that an extension wall 467 extends in the third direction from the free end of each retaining wall 478 in a direction away from adjustment support member 40, with the free end of each extension wall 467 having a slightly inturned lip 465. With this arrangement, a 2×4 framing stud 487 (or any other size framing stud) or the like can be positioned between adjacent extension walls 467 and held by inturned lips 465. Planar wall panels can then be secured on top of the 2×4 framing studs 487, and secured thereto by screws. Of course, it will be appreciated that, in such case, the screws will be exposed on the outer facing surface of the wall panels.

Figure 15:
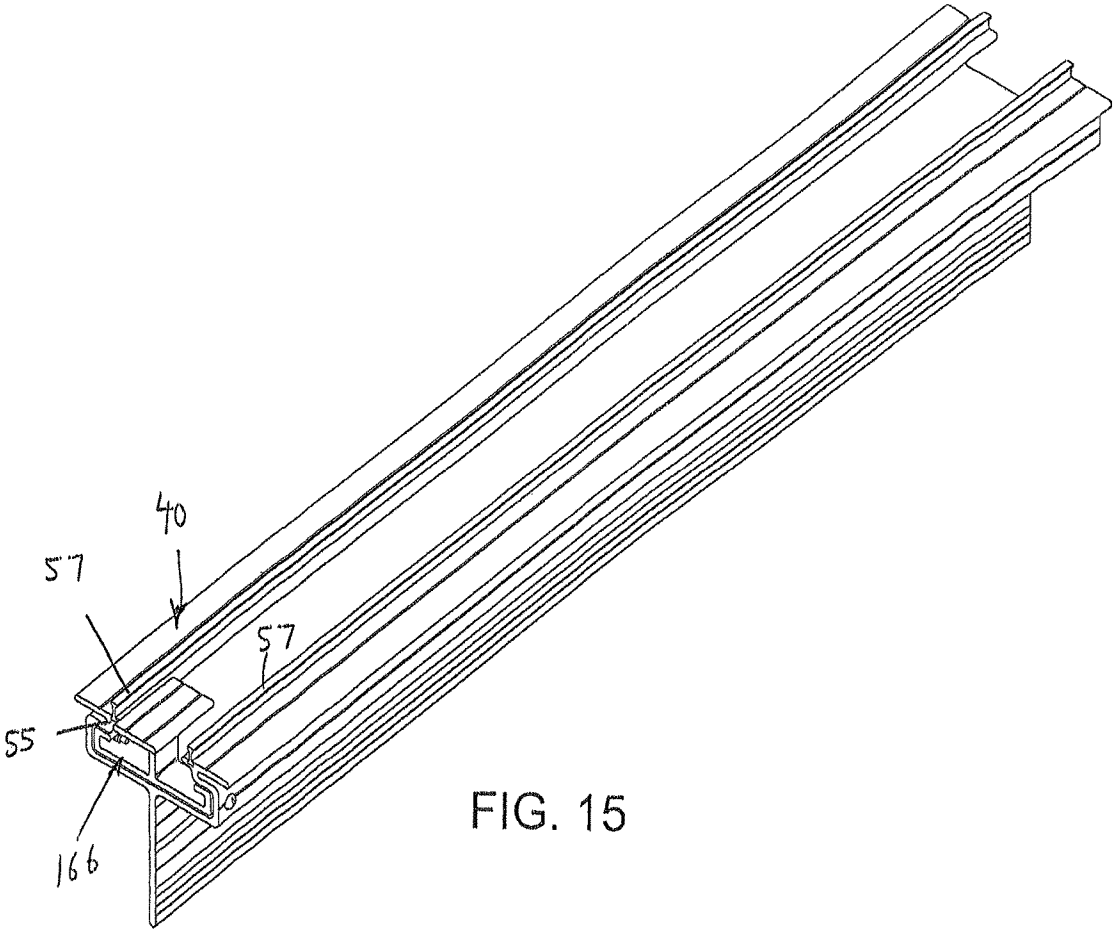
FIG. 15 is a perspective view of a wall panel sliding support which is the same as that of FIG. 9, assembled with a modified adjustment support member.
Figure 16:
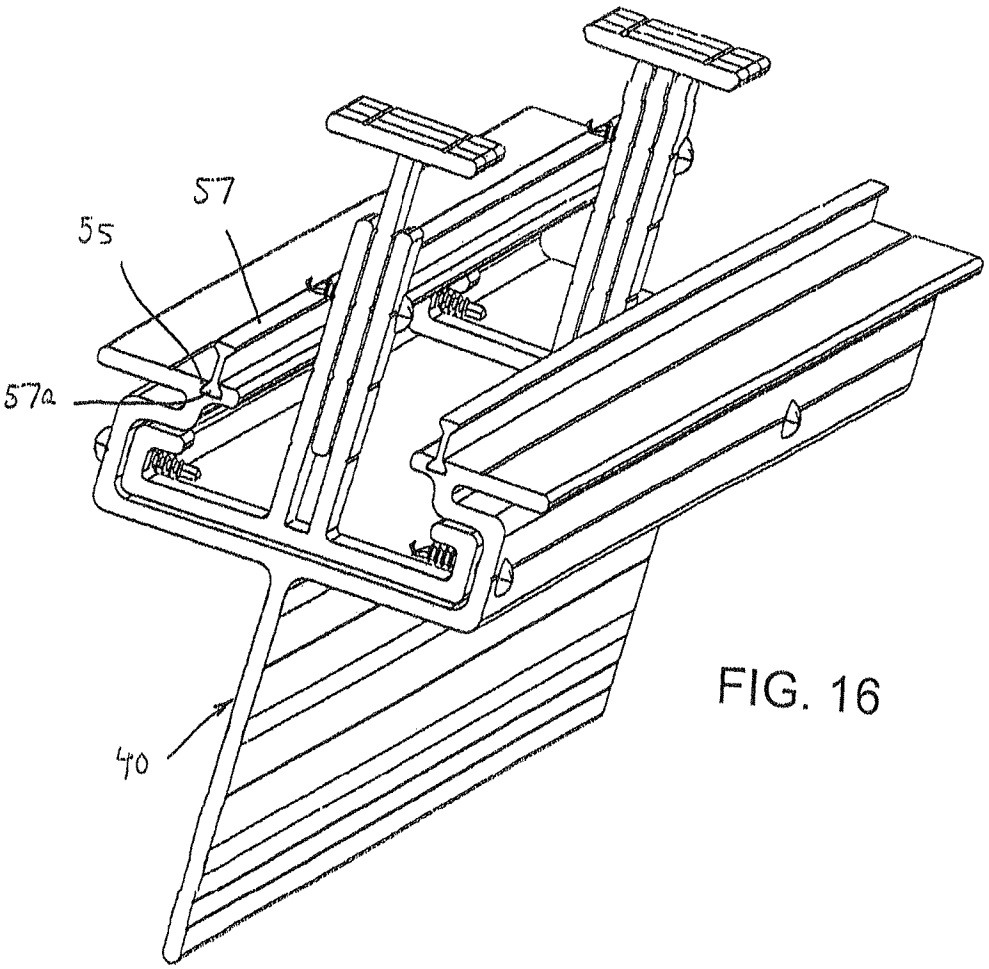
FIG. 16 is a perspective view of wall panel sliding supports which are the same as that of FIG. 10, assembled with a modified adjustment support member.
Figure 17:
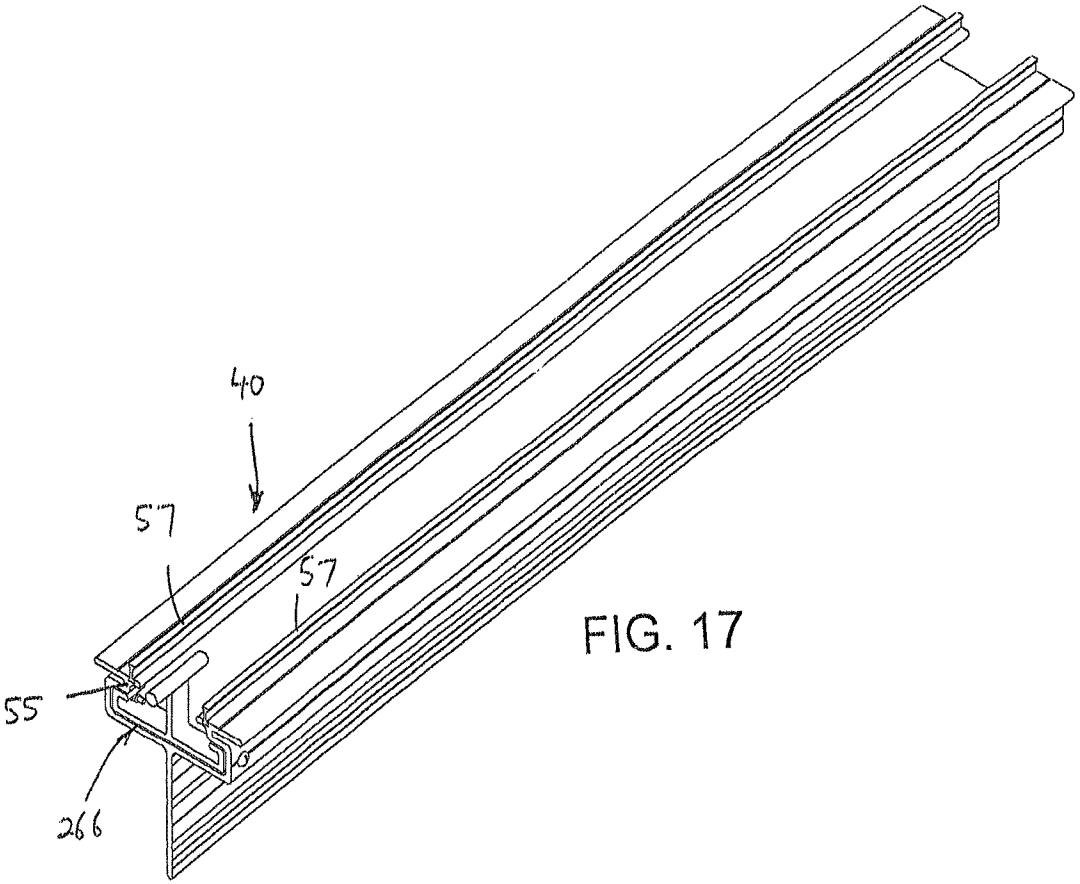
FIG. 17 is a perspective view of a wall panel sliding support which is the same as that of FIG. 11, assembled with a modified adjustment support member.

FIGS. 15-17 show embodiments which are identical to the embodiments of FIGS. 9-11, respectively, except that retaining walls 54 include elongated dovetail shaped slots 55 therein extending in the first lengthwise direction. Retaining bars 57 having at least one dovetail shaped end 57*a* fit within each dovetail shaped slot 55. Retaining bars 57 function as water locking panels to prevent water ingress. Retaining bars 57 can be inserted after wall panels 86 are assembled with adjustment support members 40, or alternatively, can be inserted prior to assembly of wall panels 86 and, in such case, wall panels 86 would be angled when assembled to pass by retaining bars 57.

It will be appreciated that, while wall panel sliding supports 66 have been disclosed as being slidable on the inside of U-shaped track 44 of adjustment support member 40, the wall panel sliding supports can be slidably positioned on the outside of adjustment support member 40 as well, as will now be disclosed.

Figure 18:
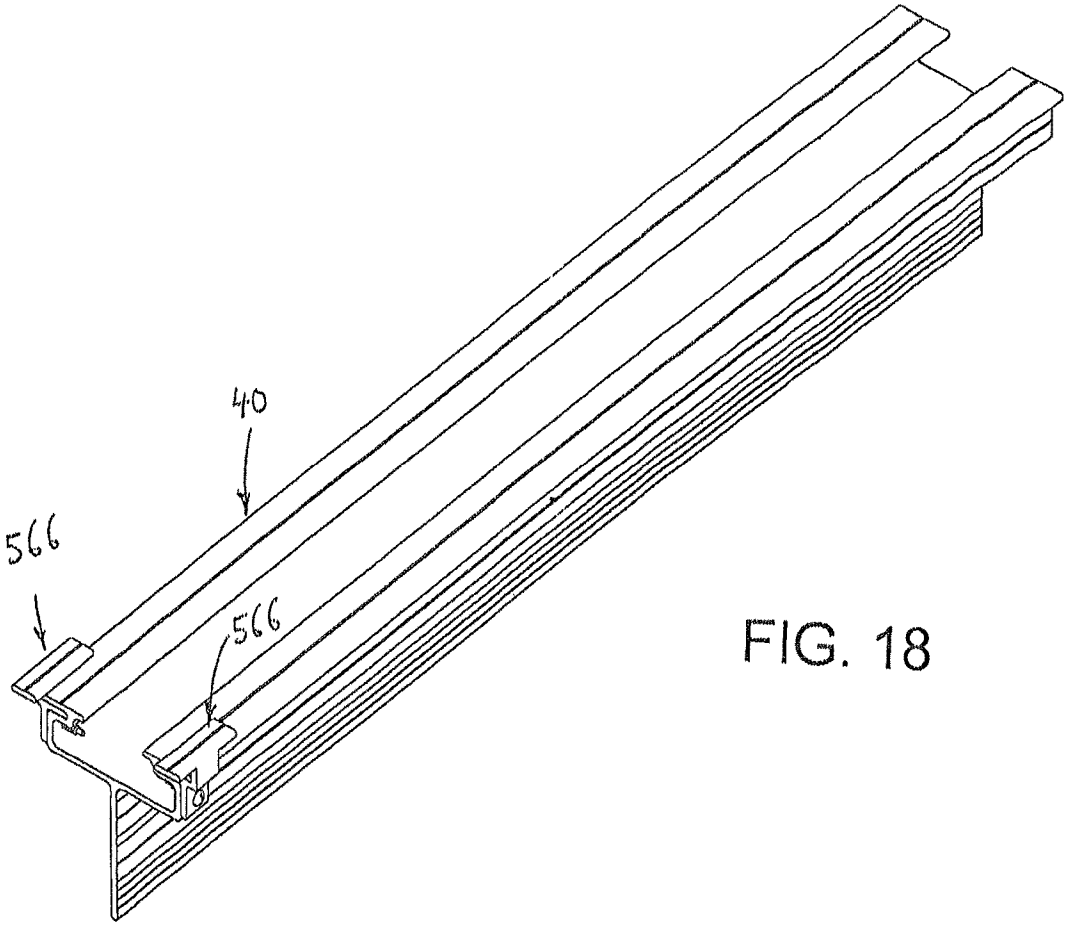
FIG. 18 is a perspective view of a modified wall panel sliding support assembled with the adjustment support member of FIG. 2.
Figure 19:
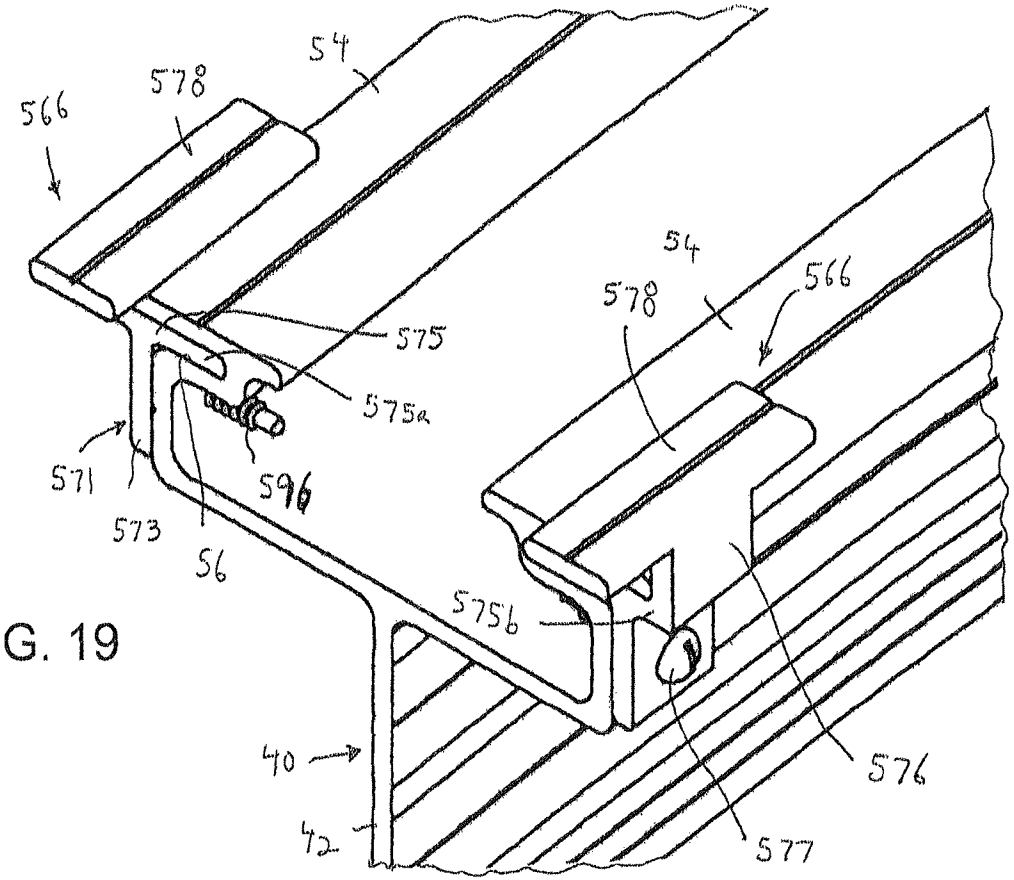
FIG. 19 is an enlarged perspective view of a portion of the assembly of FIG. 18.

Specifically, as shown in FIGS. 18 and 19, wall panel sliding supports 566 each include a T-shaped wall 571 formed by a wall 573 extending in the third orthogonal direction and a transverse wall 575 bisected by and connected at the upper end of wall 573 so as to form first and second wall sections 575*a* and 575*b* on opposite sides of transverse wall 575. An extension wall 576 extends in the third orthogonal direction from the free end of second wall section 575*b* in a direction away from wall 573. A rectangular retaining wall 578 has one edge connected to the upper end of extension wall 576. With this arrangement, first wall section 575*a* is inserted within elongated gap 56 of adjustment support member 40 sliding movement therein. In such position, wall 573 is positioned flush against the outer surface of the respective upstanding wall 48 of adjustment support member 40. Further, in such position, rectangular retaining wall 578 is positioned in parallel, spaced relation from the respective retaining wall 54 of adjustment support member 40.

With this arrangement, wall panels (not shown) which are identical to wall panels 86 of FIG. 6 are provided, except that securing wall 94 is oriented 180° from that shown in FIG. 6, that is, securing wall 94 is positioned in parallel spaced relation directly beneath outer exposed panel section 88. Thus, securing wall 94 is positioned between retaining walls 54 and 578. Wall panel sliding supports 566 are secured to upstanding walls 48 by screws 596 extending therethrough.

Figure 20:
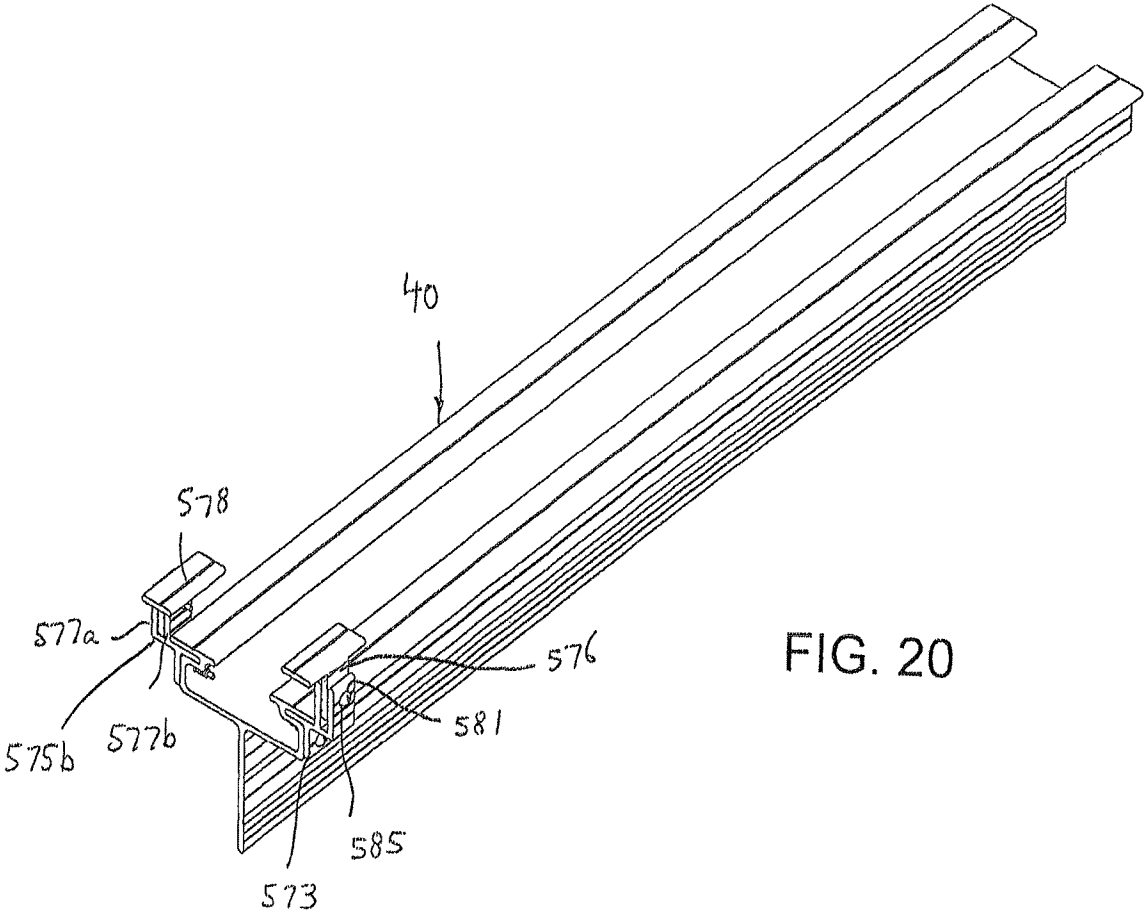
FIG. 20 is a perspective view of a further modified wall panel sliding support assembled with the adjustment support member of FIG. 2.

FIG. 20 shows a modification of the embodiment of FIGS. 18 and 19 in which adjustability of rectangular retaining wall 578 is provided relative to retaining wall 54.

Specifically, two parallel, spaced apart extension walls 577*a* and 577*b* extend outwardly in the third orthogonal direction from the free end of second wall section 575*b* in a direction away from wall 573, and have aligned openings 581. A single extension wall 576 is slidably positioned between extension walls 577*a* and 577*b*, and includes a plurality of spaced apart openings (not shown) therealong. Single extension wall 576 can be selectively secured at a desired height by adjusting the position of single extension wall 576 between extension walls 577*a* and 577*b*, and then secured in that position by a bolt 585 extending through aligned openings 581 and one of the openings in single extension wall 576. Retaining wall 578 has one edge connected to the upper end of extension wall 576.

Figure 21:
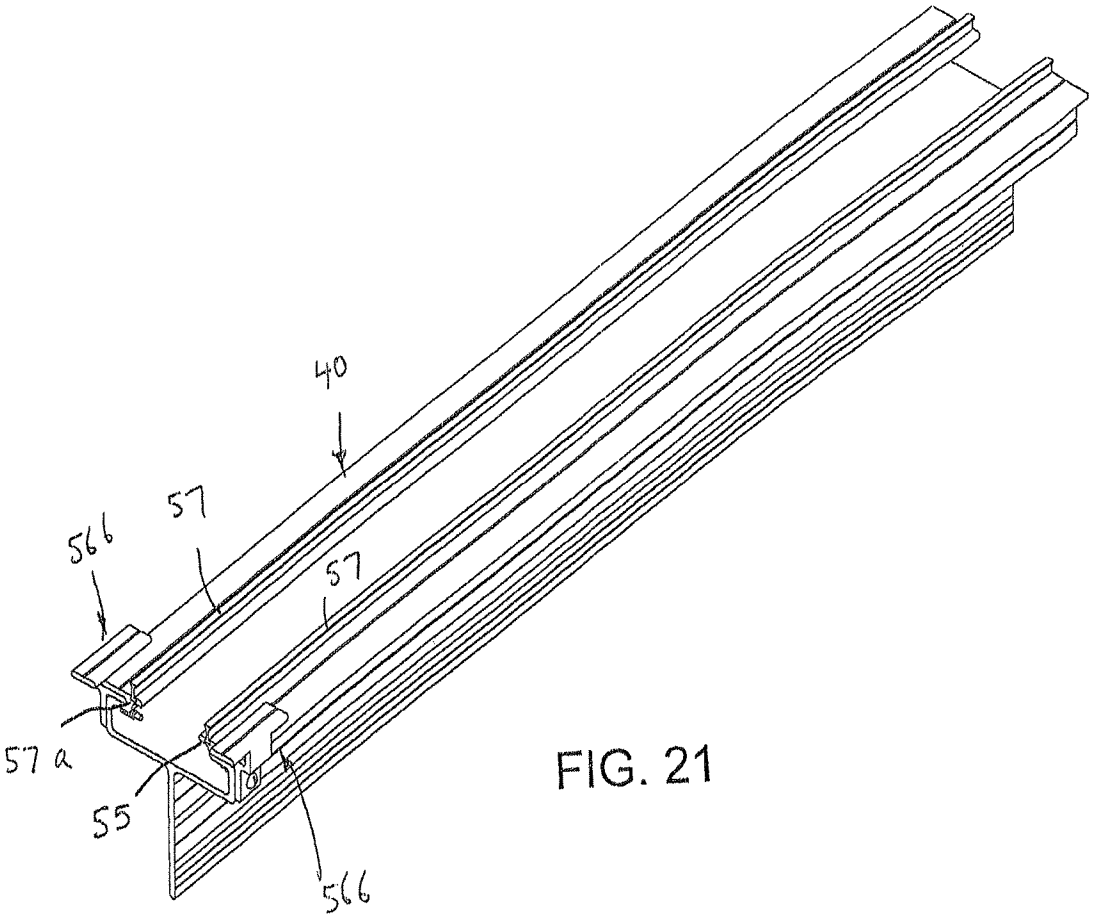
FIG. 21 is a perspective view of a wall panel sliding support which is the same as that of FIG. 18, assembled with a modified adjustment support member.
Figure 22:
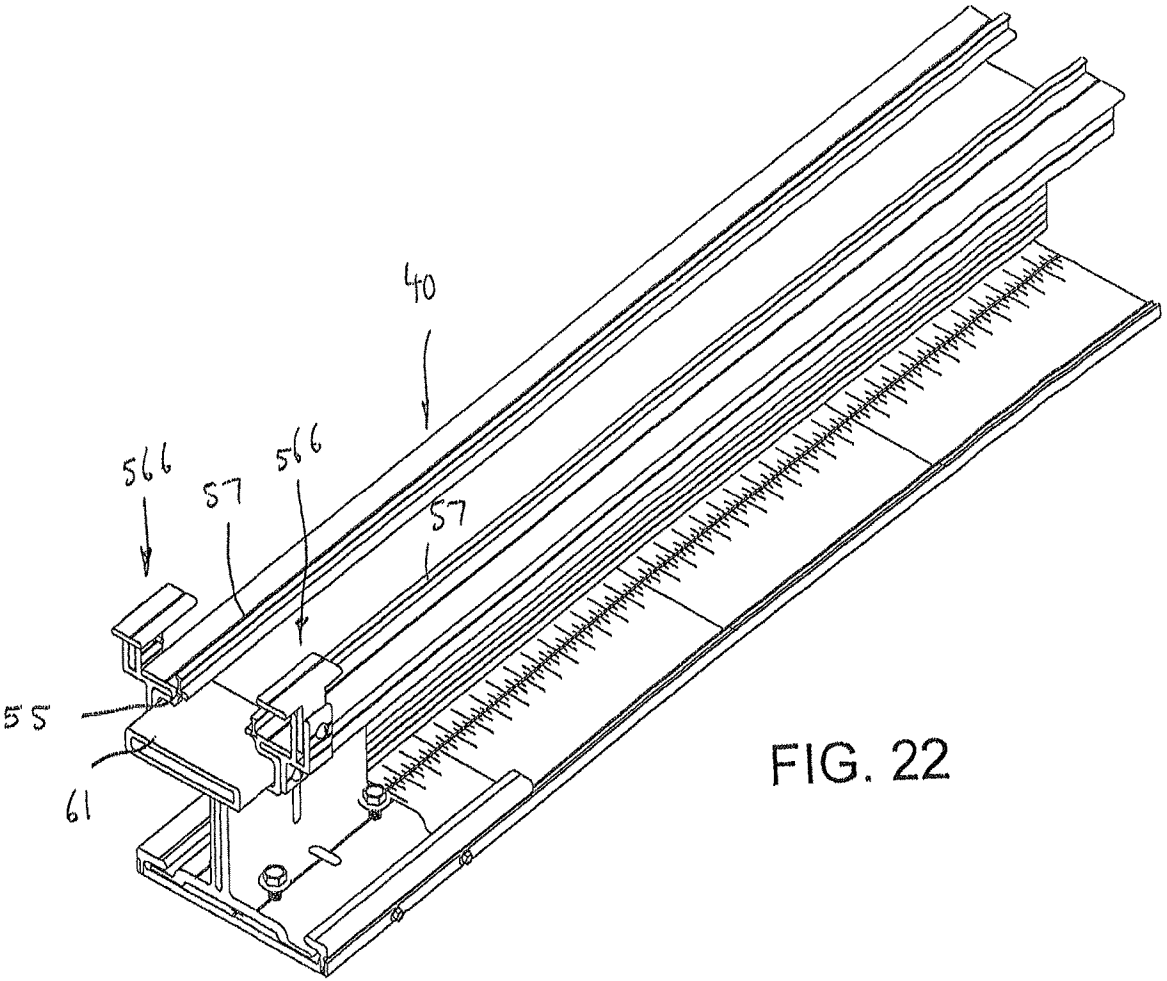
FIG. 22 is a perspective view of a wall panel sliding support which is the same as that of FIG. 20, assembled with a modified adjustment support member.

FIGS. 21 and 22 show embodiments which are identical to the embodiments of FIGS. 18-20, respectively, except that retaining walls 54 include elongated dovetail shaped slots 55 therein extending in the first lengthwise direction. Retaining bars 57 have at least one dovetail shaped end 57*a* which fits within each dovetail shaped slot 55. Retaining bars 57 function as water locking panels to prevent water ingress. Retaining bars 57 can be inserted after wall panels 86 are assembled with adjustment support members 40, or alternatively, can be inserted prior to assembly of wall panels 86 and, in such case, wall panels 86 would be angled when assembled to pass by retaining bars 57.

In addition, as shown in FIG. 22, a rectangular parallelepiped connecting member 61 is slid within track 44 to connect together in line, abutting or near abutting, adjustment support members 40.

Figure 23:
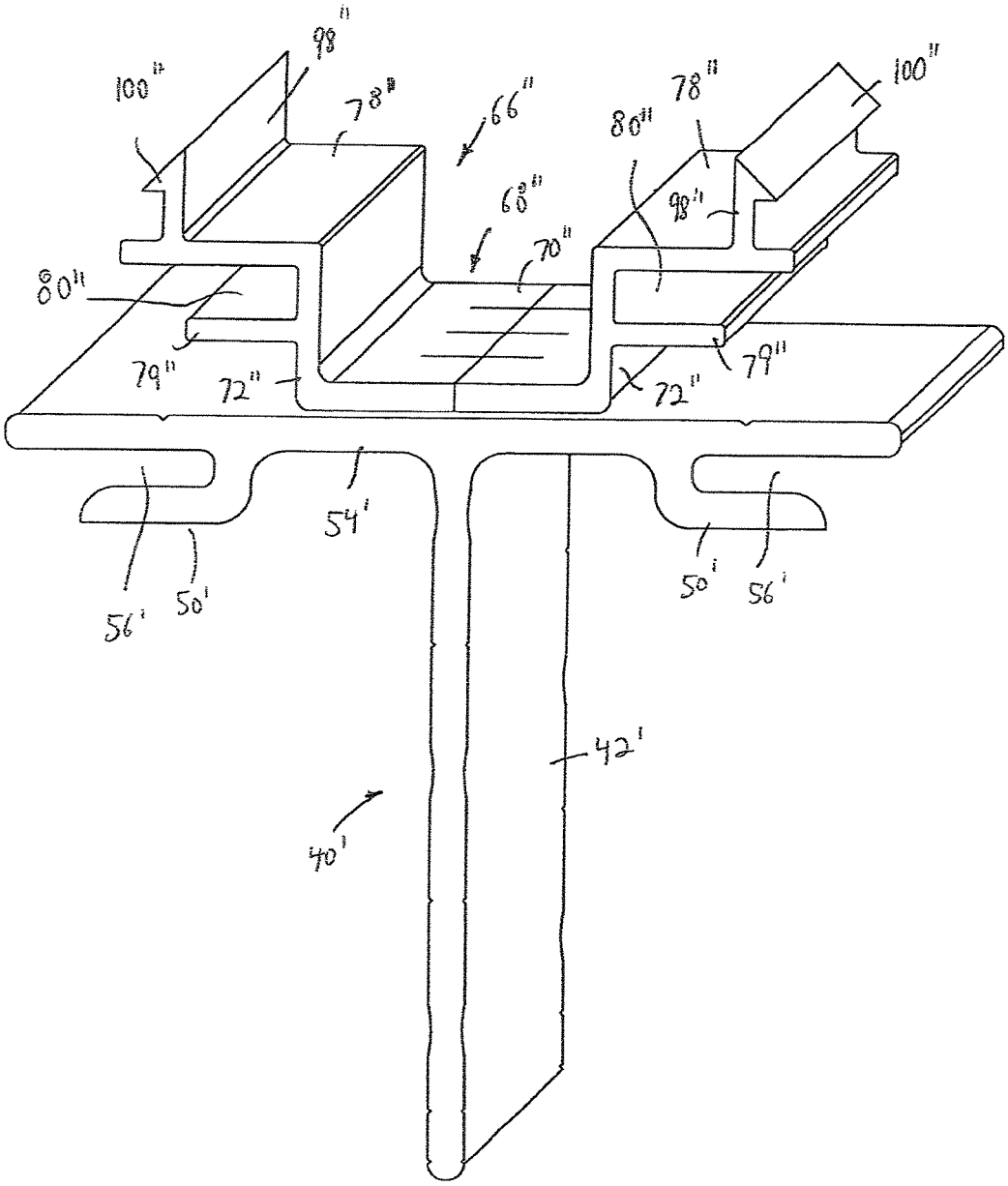
FIG. 23 is a perspective view of a modified adjustment support member and a wall panel support.
Figure 24:
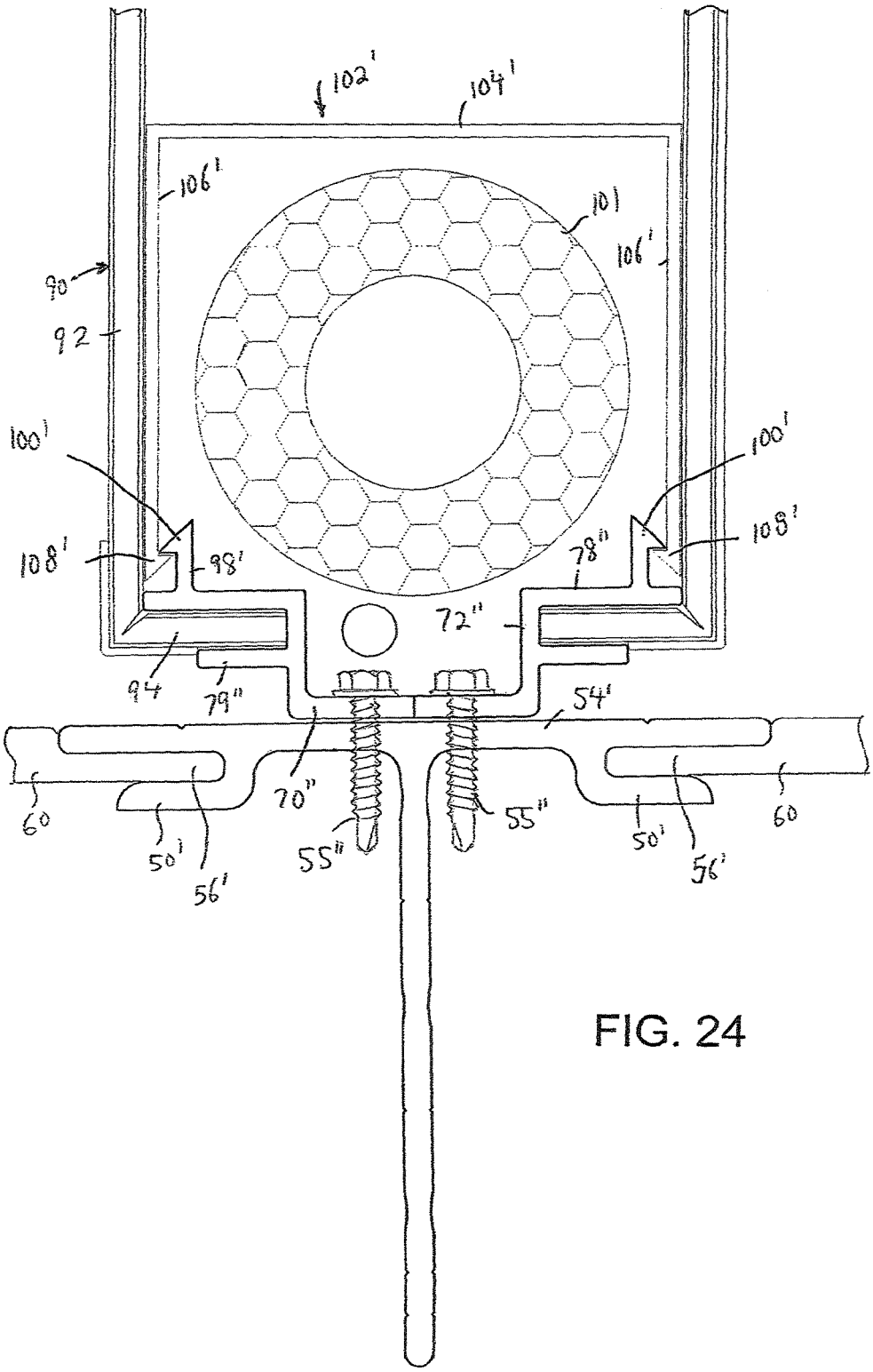
FIG. 24 is a plan view of the arrangement of FIG. 23, assembled with wall panels and connecting panels.

A further modification is shown in FIGS. 23 and 24 in which a modified adjustment support member 40' includes an elongated rectangular plate 42' that is dimensioned to fit snugly between capture walls 30 and 32, such that retaining lip 30*a* applies pressure to plate 42'. The opposite free lengthwise edge of rectangular plate 42' is fixed centrally to the lower surface of a platform wall 54'. Two L-shaped walls 50' extend from the underside of platform wall 54' on opposite sides of rectangular plate 42' and face away from rectangular plate 42', whereby a gap 56' is defined between each L-shaped wall 50' and platform wall 54' for receiving an end of a connecting panel 60 therein.

A wall panel support 66" is mounted on each modified adjustment support member 40' and includes a U-shaped support 68" having an elongated rectangular lower plate 70" and two upstanding, parallel, spaced apart walls 72" extending in the third direction from opposite lengthwise edges of lower plate 70". Rectangular lower plate 70" is secured centrally to the upper surface of platform wall 54' by screws 55". A retaining second wall 78" is connected to the outer free end of each wall 72" and extends in a direction in the second transverse direction in parallel, spaced apart relation to lower plate 70" but extending outwardly in a direction away from lower plate 70". A third retaining wall 79" extends outwardly from the outer surface of each wall 72" in parallel, spaced relation from second retaining wall 78" so as to provide a space 80" therebetween for capturing securing wall 94 of a wall panel 86. Of course, screws are then inserted between the elements to secure them together.

Catch walls 98" extend outwardly from the exposed surface of each retaining wall 78" in the third direction at a position slightly spaced inwardly from the outer edge thereof. Each catch wall 98" includes an outwardly facing V-shaped catch 100" at the upper end thereof.

As shown in FIG. 24, a heating pipe 101 can be positioned between inwardly extending walls 92 of adjacent wall panels 86. Accordingly, a modified cover 102' is provided having a central wall 104' adapted to be secured in covering relation to heating pipe 101, and capture walls 106' at opposite ends thereof which extend in parallel adjacent relation to respective inwardly extending walls 92, with each capture wall 106' having an inwardly facing V-shaped latch 108' at the free end thereof for engaging with a respective V-shaped catch 100'.

Figure 25:
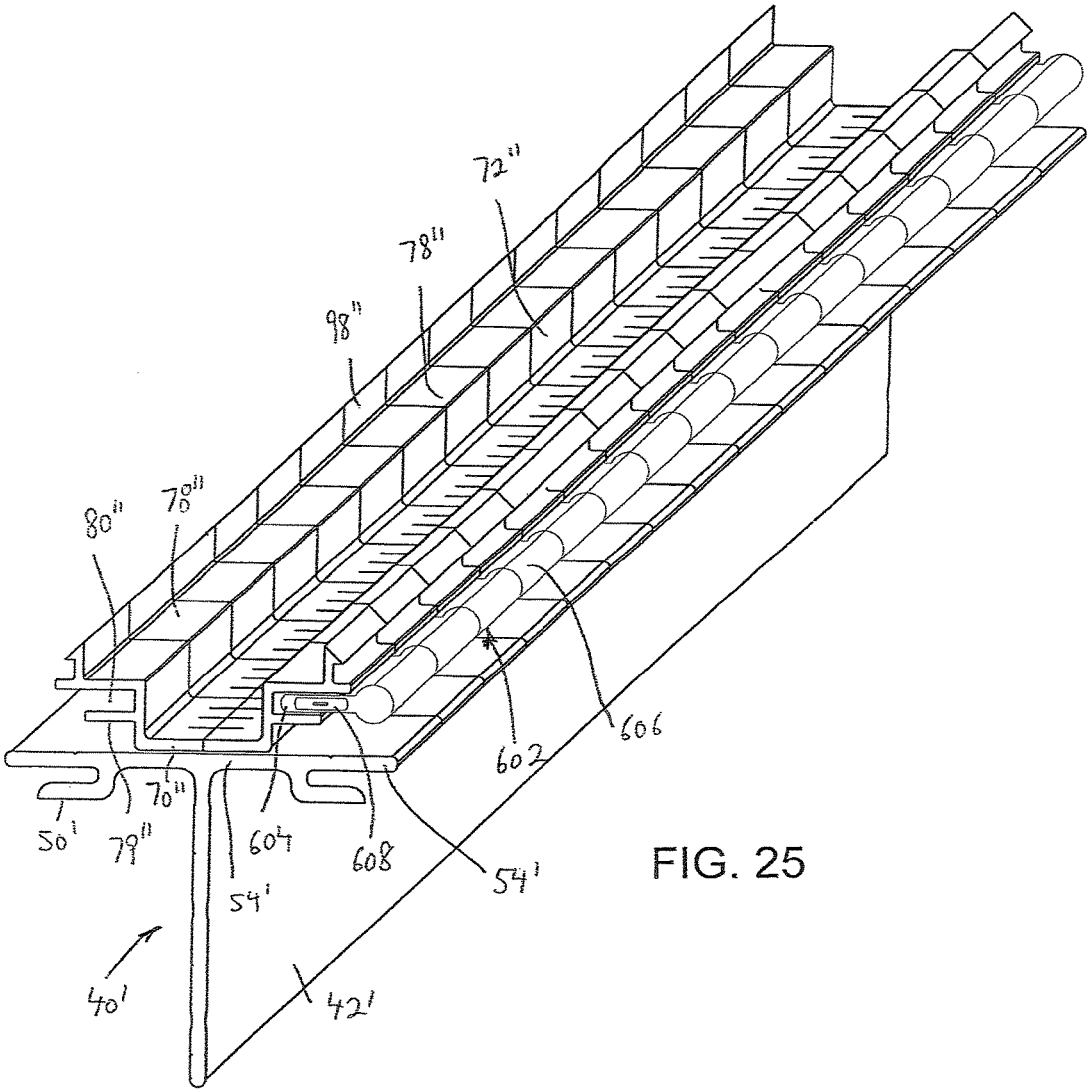
FIG. 25 is a perspective view of the arrangement of FIG. 23, used with a carpenter level.
Figure 26:
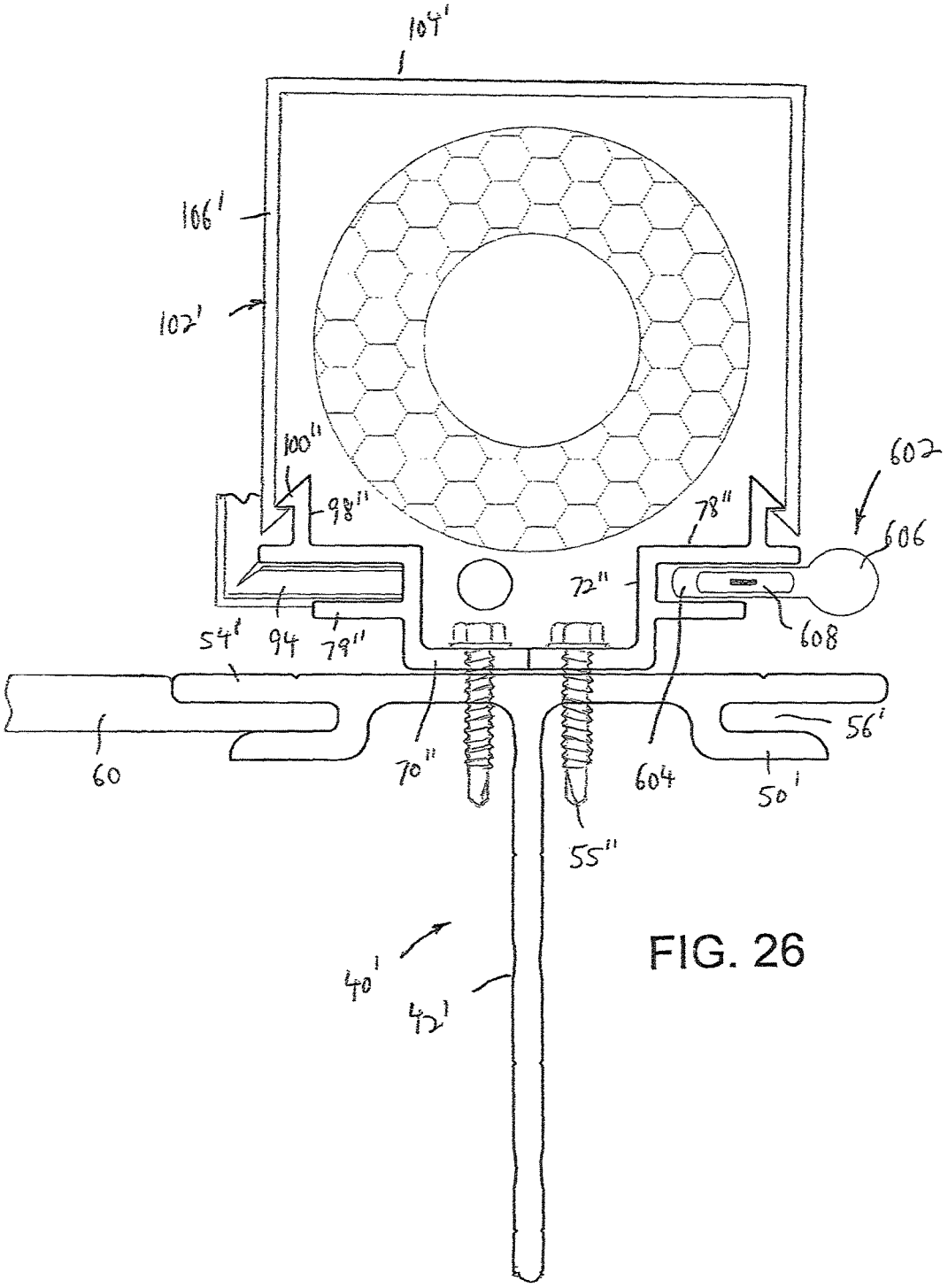
FIG. 26 is a plan view of the arrangement of FIG. 25.

As shown in FIGS. 25 and 26, in order to level each modified adjustment support member 40', a carpenter level 602 is provided which includes an elongated rectangular parallelepiped body 604 with a cylindrical grasping member 606 along an elongated edge thereof. Elongated rectangular parallelepiped body 604 includes a conventional bubble level 608 therein at a visible sign edge thereof. Thus, when assembling modified adjustment support member 40' with sliding support member 24, elongated rectangular parallelepiped body 604 of carpenter level 602 is inserted within space 80" and adjustment is made in accordance with the reading of the bubble level 608 to achieve a desired level and orientation. Thereafter, grasping member 606 is grabbed and carpenter level 602 is removed from space 80", whereupon the wall panels can then be assembled therewith.

Figure 27:
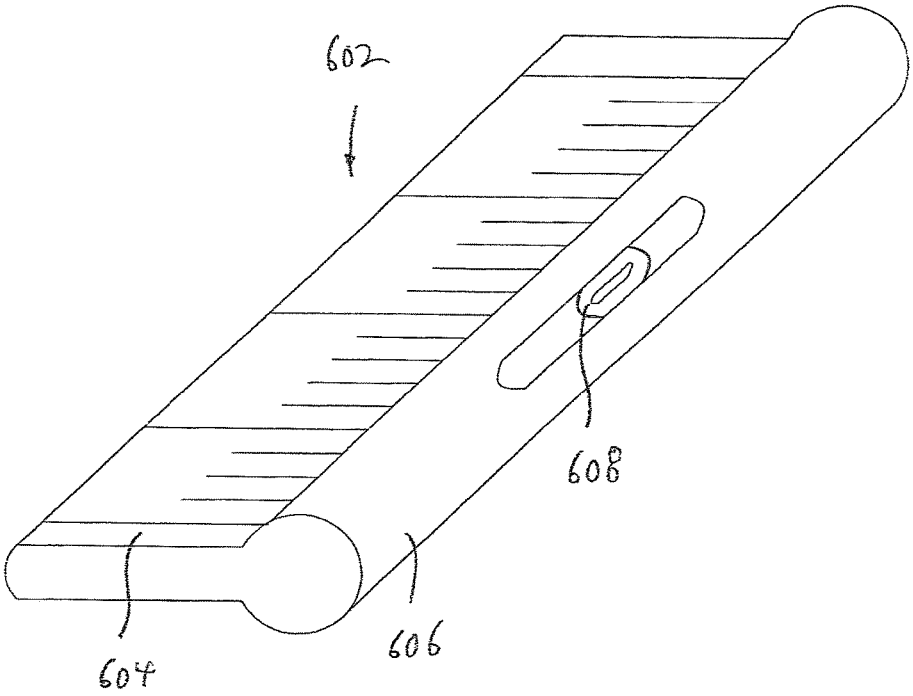
FIG. 27 is a perspective view of a modified carpenter level.

Alternatively, as shown in FIG. 27, bubble level 608 can be provided in cylindrical grasping member 606.

It will be appreciated that carpenter level 602 can be used with any of the embodiments in the present application, and instead of being positioned within space 80", it can be positioned in spaces 56, 56' as well.

It will be appreciated that the invention described above has permitted adjustment in at least three orthogonal directions. However, the present invention can also be provided with fewer degrees of freedom or adjustment, for example, adjustment in a single direction such as the first lengthwise direction.

In this regard, in all of the above embodiments, elongated rectangular plate 42 can be removed from adjustment support member 40, and lower plate 46 of adjustment support member 40 can be secured directly to an existing wall. In such case, wall panel sliding supports 66 would provide the only adjustment in the first lengthwise direction.

Figure 28:
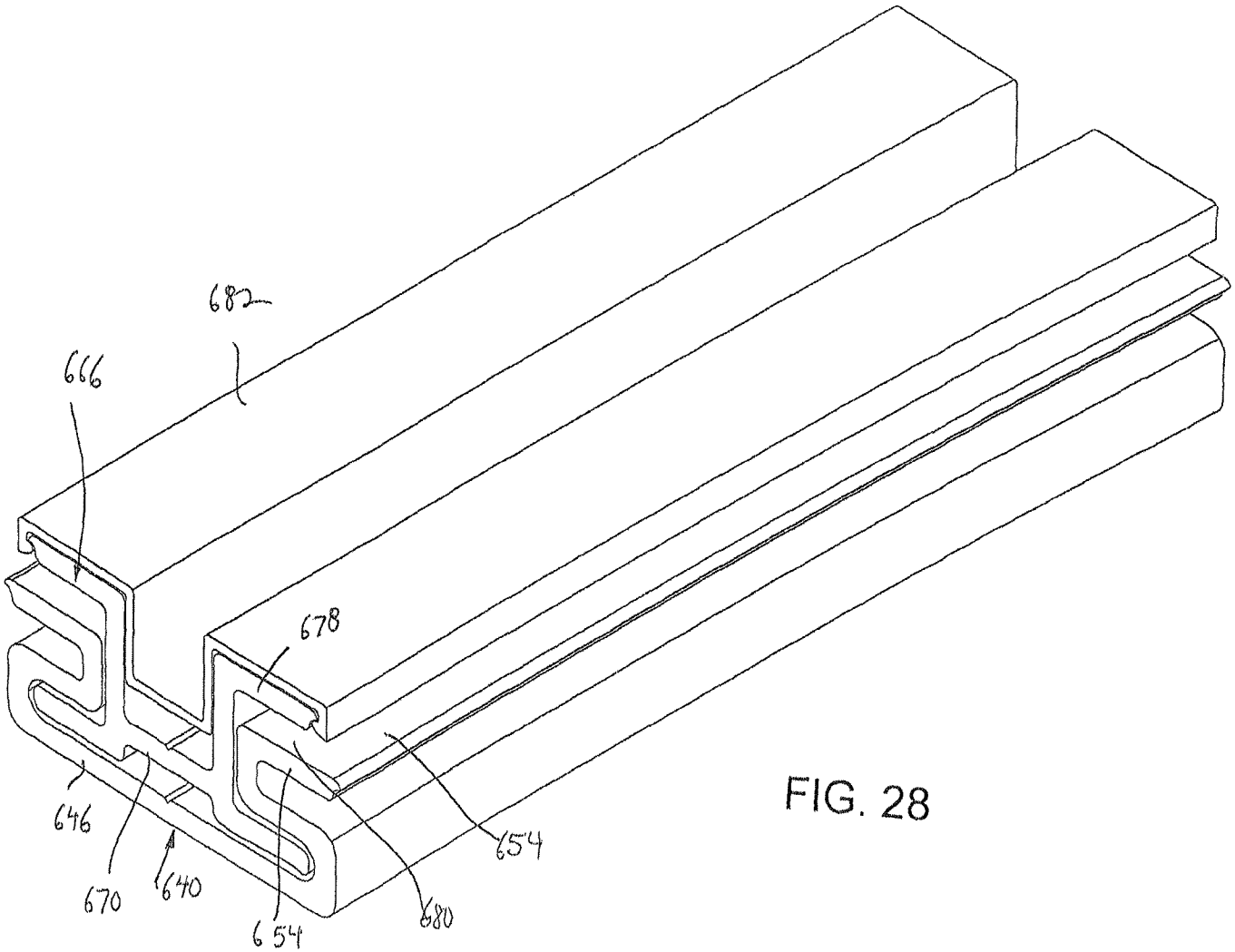
FIG. 28 is a perspective view of a modified adjustment support member and modified wall panel sliding support for adjustment in a single direction.
Figure 29:
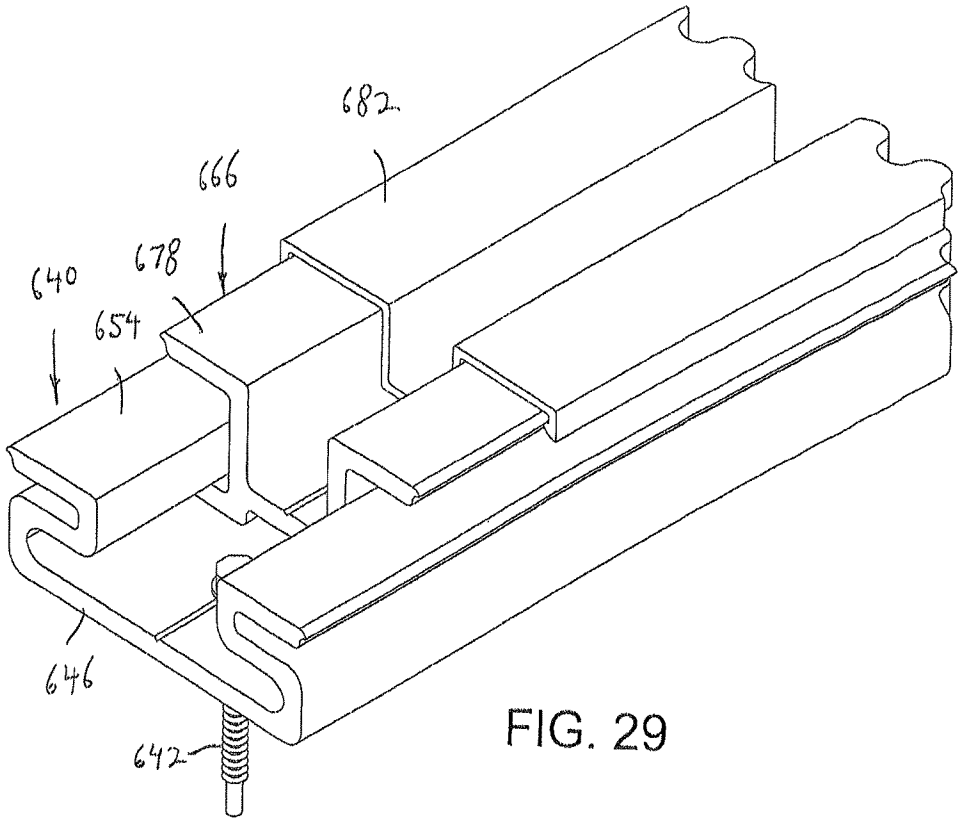
FIG. 29 is a perspective view of the arrangement of FIG. 28, showing the sliding arrangement of the parts.

One example of this arrangement, corresponding to FIG. 5, is shown in FIGS. 28 and 29 in which a modified adjustment support member 640 is provided, with a lower plate 646 adapted to be secured by screws 642 to an existing wall. A modified wall panel sliding support 666 is slidably retained by adjustment support member 640. It will be appreciated that elongated rectangular lower plate 670 of wall panel sliding support 666 has an inverted U-shape so as not to engage with the screws used to secure lower plate 646 to the existing wall. As with the aforementioned embodiments, the securing walls 94 of wall panels 86 are inserted in the space 680 between retaining wall 654 of adjustment support member 640 and retaining wall 678 of wall panel sliding support 666. A cover 682 is also shown which engages over retaining walls 678.

Figure 30:
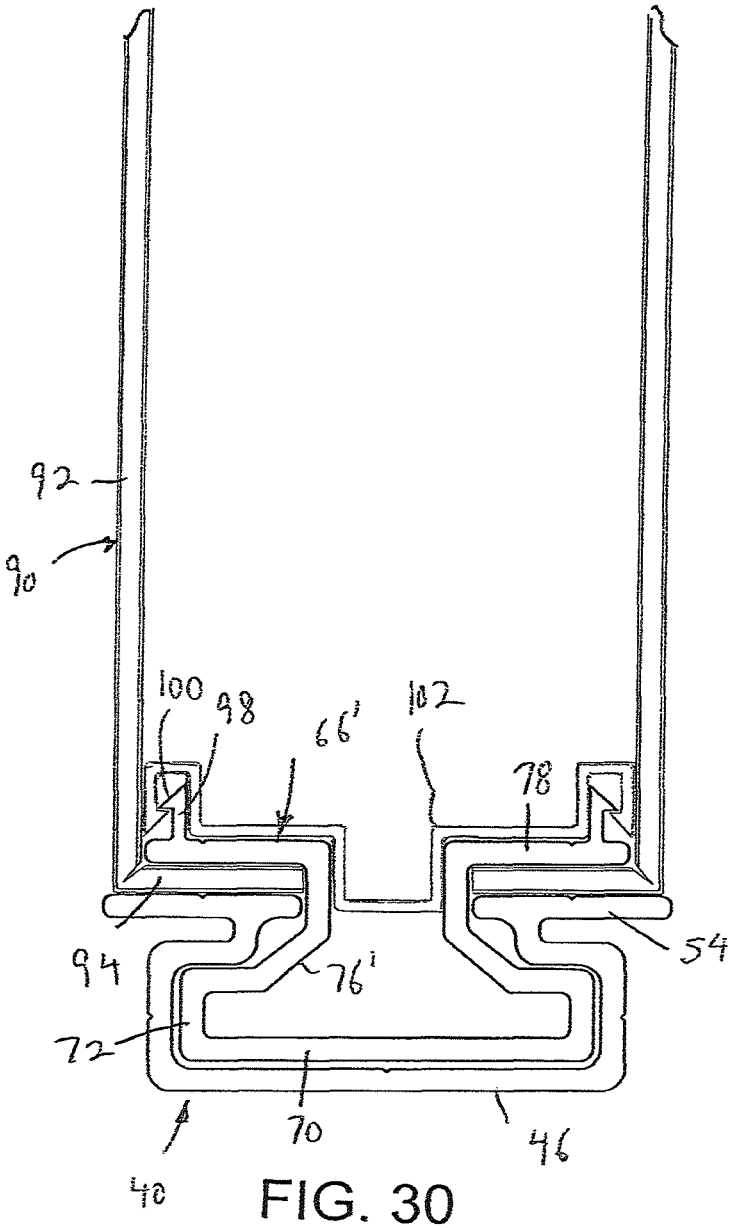
FIG. 30 is a plan view, similar to the arrangement of FIG. 28, with a further modified wall panel sliding support.
Figure 31:
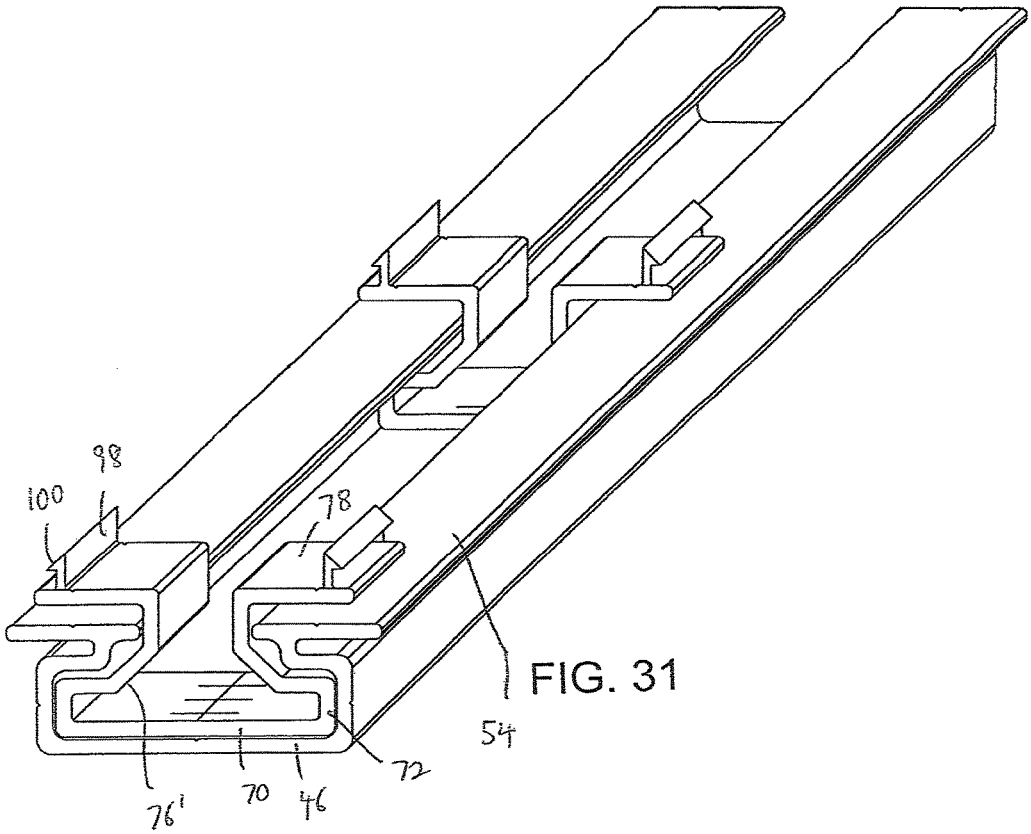
FIG. 31 is a perspective view of the arrangement of FIG. 30.
Figure 32:
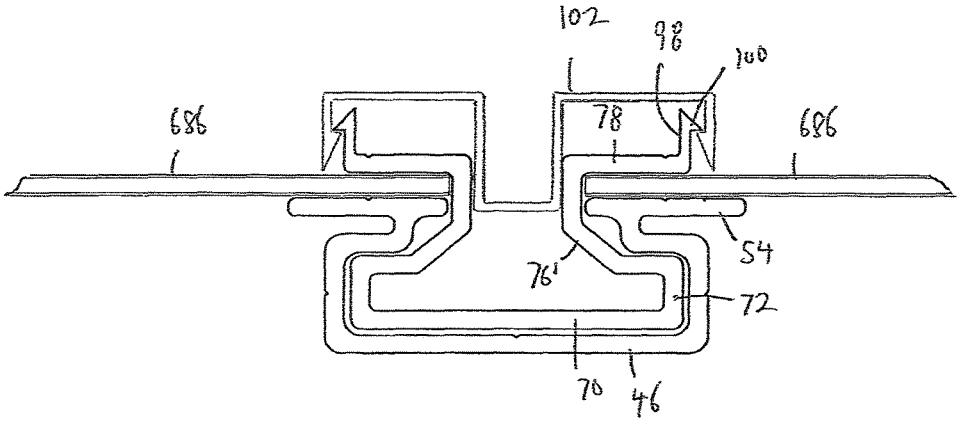
FIG. 32 is a plan view, similar to FIG. 32, showing connection with different wall panels.

As another example, reference is made to FIG. 30 which corresponds to the arrangement shown in FIGS. 7 and 8, but with elongated rectangular plate 42 removed. FIG. 32 is similar to FIG. 30, except that planar wall panels 686 are provided.

It will be appreciated that, with all of the above embodiments, wall panels 86 have been connected to adjustment support member 40 and/or wall panel sliding supports 66. However, wall panels 86 can alternatively be connected with connecting panels 60 which connect spaced apart adjustments support members 40.

Figure 33:
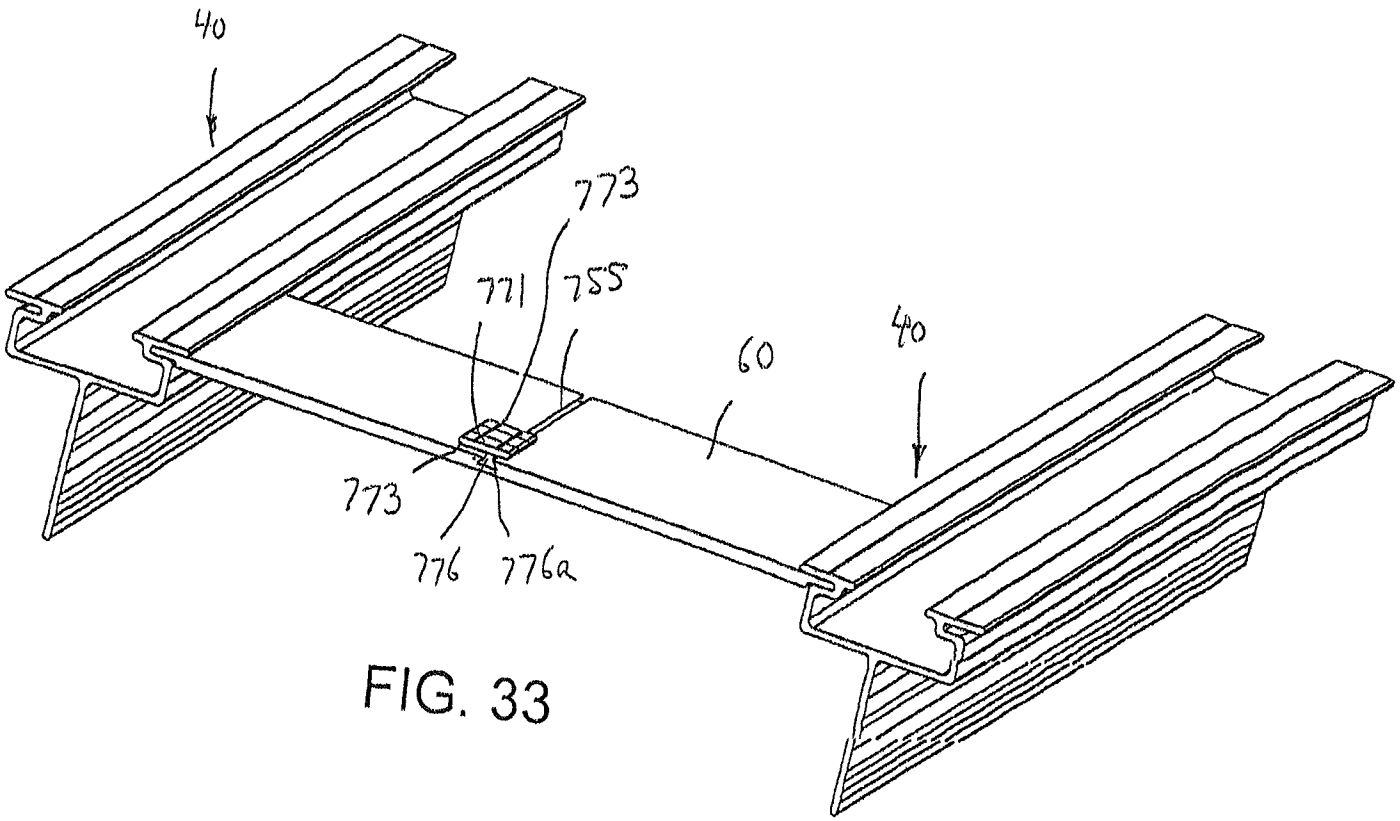
FIG. 33 is a perspective view of two adjustment support members connected together by connecting panels, with a first arrangement on the connecting panels for supporting wall panels.

Thus, for example, a rectangular securing plate 771, as shown in FIG. 33, and which is similar to rectangular securing plate 171, is connected to the upper end of an extension wall 776 having a dovetail shaped lower end **776*a* which fits within a dovetail shaped slot 755 extending in the first lengthwise direction in a connecting panel 60. As with rectangular securing plate 171, rectangular securing plate 771 defines tabs 773 extending to opposite sides of extension wall 776, for insertion into slots 189 in a side wall of a single panel member 188 of a wall panel 186 in order to retain wall panels 186 in position. With this arrangement, rectangular securing plate 771 can be moved to provide adjustment of wall panels 86. Further, with this arrangement, wall panel sliding supports 66** are eliminated.

Figure 34:
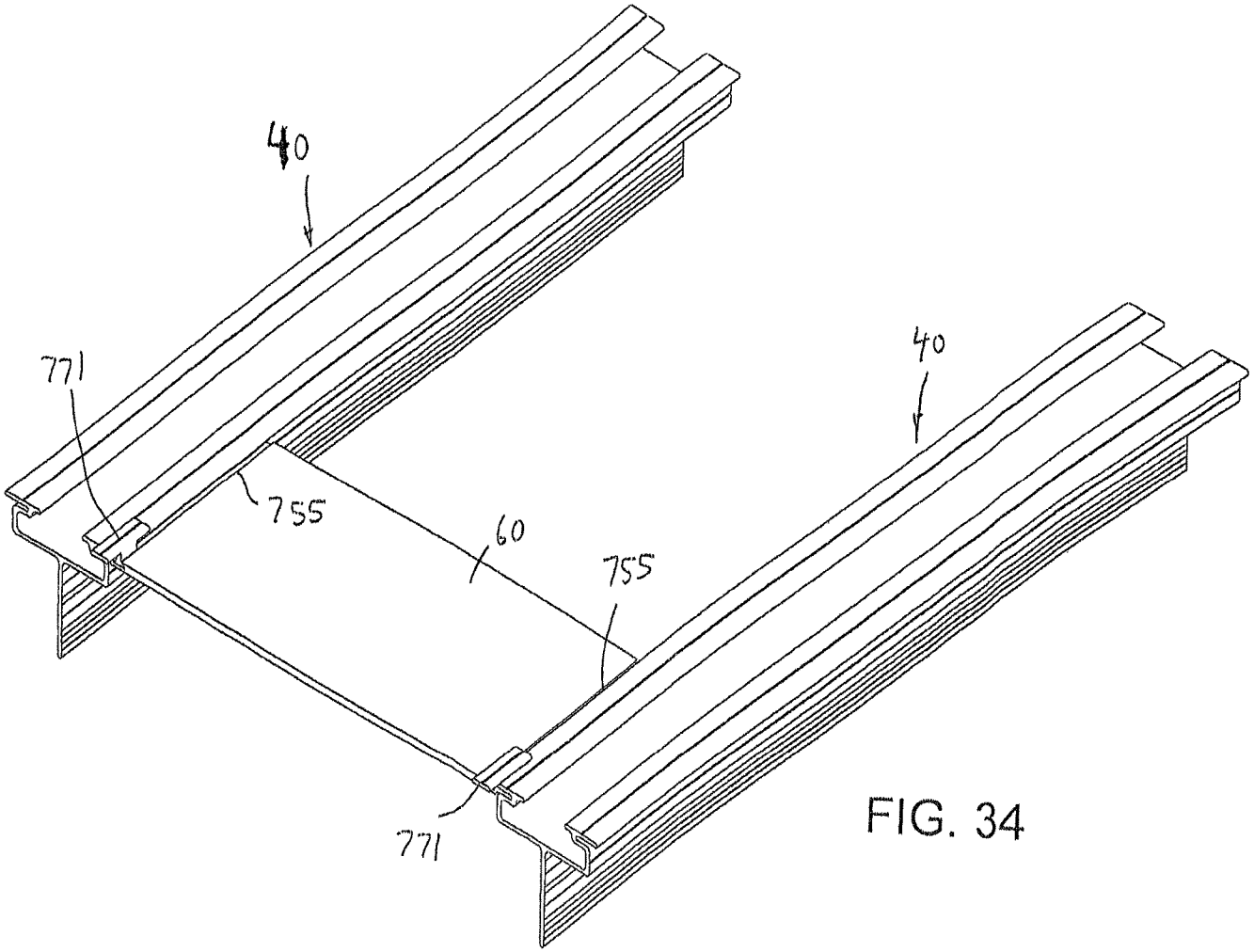
FIG. 34 is a perspective view similar to FIG. 33, with a modified arrangement on the connecting panels for supporting wall panels.
Figure 35:
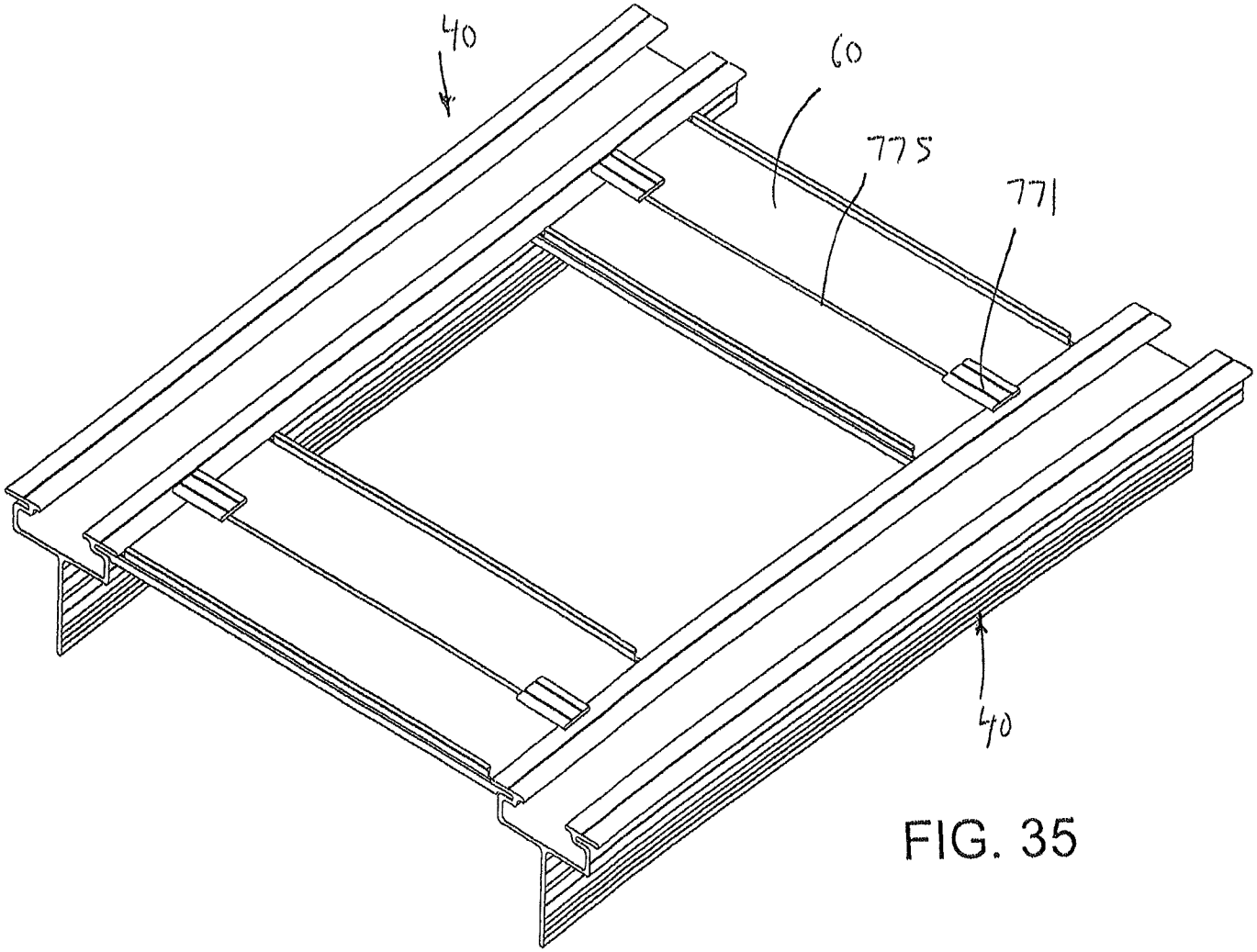
FIG. 35 is a perspective view similar to FIG. 33, with a further modified arrangement on the connecting panels for supporting wall panels.

While only one dovetail shaped slot 755 has been shown in FIG. 33, more than one dovetail shaped slot 755 can be provided, as shown in FIG. 34. Further, while dovetail shaped slots 755 has been shown in FIGS. 33 and 34 extending the first lengthwise direction, it can alternatively extend in the second transverse direction, as shown in FIG. 35.

Figure 36:
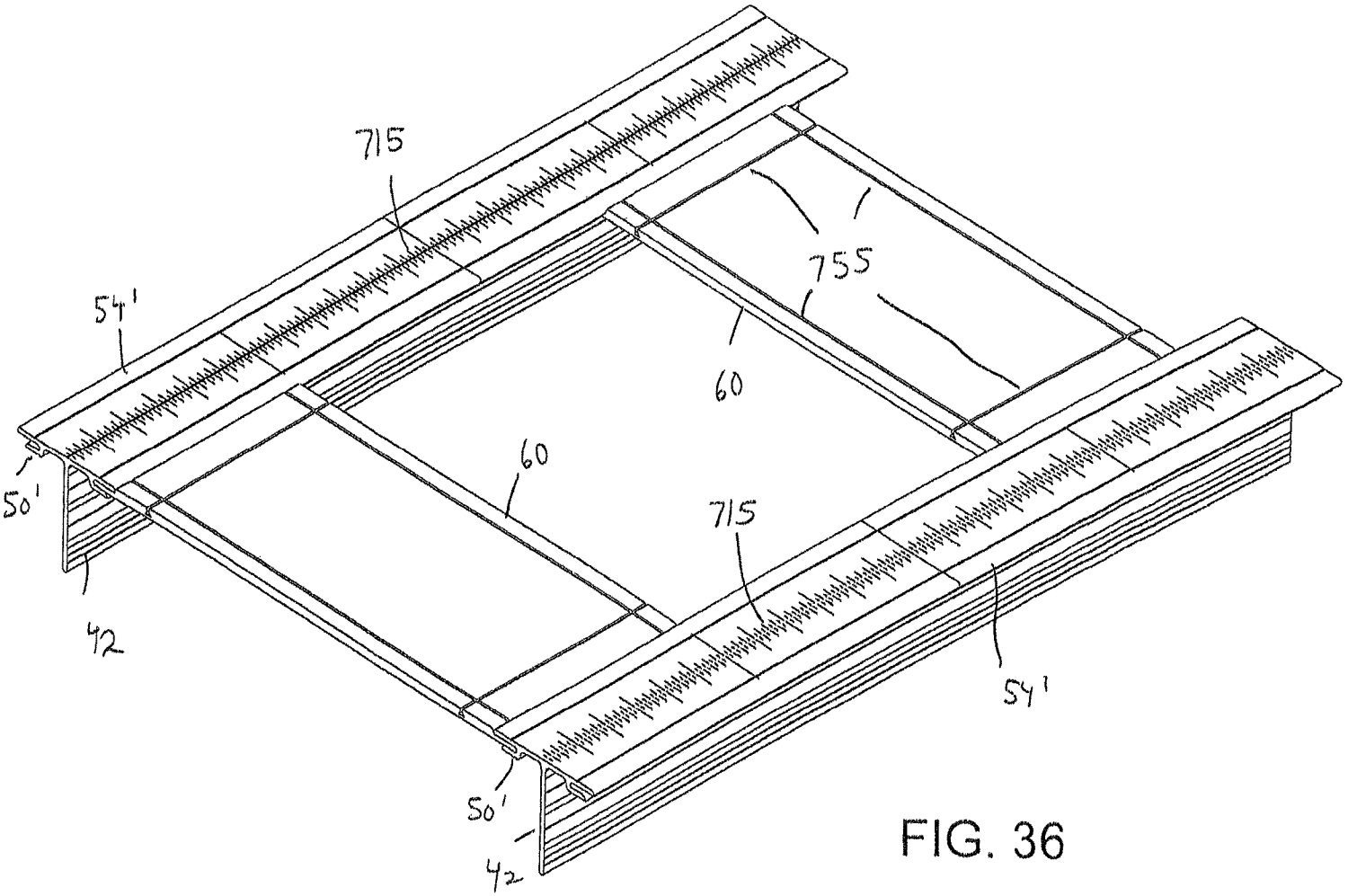
FIG. 36 is a perspective view similar to FIG. 33, with a still further modified arrangement on the connecting panels for supporting wall panels.

Still further, multiple dovetail shaped slots 755 can be provided, as shown in FIG. 36, in both the first lengthwise direction and second transverse direction. In addition, since the wall panels will be secured to rectangular securing plates 771, there is no longer a need for U-shaped track 44, and accordingly, an arrangement similar to that shown in FIG. 24 can be used, with platform wall 54' and L-shaped walls 50'. Further, measuring markings or gradations 715 are provided on the upper surface of platform wall 54'.

Figure 37:
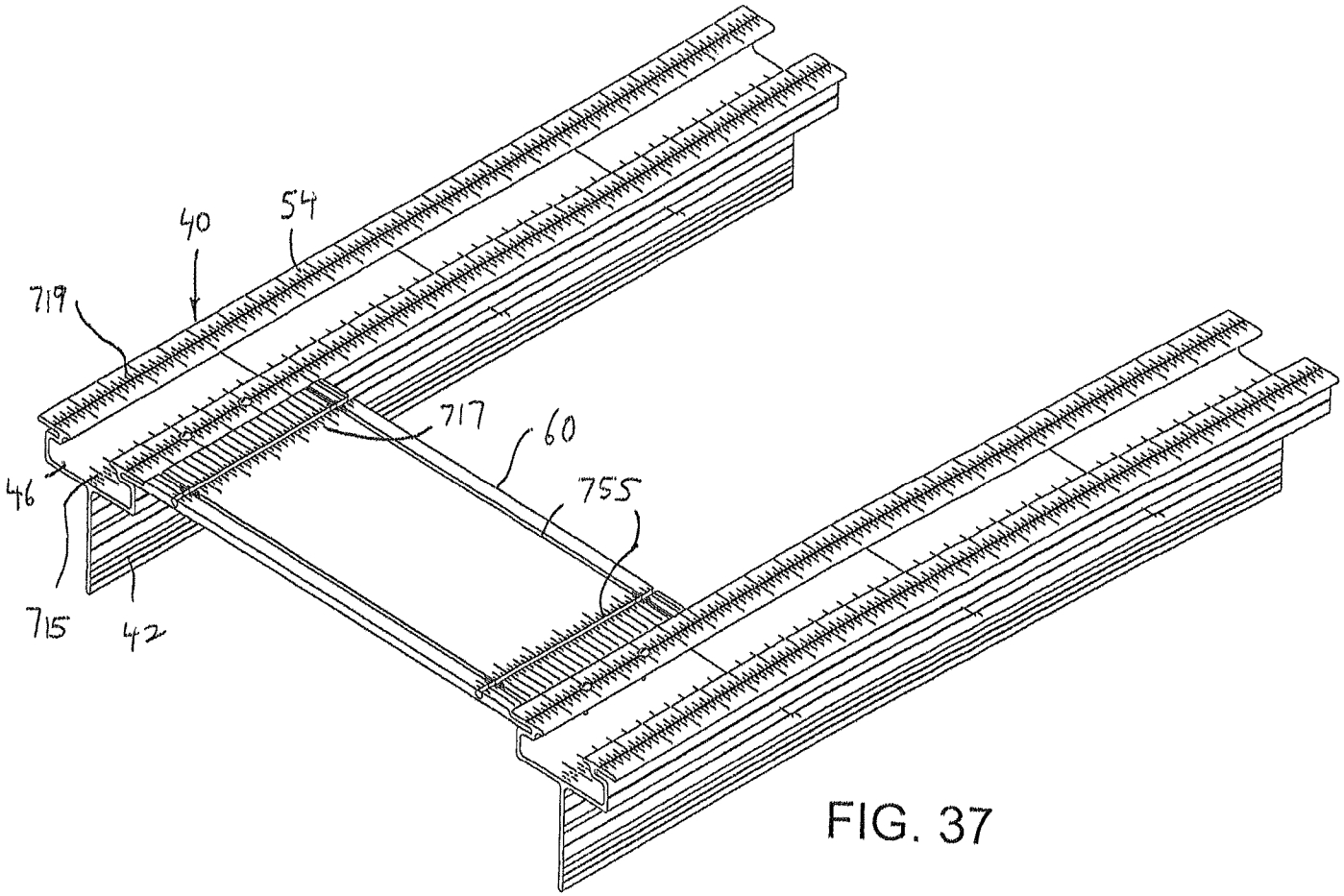
FIG. 37 is a perspective view similar to FIG. 33, with a yet further modified arrangement on the connecting panels for supporting wall panels.

FIG. 37 shows another modification in which connecting panel 60 of the type shown in FIG. 36 is connected to adjustment support members 40, with measuring markings or gradations 715, 717 and 719 provided on elongated rectangular lower plate 46, connecting plate 60 and elongated retaining walls 54, respectively.

Figure 38:
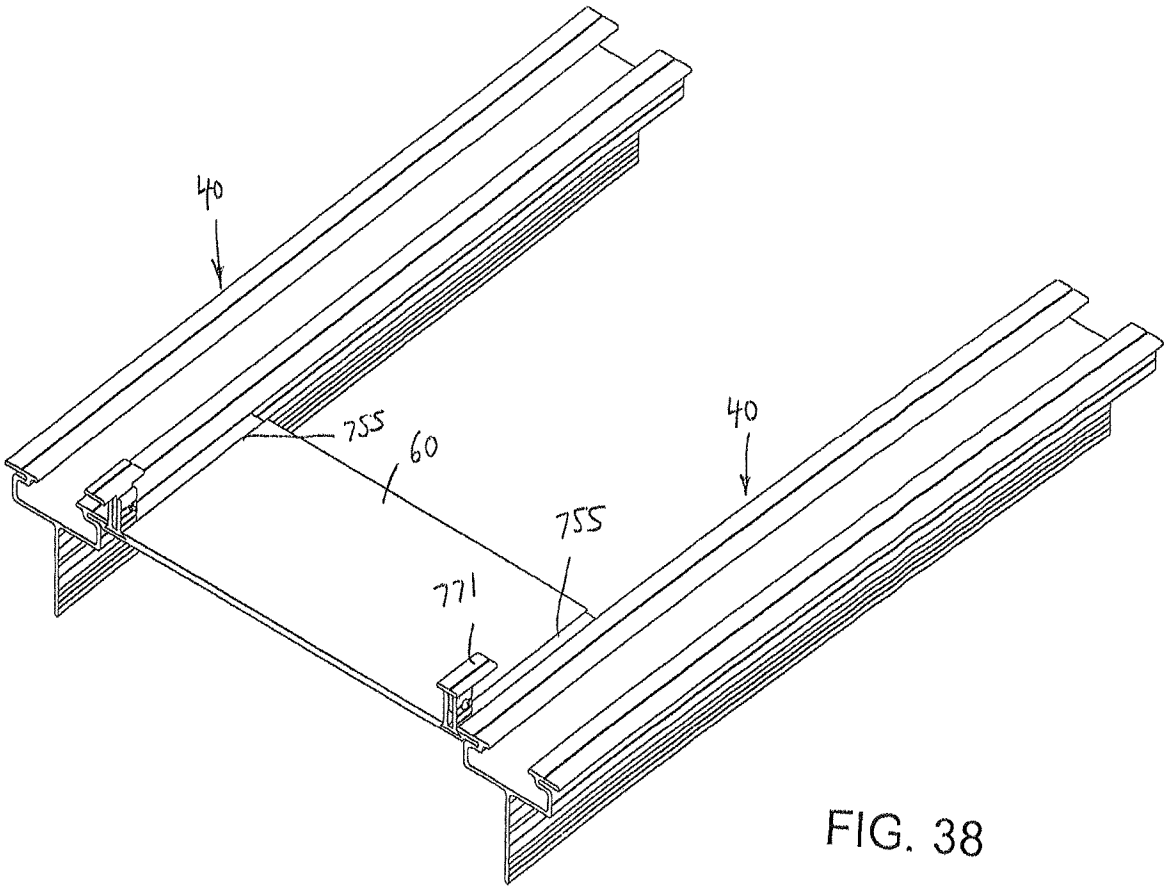
FIG. 38 is a perspective view similar to FIG. 33, with another modified arrangement on the connecting panels for supporting wall panels.

A further modification of the arrangement shown in FIG. 34 is shown in FIG. 38, in which rectangular securing plates 771 can be adjustably moved in the third orthogonal direction, in the same manner as previously described in regard to FIG. 10.

Figure 39:
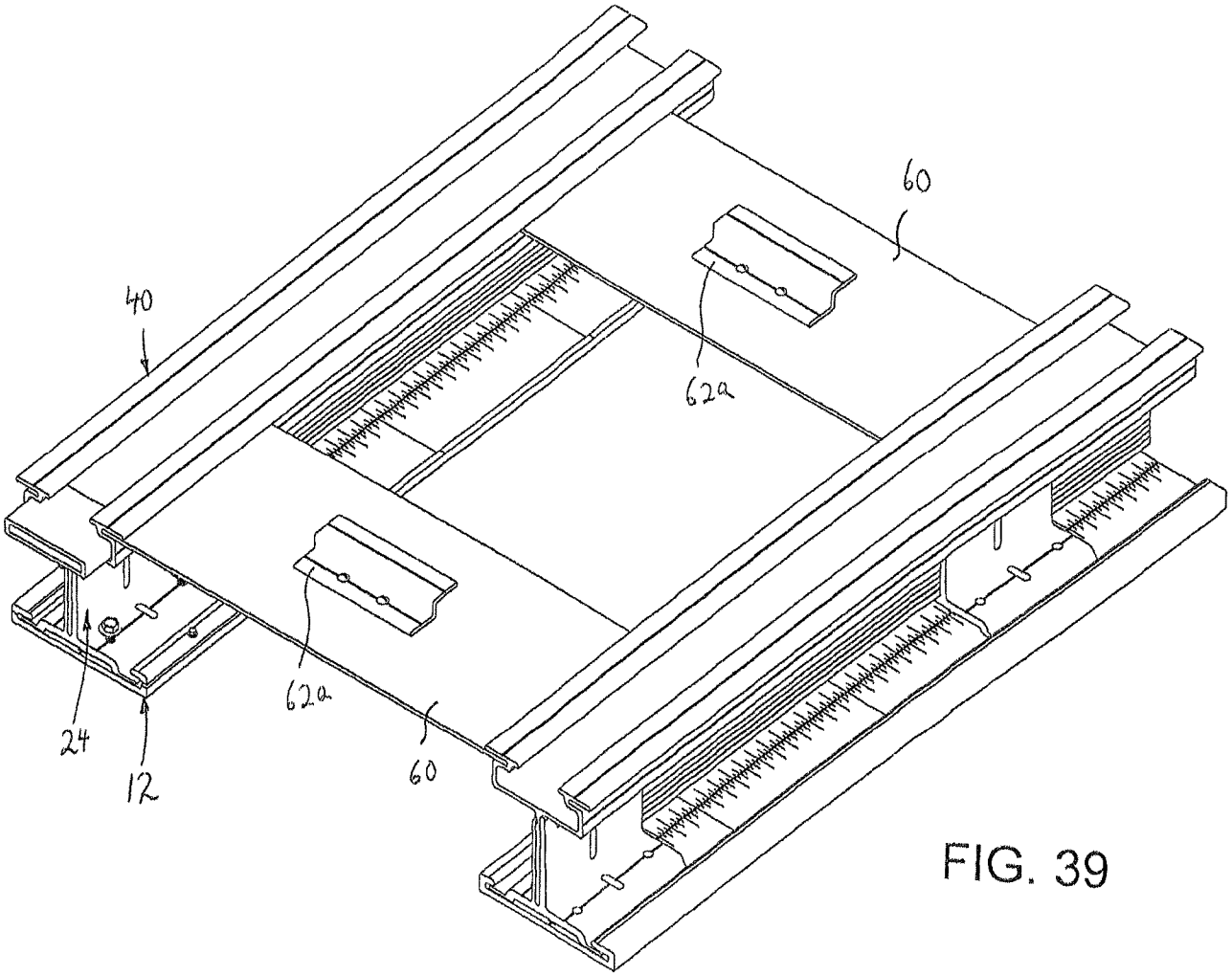
FIG. 39 is a perspective view of two adjustment support members connected together by connecting panels, with a second arrangement on the connecting panels for supporting wall panels.
Figure 40:
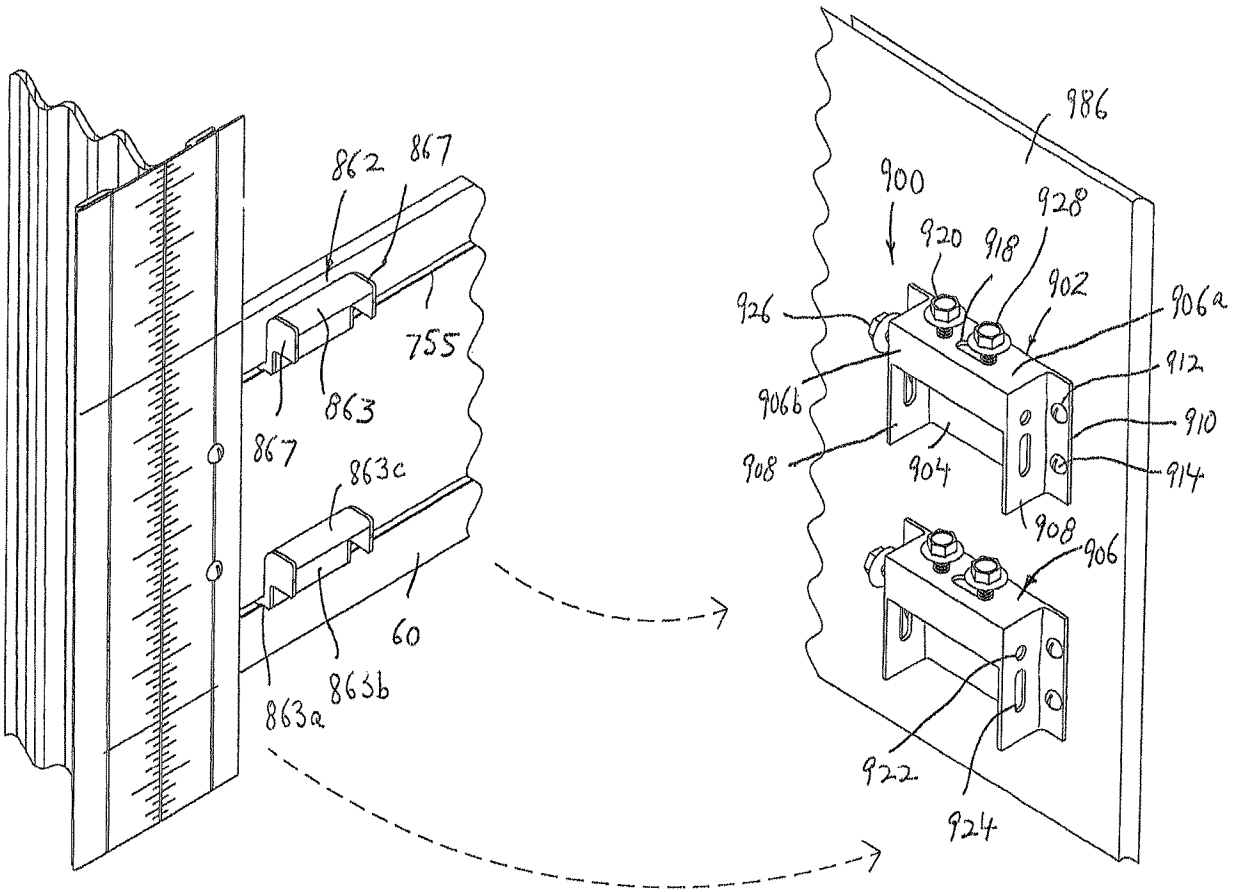
FIG. 40 is a perspective view of a portion of a modified arrangement similar to FIG. 39 for supporting wall panels according to the second arrangement
Figure 41:
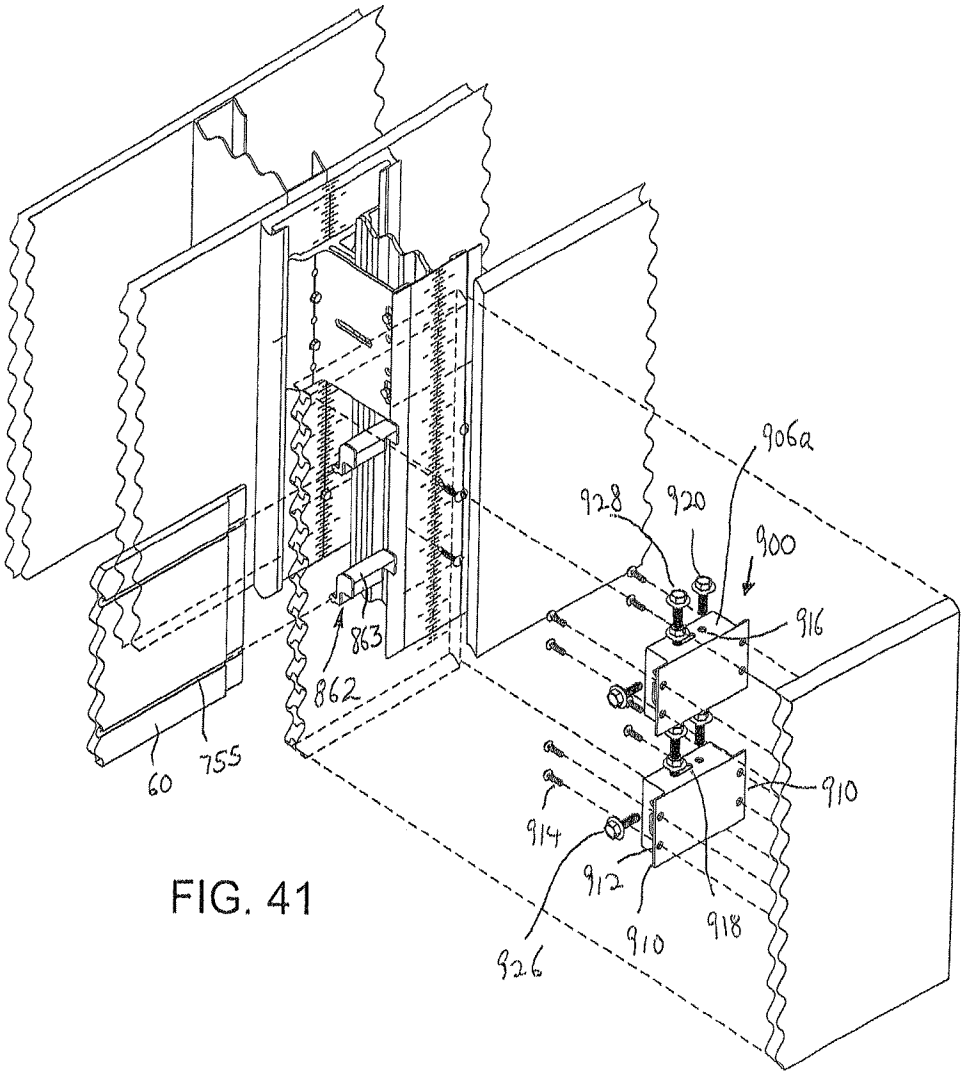
FIG. 41 is a first exploded perspective view of the arrangement of FIG. 40.
Figure 42:
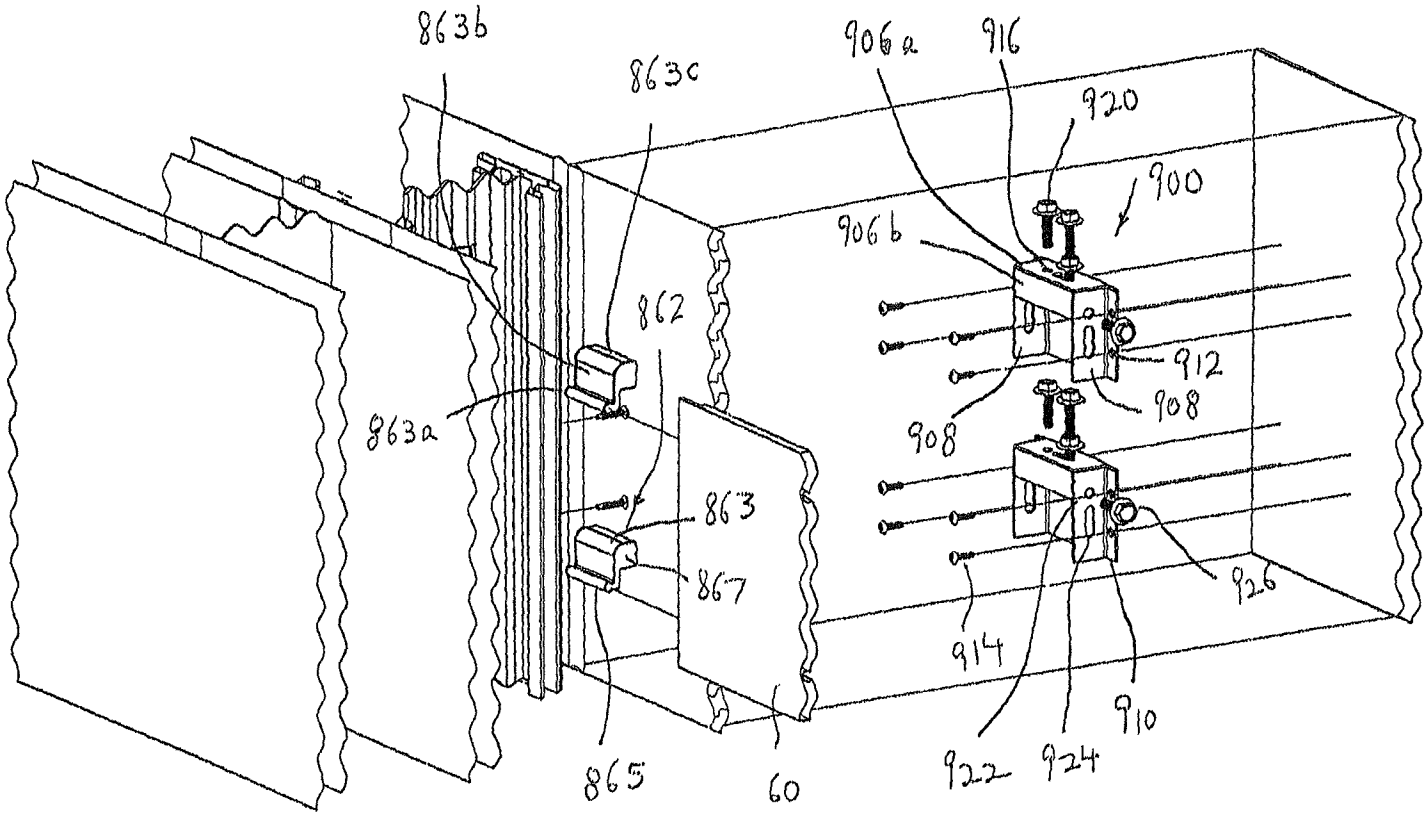
FIG. 42 is a second exploded perspective view of the arrangement of FIG. 40.
Figure 43:
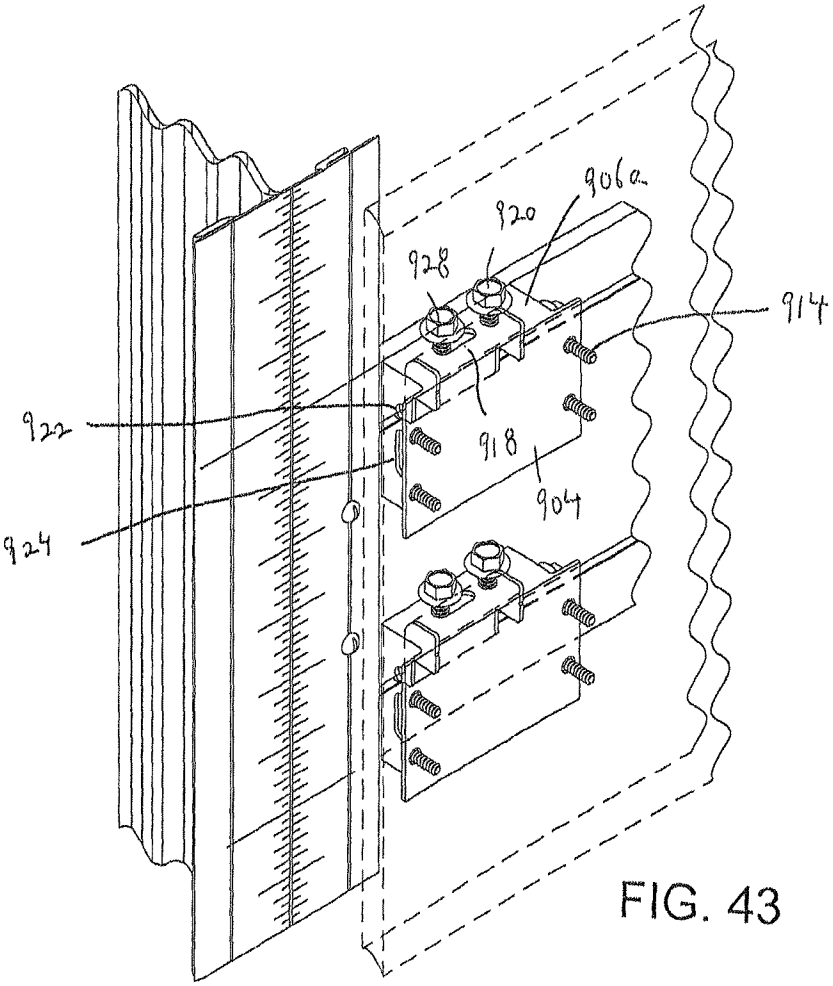
FIG. 43 is an enlarged perspective view of the portion of the modified arrangement of FIG. 40, in assembled condition.

Alternatively, instead of providing rectangular securing plates 771 with tabs 773 that fit within slots 189 in a side wall of a single panel member 188 of a wall panel 186 in order to retain wall panels 186 in position, one or more brackets can be secured on the exposed surface of each connecting panel 60, with a wall panel secured to each bracket in a hanging manner, similar to a picture frame. For example, as shown in FIG. 39, a single Z-shaped bracket 62*a* is mounted to each connecting panel 60. Similar brackets would then be provided on the rear surface of each planar wall panel for mounting the wall panel on brackets 62*a*.

In this regard, a preferred embodiment is shown in FIGS. 40-43 in which each Z-shaped bracket 862 has a Z-shaped wall 863 having one end 865 formed in a bulbous or dovetail shape for slidable insertion in a correspondingly shaped slot 755 of a connecting panel 60. Specifically, each Z-shaped wall 863 includes a first wall 863*a* having the bulbous end 865 and extending orthogonally out from the outer surface of the respective connecting panel 60, a second wall 863*b* extending orthogonally up from the free end of first wall 863*a*, and a third top wall 863*c* extending orthogonally out from the free end of second wall 863*b*. Z-shaped brackets 862 further include side walls 867 on opposite sides thereof.

Complementary hook assemblies 900 are secured to the rear surface of a planar wall panel 986 for connection with Z-shaped brackets 862. Specifically, each hook assembly 900 includes an inverted J-shaped wall 902 formed by a first rectangular wall 904 which seats flush against the rear surface of wall panel 986, and an inverted L-shaped wall 906 which extends out from the upper edge of first rectangular wall 904. L-shaped wall 906 includes a first top wall 906*a* which extends orthogonally out from the top edge of rectangular wall 904 and a downwardly extending wall 906*b* which extends down from the free edge of top wall 906*a* in parallel spaced apart relation from first wall 904. Rectangular side walls 908 are connected to and close off both sides of J-shaped wall 902. The width of rectangular wall 904 is greater than the width of J-shaped wall 902, such that rectangular wall extensions 910 extend to the sides of side walls 908, while also seating flush against the rear surface of wall panel 986. Openings 912 are provided in wall extensions 910 in order to receive screws 914 therein to secure each hook assembly 900 to the rear surface of wall panel 986.

With this arrangement, hook assemblies 900 are positioned over Z-shaped brackets 862 for mounting wall panels 986 to connecting panel 60. In such case, top wall 906*a* seats on top wall 863*c*, and side walls 908 encompass and surround side walls 867. Further, downwardly extending wall 906*b* is positioned behind second wall 863*b* to prevent pullout of wall panels 986.

In order to provide vertical adjustment of wall panels 986 relative to connecting panels 60, upper wall 906*a* includes a first circular threaded opening 916 and an adjacent slot 918. An adjustment bolt 920 is threaded within the threaded opening 916 and engages the upper surface of top wall 863*c* for moving each hook assembly 900 up and down relative to the respective connecting panel 60.

In order to provide side to side adjustment of wall panels 986 relative to connecting panels 60, at least one side wall 908 includes a first circular threaded opening 922 and an adjacent slot 924. An adjustment bolt 926 is threaded within the threaded opening 922 and engages the adjacent side wall 867 for moving each hook assembly 900 side to side relative to the respective connecting panel 60.

In this regard, it will be appreciated that hook assemblies 900 are positioned near the edges of wall panel 986 in order to permit access to adjustment screws 920 and 926.

After adjustment bolts 920 and 926 have been rotated to provide adjustment of hook assemblies 900 relative to Z-shaped brackets 862, and thereby adjustment of wall panel 986 relative to the corresponding connecting panel 60, securing screws 928 which extend through slots 918 and 924 into threaded engagement with top wall 863*c* and side wall 867, respectively, are rotated to fix hook assemblies 900 relative to Z-shaped brackets 862.

Figure 44:
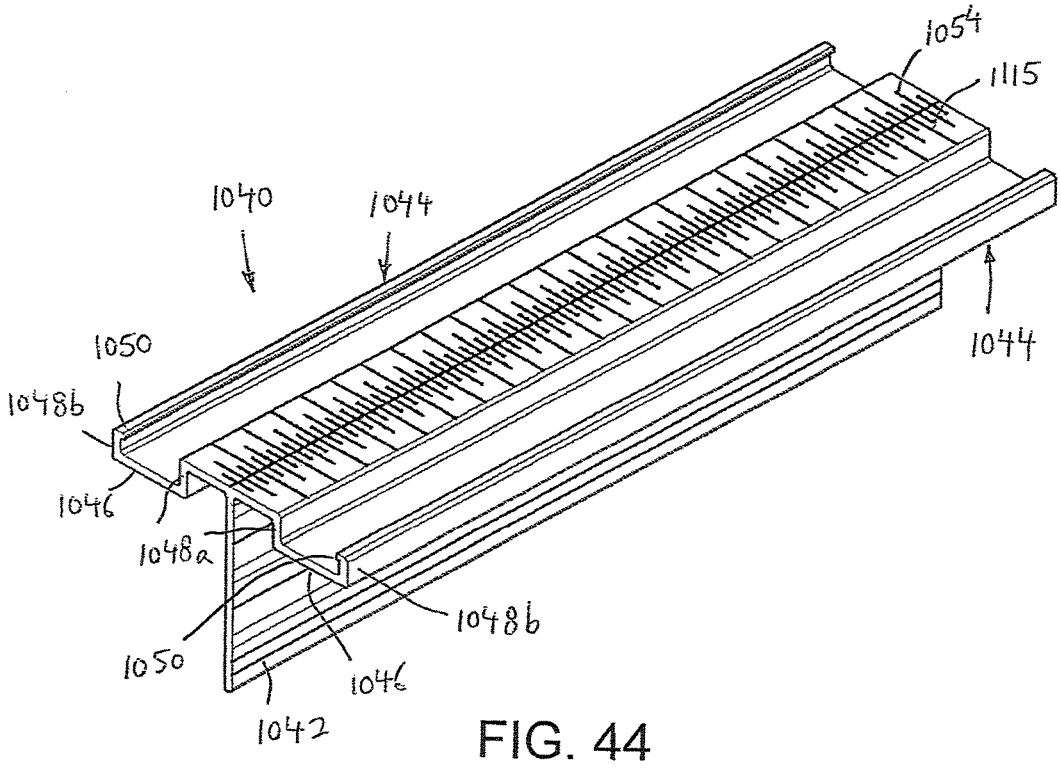
FIG. 44 is a perspective view of a modified adjustment support member according to another embodiment of the present invention.
Figure 45:
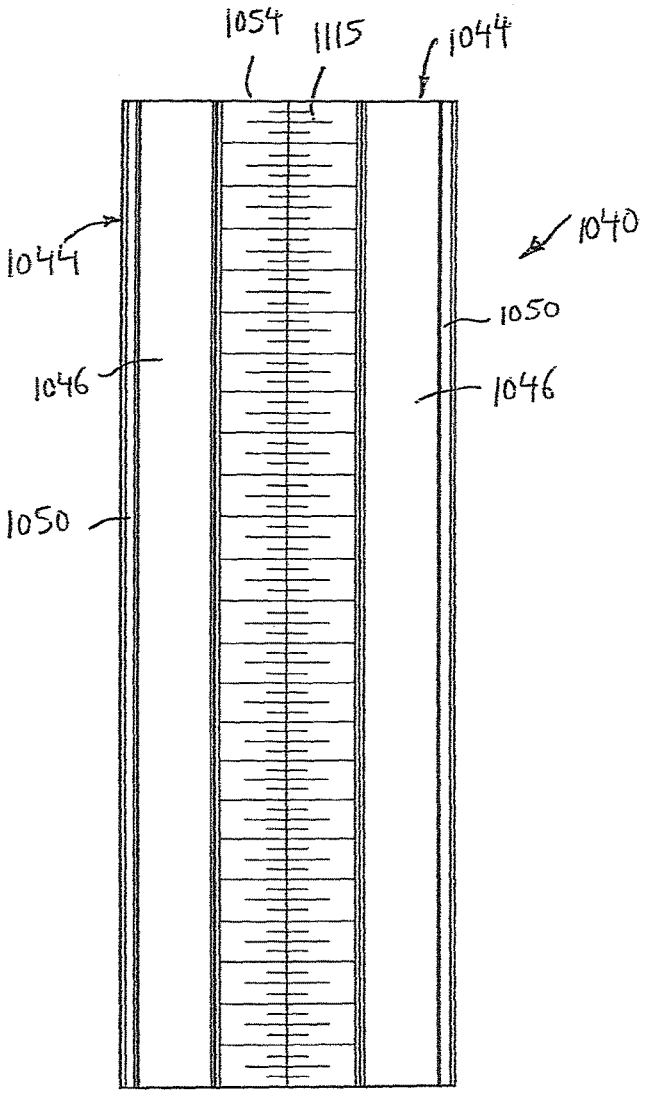
FIG. 45 is a top plan view of the modified adjustment support member of FIG. 44.
Figure 46:
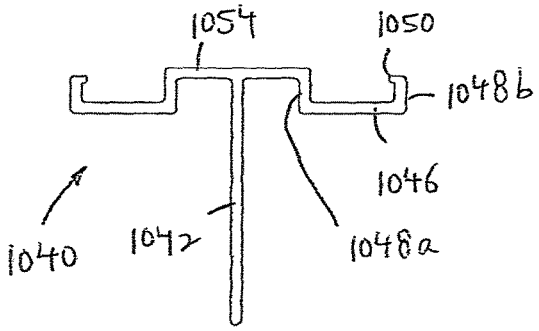
FIG. 46 is an end elevational view of the modified adjustment support member of FIG. 44.

Referring now to FIGS. 44-46, there is shown a modified adjustment support member 1040 which includes an elongated rectangular plate 1042 that is dimensioned to fit snugly between capture walls 30 and 32, such that retaining lip 30*a* applies pressure to plate 1042. As with adjustment support member 40, it will be appreciated that plate 1042 can be moved in the first lengthwise direction, as well as the third direction which is orthogonal to the first lengthwise direction and second transverse direction, and once positioned at the desired location, is secured in that position by screws extending through at least one of slots 34, 36 and openings 38. Although there are no fixed openings in plate 1042, the screws can still pass therethrough. Alternatively, openings can also be provided in plate 1042. Further, at any time, the screws can be loosened, plate 1042 is then adjusted in position and the screws are retightened. Alternatively, it will be appreciated that slots 34, 36 and openings 38 can be provided in plate 1042 instead of, or in addition to, capture walls 30 and 32.

The upper edge of plate 1042 is connected centrally in the lengthwise direction thereof to the underside of an elongated rectangular platform wall 1054. Measuring markings or gradations 1115 are provided on the upper surface of elongated rectangular platform wall 1054. Two U-shaped tracks 1044 are provided, each track 1044 connected to one lengthwise end edge of platform wall 1054. Each U-shaped track 1044 includes elongated, parallel, spaced apart walls 1048*a* and 1048*b* connected together by an elongated lower plate 1046. Specifically, the upper edge of each wall 1048*a* is connected to a respective lengthwise end edge of platform wall 1054, and extends downwardly therefrom, in parallel, spaced apart relation to plate 1042. Accordingly, lower plates 1046 are parallel to platform wall 1054, but positioned lower relative thereto. An elongated, inwardly turned lip 1050 extends inwardly from the upper edge of each wall 1048*b*.

Measuring markings or gradations can also be provided anywhere on any wall of U-shaped tracks 1044.

Figure 44A:
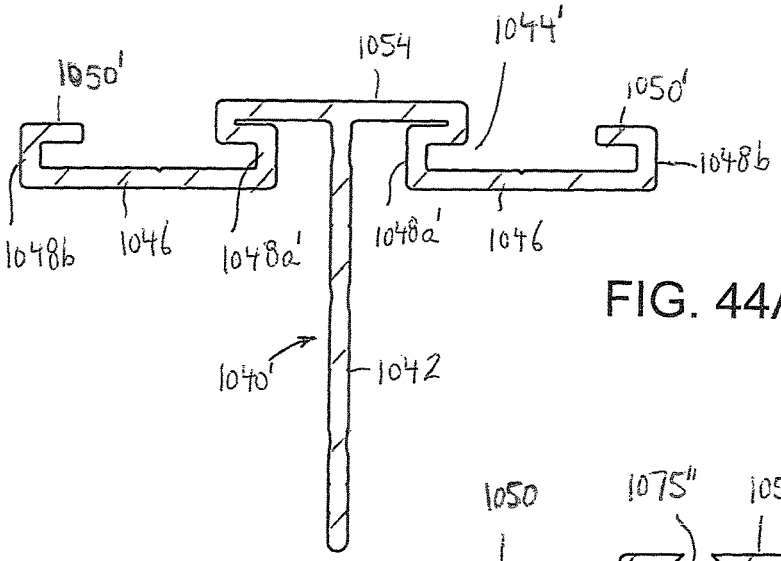
FIG. 44A is a cross-sectional view of a modified adjustment support member.

FIG. 44A shows a modified adjustment support member 1040' which is similar to adjustment support member 1040 of FIG. 44. The same reference designators are used in FIG. 44A, except that any differences have a prime (') appended thereto. The differences presented in adjustment support member 1040' are that inwardly turned lip 1050' extends inwardly to a greater extent, and each planar wall 1048*a* is replaced by a U-shaped wall 1048*a*'. In this manner, hanging members similar to hanging members 1562 in FIGS. 76-80 can be better slidably retained within the U-shaped tracks 1044'.

Figure 44B:
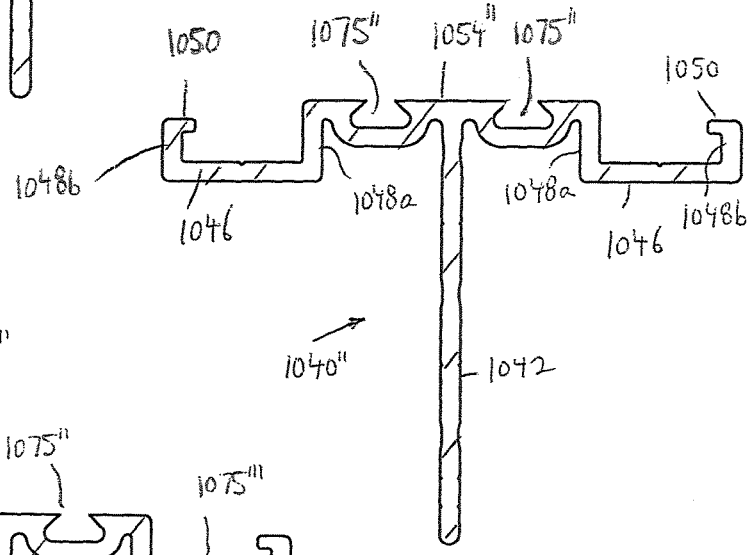
FIG. 44B is a cross-sectional view of another modified adjustment support member.

FIG. 44B shows a modified adjustment support member 1040" which is similar to adjustment support member 1040 of FIG. 44. The same reference designators are used in FIG. 44B, except that any differences have a double prime (") appended thereto. Specifically, elongated rectangular platform wall 1054" includes two elongated dovetail shaped slots 1075", similar to those shown in FIGS. 50 and 51, but extending along the lengthwise direction of elongated rectangular platform wall 1054", for receiving hooks 1062 of the type shown in FIG. 52.

Figure 44C:
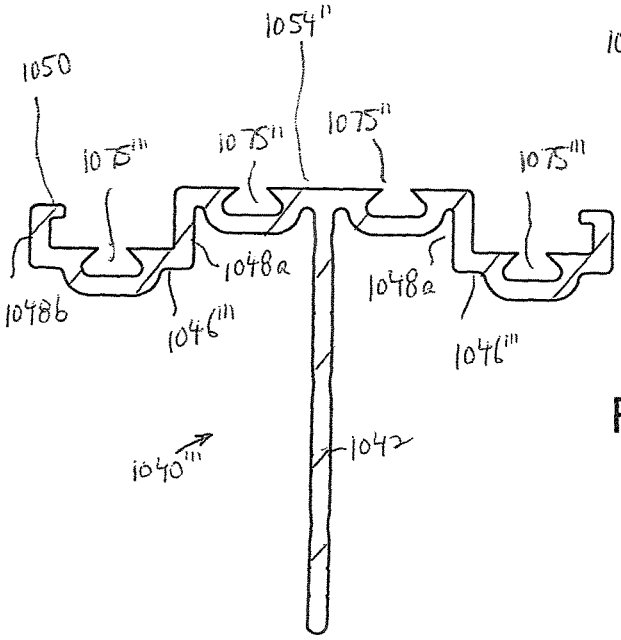
FIG. 44C is a cross-sectional view of a further modified adjustment support member.

FIG. 44C shows a modified adjustment support member 1040'" which is similar to adjustment support member 1040 of FIG. 44. The same reference designators are used in FIG. 44B, except that any differences have a triple prime (''') appended thereto. Specifically, elongated lower plates 1046'" are each provided with an elongated dovetail shaped slot 1075'" extending in the lengthwise direction thereof, for receiving hooks 1062 of the type shown in FIG. 52.

Figure 47:
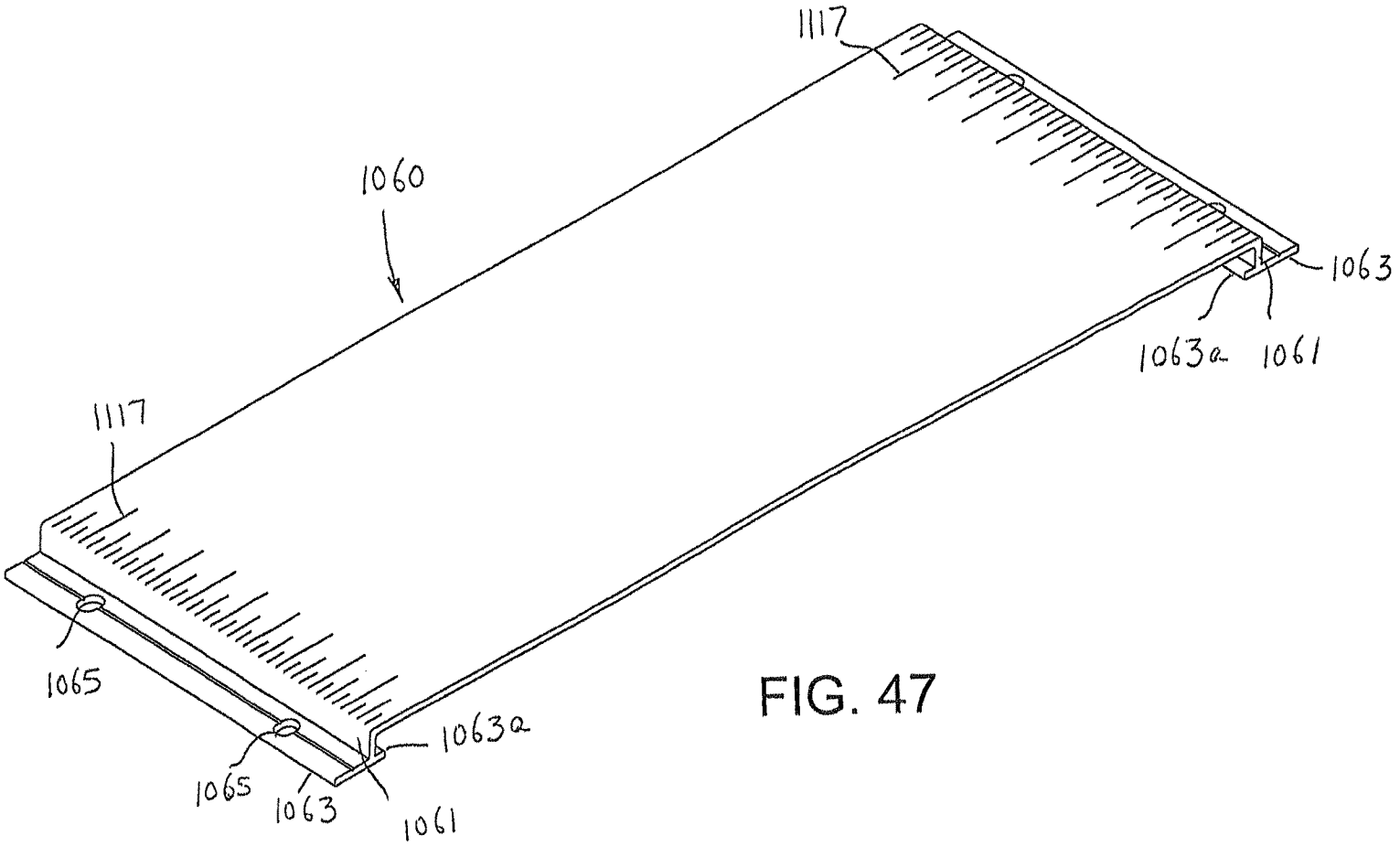
FIG. 47 is a perspective view of a modified connecting panel for use with the modified adjustment support member of FIG. 44.
Figure 48:
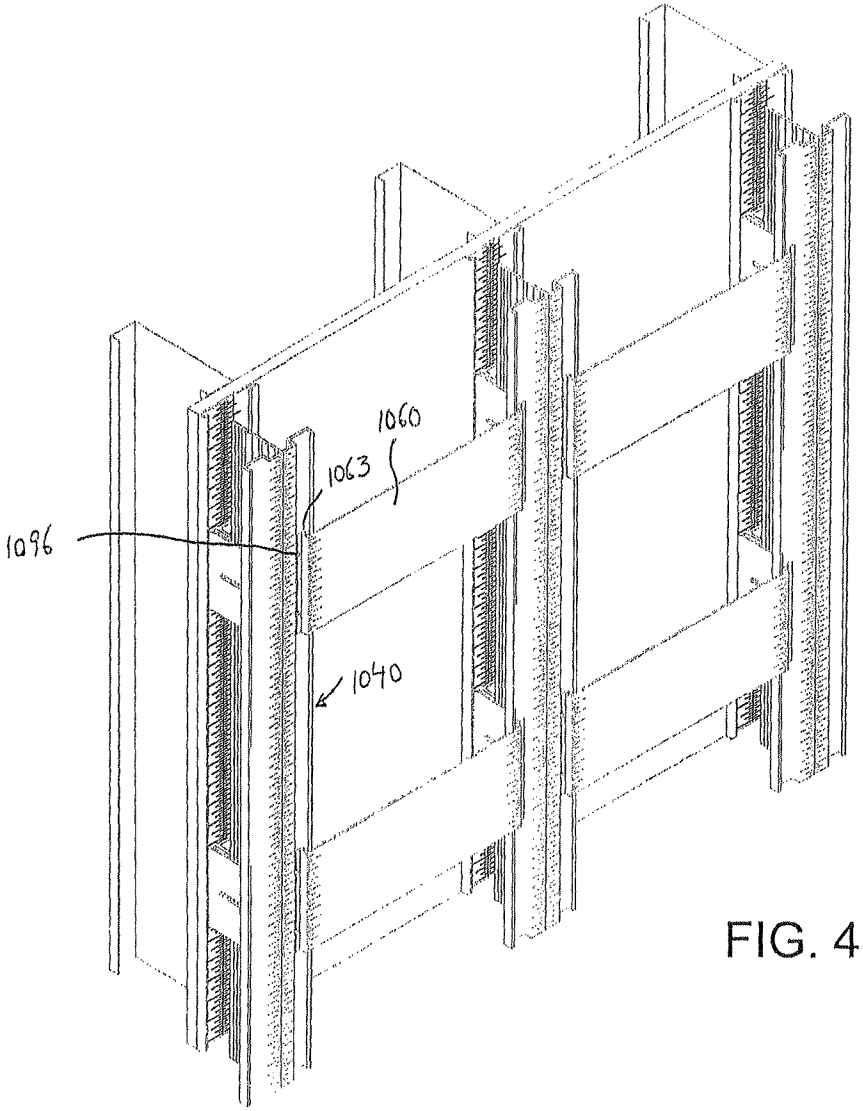
FIG. 48 is another perspective view showing assembly of modified connecting panels of FIG. 47 with modified adjustment support members of FIG. 44.
Figure 48A:
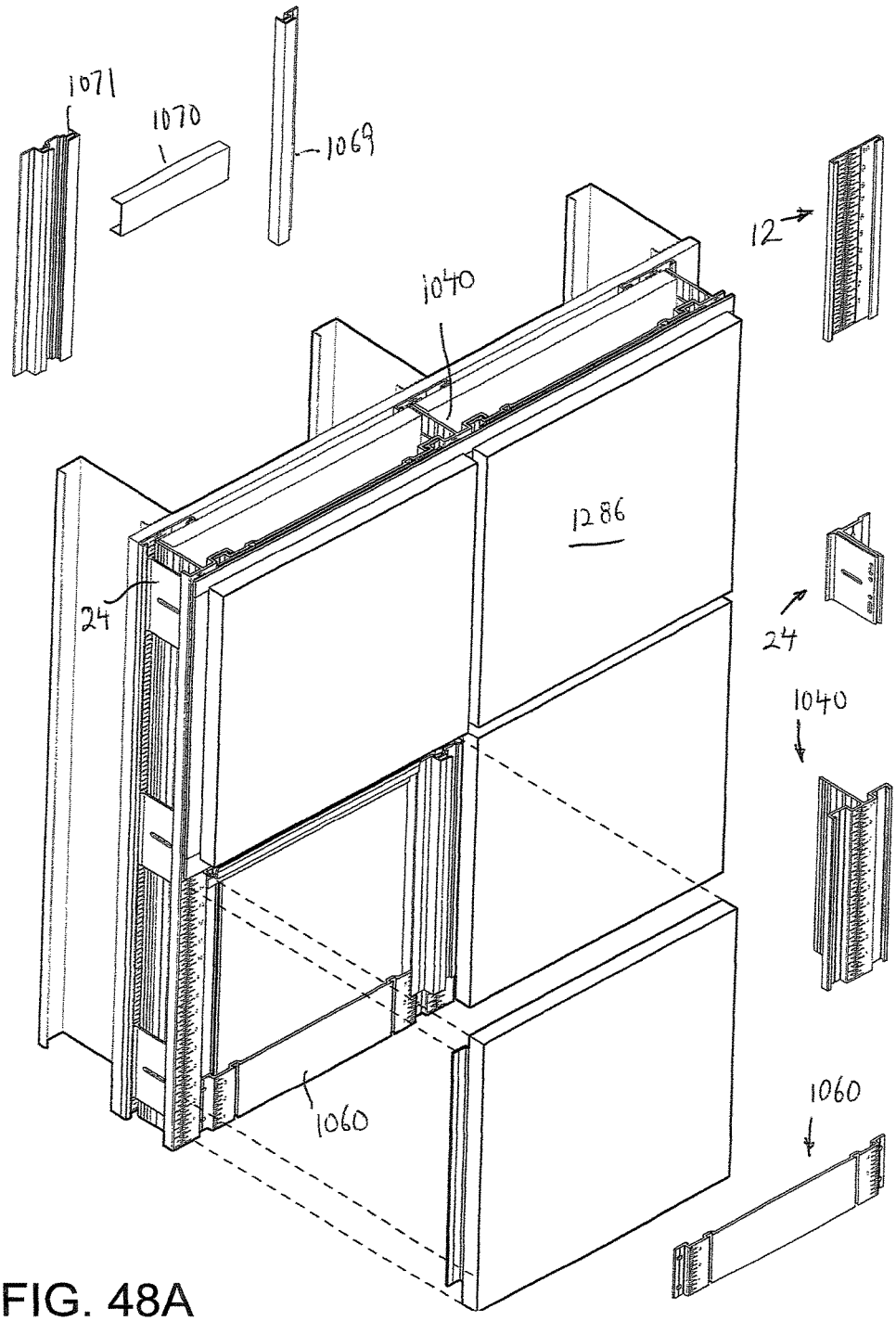
FIG. 48A is another perspective view showing assembly of modified connecting panels of FIG. 47 with modified adjustment support members of FIG. 44.

As shown in FIGS. 47, 48 and 48A, connecting panels 1060 are provided with short downwardly turned walls 1061 at opposite end edges thereof. Rectangular slide walls 1063 are connected to the free ends of downwardly turned walls 1061. Preferably, the free end of each downwardly turned wall 1061 is connected to a respective slide wall 1063 at a position about one-fourth of the distance from the inner edge 1063*a* of each slide wall 1063. The portion of each slide wall 1063 to the outside of the respective downwardly turned wall 1061 is provided with elongated openings 1065, each having its longer axis extending in the widthwise direction of each slide wall 1063. Further, measuring markings or gradations 1117 are provided at the opposite ends of connecting panel 1060, adjacent downwardly turned walls 1061.

With this arrangement, it becomes much easier to assemble connecting panels 1060 with modified adjustment support members 1040, while enabling adjustment of each connecting panel 1060 relative to modified adjustment support member 1040 in two orthogonal directions. Specifically, it is only necessary to lay each slide wall 1063 in a respective U-shaped track 1044, with slide wall 1063 seating on elongated lower plate 1046 thereof, rather than sliding into the connecting panel as with prior embodiments. In this position, measuring markings or gradations 1115 and 1117 are adjacent each other, so that connecting panel 1060 can be accurately positioned in the lengthwise direction of modified adjustment support member 1040. Then, screws 1096 (FIG. 48) are inserted through elongated slots 1065 into lower plate 1046, but not finally tightened. It will be appreciated that inwardly turned lip 1050 aids in preventing escape of slide walls 1063 during this procedure. The connecting panel 1060 is then adjusted in the widthwise direction by reason of elongated slots 1065, and screws 1096 are fully tightened to secure the connecting panel 1060 in position. Further, screws 1096 can be loosened and connecting panels 1060 can be adjusted in position, for example, to allow adjustment for expansion and contraction of materials. Also, with this arrangement, connecting panels 1060 can be removed at any time and replaced, whereas in prior embodiments where there is a sliding in arrangement, this cannot occur.

Further, in FIG. 48A, there are shown a rain screen starter 1069, rain screen stiffener 1070 and rain screen base connector 1071. The rain screen system allows air and water behind the panels.

Figure 49:
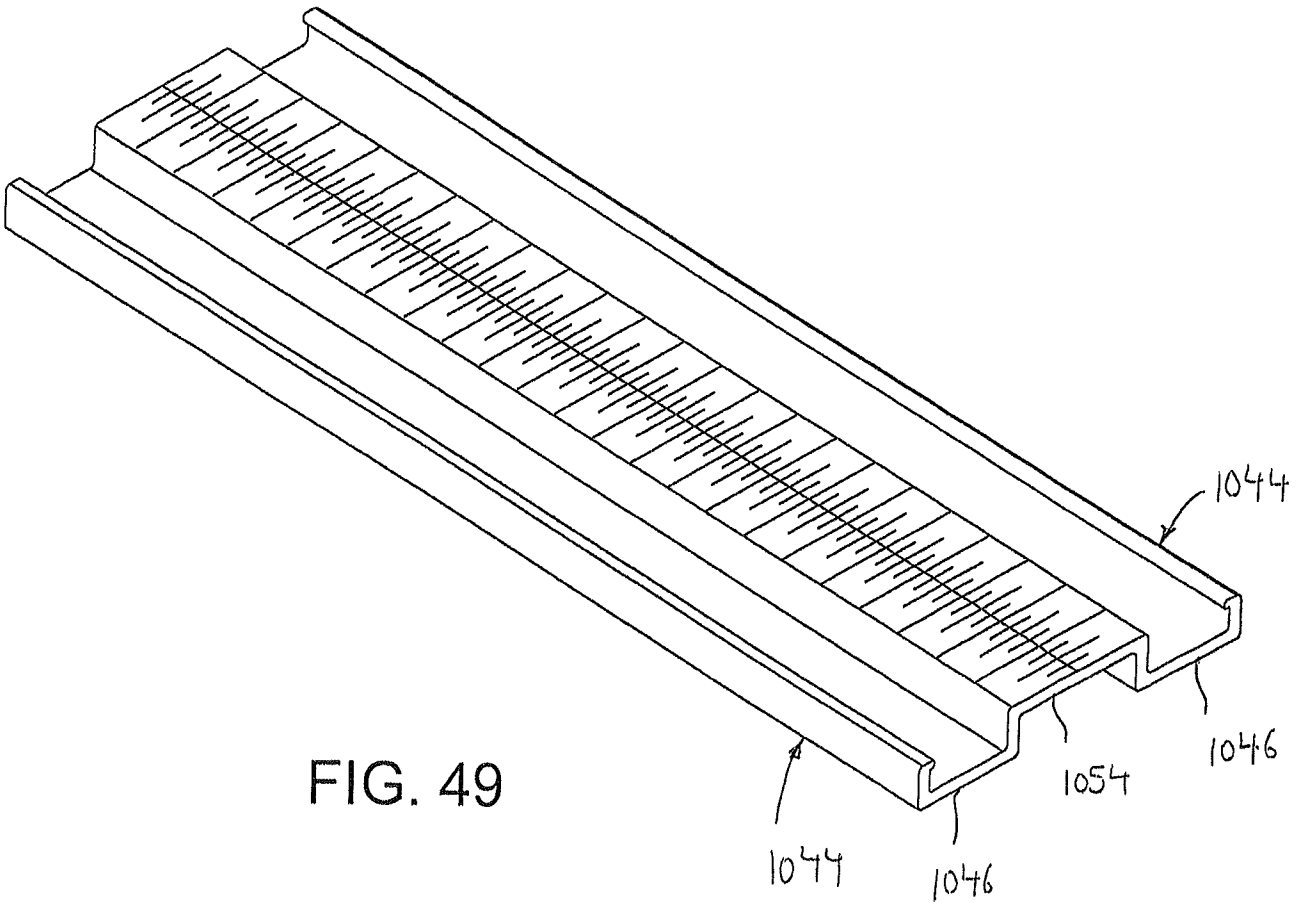
FIG. 49 is a perspective view of a modified adjustment support member according to another embodiment of the present invention.

Of course, as shown in FIG. 49, it will be appreciated that elongated rectangular plate 1042 of the adjustment support member can be eliminated, with lower plates 1046 and/or rectangular platform wall 1054 secured directly to an existing wall, in a similar manner as discussed above with respect to FIGS. 28 and 29.

Figure 50:
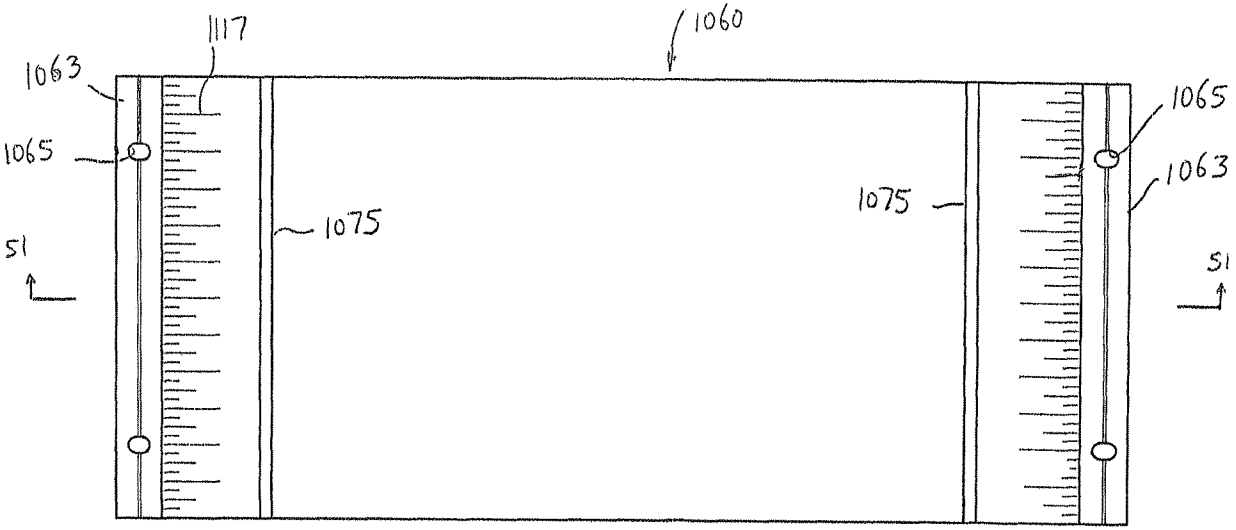
FIG. 50 is a top plan view of a modified connecting panel according to another embodiment of the present invention.
Figure 51:
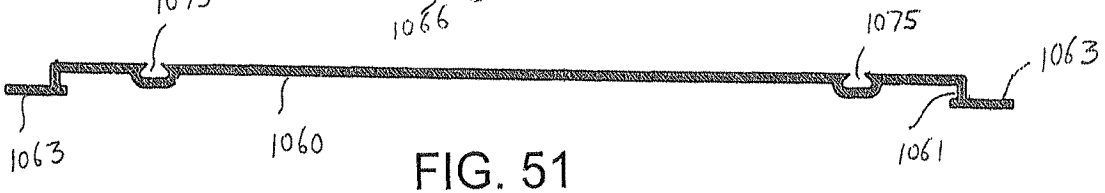
FIG. 51 is a cross-sectional view of the connecting panel of FIG. 50, taken along line 51-51 thereof.
Figure 53:
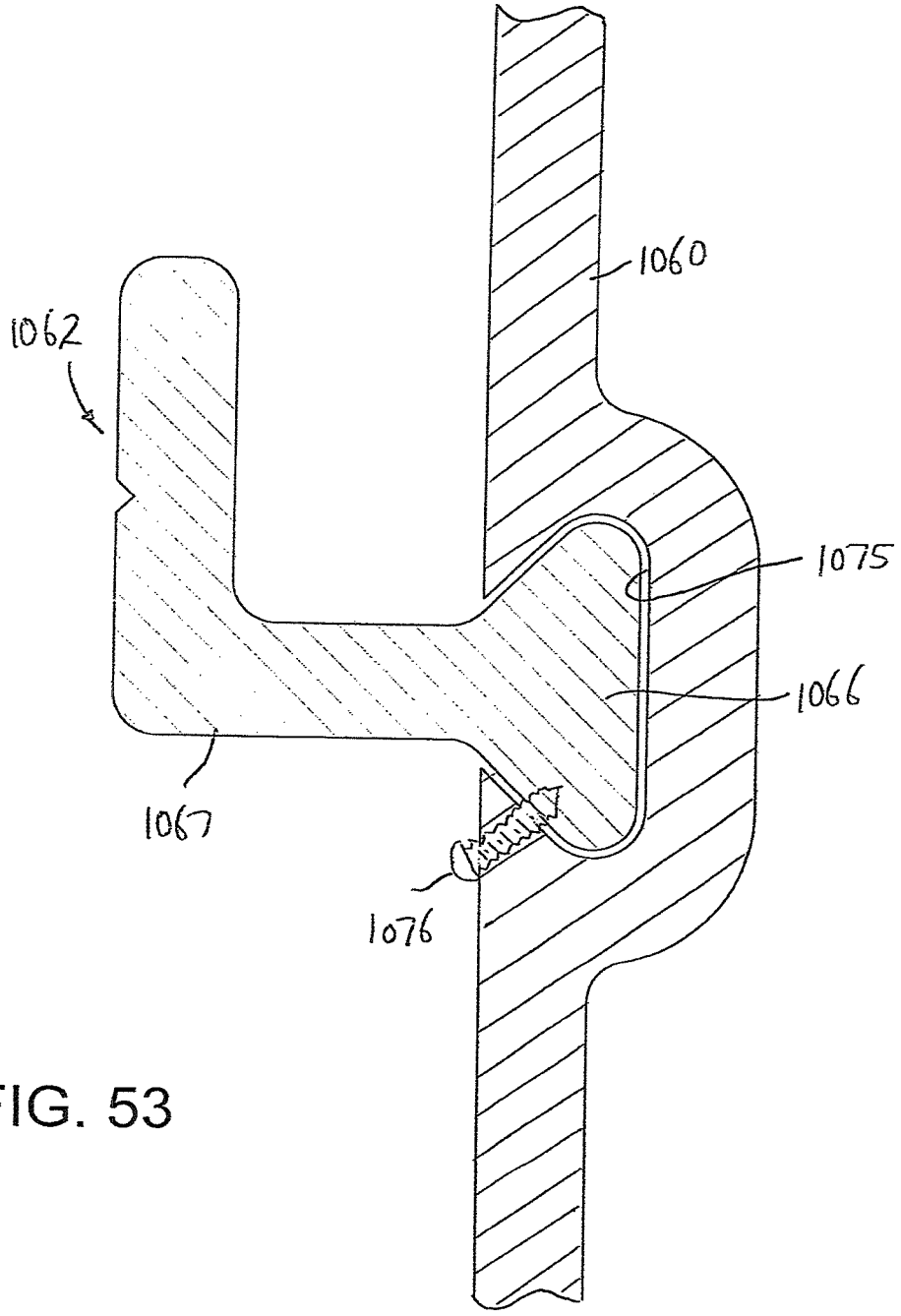
FIG. 53 is an enlarged cross-sectional view showing the hook assembled in a slot of the modified connecting panel of FIG. 50.

It will be appreciated that, preferably, connecting panels 1060 are provided with dovetail shaped slots 1075 extending transversely across the upper surface thereof in the widthwise direction thereof, as shown in FIGS. 50, 51 and 53.

Figure 49A:
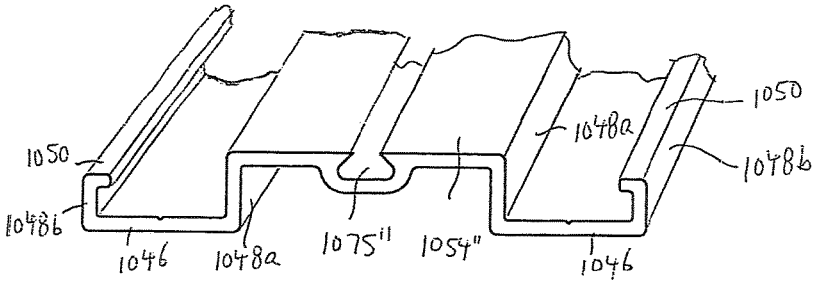
FIG. 49A is a perspective view of a modified adjustment support member according to another embodiment of the present invention.
Figure 52:
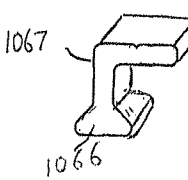
FIG. 52 is a perspective view of a hook for use with the modified connecting panel of FIG. 50.

FIG. 49A shows a modification of the adjustment support member of the embodiment shown in FIG. 49, in which a single dovetail shaped slot 1075", similar to that shown in FIG. 44B and extending along the lengthwise direction of elongated rectangular platform wall 1054", is provided for receiving hooks 1062 of the type shown in FIG. 52.

Figure 49B:
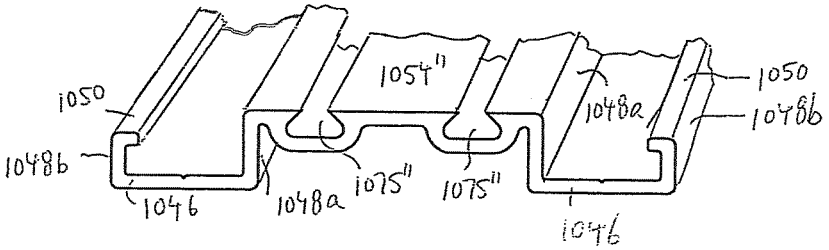
FIG. 49B is a perspective view of a modified adjustment support member according to another embodiment of the present invention.

FIG. 49B shows a further modification of the adjustment support member in which two parallel, spaced apart dovetail shaped slots 1075", similar to those shown in FIG. 44B and extending along the lengthwise direction of elongated rectangular platform wall 1054", are provided for receiving hooks 1062 of the type shown in FIG. 52.

Thus, in accordance with another embodiment of the present invention, as shown in FIGS. 52 and 53, hooks 1062 are slidably inserted into slots 1075. As shown, each hook 1062 includes a dovetail shaped base 1066, with an L-shaped wall 1067 extending outwardly from dovetail shaped base 1066. Once a hook 1062 is slid into a slot 1075 at a desired location, it can be fixed in place by any suitable means. For example, screws (not shown) can be screwed into slots 1075 on opposite sides of the slid-in hook 1062. Alternatively, as shown in FIG. 53, screws 1076 can be screwed through the upper surface of connecting panel 1060 adjacent a slot 1075 and into dovetail shaped base 1066. Still further, screws (not shown) can be screwed through the undersurface of connecting panel 1060 into dovetail shaped base 1066. As a further alternative, stops (not shown) can be inserted into slots 1075 on opposite sides of hooks 1062 to temporarily hold hooks 1062 in position until they are secured in position by screws.

With this arrangement, similar brackets or hooks would be mounted on the rear surface of each planar wall panel for mounting the wall panel on hooks 1062 in the manner discussed above with respect to FIG. 39. For example, complementary hook assemblies 900 (FIGS. 40-42) can be secured to the rear surface of a planar wall panel for connection with hooks 1062 in order to hang the wall panels on hooks 1062.

As a further alternative, short downwardly turned walls 1061 and rectangular slide walls 1063 can be eliminated. In such case, the lengthwise side edges of connecting panel 1060 to the outside of slots 1075 would slide into elongated gap 56 of adjustment support member 40, in the manner described with the previous embodiments.

It will be appreciated that, with the above embodiments, slots 1075 need not be dovetail shaped. For example, they can have any bulbous cross-sectional shape, such as circular, T-shaped, triangular, etc., and in such case, bases 1066 would have complementary shapes.

Figure 54:
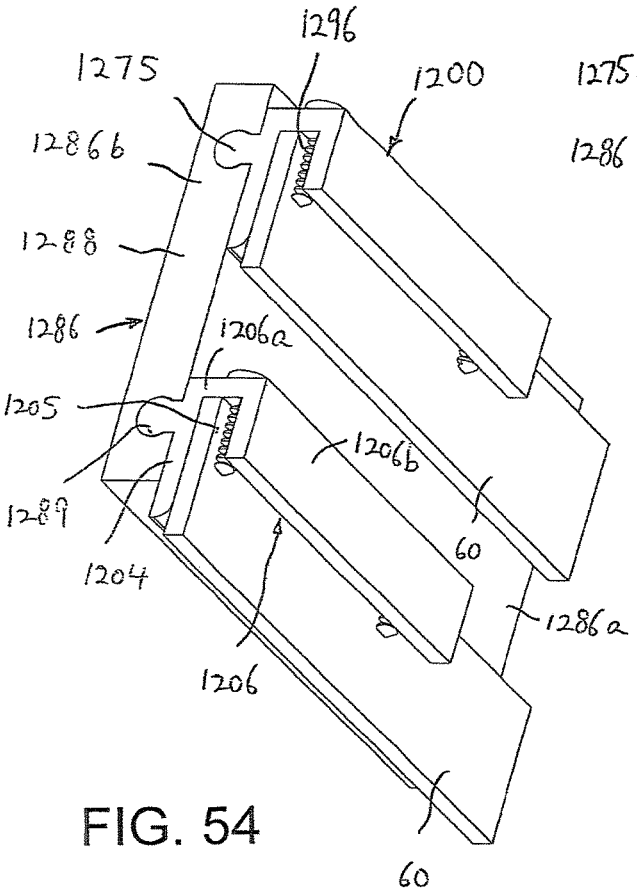
FIG. 54 is a perspective view of a wall panel having hook assemblies mounted thereto and hung on connecting panels.
Figure 55:
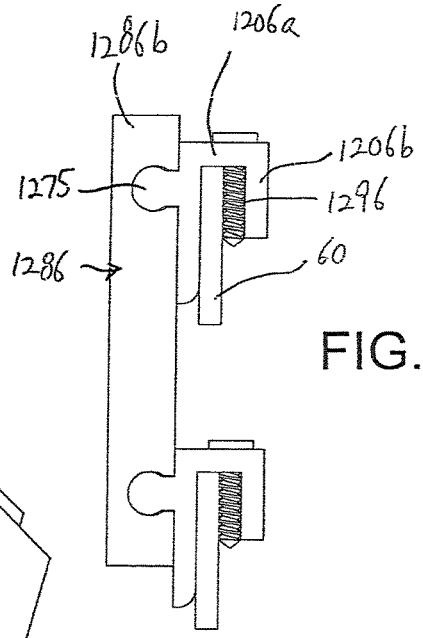
FIG. 55 is a side elevational view of the arrangement of FIG. 54.
Figure 56:
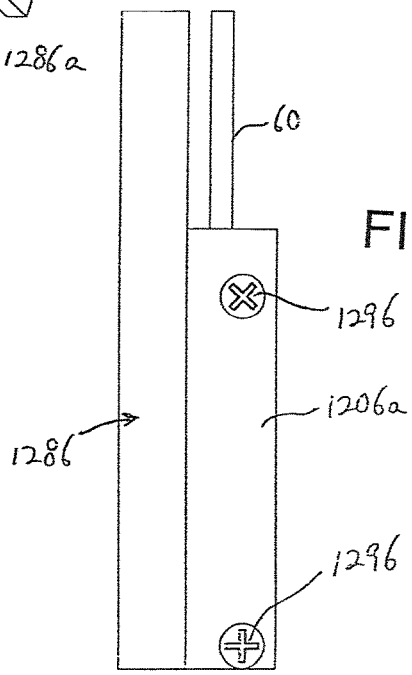
FIG. 56 is a top plan view of the arrangement of FIG. 54.

Referring now to FIGS. 54-56, a wall panel 1286 having only an outer exposed panel section 1288, that is, with the inwardly extending L-shaped connecting walls eliminated, includes elongated transverse cylindrical grooves 1289 therein which open to the rear surface 1286*a* of wall panel 1286 and to at least one side edge 1286*b* thereof, and preferably to both side edges thereof.

Hook assemblies 1200 are mounted to the rear surface of wall panel 1286. Specifically, each hook assembly 1200 includes an elongated rectangular wall 1204 that lies flush against the rear surface 1286*a* of wall panel 1286. The lower surface of elongated rectangular wall 1204 includes an elongated cylindrical projection 1275 that fits within elongated transverse cylindrical grooves 1289 so as to secure hook assemblies 1200 to the rear of wall panels 1286. An L-shaped hook wall 1206 extends rearwardly from one free lengthwise edge of elongated rectangular wall 1204 so as to define an open area 1205 between elongated rectangular wall 1204 and L-shaped hook wall 1206. L-shaped hook wall 1206 includes a first wall 1206*a* that extends rearwardly from the free lengthwise edge of elongated rectangular wall 1204 and a second wall 1206*b* that extends in parallel, spaced apart relation to elongated rectangular wall 1204.

With this arrangement, L-shaped hook walls 1206 are shown positioned over connecting panels 60 in order to hang wall panels 1286 thereon. In order to lock wall panels 1286 thereon, screws 1296 are screwed through first wall 1206*a* to a position between second wall 1206*b* and connecting panel 60 positioned in open area 1205 in order to wedge lock wall panels 1286 to hook assemblies 1200.

It will be appreciated that, although projections 1275 have been described as cylindrical, the present invention is not limited thereto, and any other suitable cross-sectional shape can be used, such as dovetail shaped, T-shaped, triangular, etc.

Further, although hook assemblies 1200 have been described as hanging directly from connecting panels 60, they can also hang from hooks or brackets of the type previously described, which are mounted to connecting panels 60.

Referring now to FIGS. 57-60, a modification of the arrangement of FIGS. 54-56 is shown.

Specifically, elongated cylindrical projections 1275 and elongated transverse cylindrical grooves 1289 are eliminated. Instead, elongated rectangular wall 1204 is provided with countersunk openings 1204*a* for receiving screws 1276 therein in order to secure the hook assembly 1200 to the rear surface of wall panel 1286. In such case, the upper surface of the head of each screw 1276 is flush with the outer surface of elongated rectangular wall 1204.

In addition, adjustment screws 1297 are screwed through first wall 1206*a* to a position onto the top surface of the connecting panel 60 but merely function to adjust the vertical position of hook assemblies 1200, and thereby, of wall panels 1286, relative to connecting panels 60. Thereafter, securing screws 1296 are screwed into position to wedge lock the wall panel 1286 to the connecting panel 60 in the manner described in the previous embodiment.

Alternatively, in place of countersunk openings 1204*a*, screws 1276 can just be screwed into the front surface of wall panel 1286 into elongated rectangular wall 1204 to secure the two together.

Referring now to FIGS. 61-64, there is shown another embodiment for securing walls panels to an existing wall. Specifically, each wall panel 1386 includes two elongated transverse dovetail shaped grooves 1389 therein which open to the rear surface 1386*a* of wall panel 1386 and to one side edge 1386*b* thereof, and extends for about one-quarter of the width of wall panel 1386.

Connecting panel 1360 is bent to form two parallel, spaced apart, dovetail shaped bent wall sections 1361. The spacing between dovetail shaped bent wall sections 1361 is the same as the spacing between transverse dovetail shaped grooves 1389 so that, when wall panel 1386 is positioned against connecting panel 1360, dovetail shaped bent wall sections 1361 align and open up to transverse dovetail shaped grooves 1389.

With this arrangement, a locking bar 1391 is slid into dovetail shaped bent wall sections 1361 and transverse dovetail shaped grooves 1389, to secure wall panel 1386 to connecting panel 1360. In this regard, locking bar 1391 has a generally hourglass shaped cross-section with a first dovetail shaped section 1391*a* for fitting within transverse dovetail shaped grooves 1389, and a second connected dovetail shaped section 1391*b* for fitting within dovetail shaped bent wall sections 1361. Screws 1393 are then screwed through dovetail shaped bent wall sections 1361 and locking bar 1391 to lock these elements in place relative to each other. Preferably, locking bar 1391 is made of a material, such as polyamide, that is not thermally conductive, that is, that does not transfer heat and cold between the wall panel and the connecting panel.

Of course, it will be appreciated that connecting panels 1360 are connected at their ends to adjustment support members in any of the arrangements previously described, and which is not shown herein.

Further, although grooves 1389 and bent wall sections 1361 have been described as being dovetail shaped, the present invention is not limited thereto, and any other suitable cross-sectional shape can be provided, for example, circular, T-shaped, triangular, etc. Rather, it is only important that a width of each locking bar 1391 at a connecting area between first section 1391*a* and second section 1391*b* be of a lesser dimension than at other areas of portions of first section 1391*a* and second section 1391*b*.

For assembly purposes, wall panel 1386 can be positioned with connecting panel 1360, and then locking bar 1391 is slid into dovetail shaped bent wall sections 1361 and transverse dovetail shaped grooves 1389. Alternatively, first dovetail shaped sections 1391*a* of locking bars 1391 are slid into transverse dovetail shaped grooves 1389, and then dovetail shaped bent wall sections 1361 are slid onto second dovetail shaped sections 1391*b* of locking bars 1391. As a further alternative, second dovetail shaped sections 1391*b* of locking bars 1391 are slid into dovetail shaped bent wall sections 1361, and then, transverse dovetail shaped grooves 1389 are slid onto first dovetail shaped sections 1391*a* of locking bars 1391.

Figure 61:
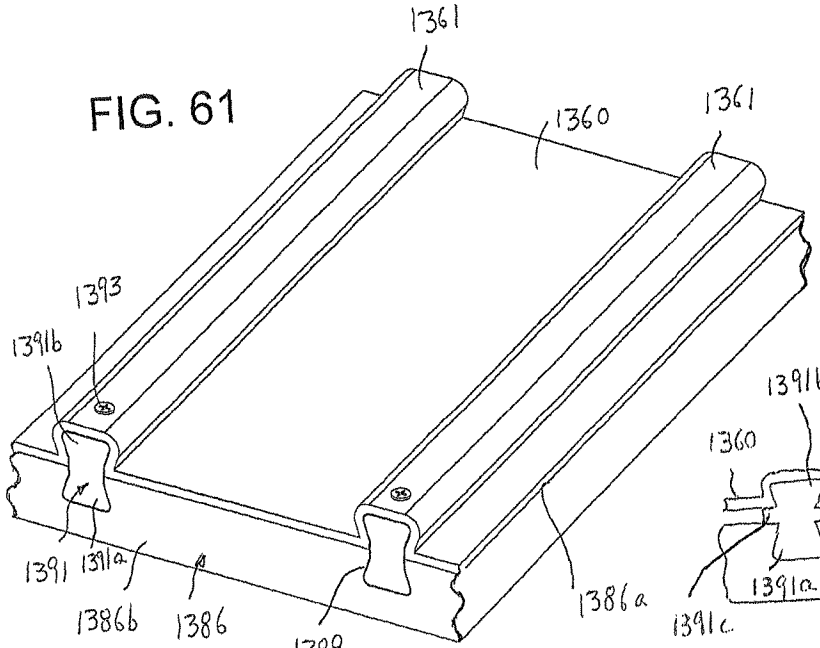
FIG. 61 is a perspective view of a further embodiment of the present invention for securing the wall panels to the connecting panels.
Figure 64:
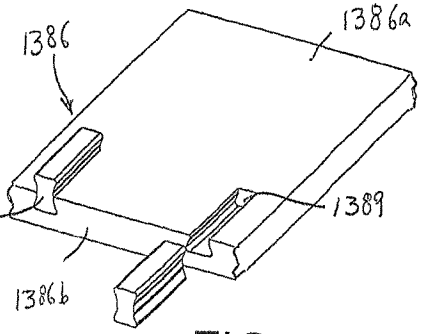
FIG. 64 is a perspective view of the further embodiment of FIG. 61, with the connecting panel removed.
Figure 61A:
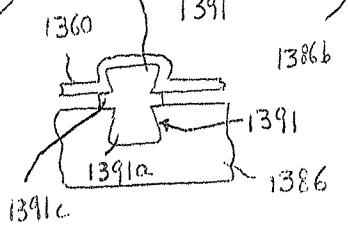
FIG. 61A is a side elevational view of a modification of the embodiment of FIG. 61.
Figure 67:
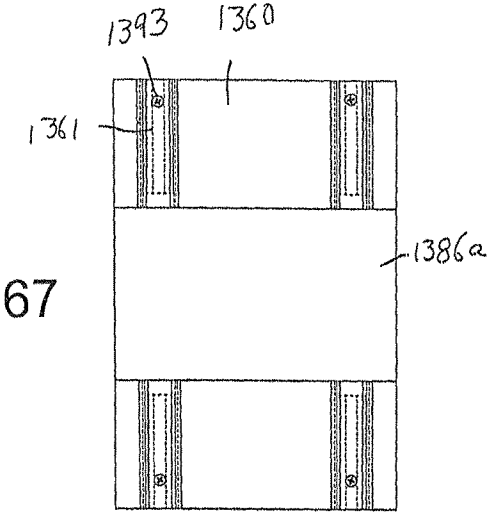
FIG. 67 is a top plan view of the further embodiment of FIG. 66.
Figure 68:
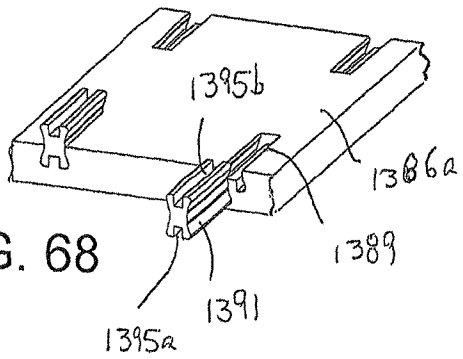
FIG. 68 is a perspective view of the further embodiment of FIG. 66, with the connecting panel removed.
Figure 66:
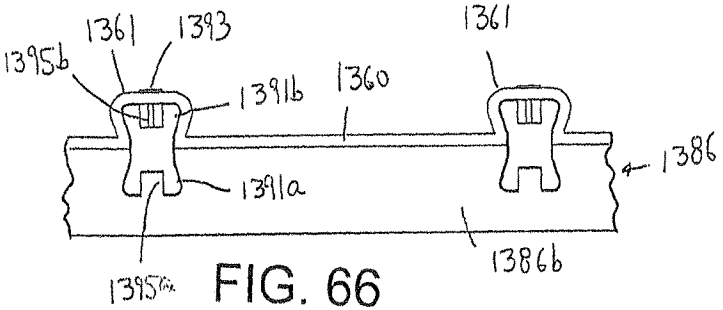
FIG. 66 is a side elevational view of the further embodiment of FIG. 66.

A further modification is shown in FIG. 61A in which first dovetail shaped sections 1391*a* and second dovetail shaped sections 1391*b* are connected together by a spacer section 1391*c* to separate connecting panel 1360 from wall panel 1386 by an air gap therebetween. Again, in such case, locking bars 1391 are made of a thermally isolated material such as polyamide, an equivalent thereof or any other suitable material.

FIGS. 65-68 show a modification of the further embodiment of FIG. 61. Specifically, a parallel, spaced apart pair of transverse dovetail shaped grooves 1389 is provided on each side of wall panel 1386, and two narrower, spaced apart connecting panels 1360 are mounted thereto in the manner described above.

Further, the free lower surface of each first dovetail shaped section 1391*a* of locking bar 1391 is provided with an elongated recess 1395*a* therein, and the free upper surface of each second dovetail shaped section 1391*b* of locking bar 1391 is provided with an elongated recess 1395*b* therein. Therefore, locking bar 1391 has an essentially H-shape in cross-section. This enables screws 1393 to more easily be screwed through locking bar 1391 into wall panel 1386 before being assembled with connecting panels 1360.

Figure 65:
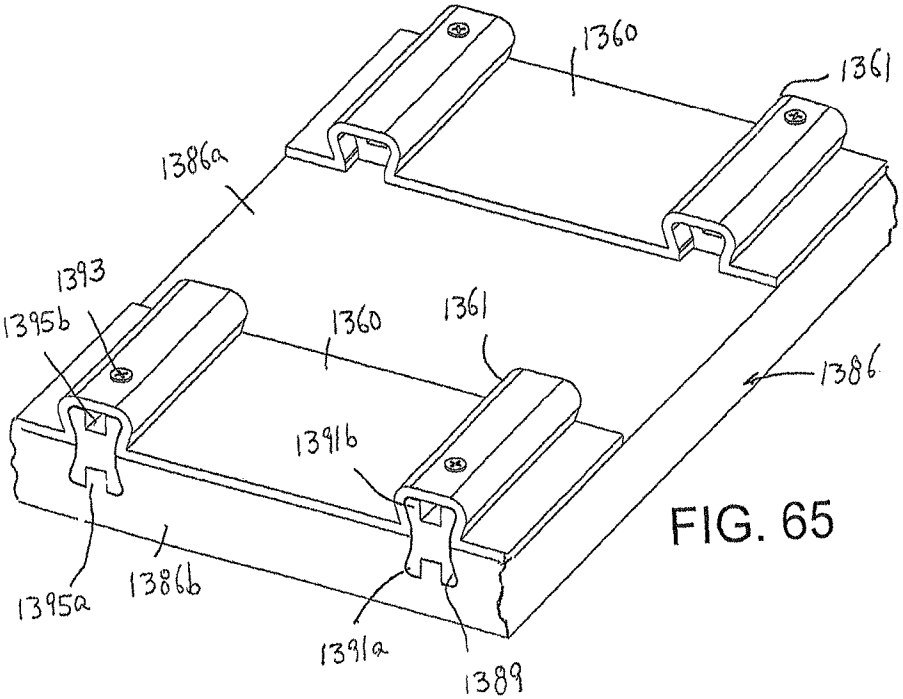
FIG. 65 is a perspective view of a modification of the further embodiment of FIG. 61.
Figure 71:
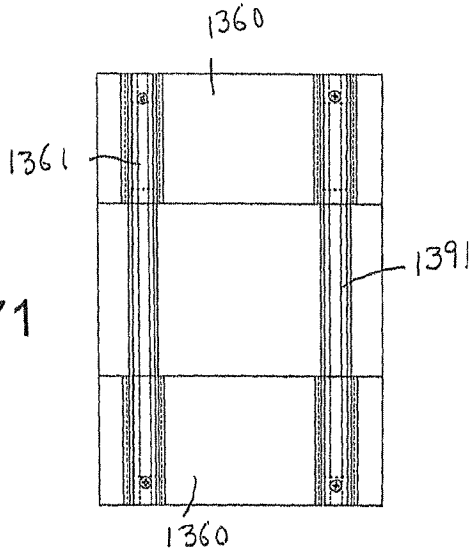
FIG. 71 is a top plan view of the further embodiment of FIG. 69.
Figure 72:
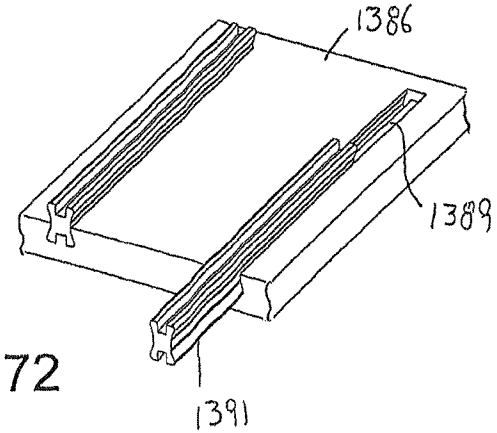
FIG. 72 is a perspective view of the further embodiment of FIG. 69, with the connecting panel removed.
Figure 70:
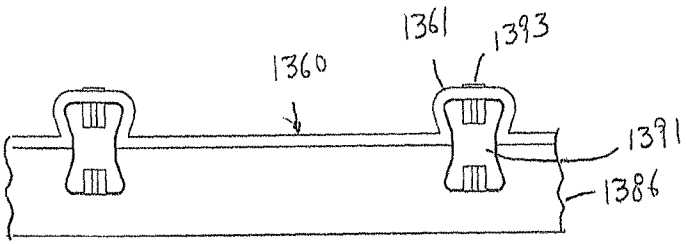
FIG. 70 is a side elevational view of the further embodiment of FIG. 69.
Figure 69:
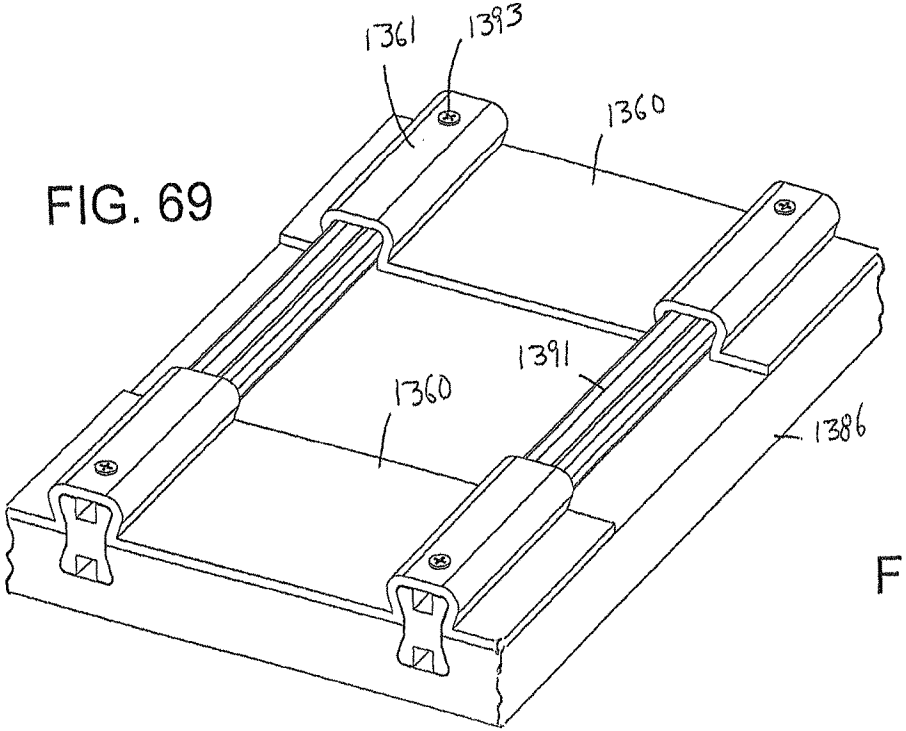
FIG. 69 is a perspective view of a modification of the further embodiment of FIG. 65.

FIGS. 69-72 show a modification of the further embodiment of FIG. 65. Specifically, there is only one pair of parallel, spaced apart transverse dovetail shaped grooves 1389, but they extend almost the entire width of wall panel 1386, and the length of locking bars 1391 is thereby also increased accordingly.

Figure 73:
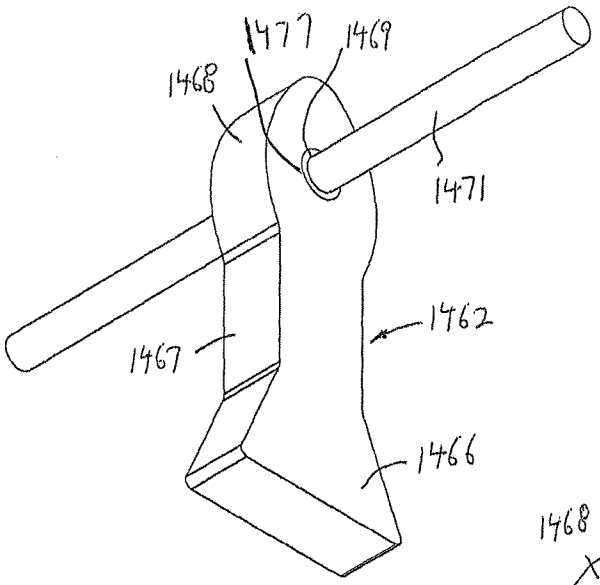
FIG. 73 is a perspective view of a hanging member that can be used to assembly a wall panel with a connecting panel.
Figure 75:
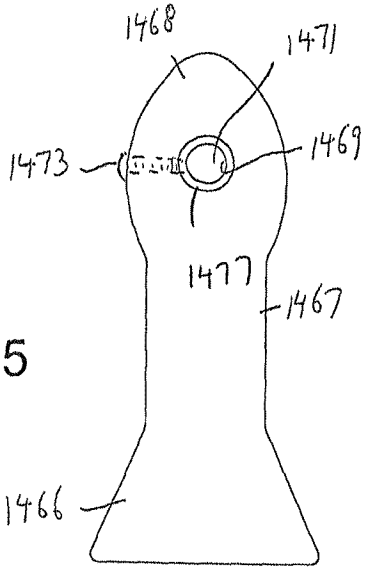
FIG. 75 is a front elevational view of the hanging member of FIG. 73.
Figure 74:
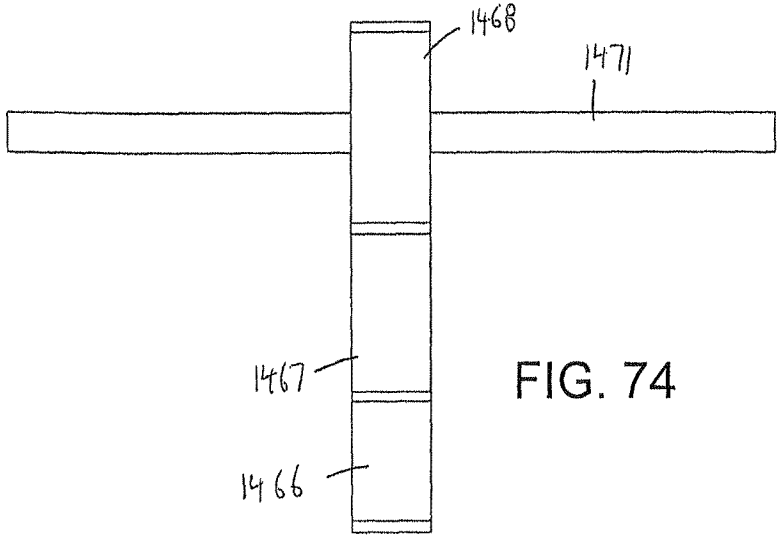
FIG. 74 is a side elevational view of the hanging member of FIG. 73.
Figure 76:
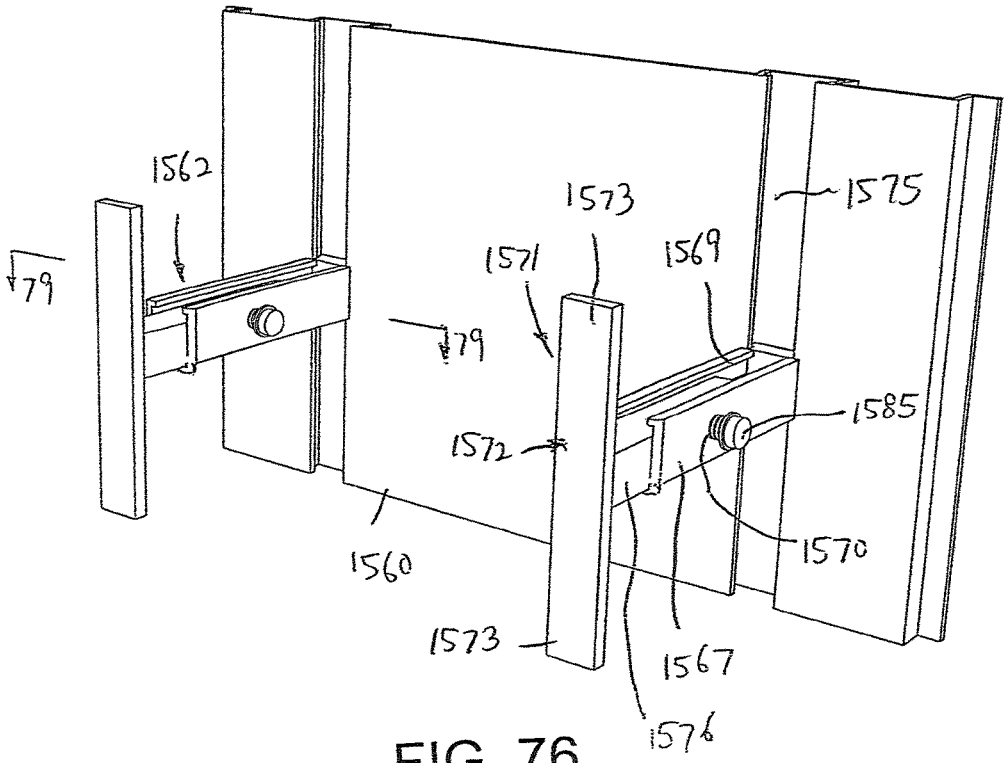
FIG. 76 is a perspective view of a hanging member that can be used to assembly a wall panel with a connecting panel.
Figure 77:
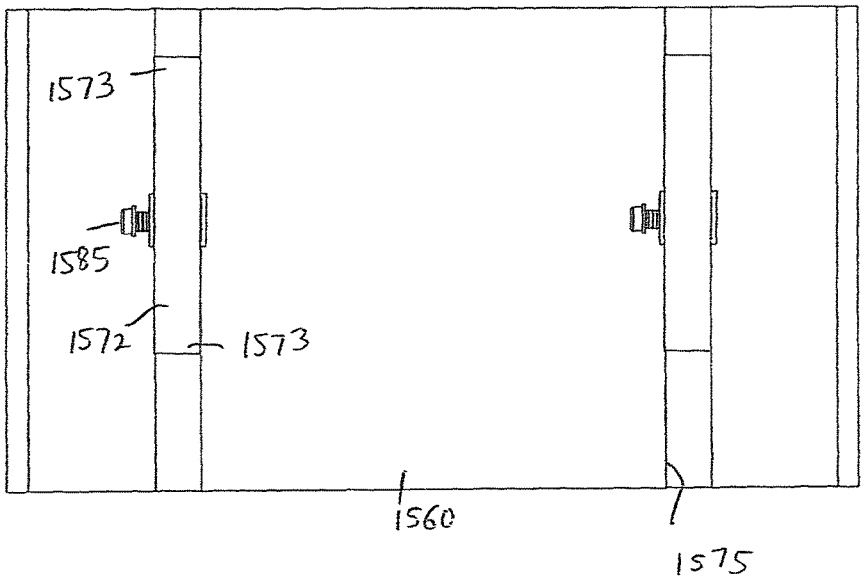
FIG. 77 is a top plan view of the hanging member of FIG. 76.
Figure 78:
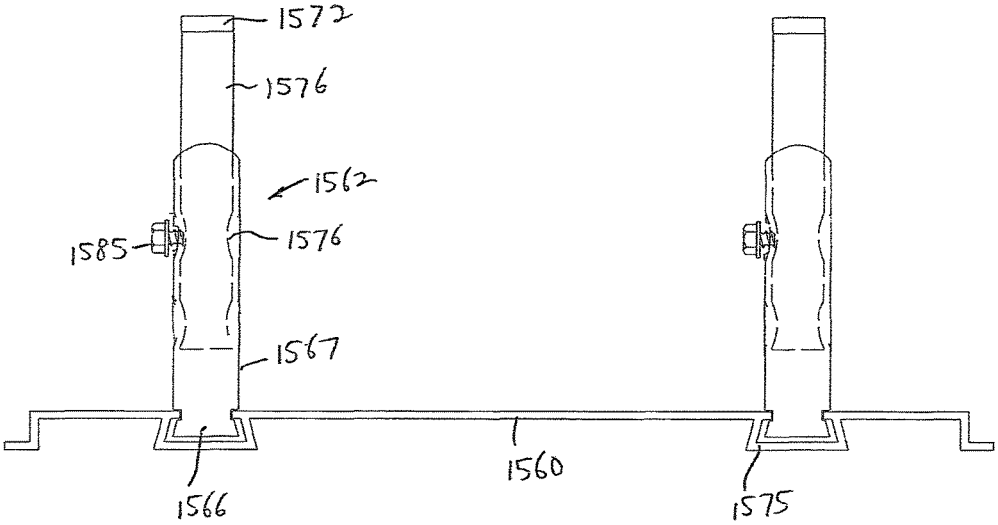
FIG. 78 is a side elevational view of the hanging member of FIG. 76.
Figure 79:
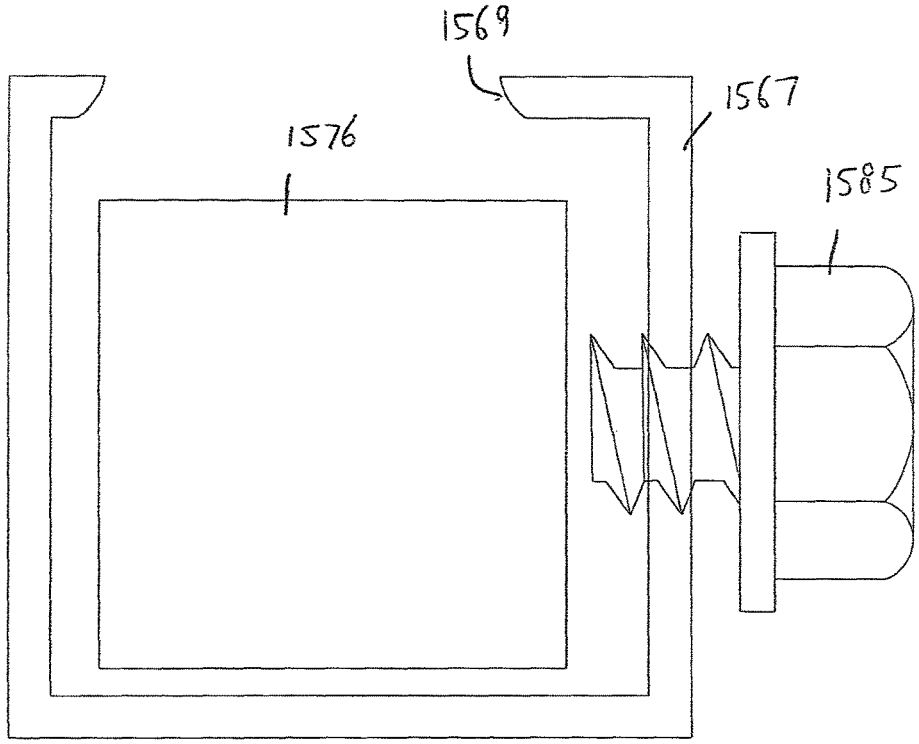
FIG. 79 is a cross-sectional view of FIG. 76, taken along line 79-79 thereof.
Figure 80:
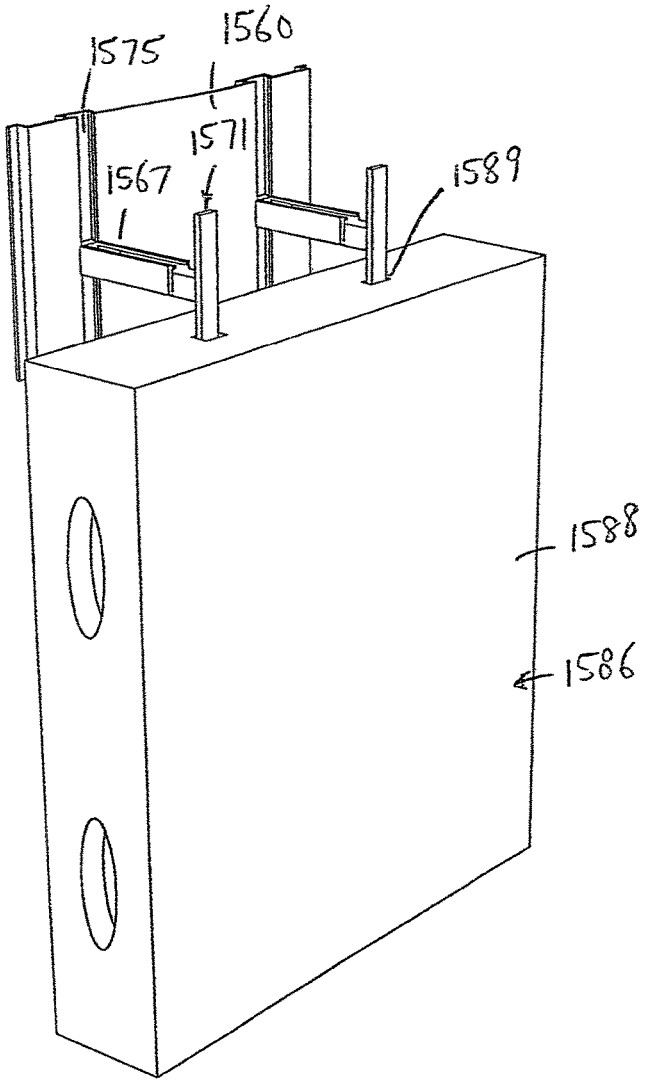
FIG. 80 is a perspective view of the hanging member of FIG. 76 assembled with a wall panel.

Referring now to FIGS. 73-75, there is shown another embodiment for securing walls panels to an existing wall. Specifically, in place of hooks 1062, hanging members 1462 are provided. Each hanging member 1462 includes a dovetail shaped base 1466, which continues outwardly with a center rectangular extension wall section 1467 and terminating at a bulbous extension wall section 1468, having a through opening 1469 extending therethrough.

With this embodiment, dovetail shaped base 1466 is slid into a slot 1075 of a connecting panel 1060 to a desired location, and it can be fixed in place by any suitable means, for example, as previously described relative to hooks 1062. A rod 1471 is then inserted through opening 1469. Rod 1471 can be secured in position by any suitable means. For example, each opening 1469 can have a rubber grommet 1477 to hold rod 1471. Alternatively, a tightening set screw 1473 extends through bulbous wall section 1468, as shown in FIG. 75.

Figure 57:
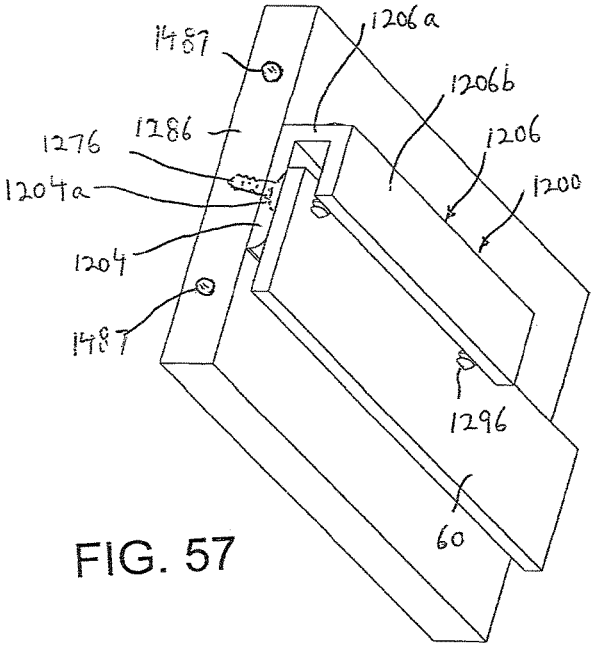
FIG. 57 is a perspective view of a wall panel having modified hook assemblies mounted thereto and hung on connecting panels.
Figure 58:
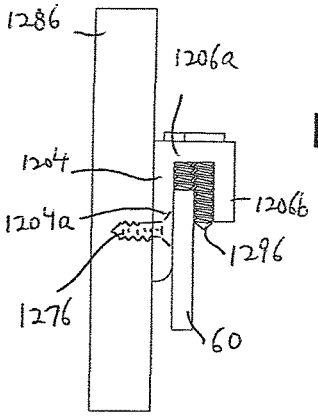
FIG. 58 is a side elevational view of the arrangement of FIG. 57.
Figure 59:
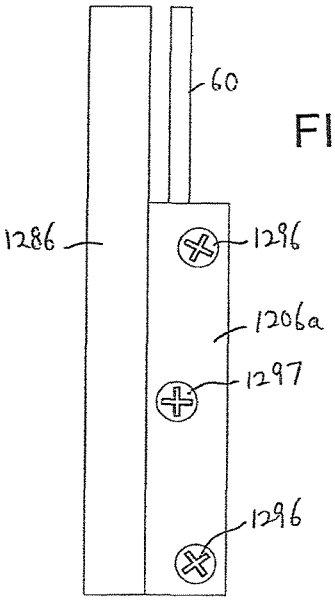
FIG. 59 is a top plan view of the arrangement of FIG. 57.
Figure 60:
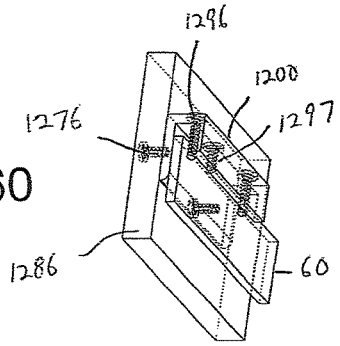
FIG. 60 is a perspective view of the arrangement of FIG. 57, showing a modification of securement of the hook assembly to the wall panel.
Figure 63:
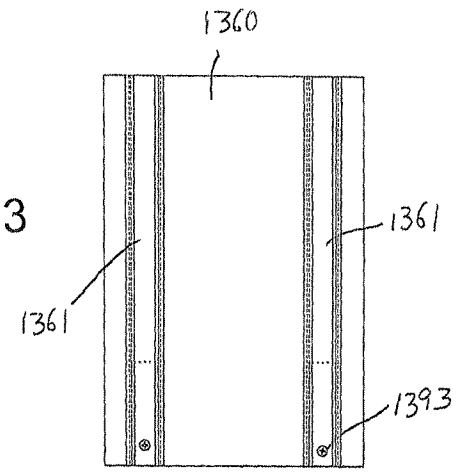
FIG. 63 is a top plan view of the further embodiment of FIG. 61.
Figure 62:
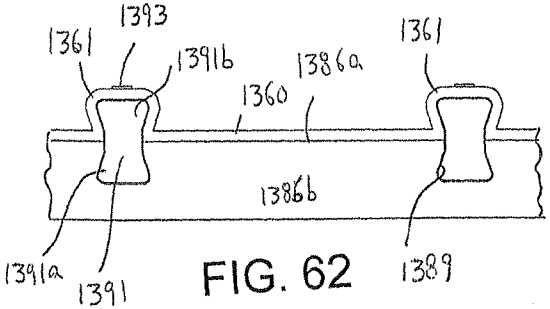
FIG. 62 is a side elevational view of the further embodiment of FIG. 61.

With this embodiment, the wall panels would have through openings 1487 therethrough, as shown in wall panels 1286 in FIG. 57, through which rods 1471 would extend for mounting the wall panels. Of course, set screws can extend through the wall panels for securing the rods 1471 therein.

Referring now to FIGS. 76-80, there is shown another embodiment for securing walls panels to an existing wall. Specifically, in place of hanging members 1462, hanging members 1562 are provided. Each hanging member 1562 includes a dovetail shaped base 1566, which continues outwardly with a peripheral rectangular wall housing 1567. An elongated slot 1569 is provide along the length of rectangular wall 1567 at one side, although this is not required by the present invention. Further, a threaded opening 1570 is provided in one side of rectangular wall 1567.

A T-shaped securing member 1571 is provided and includes a rectangular slide member 1576 slidably positioned within rectangular wall 1567, and a rectangular securing plate 1572 mounted centrally to the free end of rectangular slide member 1576 so as to define tabs 1573 extending to opposite sides of rectangular slide member 1576. Rectangular slide member 1576 can be selectively secured at a desired height within rectangular wall 1567 by adjusting the position of rectangular slide member 1576 therein, and then securing the position by a bolt or screw 1585 extending through threaded opening 1570 into engagement with a side of rectangular slide member 1576. To aid in such securement, rectangular slide member 1576 preferably has a plurality of spaced depressions 1576*a* along the length thereof.

Each wall panel 1586 is formed from a single panel member 1588 having slots 1589 at opposite side edges thereof. As a result, with dovetail shaped bases 1566 secured in dovetail shaped slots 1575 of a connecting panel 1560, and with the height of rectangular slide member 1576 adjusted and secured in rectangular wall 1567, tabs 1573 are inserted within slots 1589.

Figure 81:
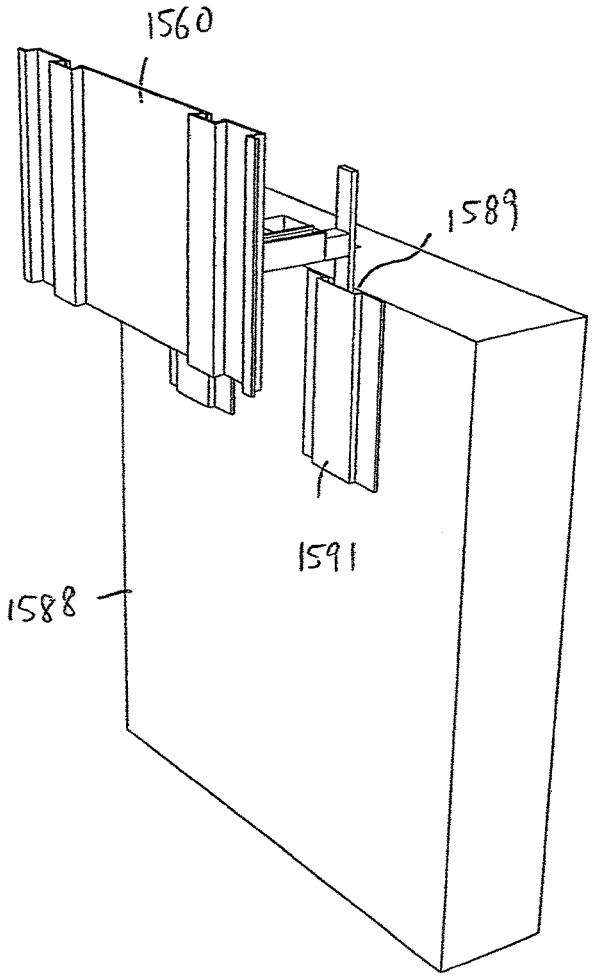
FIG. 81 is a perspective view of the hanging member of FIG. 76 assembled with a wall panel having a bracket.

Alternatively, as shown in FIG. 81, instead of slots 1589 in single panel member 1588, U-shaped brackets 1591 can be secured to the rear surface of single panel member 1588 to create slots 1589.

It will be appreciated that slots 1575 can be oriented vertically, and in such case, a bottom wall panel 1586 is first provided, following by tabs 1573 inserted into slots 1589 in the upper facing edge of bottom wall panel 1586. Then, another wall panel 1586 is positioned to receive the opposite facing tabs 1573 in slots 158 in the lower facing edge of the next wall panel 1586, and so on. Alternatively, slots 1575 can be positioned horizontally, and the same process is performed horizontally.

It will be appreciated that slots 1575 need not be dovetail shaped. For example, they can have any bulbous cross-sectional shape, such as circular, T-shaped, triangular, etc., and in such case, bases 1566 would have complementary shapes.

Figure 82:
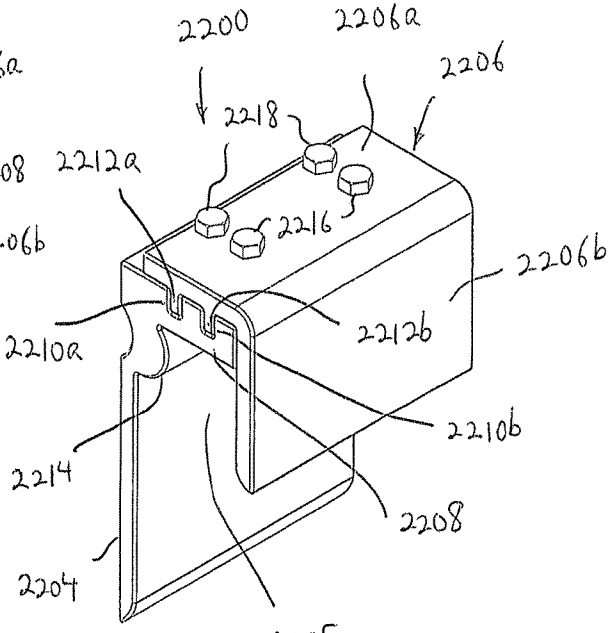
FIG. 82 is a perspective view of a modified hook assembly.
Figure 83:
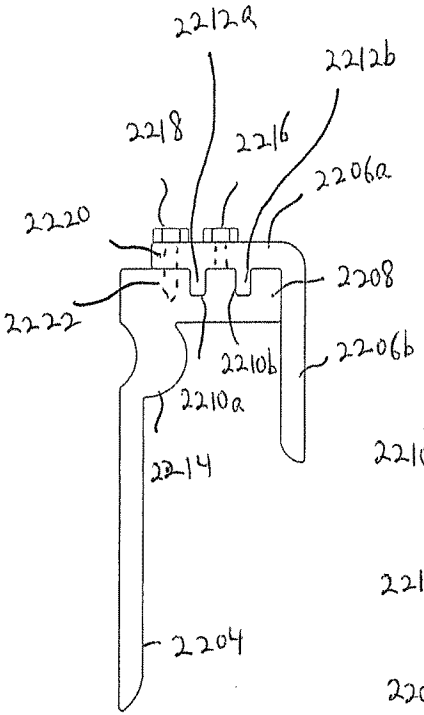
FIG. 83 is a side elevational view of the hook assembly of FIG. 82.
Figure 84:
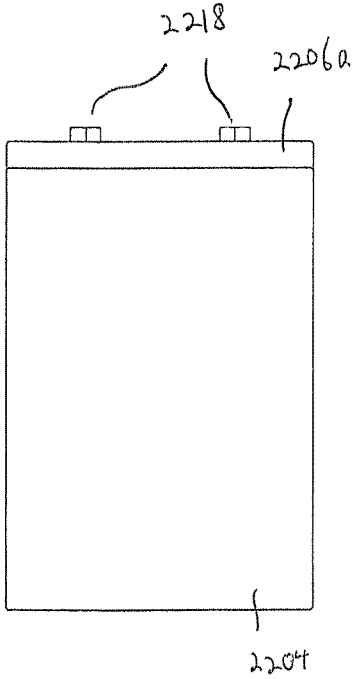
FIG. 84 is a rear elevational view of the hook assembly of FIG. 82.

As shown in FIGS. 82-84, modified hook assemblies 2200 are mounted to the rear surface of wall panel 1286 in the manner shown in FIG. 57. Specifically, each hook assembly 2200 includes an elongated rectangular wall 2204 that lies flush against the rear surface 1286*a* (FIG. 54) of wall panel 1286. As with the embodiment of FIG. 57, elongated rectangular wall 2204 can be provided with countersunk openings (not shown) for receiving screws 1276 therein in order to secure the hook assembly 2200 to the rear surface of wall panel 1286. In such case, the upper surface of the head of each screw 1276 would be flush with the outer surface of elongated rectangular wall 2204.

A support ledge 2208 extends outwardly at a right angle from the upper edge of elongated rectangular wall 2204 and includes two parallel, spaced apart grooves 2210*a* and 2210*b* formed in the upper surface of support ledge 2208 and extending in the lengthwise direction thereof. Although not limited thereto, grooves 2210*a* and 2210*b* preferably have a rectangular cross-section.

An L-shaped hook wall 2206 is mounted on support ledge 2208. Specifically, L-shaped hook wall 2206 includes a first wall 2206*a* that is supported on the upper surface of support ledge 2208 and a second wall 2206*b* that extends from the free edge of first wall 2206*a* in parallel, spaced apart relation to elongated rectangular wall 2204, so as to define an open area 2205 between elongated rectangular wall 2204 and L-shaped hook wall 2206. First wall 2206*a* is provided with two parallel, spaced apart projections 2212*a* and 2212*b* at the lower surface thereof, and extending in the lengthwise direction thereof, for engagement within grooves 2210*a* and 2210*b*, respectively. In this regard, projections 2212*a* and 2212*b* preferably have the same shape and dimensions as grooves 2210*a* and 2210*b*.

With this arrangement, L-shaped hook walls 2206 are positioned over connecting panels 60 in the manner shown in FIGS. 57-60, in order to hang wall panels 1286 thereon. It will be appreciated that, for wall panels 1286 having a greater thickness, projection 2212*a* can fit within groove 2210*b*, and in such case, projection 2212*b* would be positioned adjacent the free end surface of support ledge 2208.

Further, to enable easy entry of a connecting panel 60 within open area 2205, the upper end of the inner surface of elongated rectangular wall 2204 includes an arcuate projection 2214. Arcuate projection 2214 also serves to wedge lock connecting panels 60 to hook assemblies 2200.

With the above arrangement, L-shaped hook wall 2206 can be adjusted in the widthwise and lengthwise directions of support ledge 2208.

In addition, L-shaped hook wall 2206 can also be adjusted in the heightwise direction relative to support ledge 2208. Specifically, set screws 2216 extend through first wall 2206*a* for engaging the upper surface of support ledge 2208, so as to adjust the height of first wall 2206*a* relative to support ledge 2208. Once the desired height is achieved, locking screws 2218, which also extend through first wall 2206*a*, are positioned within openings 2220 of first wall 2206*a*, and threadedly received within threaded openings 2222 of support ledge 2208 to fix L-shaped hook wall 2208 in a desired position relative to support ledge 2208.

Figure 85:
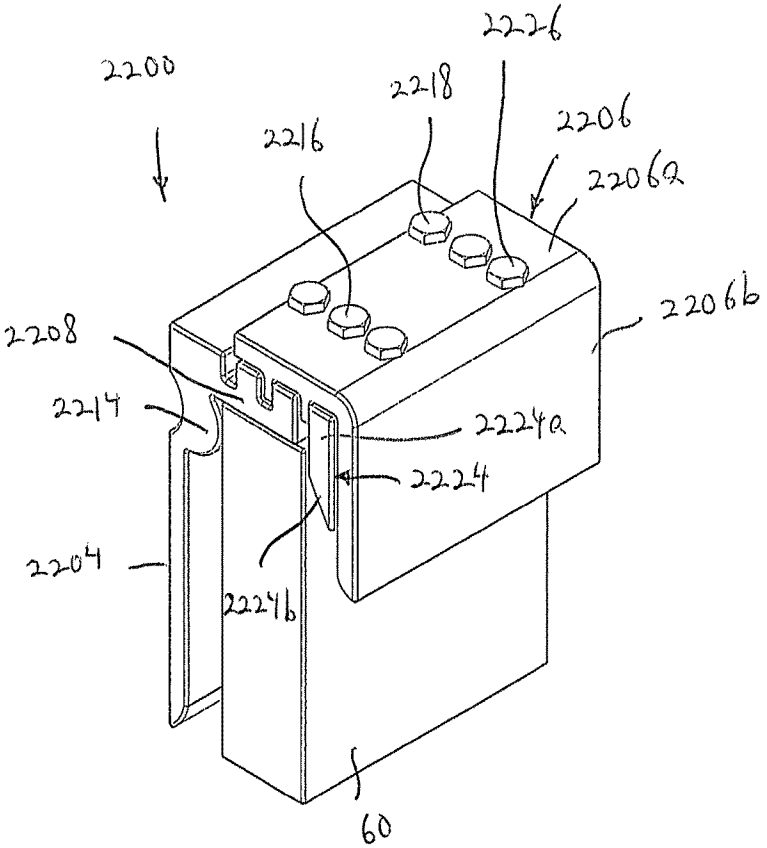
FIG. 85 is a perspective view of another modified hook assembly.
Figure 86:
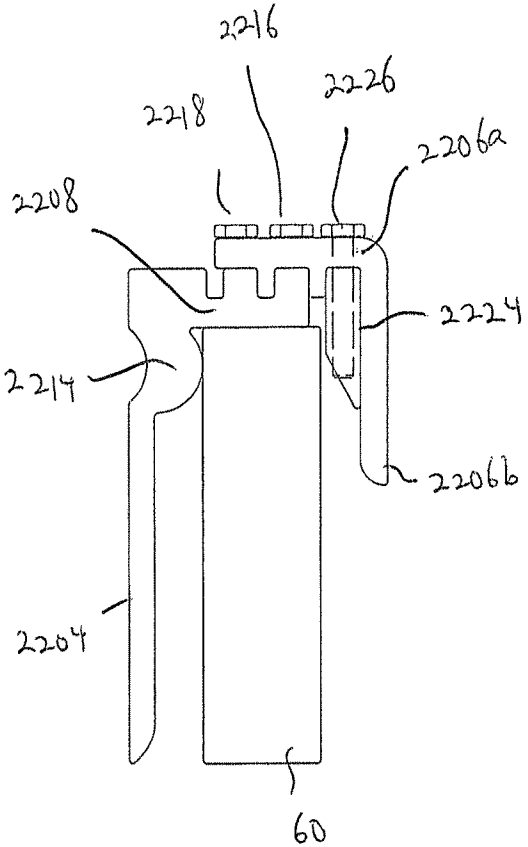
FIG. 86 is a side elevational view of the hook assembly of FIG. 85.

As shown in FIGS. 85 and 86, for wall panels 1286 having a greater thickness, with projection 2212*a* fit within groove 2210*b*, a wedge 2224 is secured to the underside of first wall 2206*a* by screws 2226. Wedge 2224 has an upper section 2224*a* of a generally rectangular cross-sectional configuration which functions to wedge wall panel 1286 between arcuate projection 2214 and upper section 2224*a* of wage 2224, and a lower section 2224*b* of a generally triangular cross-sectional configuration which functions to provide access of the end of a connecting panel 60 into space 2205.

Figure 87:
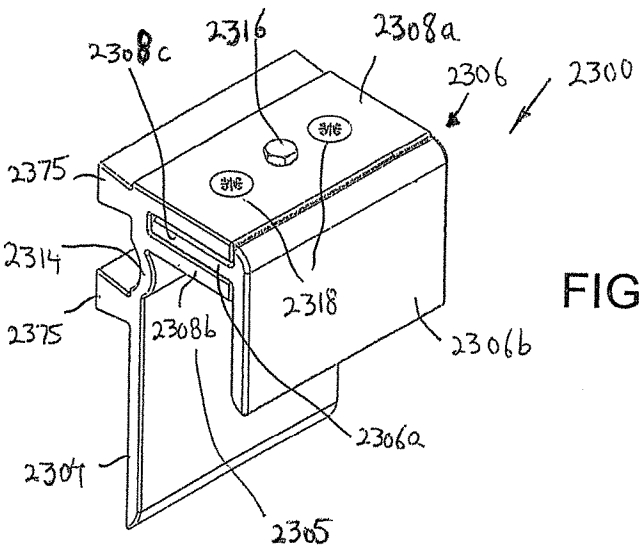
FIG. 87 is a perspective view of still another modified hook assembly.
Figure 88:
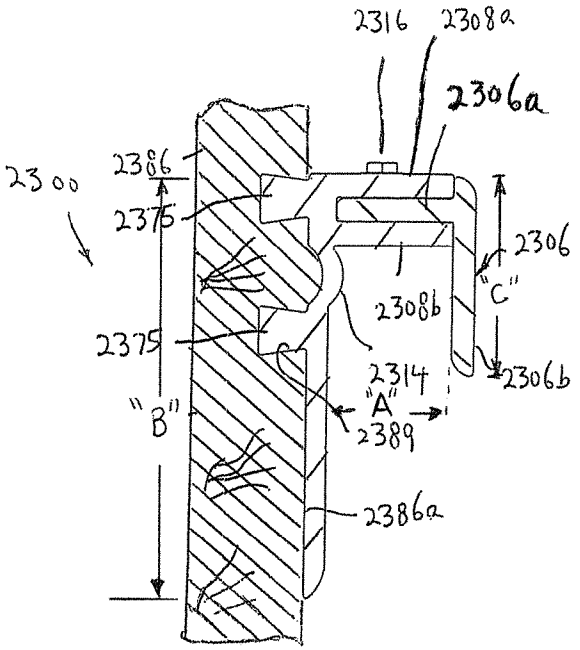
FIG. 88 is a side elevational view of the hook assembly of FIG. 87.
Figure 89:
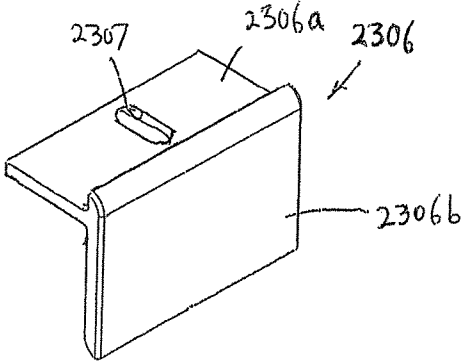
FIG. 89 is a perspective view of the L-shaped hook wall of the hook assembly of FIG. 87.

FIGS. 87-89 show a hook assembly 2300 according to another embodiment of the present invention. Hook assembly 2300 is mounted to the rear surface of wall panel 2386. Specifically, each hook assembly 2300 includes an elongated rectangular wall 2304 that lies flush against the rear surface 2386*a* of wall panel 2386.

The rear surface of elongated rectangular wall 2304 includes elongated projections 2375, each having a trapezoidal cross-sectional configuration that fits within elongated transverse grooves 2389 in rear surface 2386*a* of wall panel 2386 and also having a trapezoidal cross-sectional configuration, so as to secure hook assemblies 2300 to the rear of wall panels 2386. It will be appreciated that, although projections 2375 have been described as having a trapezoidal cross-sectional configuration, the present invention is not limited thereto, and any other suitable cross-sectional shape can be used, such as T-shaped, triangular, circular, etc.

Two parallel, spaced apart support ledges 2308*a* and 2308*b* extend outwardly at right angles from the upper end of elongated rectangular wall 2304 so as to define a space 2308*c* therebetween.

An L-shaped hook wall 2306 is mounted to support ledges 2308*a* and 2308*b*. Specifically, L-shaped hook wall 2306 includes a first wall 2306*a* that is positioned between and supported by support ledges 2308*a* and 2308*b*, and a second wall 2306*b* that extends from the free edge of first wall 2306*a* in parallel, spaced apart relation to elongated rectangular wall 2304, so as to define an open area 2305 between elongated rectangular wall 2304 and L-shaped hook wall 2306. It will be appreciated that second wall 2306*b* extend slightly above the upper surface of first wall 2306*a*, such that when first wall 2306*a* is fully inserted between support ledges 2308*a* and 2308*b*, a portion of second wall 2306*b* that extends above first wall 2306*a*, abuts against the free edge of support ledge 2308*a*.

First wall 2306*a* includes an elongated slot 2307 therein. A guide bolt 2316 is secured within openings in support ledges 2308*a* and 2308*b*, and extends through the elongated slot 2307, in order to guide first wall 2306*a* at different positions between support ledges 2308*a* and 2308*b*. Once the desired position is attained, locking screws 2318 are secured through support ledge 2308*a*, first wall 2306*a* and support ledge 2308*b* to fix L-shaped hook wall 2306 in position.

Further, to enable easy entry of a connecting panel 60 within open area 2305, the upper end of the inner surface of elongated rectangular wall 2304 includes an arcuate projection 2314. Arcuate projection 2314 also serves to wedge lock connecting panels 60 to hook assemblies 2300.

Figure 90:
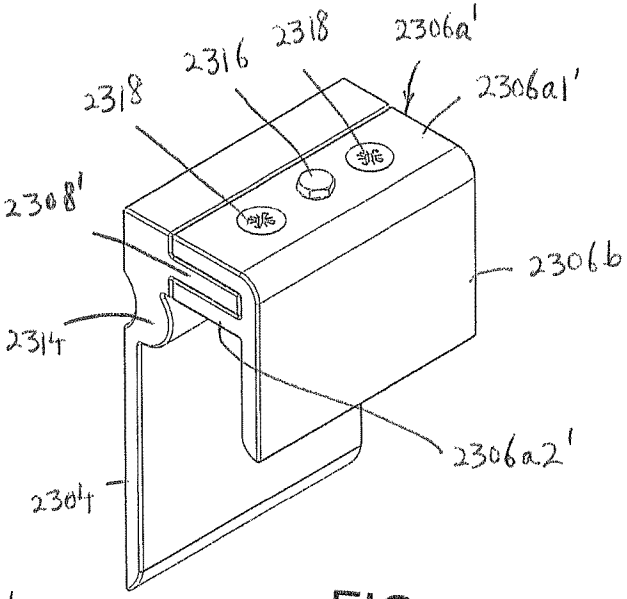
FIG. 90 is a perspective view of a further modified hook assembly.
Figure 91:
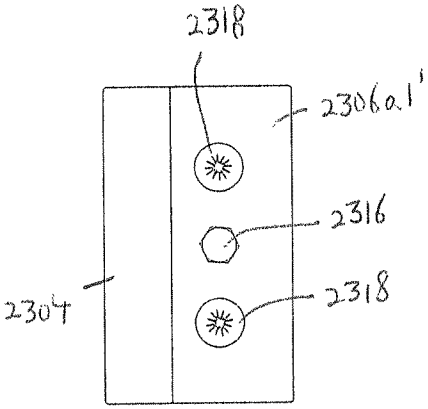
FIG. 91 is a top plan view of the hook assembly of FIG. 90.
Figure 92:
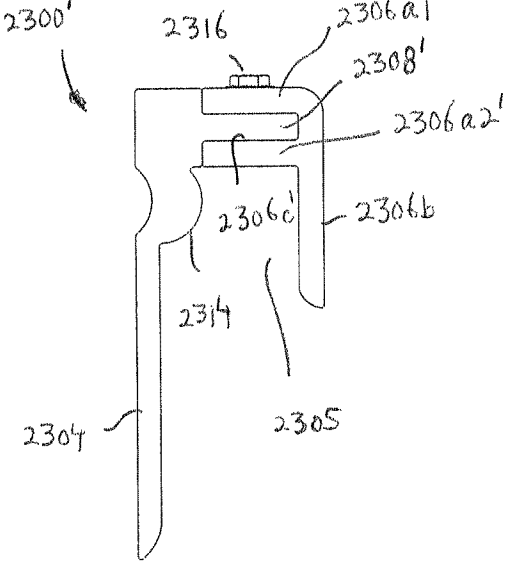
FIG. 92 is a side elevational view of the hook assembly of FIG. 90.

FIGS. 90-92 show a hook assembly 2300' which is identical to hook assembly 2300 except as where indicated below. However, the same reference numerals are used to identify the identical parts.

Hook assembly 2300' differs from hook assembly 2300 by a reversal of parts of first wall 2306*a* and a support ledges 2308*a* and 2308*b*. Specifically, first wall 2306*a'* of hook assembly 2300' is formed by two parallel, spaced apart walls 2306*a*1' and 2306*a*2' which extend outwardly at right angles from the upper end of second wall 2306*b'*, so as to define a space 2306*c'* therebetween. A single support ledge 2308' extends at a right angle from the upper end of elongated rectangular wall 2304. Accordingly, the elongated slot (not shown) similar to elongated slot 2307, is formed in single support ledge 2308'.

Further, as with the embodiment of FIG. 57, elongated rectangular wall 2304 can be provided with countersunk openings (not shown) for receiving screws 1276 therein in order to secure the hook assembly 2300 to the rear surface of wall panel 2386. In such case, the upper surface of the head of each screw 1276 would be flush with the outer surface of elongated rectangular wall 2304.

In all other respects, hook assembly 2300' is constructed and operates in a similar manner to assembly 2300.

Figure 93:
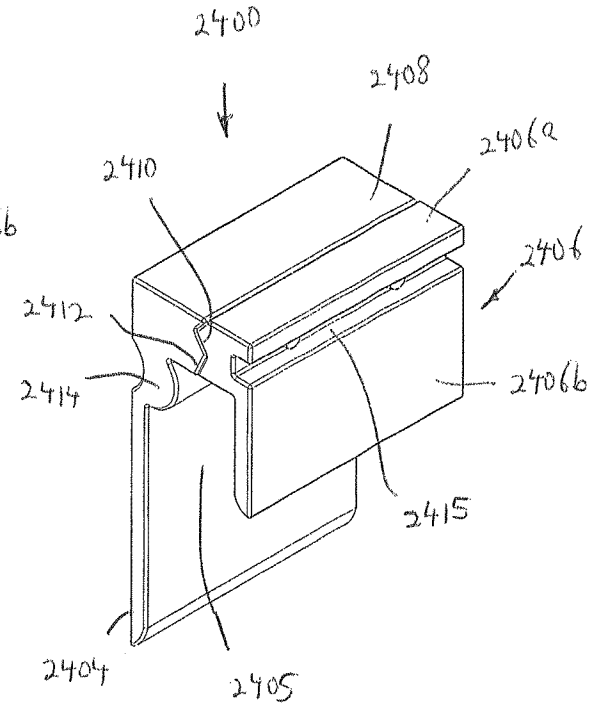
FIG. 93 is a perspective view of a still further modified hook assembly.
Figure 94:
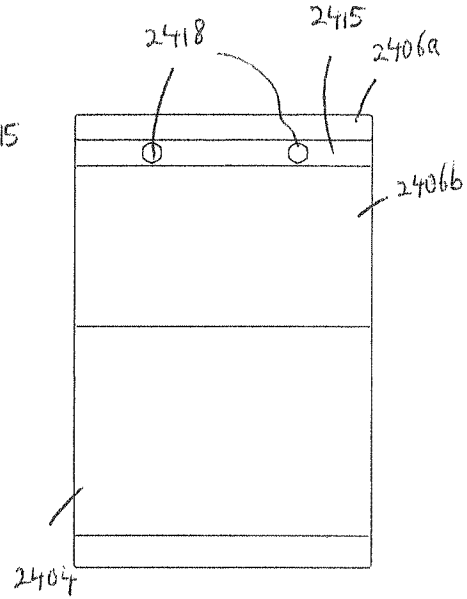
FIG. 94 is a front elevational view of the hook assembly of FIG. 93.
Figure 95:
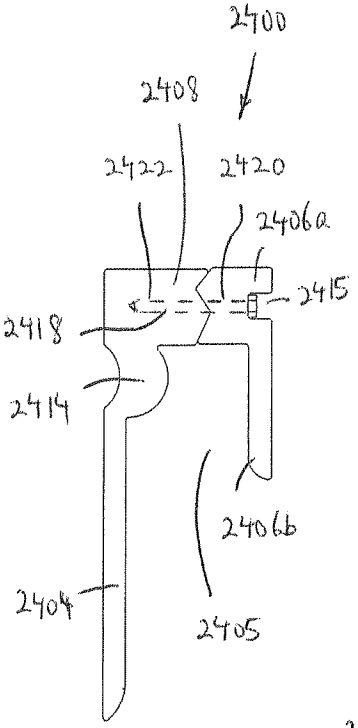
FIG. 95 is a side elevational view of the hook assembly of FIG. 93.

FIGS. 93-95 show a hook assembly 2400 according to another embodiment of the present invention. Hook assembly 2400 is mounted to the rear surface of wall panel 1286. Specifically, each hook assembly 2400 includes an elongated rectangular wall 2404 that lies flush against the rear surface 1286*a* of wall panel 1286. As with the embodiment of FIG. 57, elongated rectangular wall 2404 can be provided with countersunk openings (not shown) for receiving screws 1276 therein in order to secure the hook assembly 2400 to the rear surface of wall panel 1286. In such case, the upper surface of the head of each screw 1276 would be flush with the outer surface of elongated rectangular wall 2404.

A support ledge 2408 extends outwardly at a right angle from the upper edge of elongated rectangular wall 2404 and includes an end face 2410 having a vertical zig-zag configuration.

An L-shaped hook wall 2406 is mounted on support ledge 2408. Specifically, L-shaped hook wall 2406 includes a first wall 2406*a* that is supported on by support ledge 2408 and a second wall 2406*b* that extends from the free edge of first wall 2406*a* in parallel, spaced apart relation to elongated rectangular wall 2404, so as to define an open area 2405 between elongated rectangular wall 2404 and L-shaped hook wall 2406. First wall 2406*a* includes an end face 2412 also having a vertical zig-zag configuration which matches the configuration of end face 2410 so as to mesh therewith. It will be appreciated, however, that any suitable configuration of the end faces can be provided, and the present invention is not limited to zig-zag faces.

A channel 2415 is provided in the outer surface of second wall 2406*b* at a position corresponding to first wall 2406*a* and also extends into first wall 2406*a*. Locking bolts 2418 extend within channel 2415, through a threaded opening 2420 in first wall 2406*a* and into a threaded opening 2422 in the end face of support ledge 2408. Therefore, as locking bolts 2418 are rotated, first wall 2406*a* is move toward or away from support ledge 2408, in order to adjust the position of L-shaped hook wall 2406 relative to support ledge 2408.

Further, to enable easy entry of a connecting panel 60 within open area 2405, the upper end of the inner surface of elongated rectangular wall 2404 includes an arcuate projection 2414. Arcuate projection 2414 also serves to wedge lock connecting panels 60 to hook assemblies 2400.

Referring to FIGS. 96-100, there is shown a hook assembly 1200' which is very similar to hook assembly 1200 of FIGS. 57-60, and the same reference designators are used. Specifically, the width of hook assembly 1200' is narrower than hook assembly 1200 of FIGS. 57-60. Further, there is an opening 1298 for one adjustment screw 1297 and only one opening 1299 for a wedging securing screw 1296.

Figure 96A:
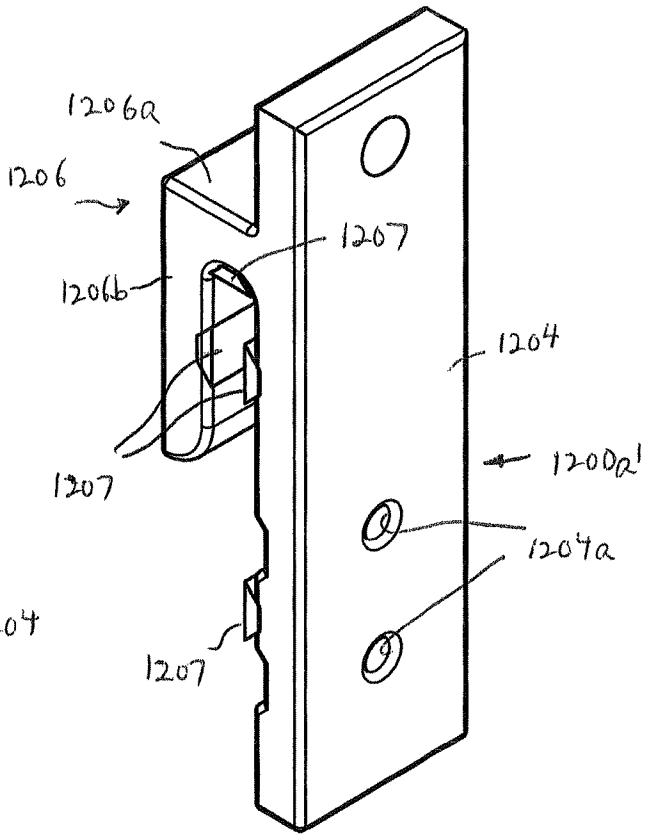
FIG. 96A is a top, rear perspective view of modified hook assembly similar to that of FIG. 96.
Figure 99A:
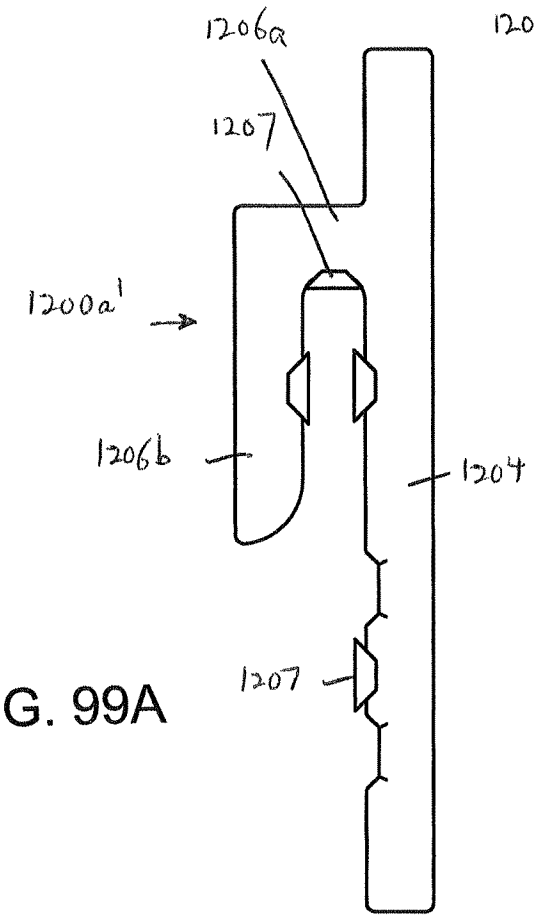
FIG. 99A is a side elevational view of the hook assembly of FIG. 96A.
Figure 103:
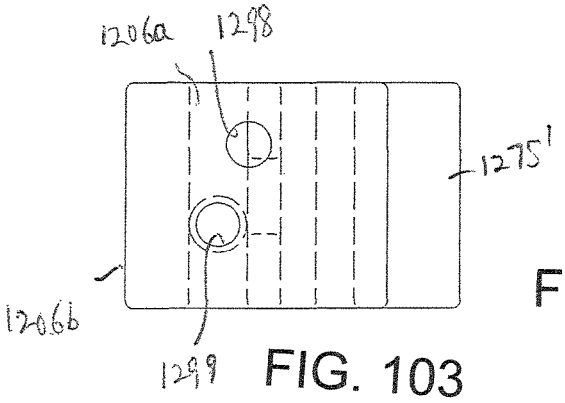
Figure 101:
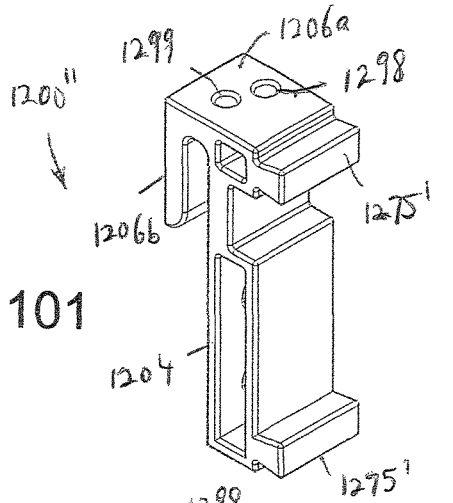
FIG. 101 is a top, front perspective view of a yet further modified hook assembly.
Figure 104:
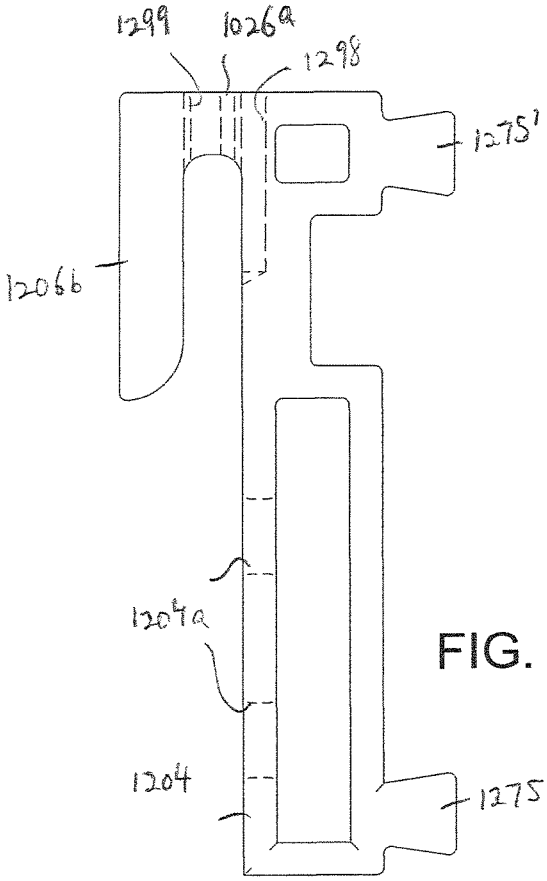
Figure 102:
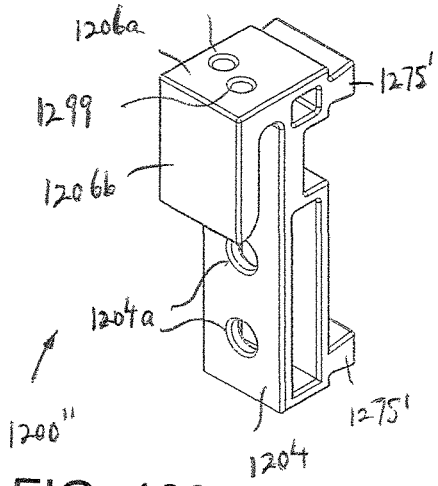
Figures 101A, 102A, 103A, 104A:
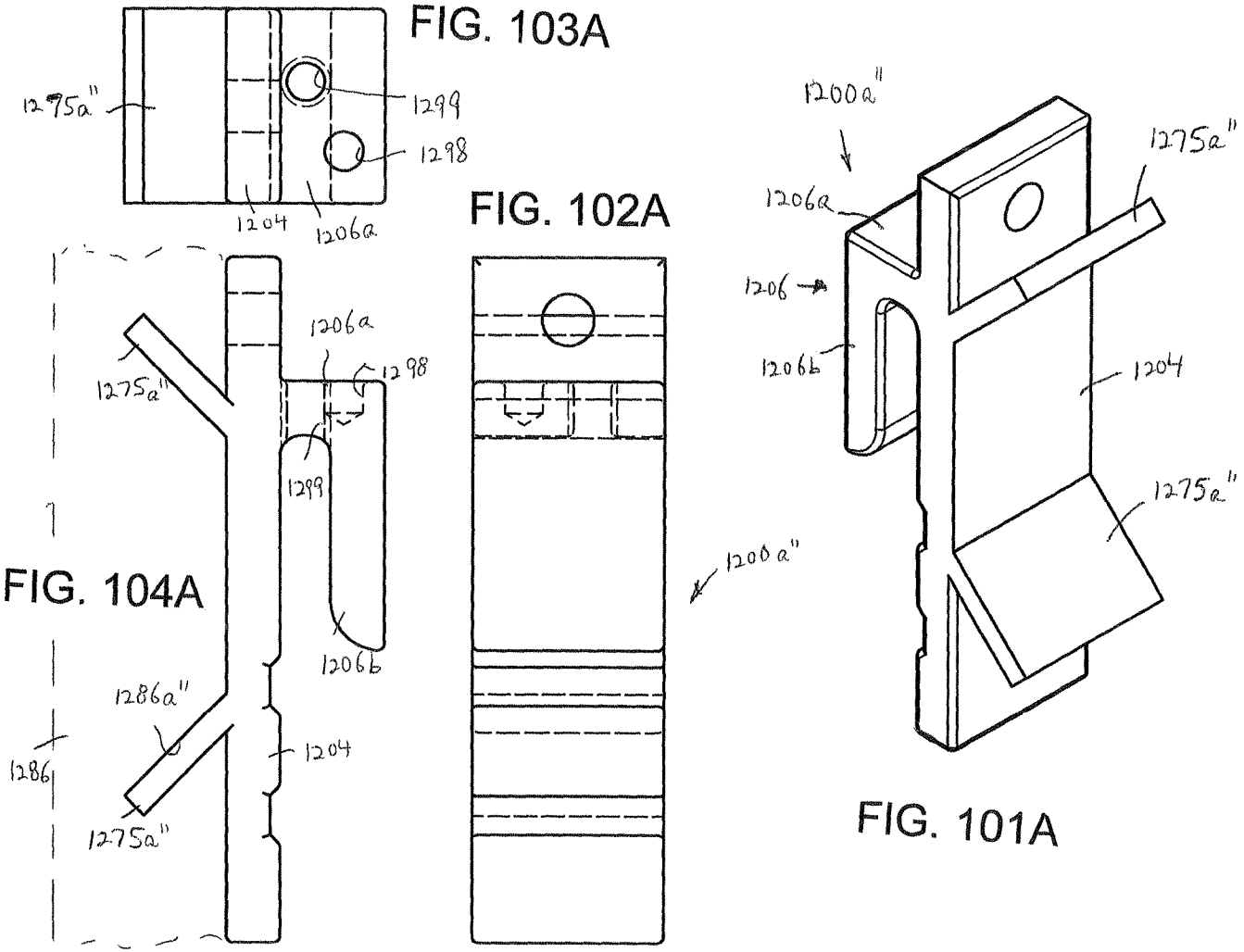

FIGS. 96A and 99A shown a hook assembly 1200*a'* which is very similar to hook assembly 1200' of FIGS. 96-100, and the same reference designators are used. Specifically, hook assembly 1200*a'* differs from hook assembly 1200' by positioning first wall 1206*a* of L-shaped hook wall 1206 spaced below the upper end of elongated rectangular wall 1204, and further, by including thermal blockers 1207 mounted to the inner surfaces of elongated rectangular wall 1204, first wall 1206*a* and second wall 1206*b*. This is because hook assembly 1200*a*' and connecting panels 1060 are preferably made from aluminum which is a heat transferring material. Thermal blockers 1207 block the heat transfer between hook assembly 1200*a*' and connecting panels 1060. As a result, openings 1298 and 1299 are eliminated as well. However, it will be appreciated that the thermal blocker 1207 at the inner surface of first wall 1206*a* can be eliminated, and in such case, openings 1298 and 1299 can be provided in the manner previously discussed.

FIGS. 101-104 show a hook assembly 1200" which is a variation of hook assembly 1200 of FIGS. 54-56 and hook assembly 1200' of FIGS. 96-100. Specifically, hook assembly 1200" is effectively the same as hook assembly 1200', except that it also includes a trapezoidal projection 1275' that fits within trapezoidal grooves (not shown) in wall panel 1286, in a dovetail manner, so as to secure hook assemblies 1200' to the rear of wall panels 1286.

FIGS. 101*a*-104*a* show a hook assembly 1200*a*" which is a variation of hook assembly 1200" of FIGS. 101-104. Specifically, hook assembly 1200*a*" differs from hook assembly 1200" by positioning first wall 1206*a* of L-shaped hook wall 1206 spaced below the upper end of elongated rectangular wall 1204, and further, by replacing trapezoidal projections 1275' with angled projections 1275*a*" that fit within corresponding angled grooves 1286*a*" in wall panel 1286 to allow sliding in of hook assemblies 1200*a*", so as to secure hook assemblies 1200*a*" to the rear of wall panels 1286.

Figure 105:
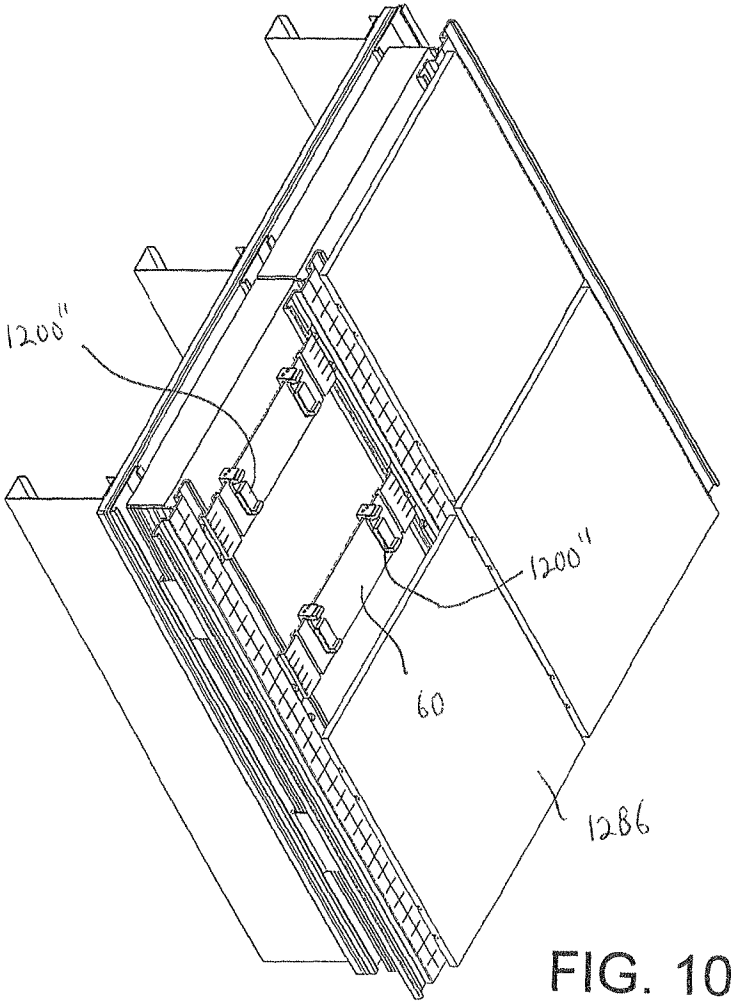
Figure 106:
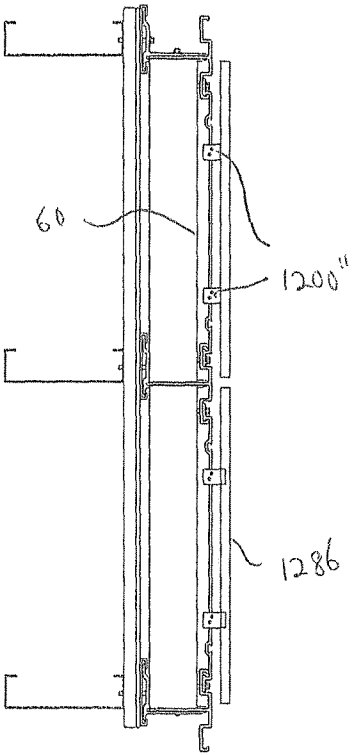

FIGS. 105 and 106 show the hook assemblies 1200" mounted to connecting panels 60 and wall panels 1286 secured to hook assemblies 1200".

Figure 107:
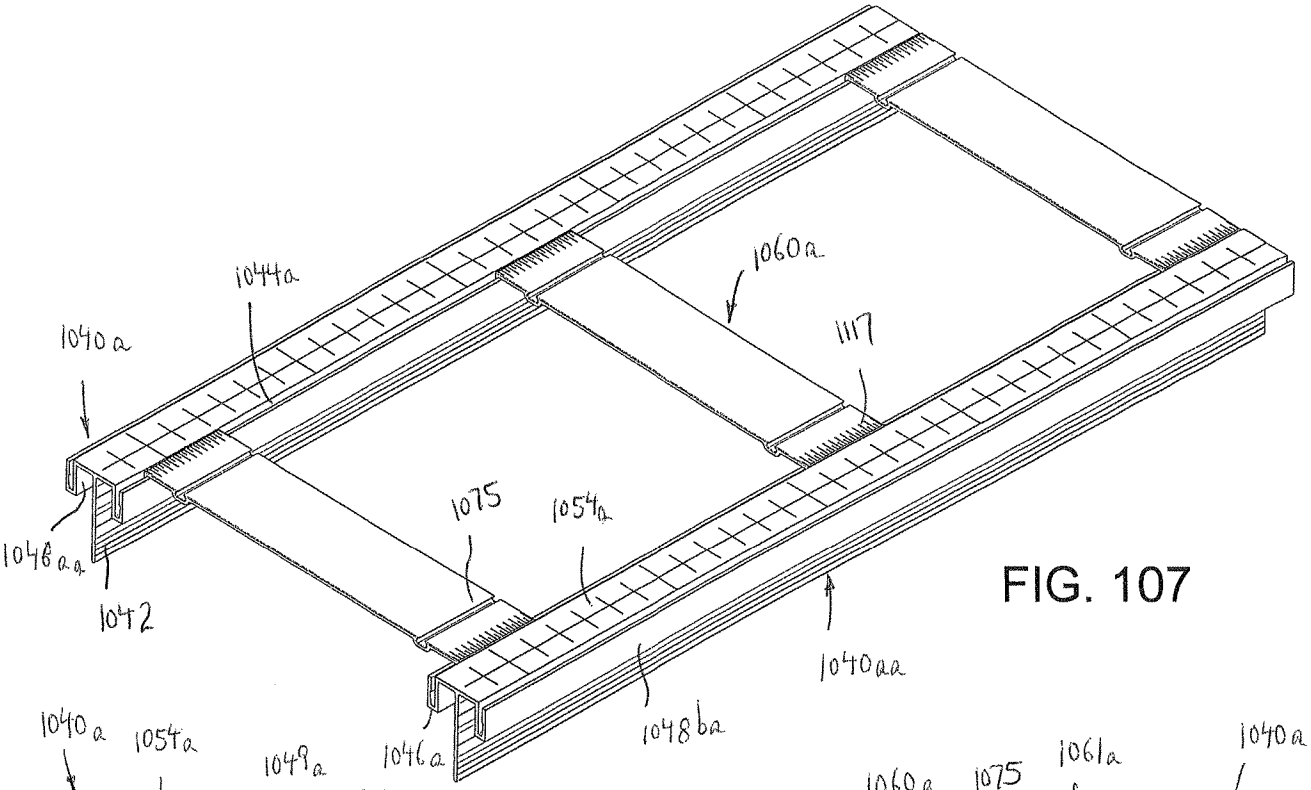
Figure 108:
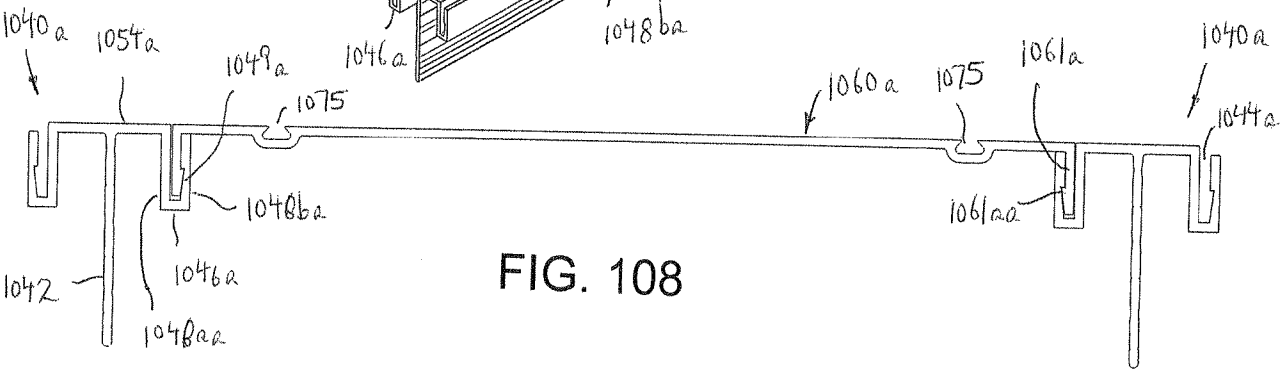

Referring now to FIGS. 107 and 108, there are shown modified adjustment support members 1040*a* and modified connecting panels 1060*a*.

Specifically, each adjustment support member 1040*a* is identical to adjustment support member 1040 of FIGS. 44-46 so that the same reference designators are used, except for where indicated. Adjustment support member 1040*a* differs from adjustment support member 1040 by providing U-shaped tracks 1044*a* which are much narrower, that is, elongated lower plates 1046*a* have a much smaller width. In addition, each wall 1048*ba* is of a lesser height than the respective wall 1048*aa* so that the upper and of each wall 1048*ba* is spaced slightly below platform wall 1054*a*. Further, elongated, inwardly turned lips 1050 are eliminated. In addition, the inner surface of wall 1048*ba* has an angled recess 1049*a* extending therealong.

Each connecting panel 1060*a* is identical to connecting panel 1060 of FIGS. 50 and 51 so that the same reference designators are used, except where indicated. Connecting panel 1060*a* differs from connecting panel 1060 by eliminating rectangular slide walls 1063, and increasing the height of downwardly turned walls 1061*a* which are adapted to fit within narrower U-shaped tracks 1044*a* of adjustment support member 1040*a*. Further, the inner surface of each downwardly turned wall 1061*a* is provided with at least one barb 1061*aa* which engages within the respective recess 1049*a* to lock the downwardly turned wall 1061*a* in the respective narrower U-shaped track 1044*a*.

It will be appreciated that, because of the lesser height of wall 1048*ba*, the upper surface of connecting panel 1060*a* is coplanar with the upper surface of platform wall 1054*a*. This provides a zero sightline concept with no setback.

Referring now to FIGS. 109-115, there are shown further modified adjustment support members 1040*b* and modified connecting panels 1060*b* to provide zero sightline with no setback.

Specifically, each adjustment support member 1040*b* is identical to adjustment support member 1040 of FIGS. 44-46 so that the same reference designators are used, except where indicated. Adjustment support member 1040*b* differs from adjustment support member 1040 by providing elongated spaced apart slots 1051*b* in each wall 1048*b*.

Each connecting panel 1060*b* is identical to connecting panel 1060 of FIGS. 50 and 51 so that the same reference designators are used, except where indicated. Connecting panel 1060*b* differs from connecting panel 1060 by eliminating openings 1065 in rectangular slide walls 1063*b* and providing elongated slots 1065*b* open at one edge 1063*b*1 of rectangular slide walls 1063*b* centrally thereof and extending about one-half the widthwise dimension thereof. As a result, elongated slots 1065*b* divide rectangular slide walls 1063*b* into an inner slide wall section 1063*b*2 and an outer slide wall section 1063*b*3.

In this manner, outer slide wall sections 1063*b*3 are inserted through respective slots 1051*b* in walls 1048*b*, and slid down, as shown in FIG. 111, to removably lock connecting panels 1060*b* to adjustment support members 1040*b*.

It will be appreciated that, because of this arrangement, the upper surfaces of connecting panels 1060*b* are coplanar with the upper surfaces of platform walls 1054. This provides a zero sightline concept with no setback.

The opening or width a (FIG. 114) of elongated slots 1065*b* can also be varied. For example, the width a can be made larger to compensate for expansion and contraction of the aluminum connecting panels 1060*b*.

It will further be appreciated that elongated lower plate 1046 and outer wall 1048*b* can be eliminated, and slots 1051*c* can be provided in inner wall 1048*a*, as shown in FIG. 116 of modified adjustment support member 1040*c*.

Further, adjustment support member 1040*c* can be modified, as shown by modified adjustment support member 1040*d* in FIG. 117, by adding an inwardly turned lip 1050*d* at the free end of inner wall 1048*a*, and further providing that elongated rectangular platform wall 1054*d* includes two elongated dovetail shaped slots 1075*d*, similar to those shown in FIGS. 44B and 49B, extending along the lengthwise direction of elongated rectangular platform wall 1054*d*, for receiving hooks 1062 of the type shown in FIG. 52.

In FIG. 118, modified adjustment support members 1040*d* of FIG. 117, are shown connected by connecting panels 1060*b* of FIGS. 113-115.

Referring now to FIGS. 119-124, there are shown further modified adjustment support members 1040*e* and modified connecting panels 1060*c* to provide zero sightline with no setback.

Specifically, each adjustment support member 1040*e* is identical to adjustment support member 1040 of FIGS. 45 and 46 so that the same reference designators are used, except where indicated. Adjustment support member 1040*e* differs from adjustment support member 1040*b* by providing elongated spaced apart slots 1051*e* in elongated lower plate 1046 adjacent each wall 1048*b*, instead of in each wall 1048*b* as in the embodiment of FIGS. 109-116.

Each connecting panel 1060*e* is identical to connecting panel 1060*a* of FIGS. 107 and 108 so that the same reference designators are used, except where indicated. Connecting panel 1060*c* differs from connecting panel 1060*a* by eliminating barbs 1061*aa*, and instead, providing elongated slots 1065*e* open at one edge 1061*e*1 of downwardly turned walls

1061*a* centrally thereof and extending about one-half the widthwise dimension thereof. As a result, elongated slots 1065*e* divide downwardly turned walls 1061*a* into an upper wall section 1061*e*2 and a lower wall section 1061*e*3.

In this manner, lower wall sections 1061*e*3 are inserted through respective slots 1051*e* in elongated lower plates 1046, and slid down, as shown in FIG. 121, to removably lock connecting panels 1060*e* to adjustment support members 1040*e*. It will be appreciated that, because of this arrangement, the upper surfaces of connecting panels 1060*e* are coplanar with the upper surfaces of platform walls 1054. This provides a zero sightline concept with no setback.

It will further be appreciated that outer wall 1048*b* can also be eliminated.

Referring now to FIGS. 125-131, a further modification is shown which uses adjustment support members 1040 of FIG. 44 and connecting panels 1060 of FIG. 50. Specifically, hooks 1062*a* are slidably inserted within dovetail shaped slots 1075 of connecting panels 1060. Each hook 1062*a* includes a dovetail shaped base 1066*a* with a trapezoidal cross-sectional configuration. Two spaced apart threaded openings 1068*a* and 1068*b* extend from the upper surface of each dovetail shaped base 1066*a*, an entirely through dovetail shaped base 1066*a*.

A set screw 1072 is threadedly received within opening 1068*a* and has a hexagonal recess 1072*a* in the upper surface thereof by which set screw 1072 can be turned within threaded opening 1068*a*. When set screw 1072 is turned so as to extend past the lower surface of dovetail shaped base 1066*a*, the lower end of set screw 1072 contacts the lower surface 1075*a* of the respective dovetail shaped slot 1075, so as to move dovetail shaped base 1066*a* upwardly such that the side surfaces 1066*b* of dovetail shaped base 1066*a* contact the respective side surfaces 1075*b* of dovetail shaped slots 1075, so as to releasably lock dovetail shaped base 1066*a* into the respective dovetail shaped slot 1075.

A threaded post 1073 is threadedly received within opening 1068*b*. Threaded post 1073 has an enlarged head 1073*a* with a hexagonal recess 1073*b* in the upper surface thereof by which threaded post 1073 can be turned within threaded opening 1068*b* to adjust the height of threaded post 1073 extending out from dovetail shaped base 1066*a*.

A wall panel connecting member in the form of an annular disk 1078 having a center threaded opening 1078*a* threadedly receives threaded post 1073 therein. Accordingly, annular disk 1078 is constrained between the upper surface of connecting panel 1060 and an enlarged head 1073*a*. The height of annular disk 1078 above the upper surface of connecting panel 1060 is thereby adjustable by rotating annular disk 1078 on threaded post 1073, and also, by rotating threaded post 1073 within dovetail shaped base 1066*a*.

With this arrangement, each wall panel 1286 includes arcuate slots 1286*c* inside openings 1286*b* thereof for receiving a portion of each annular disk 1078, in order to align and restrain wall panels 1286 relative to each other, as shown in FIG. 125. It will be appreciated that the portion of threaded post 1073 and its enlarged head 1073*a* are omitted from these figures for ease of illustration.

With this arrangement, any irregularities in the existing wall can be compensated by adjusting the height of annular disk 1078 relative to the upper surface of the respective connecting panel 1060.

FIG. 132 shows a threaded post 1073' which includes an enlarged head 1073*a*' of a parallelepiped configuration, with a slot recess 1073*b*' for rotating threaded post 1073' with a conventional screwdriver.

FIGS. 133-135 show a further modification of the arrangement of FIGS. 125-131 in which annular disk 1078 is replaced by a rectangular plate 1078' as the wall panel connecting member, having a threaded central opening 1078*a*'. Accordingly, openings 1286*c* in wall panel 1286 would have correspondingly shaped openings for receiving ends of rectangular plate 1078'.

FIGS. 136 and 137 show a further modification of the arrangement of FIGS. 125-131 in which annular disk 1078 is replaced by a cylinder 1078" as the wall panel connecting member, having a threaded central opening 1078*a*". Accordingly, openings 1286*c* in wall panel 1286 would have correspondingly shaped openings for receiving ends of cylinder 1078".

It will be appreciated that any shaped element can be threaded on threaded post 1073.

Referring now to FIG. 138, there is shown an arrangement utilizing the above described elements for hanging ceiling tiles from a ceiling. Specifically, the arrangement shown in FIG. 38 utilizes the adjustment support member of FIG. 49B inverted by 180° and with the difference being an inward extension of elongated lower plate 1046 that forms inturned lips 1047. In this regard, rectangular plates 1052 are slidably positioned in the space created between elongated walls 1048*a*, the walls defining dovetail shaped slots 1075" and inturned lips 1047. Each rectangular plate 1052 includes a central opening 1052*a* with a backing plate 1053 position in the aforementioned space behind each rectangular plate 1052. A cable 1053*a* has one end attached to backing plate 1053 and extends out of central opening 1052*a*, with the opposite end of the cable attached to a ceiling (not shown) for supporting the adjustment support member in a hanging manner. With this arrangement, because of the sliding nature of each rectangular plate 1052 in the adjustment support member, the adjustment support member can be adjusted to a desired position on the rectangular plates 1052.

Although the embodiment of FIG. 138 discussed hanging ceiling tiles, the present invention can be used to hang any item, such as a lighting fixture, etc.

Of course, it will be appreciated that connecting panels 1060 would be connected in the matter shown in FIG. 125 to connect together the different adjustment support members. Further, hooks would be positioned within dovetail shaped slots 1075", with ceiling panels secured to the hooks in the manner previously described.

Further, it will be appreciated that hooks can be connected with the connecting panels 1060 in such arrangement, in the manner previously described, with the ceiling panels secured to the hooks.

Of course, any of the different aspects of the above embodiments can be mixed and matched as desired.

It will be appreciated that the present invention, in all of the above embodiments, provides a zero sightline concept with no setback, such that the upper surfaces of connecting panels 1060 are coplanar with the upper surfaces of the platform walls 54 and 1054.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. For use with a system for mounting wall panels to an existing wall, the system being of a type including a mounting structure connected in spaced relation from the existing wall for supporting the wall panels, the improvement comprising a hook member including:

a wall panel securing section to which a wall panel is secured prior to supporting the wall panel on the mounting structure, an L-shaped hook wall for slidably mounting the hook member to the mounting structure, the L-shaped hook wall including a first wall movably connected with the wall panel securing section, and a second wall extending at an angle from the first wall and spaced from the wall panel securing section by a first spacing distance so as to receive the mounting structure in a space between the L-shaped hook wall and the wall panel securing section after the wall panel securing section is secured to the wall panel, the wall panel securing section having a first height dimension, the second wall having a second height dimension and the first spacing distance always being less than the first and second height dimensions, and an adjustment arrangement for adjusting a position of the first wall of the hook wall on the wall panel securing section so as to move the second wall toward and away from the wall panel securing section, wherein, after the wall panel securing section is secured to the wall panel, the L-shaped hook wall is merely inserted over the mounting structure to hang the wall panel thereon.

2. A hook member according to claim 1, wherein:

one of the wall panel securing section and the first wall of the hook wall includes at least one groove therein, and the other of the wall panel securing section and the first wall of the hook wall includes at least one projection for engagement within the at least one groove, and further including a fastening arrangement for fixedly securing the wall panel securing section and the hook wall together after the at least one projection is in engagement within the at least one groove.

3. A hook member according to claim 2, wherein:

the at least one groove includes a plurality of grooves, and the at least one projection includes a plurality of projections, with the projections adapted to engage within different ones of the grooves in order to move the second wall toward and away from the wall panel securing section.

4. A hook member according to claim 1, further including a wedge secured to an underside of the first wall and adjacent the second wall to wedge the mounting structure in the hook member.

5. A hook member according to claim 1, wherein the wall panel is mounted to the wall panel securing section by one of:

projections extending from the wall panel securing section for engagement within grooves in the wall panel, and fastening devices extending through the wall panel securing section into the wall panel.

6. A hook member according to claim 1, wherein:

the wall panel securing section includes:

a first wall to which a wall panel is mounted with the first spacing distance being a distance between the first wall of the wall panel securing section and the second wall of the hook wall, and two parallel spaced apart walls connected at a right angle to the first wall;

the first wall of the L-shaped hook wall is slidably positioned between said parallel, spaced apart walls, the second wall of the L-shaped hook wall extends at a right angle from the first wall and is in parallel, spaced apart relation to the first wall of the wall panel securing section, the second wall being movable toward and away from the first wall of the wall panel securing section.

7. A hook member according to claim 6, wherein the first wall of the L-shaped hook wall includes an elongated slot for receiving a fastening member extending through the two parallel, spaced apart walls of the wall panel securing section and through the elongated slot.

8. A hook member according to claim 1, wherein:

the first wall of the L-shaped hook wall includes two parallel, spaced apart walls, the second wall of the L-shaped hook wall extends at a right angle from the first wall, and the wall panel securing section includes:

a first wall to which a wall panel is mounted with the first spacing distance being a distance between the first wall of the wall panel securing section and the second wall of the hook wall, and a second wall connected at a right angle to the first wall and slidably positioned between said parallel, spaced apart walls such that the second wall of the L-shaped hook wall extends at a right angle from the two parallel, spaced apart walls of the first wall and is in parallel, spaced apart relation to the first wall of the wall panel securing section, the second wall being movable toward and away from the first wall of the wall panel securing section.

9. A hook member according to claim 8, wherein the second wall of the wall panel securing section includes an elongated slot for receiving a fastening member extending through the two parallel, spaced apart walls of the first wall of the L-shaped hook wall and through the elongated slot.

10. A hook member according to claim 1, wherein:

the wall panel securing section includes:

a first wall to which a wall panel is mounted with the first spacing distance being a distance between the first wall of the wall panel securing section and the second wall of the hook wall, and a second wall connected at a right angle to the first wall, the second wall having an end face;

the first wall of the L-shaped hook wall includes an end face in opposing position to the end face of the second wall of the wall panel securing section; and fastening devices extend through the first wall of the L-shaped hook wall into the end face of the second wall of the wall panel securing section to secure the first wall of the L-shaped hook wall to the second wall of the wall panel securing section with a variable distance therebetween.

11. A hook member according to claim 10, wherein said first wall of the L-shaped hook wall includes a channel in an outer facing surface thereof for receiving the fastening devices therein.

12. A hook member according to claim 10, wherein said end faces have complementary zig-zag shapes.

13. A hook member according to claim 12, further comprising at least one thermal blocking member connected to at least one of said L-shaped hook wall and said wall panel securing section for blocking heat transfer between said hook member and the mounting structure.

14. For use with a system for mounting wall panels to an existing wall, the system being of a type including a mounting structure connected in spaced relation from the existing wall for supporting wall panels, the improvement comprising a hook member including:

a wall panel securing section to which a wall panel is secured prior to supporting the wall panel on the mounting structure, an L-shaped hook wall for slidably mounting the hook member to the mounting structure, the L-shaped hook wall including a first wall connected with and extending from the wall panel securing section, and a second wall extending at an angle from the first wall and spaced from the wall panel securing section by a first spacing distance so as to receive the mounting structure in a space between the L-shaped hook wall and the wall panel securing section after the wall panel securing section is secured to the wall panel, the wall panel securing section having a first height dimension, the second wall having a second height dimension and the first spacing distance always being less than the first and second height dimensions, and an adjustment and securing arrangement for adjusting a position of the mounting structure in the space, the adjustment and securing arrangement including a first opening in the first wall for receiving a set screw to adjust the position of the mounting structure in the space, and a second opening in the first wall for securing the hook member to the mounting structure, wherein, after the wall panel securing section is secured to the wall panel, the L-shaped hook wall is merely inserted over the mounting structure to hang the wall panel thereon.

15. A combination wall panel and hook member for mounting the wall panel to an existing wall in a system of a type including a mounting structure connected in spaced relation from the existing wall for supporting the wall panel, the combination wall panel and hook member comprising:

a wall panel; and a hook member including:

a wall panel securing section to which the wall panel is secured prior to supporting the wall panel on the mounting structure;

an L-shaped hook wall for slidably mounting the hook member to the mounting structure, the L-shaped hook wall including a first wall movably connected with the wall panel securing section, and a second wall extending at an angle from the first wall and spaced from the wall panel securing section by a first spacing distance so as to receive the mounting structure in a space between the L-shaped hook wall and the wall panel securing section after the wall panel securing section is secured to the wall panel, the wall panel securing section having a first height dimension, the second wall having a second height dimension and the first spacing distance always being less than the first and second height dimensions, and an adjustment arrangement for adjusting a position of the first wall of the hook wall on the wall panel securing section so as to move the second wall toward and away from the wall panel securing section, wherein, after the wall panel securing section is secured to the wall panel, the L-shaped hook wall is merely inserted over the mounting structure to hang the wall panel thereon.

16. A combination wall panel and hook member for mounting the wall panel to an existing wall in a system of a type including a mounting structure connected in spaced relation from the existing wall for supporting the wall panel, the combination wall panel and hook member comprising:

a wall panel; and a hook member including:

a wall panel securing section to which the wall panel is secured prior to supporting the wall panel on the mounting structure;

an L-shaped hook wall for slidably mounting the hook member to the mounting structure, the L-shaped hook wall including a first wall connected with and extending from the wall panel securing section, and a second wall extending at an angle from the first wall and spaced from the wall panel securing section by a first spacing distance so as to receive the mounting structure in a space between the L-shaped hook wall and the wall panel securing section after the wall panel securing section is secured to the wall panel, the wall panel securing section having a first height dimension, the second wall having a second height dimension and the first spacing distance always being less than the first and second height dimensions, and wherein, after the wall panel securing section is secured to the wall panel, the L-shaped hook wall is merely inserted over the mounting structure to hang the wall panel thereon, and an adjustment and securing arrangement for adjusting a position of the mounting structure in the space, the adjustment and securing arrangement including a first opening in the first wall for receiving a set screw to adjust the position of the mounting structure in the space, and a second opening in the first wall for securing the hook member to the mounting structure.

* * * * *